US012226679B2

(12) United States Patent
Martens et al.

(10) Patent No.: US 12,226,679 B2
(45) **Date of Patent: *Feb. 18, 2025**

(54) GOLF CLUB HAVING A DAMPING ELEMENT FOR BALL SPEED CONTROL

(71) Applicant: Acushnet Company, Fairhaven, MA (US)

(72) Inventors: Grant M. Martens, San Diego, CA (US); Doug M. Takehara, Oceanside, CA (US)

(73) Assignee: Acushnet Company, Fairhaven, MA (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/076,729

(22) Filed: Dec. 7, 2022

(65) Prior Publication Data

US 2023/0097561 A1 Mar. 30, 2023

Related U.S. Application Data

(63) Continuation of application No. 17/958,233, filed on Sep. 30, 2022, which is a continuation-in-part of (Continued)

(51) Int. Cl.

| | |
|---|---|
| ***A63B 53/04*** | (2015.01) |
| ***A63B 60/54*** | (2015.01) |
| *A63B 102/32* | (2015.01) |

(52) U.S. Cl.

CPC ..... *A63B 60/54* (2015.10); *A63B 53/047* (2013.01); *A63B 53/0416* (2020.08); *A63B 2102/32* (2015.10); *A63B 2209/00* (2013.01)

(58) Field of Classification Search

CPC ..... A63B 60/54; A63B 53/0458–0462

See application file for complete search history.

(56) References Cited

U.S. PATENT DOCUMENTS

| | | | |
|---|---|---|---|
| 1,133,129 | A | 3/1915 | Govan |
| 2,077,377 | A | 4/1937 | Link |

(Continued)

FOREIGN PATENT DOCUMENTS

| | | |
|---|---|---|
| JP | 03007178 A | 1/1991 |
| JP | H11-192329 | 5/2001 |

(Continued)

OTHER PUBLICATIONS

MIT, Material Property Databse—Aluminum, uploaded Feb. 20, 2024, MIT.edu, 3 pages.*

*Primary Examiner* — Eugene L Kim
*Assistant Examiner* — Matthew B Stanczak
(74) *Attorney, Agent, or Firm* — Ryan A. Reis

(57) ABSTRACT

A golf club head including a striking face, a periphery portion surrounding and extending rearwards from the striking face, a damping element including a front surface and a rear surface, the rear surface of the damping element opposite the front surface of the damping element, wherein the striking face comprises a first portion having a substantially constant thickness, wherein the front surface of the damping element comprises a geometric center, wherein the golf club head includes additional damping structures and materials to achieve desired acoustic characteristics.

16 Claims, 97 Drawing Sheets

Related U.S. Application Data application No. 17/543,459, filed on Dec. 6, 2021, now Pat. No. 11,938,387, which is a continuation-in-part of application No. 17/532,222, filed on Nov. 22, 2021, which is a continuation-in-part of application No. 17/377,696, filed on Jul. 16, 2021, now Pat. No. 11,826,620, which is a continuation-in-part of application No. 17/349,519, filed on Jun. 16, 2021, now Pat. No. 11,786,789, which is a continuation-in-part of application No. 17/138,618, filed on Dec. 30, 2020, now Pat. No. 11,794,080, which is a continuation-in-part of application No. 17/127,061, filed on Dec. 18, 2020, now Pat. No. 11,433,284, which is a continuation-in-part of application No. 17/085,474, filed on Oct. 30, 2020, now Pat. No. 11,202,946, which is a continuation-in-part of application No. 16/833,054, filed on Mar. 27, 2020, now Pat. No. 11,020,639, which is a continuation-in-part of application No. 16/286,412, filed on Feb. 26, 2019, now Pat. No. 10,625,127, which is a continuation-in-part of application No. 16/225,577, filed on Dec. 19, 2018, now abandoned, which is a continuation-in-part of application No. 16/158,578, filed on Oct. 12, 2018, now Pat. No. 10,293,226, which is a continuation-in-part of application No. 16/027,077, filed on Jul. 3, 2018, now abandoned, which is a continuation-in-part of application No. 15/220,122, filed on Jul. 26, 2016, now Pat. No. 10,086,244, said application No. 17/085,474 is a continuation of application No. 16/592,170, filed on Oct. 3, 2019, now Pat. No. 10,821,344, which is a continuation of application No. 16/214,405, filed on Dec. 10, 2018, now Pat. No. 10,471,319, said application No. 17/085,474 is a continuation-in-part of application No. 16/401,926, filed on May 2, 2019, now Pat. No. 10,821,338, which is a continuation-in-part of application No. 15/848,697, filed on Dec. 20, 2017, now abandoned, which is a continuation-in-part of application No. 15/359,206, filed on Nov. 22, 2016, now Pat. No. 10,150,019, which is a continuation-in-part of application No. 15/220,107, filed on Jul. 26, 2016, now Pat. No. 9,993,704, said application No. 17/543,459 is a continuation-in-part of application No. 17/337,151, filed on Jun. 2, 2021, now abandoned.

(60) Provisional application No. 63/065,310, filed on Aug. 13, 2020.

(56) References Cited

U.S. PATENT DOCUMENTS

| | | | | | |
|---|---|---|---|---|---|
| 2,111,249 | A | | 3/1938 | Plese | |
| 3,817,522 | A | | 6/1974 | Simmons | |
| 3,858,886 | A | * | 1/1975 | Cosby | A63B 53/04 473/350 |
| 4,195,842 | A | | 4/1980 | Coleman | |
| 4,398,965 | A | | 8/1983 | Campau | |
| 4,754,977 | A | | 7/1988 | Sahm | |
| 4,811,950 | A | | 3/1989 | Kobayashi | |
| 4,826,172 | A | | 5/1989 | Antonious | |
| 4,928,972 | A | * | 5/1990 | Nakanishi | A63B 53/047 473/332 |
| 4,938,470 | A | | 7/1990 | Antonious | |
| 4,957,294 | A | * | 9/1990 | Long | A63B 53/047 473/331 |
| 5,048,835 | A | | 9/1991 | Gorman | |
| 5,056,788 | A | | 10/1991 | Katayama | |
| 5,121,922 | A | | 6/1992 | Harsh, Sr. | |
| 5,184,823 | A | | 2/1993 | Desboilles | |
| 5,261,664 | A | | 11/1993 | Anderson | |
| 5,290,032 | A | | 3/1994 | Fenton | |
| 5,316,298 | A | | 5/1994 | Hutin | |
| 5,326,047 | A | | 7/1994 | Shaw et al. | |
| 5,328,184 | A | | 7/1994 | Antonious | |
| 5,346,213 | A | | 9/1994 | Yamada | |
| 5,398,929 | A | | 3/1995 | Kitaichi | |
| 5,403,007 | A | | 4/1995 | Chen | |
| 5,464,211 | A | | 11/1995 | Atkins, Sr. | |
| 5,492,327 | A | | 2/1996 | Biafore, Jr. | |
| 5,499,814 | A | | 3/1996 | Lu | |
| 5,505,453 | A | | 4/1996 | Mack | |
| 5,529,543 | A | | 6/1996 | Beaumont, Sr. | |
| 5,547,194 | A | | 8/1996 | Aizawa | |
| 5,547,427 | A | | 8/1996 | Rigal | |
| 5,586,947 | A | | 12/1996 | Hutin | |
| 5,586,948 | A | | 12/1996 | Mick | |
| 5,588,923 | A | | 12/1996 | Schmidt | |
| 5,626,530 | A | | 5/1997 | Schmidt | |
| 5,628,697 | A | | 5/1997 | Gamble | |
| 5,669,829 | A | | 9/1997 | Lin | |
| 5,697,855 | A | * | 12/1997 | Aizawa | A63B 53/04 473/332 |
| 5,766,092 | A | | 6/1998 | Mimeur | |
| 5,830,084 | A | * | 11/1998 | Kosmatka | A63B 60/00 473/324 |
| 5,833,551 | A | | 11/1998 | Vincent | |
| 5,888,148 | A | | 3/1999 | Allen | |
| 5,890,973 | A | | 4/1999 | Gamble | |
| 5,899,821 | A | | 5/1999 | Hsu | |
| 5,971,868 | A | * | 10/1999 | Kosmatka | A63B 69/3635 473/324 |
| 6,001,030 | A | | 12/1999 | Delaney | |
| 6,015,354 | A | | 1/2000 | Ahn | |
| 6,042,486 | A | | 3/2000 | Gallagher | |
| 6,162,133 | A | | 12/2000 | Peterson | |
| 6,165,081 | A | | 12/2000 | Chou | |
| 6,200,228 | B1 | | 3/2001 | Takeda | |
| D444,195 | S | | 6/2001 | Wahl | |
| 6,299,547 | B1 | | 10/2001 | Kosmatka | |
| 6,299,549 | B1 | | 10/2001 | Shieh | |
| 6,306,048 | B1 | | 10/2001 | McCabe | |
| 6,309,311 | B1 | | 10/2001 | Lu | |
| 6,364,789 | B1 | | 4/2002 | Kosmatka | |
| 6,508,722 | B1 | | 1/2003 | McCabe | |
| 6,595,870 | B2 | | 7/2003 | Stites | |
| 6,695,715 | B1 | | 2/2004 | Chikaraishi | |
| D489,106 | S | | 4/2004 | Wahl | |
| 6,719,641 | B2 | | 4/2004 | Dabbs | |
| 6,832,961 | B2 | | 12/2004 | Sano | |
| 6,835,144 | B2 | | 12/2004 | Best | |
| 6,855,066 | B2 | | 2/2005 | Best | |
| 6,887,164 | B2 | | 5/2005 | Danwanjee | |
| 6,902,495 | B2 | | 6/2005 | Pergande | |
| 6,921,344 | B2 | | 7/2005 | Gilbert | |
| 6,964,620 | B2 | | 11/2005 | Gilbert | |
| 6,976,924 | B2 | | 12/2005 | Gilbert | |
| 6,991,559 | B2 | | 1/2006 | Yabu | |
| 7,008,331 | B2 | | 3/2006 | Chen | |
| 7,056,229 | B2 | | 6/2006 | Chen | |
| 7,096,558 | B2 | | 8/2006 | Sano | |
| 7,140,977 | B2 | | 11/2006 | Atkins, Sr. | |
| 7,160,204 | B2 | | 1/2007 | Huang | |
| 7,169,057 | B2 | | 1/2007 | Wood et al. | |
| 7,211,006 | B2 | | 5/2007 | Chang | |
| 7,247,104 | B2 | | 7/2007 | Poynor | |
| 7,371,190 | B2 | | 5/2008 | Gilbert | |
| 7,387,579 | B2 | | 6/2008 | Lin | |
| 7,476,162 | B2 | | 1/2009 | Stites | |
| 7,559,853 | B2 | | 7/2009 | Hirano | |
| 7,575,523 | B2 | | 8/2009 | Yokota | |
| 7,578,755 | B2 | | 8/2009 | Oyama | |
| 7,582,024 | B2 | | 9/2009 | Shear | |
| 7,588,503 | B2 | | 9/2009 | Roach | |
| 7,591,735 | B2 | | 9/2009 | Matsunaga | |
| 7,597,633 | B2 | | 10/2009 | Shimazaki | |
| 7,604,550 | B1 | | 10/2009 | Currie | |
| 7,686,706 | B2 | | 3/2010 | Matsunaga | |

(56) References Cited

U.S. PATENT DOCUMENTS 7,713,141 B2 5/2010 Yamamoto
7,731,604 B2 6/2010 Wahl
7,749,100 B2 7/2010 Tavares
7,753,806 B2 7/2010 Beach
7,785,212 B2 8/2010 Lukasiewicz, Jr.
7,798,913 B2 9/2010 Noble
7,871,338 B2 1/2011 Nakano
7,878,920 B2 2/2011 Clausen
7,892,106 B2 2/2011 Matsunaga
7,935,000 B2 5/2011 Stites
7,967,700 B2 6/2011 Stites
8,088,025 B2 1/2012 Wahl
8,157,673 B2 4/2012 Gilbert
8,187,116 B2 5/2012 Boyd
8,202,174 B2 6/2012 Breier
8,210,961 B2 7/2012 Finn
8,210,965 B2 7/2012 Roach
8,267,807 B2 9/2012 Takechi
8,277,337 B2 10/2012 Shimazaki
8,328,663 B2 12/2012 Wahl
8,333,667 B2 12/2012 Kumamoto
8,348,782 B2 1/2013 Park
8,353,784 B2 1/2013 Boyd
8,403,771 B1 3/2013 Rice
8,403,774 B2 3/2013 Stites
8,517,863 B2 8/2013 Wahl
8,535,176 B2 9/2013 Bazzel
8,535,177 B1 * 9/2013 Wahl ..... A63B 53/04 D21/748
8,562,652 B2 10/2013 Biedermann
8,608,585 B2 12/2013 Stites
8,696,489 B2 4/2014 Gibbs
8,753,219 B2 6/2014 Gilbert
8,753,228 B2 6/2014 Golden
8,758,159 B2 6/2014 Morin
8,814,725 B2 8/2014 Wahl
8,821,307 B2 9/2014 Park
8,864,603 B2 10/2014 Kumamoto
8,876,630 B2 11/2014 Takechi
8,920,261 B2 12/2014 Taylor et al.
8,961,336 B1 2/2015 Parsons et al.
9,011,266 B2 4/2015 Brunski
9,039,543 B2 5/2015 Mizutani
9,101,809 B2 8/2015 Gibbs
9,265,995 B2 2/2016 Wahl
9,457,241 B2 10/2016 Hebreo
9,597,562 B2 3/2017 Dipert
9,662,549 B2 5/2017 Vrska, Jr.
9,849,354 B2 12/2017 Stokke
9,993,699 B2 6/2018 Larson
9,993,704 B2 6/2018 Hebreo
10,039,965 B1 8/2018 Seluga
10,086,244 B2 * 10/2018 Morin ..... A63B 53/08
10,150,019 B2 12/2018 Ines
10,220,272 B2 3/2019 Gonzalez
10,293,226 B2 5/2019 Hebreo
10,413,789 B1 * 9/2019 Seluga ..... A63B 60/00
10,471,319 B1 11/2019 Mata
10,625,127 B2 4/2020 Golden
10,821,338 B2 11/2020 Hebreo
10,821,344 B2 11/2020 Mata
11,020,639 B2 6/2021 Golden
11,090,532 B2 8/2021 Wahl
11,090,534 B2 8/2021 Westrum
11,465,018 B2 10/2022 Stokke
2002/0098910 A1 * 7/2002 Gilbert ..... A63B 60/02 473/332
2003/0092502 A1 5/2003 Pergande
2003/0190975 A1 10/2003 Fagot
2003/0228928 A1 * 12/2003 Yabu ..... A63B 53/047 473/332
2004/0214654 A1 * 10/2004 Pelz ..... A63B 53/04 473/287
2005/0003900 A1 * 1/2005 Sugimoto ..... A63B 53/047 473/290
2005/0009624 A1 1/2005 Long
2005/0049079 A1 * 3/2005 Yamamoto ..... A63B 53/047 473/349
2005/0107183 A1 5/2005 Takeda
2005/0277485 A1 12/2005 Hou
2006/0234805 A1 * 10/2006 Gilbert ..... A63B 53/0408 473/290
2007/0026961 A1 2/2007 Hou
2007/0135233 A1 7/2007 Perras
2008/0004131 A1 1/2008 Lin
2008/0287216 A1 * 11/2008 Nakamura ..... A63B 53/047 473/350
2008/0305888 A1 12/2008 Tseng
2009/0137339 A1 * 5/2009 Nakano ..... A63B 60/54 473/332
2009/0156324 A1 * 6/2009 Cole ..... A63B 60/54 473/332
2009/0163295 A1 6/2009 Tseng
2009/0247314 A1 * 10/2009 Matsunaga ..... A63B 53/047 473/291
2009/0325729 A1 * 12/2009 Takechi ..... A63B 53/047 473/345
2010/0056296 A1 3/2010 Kumamoto
2010/0056297 A1 3/2010 Roach
2010/0273565 A1 * 10/2010 Stites ..... A63B 53/047 473/282
2010/0273570 A1 * 10/2010 Ines ..... A63B 53/047 473/349
2011/0124432 A1 5/2011 Oldknow
2011/0159981 A1 6/2011 Bazzel
2011/0207552 A1 * 8/2011 Finn ..... A63B 53/0466 473/346
2011/0250985 A1 10/2011 Stites
2012/0064997 A1 3/2012 Sato
2012/0172144 A1 7/2012 Mazutani
2013/0130827 A1 5/2013 Boyd
2013/0281227 A1 * 10/2013 Roach ..... A63B 69/0002 473/332
2013/0316847 A1 * 11/2013 Wallans ..... A63B 60/54 473/332
2013/0324297 A1 12/2013 Larson
2014/0038737 A1 * 2/2014 Roach ..... A63B 53/04 473/226
2014/0038747 A1 * 2/2014 Dolezel ..... A63B 60/02 228/101
2015/0165280 A1 6/2015 Hebreo
2015/0343281 A1 12/2015 Ban
2015/0375068 A1 * 12/2015 Mizutani ..... A63B 53/0466 473/324
2016/0193508 A1 * 7/2016 Issertell ..... A63B 60/00 473/349
2016/0346636 A1 * 12/2016 Sander ..... A63B 53/047
2017/0028271 A1 * 2/2017 Petersen ..... A63B 53/08
2017/0144037 A1 5/2017 Dipert
2017/0239533 A1 * 8/2017 Cole ..... A63B 53/0475
2017/0333765 A1 11/2017 Parsons
2018/0028882 A1 2/2018 Hebreo
2018/0028883 A1 * 2/2018 Morin ..... A63B 53/06
2018/0093145 A1 * 4/2018 Ripp ..... A63B 60/50
2018/0133565 A1 5/2018 Hebreo
2018/0185717 A1 * 7/2018 Demkowski ..... A63B 53/047
2018/0200593 A1 * 7/2018 Golden ..... A63B 60/00
2018/0345106 A1 * 12/2018 Kitagawa ..... A63B 60/52
2019/0015711 A1 * 1/2019 Abe ..... A63B 53/02
2019/0134473 A1 * 5/2019 Golden ..... A63B 53/0408
2019/0151722 A1 5/2019 Gonzalez
2019/0201760 A1 7/2019 Golden et al.
2019/0217162 A1 * 7/2019 Seagram ..... A63B 53/02
2019/0240733 A1 * 8/2019 Chen ..... B22F 3/1021
2019/0262673 A1 * 8/2019 Clarke ..... A63B 53/042
2020/0222767 A1 * 7/2020 Golden ..... A63B 60/54
2020/0298077 A1 * 9/2020 Clarke ..... A63B 60/02
2021/0046360 A1 * 2/2021 Demkowski ..... A63B 53/047
2021/0046363 A1 2/2021 Golden
2021/0106887 A1 4/2021 Gonzalez
2021/0121748 A1 4/2021 Ines

(56) References Cited

U.S. PATENT DOCUMENTS

| | | | | |
|---|---|---|---|---|
| 2021/0236887 | A1 | 8/2021 | Demkowski | |
| 2022/0370864 | A1* | 11/2022 | Lambeth ..... | A63B 53/047 |
| 2024/0042287 | A1* | 2/2024 | Ripp ..... | A63B 53/047 |

FOREIGN PATENT DOCUMENTS

| | | |
|---|---|---|
| JP | 2001-170222 | 6/2001 |
| JP | 2003284794 | 10/2003 |
| JP | 2006-000139 | 1/2006 |
| JP | 2007-21171 | 1/2007 |
| JP | 2009-61317 | 3/2009 |
| JP | 4291836 | 8/2009 |
| JP | 2009240365 | 10/2009 |
| JP | 2015-517882 | 6/2015 |
| KR | 10-2017-0008275 | 11/2015 |

* cited by examiner

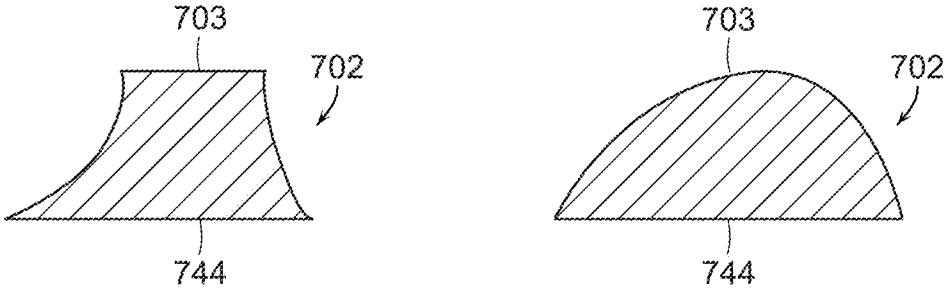
FIG. 14G
FIG. 14H
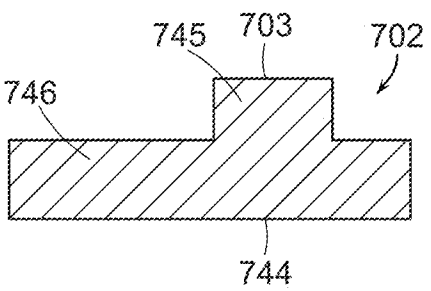
FIG. 14I
FIG. 14J
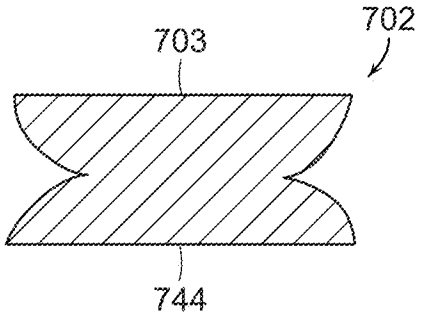
FIG. 14K
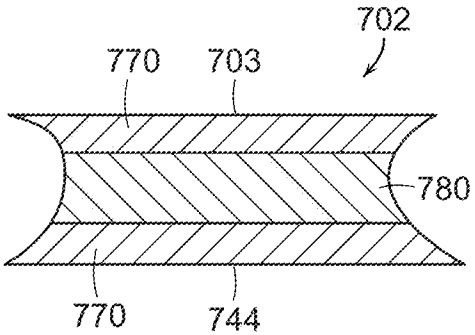
FIG. 14L

GOLF CLUB HAVING A DAMPING ELEMENT FOR BALL SPEED CONTROL

RELATED APPLICATIONS

This application is a continuation-in-part of U.S. patent application Ser. No. 17/958,233, filed on Sep. 30, 2022, which is a continuation-in-part of U.S. patent application Ser. No. 17/543,459, filed on Dec. 6, 2021, which is a continuation-in-part of U.S. patent application Ser. No. 17/532,222, filed on Nov. 22, 2021, which is a continuation-in-part of U.S. patent application Ser. No. 17/377,696, filed on Jul. 16, 2021, which is a continuation-in-part of U.S. patent application Ser. No. 17/349,519, filed on Jun. 16, 2021, which is a continuation-in-part of U.S. patent application Ser. No. 17/138,618, filed on Dec. 30, 2020, which is a continuation in-part of U.S. patent application Ser. No. 17/127,061, filed Dec. 18, 2020, now U.S. Pat. No. 11,433,284, which is a continuation-in-part of U.S. patent application Ser. No. 17/085,474, filed Oct. 30, 2020, now U.S. Pat. No. 11,202,946, which is a continuation-in-part of U.S. patent application Ser. No. 16/833,054, filed Mar. 27, 2020, now U.S. Pat. No. 11,020,639, which is a continuation-in-part of U.S. patent application Ser. No. 16/286,412, filed Feb. 26, 2019, now U.S. Pat. No. 10,625,127, which is a continuation-in-part of U.S. patent application Ser. No. 16/225,577, filed Dec. 19, 2018, now abandoned, which is a continuation-in-part of U.S. patent application Ser. No. 16/158,578, filed Oct. 12, 2018, now U.S. Pat. No. 10,293,226, which is a continuation-in-part of U.S. patent application Ser. No. 16/027,077, filed Jul. 3, 2018, now abandoned, which is a continuation-in-part of U.S. patent application Ser. No. 15/220,122, filed Jul. 26, 2016, now U.S. Pat. No. 10,086,244, and U.S. patent application Ser. No. 17/085,474 is a continuation-in-part of U.S. patent application Ser. No. 16/592,170, filed Oct. 3, 2019, now U.S. Pat. No. 10,821,344, which is a continuation of U.S. patent application Ser. No. 16/214,405, filed Dec. 10, 2018, now U.S. Pat. No. 10,471,319, and U.S. patent application Ser. No. 17/085,474 is a continuation-in-part of U.S. patent application Ser. No. 16/401,926, filed May 2, 2019, now U.S. Pat. No. 10,821,338, which is a continuation-in-part of U.S. patent application Ser. No. 15/848,697, filed Dec. 20, 2017, now abandoned, which is a continuation-in-part of U.S. patent application Ser. No. 15/359,206, filed Nov. 22, 2016, now U.S. Pat. No. 10,150,019, which is a continuation-in-part of U.S. patent application Ser. No. 15/220,107, filed Jul. 26, 2016, now U.S. Pat. No. 9,993,704, and U.S. patent application Ser. No. 17/543,459 is a continuation in part of U.S. patent application Ser. No. 17/337,151, filed Jun. 2, 2021, which claims the benefit of U.S. Provisional Patent Application Ser. No. 63/065,310, filed on Aug. 13, 2020, which are hereby incorporated by reference in their entirety. To the extent appropriate, the present application claims priority to the above-referenced applications.

BACKGROUND

It is a goal for golfers to reduce the total number of swings needed to complete a round of golf, thus reducing their total score. To achieve that goal, it is generally desirable to for a golfer to have a ball fly a consistent distance when struck by the same golf club and, for some clubs, also to have that ball travel a long distance. For instance, when a golfer slightly mishits a golf ball, the golfer does not want the golf ball to fly a significantly different distance. At the same time, the golfer also does not want to have a significantly reduced overall distance every time the golfer strikes the ball, even when the golfer strikes the ball in the "sweet spot" of the golf club. Additionally, it is also preferable for a golf club head to produce a pleasant sound to the golfer when the golf club head strikes the golf ball.

SUMMARY

One non-limiting embodiment of the present technology includes a golf club head including a striking face, a periphery portion surrounding and extending rearwards from the striking face, a coordinate system centered at a center of gravity of the golf club head, the coordinate system including a y-axis extending vertically, perpendicular to a ground plane when the golf club head is in an address position at prescribed loft and lie, an x-axis perpendicular to the y-axis and parallel to the striking face, extending towards a heel of the golf club head, and a z-axis, perpendicular to the y-axis and the x-axis and extending through the striking face, a hosel configured to receive a shaft, the hosel located on a heel side of the golf club head, the heel side located opposite a toe side, wherein the striking face comprises a front surface configured to strike a golf ball and a rear surface opposite the front surface, a damping element including a front surface and a rear surface, the rear surface of the damping element opposite the front surface of the damping element, wherein the front surface of the damping element is in contact with the rear surface of the striking face, wherein the striking face comprises a first portion having a substantially constant thickness, wherein the striking face comprises a plurality of scorelines having the same length, and a center face plane parallel to the y-axis and the z-axis, the center face plane located equidistant from a heel-most extent of the plurality of scorelines and a toe-most extent of the plurality of scorelines, wherein the front surface of the damping element contacts the first portion of the striking face, wherein the front surface of the damping element comprises a geometric center, wherein the geometric center of the front surface of the damping element is located toeward of the center face plane, wherein the striking face comprises a second portion, the second portion of the striking face located heelward of the center face plane, the second portion of the striking face having a thickness which tapers from a maximum thickness at a thick end of the second portion to a minimum thickness at a thin end of the second portion, wherein the thick end is located toeward of the thin end.

In an additional non-limiting embodiment of the present technology the geometric center of the front surface of the damping element is located a damping offset distance from the center face plane, wherein the thick end of the second portion of the striking face is located a heel offset distance from the center face plane, and wherein the heel offset distance is greater than the damping offset distance.

In an additional non-limiting embodiment of the present technology the damping offset distance is greater than or equal to 5 mm.

In an additional non-limiting embodiment of the present technology the second portion has a height which tapers from a maximum height at the thick end of the second portion to a minimum height at the thin end of the second portion.

In an additional non-limiting embodiment of the present technology the first portion of the striking face extends above the second portion.

In an additional non-limiting embodiment of the present technology a chamfer is formed between an upper edge of the second portion and the first portion.

In an additional non-limiting embodiment of the present technology the striking face comprises a third portion, the third portion of the striking face located toeward of the center face plane, the third portion of the striking face having a thickness which tapers from a maximum thickness at a heel end of the third portion to a minimum thickness at a toe end of the third portion.

In an additional non-limiting embodiment of the present technology the periphery portion comprises a sole extending rearwards from a bottom of the striking face, a topline extending rearwards from a top of the striking face, and a back portion extending upwards from the sole and spaced from the striking face, wherein the striking face and the periphery portion form an internal cavity, wherein the damping element resides within the internal cavity, and wherein the rear surface of the damping element is in contact with the periphery portion.

An additional non-limiting embodiment of the present technology includes a golf club head including a striking face, a periphery portion surrounding and extending rearwards from the striking face, a coordinate system centered at a center of gravity of the golf club head, the coordinate system including a y-axis extending vertically, perpendicular to a ground plane when the golf club head is in an address position at prescribed loft and lie, an x-axis perpendicular to the y-axis and parallel to the striking face, extending towards a heel of the golf club head, and a z-axis, perpendicular to the y-axis and the x-axis and extending through the striking face, a hosel configured to receive a shaft, the hosel located on a heel side of the golf club head, the heel side located opposite a toe side, wherein the striking face comprises a front surface configured to strike a golf ball and a rear surface opposite the front surface, a damping element including a front surface and a rear surface, the rear surface of the damping element opposite the front surface of the damping element, wherein the front surface of the damping element is in contact with the rear surface of the striking face, wherein the striking face comprises a first portion having a substantially constant thickness, wherein the striking face comprises a plurality of scorelines having the same length, and a center face plane parallel to the y-axis and the z-axis, the center face plane located equidistant from a heel-most extent of the plurality of scorelines and a toe-most extent of the plurality of scorelines, wherein the front surface of the damping element contacts the first portion of the striking face, wherein the front surface of the damping element comprises a geometric center, wherein the striking face comprises a second portion, the second portion of the striking face located heelward of the center face plane, the second portion of the striking face having a thickness which tapers from a maximum thickness at a thick end of the second portion to a minimum thickness at a thin end of the second portion, wherein the thick end is located toeward of the thin end, wherein the second portion has a height which tapers from a maximum height at the thick end of the second portion to a minimum height at the thin end of the second portion.

In an additional non-limiting embodiment of the present technology the geometric center of the front surface of the damping element is located toeward of the center face plane.

In an additional non-limiting embodiment of the present technology the geometric center of the front surface of the damping element is located a damping offset distance from the center face plane, wherein the thick end of the second portion of the striking face is located a heel offset distance from the center face plane, and wherein the heel offset distance is greater than the damping offset distance.

In an additional non-limiting embodiment of the present technology the damping offset distance is greater than or equal to 5 mm.

In an additional non-limiting embodiment of the present technology the periphery portion comprises a sole extending rearwards from a bottom of the striking face, a topline extending rearwards from a top of the striking face, and a back portion extending upwards from the sole and spaced from the striking face, wherein the striking face and the periphery portion form an internal cavity, wherein the damping element resides within the internal cavity, and wherein the rear surface of the damping element is in contact with the periphery portion.

An additional non-limiting embodiment of the present technology includes a golf club head including a striking face, a periphery portion surrounding and extending rearwards from the striking face, a coordinate system centered at a center of gravity of the golf club head, the coordinate system including a y-axis extending vertically, perpendicular to a ground plane when the golf club head is in an address position at prescribed loft and lie, an x-axis perpendicular to the y-axis and parallel to the striking face, extending towards a heel of the golf club head, and a z-axis, perpendicular to the y-axis and the x-axis and extending through the striking face, a hosel configured to receive a shaft, the hosel located on a heel side of the golf club head, the heel side located opposite a toe side, wherein the striking face comprises a front surface configured to strike a golf ball and a rear surface opposite the front surface, wherein the striking face comprises a first portion having a substantially constant thickness, wherein the striking face comprises a plurality of scorelines having the same length, and a center face plane parallel to the y-axis and the z-axis, the center face plane located equidistant from a heel-most extent of the plurality of scorelines and a toe-most extent of the plurality of scorelines, wherein the striking face comprises a second portion, the second portion of the striking face located heelward of the center face plane, the second portion of the striking face having a thickness which tapers from a maximum thickness at a thick end of the second portion to a minimum thickness at a thin end of the second portion, wherein the thick end is located toeward of the thin end, wherein the striking face comprises a third portion, the third portion of the striking face located toeward of the center face plane, the third portion of the striking face having a thickness which tapers from a maximum thickness at a heel end of the third portion to a minimum thickness at a toe end of the third portion.

An additional non-limiting embodiment of the present technology includes a damping element including a front surface and a rear surface, the rear surface of the damping element opposite the front surface of the damping element, wherein the front surface of the damping element is in contact with the rear surface of the striking face, wherein the front surface of the damping element contacts the first portion of the striking face, wherein the front surface of the damping element comprises a geometric center, wherein the geometric center of the front surface of the damping element is located toeward of the center face plane, In an additional non-limiting embodiment of the present technology the geometric center of the front surface of the damping element is located a damping offset distance from the center face plane, wherein the thick end of the second portion of the striking face is located a heel offset distance from the center face plane, and wherein the heel offset distance is greater than the damping offset distance and wherein the damping offset distance is greater than or equal to 5 mm.

In an additional non-limiting embodiment of the present technology the second portion has a height which tapers from a maximum height at the thick end of the second portion to a minimum height at the thin end of the second portion.

In an additional non-limiting embodiment of the present technology the first portion of the striking face extends above the second portion.

In an additional non-limiting embodiment of the present technology a chamfer is formed between an upper edge of the second portion and the first portion.

In an additional non-limiting embodiment of the present technology the periphery portion comprises a sole extending rearwards from a bottom of the striking face, a topline extending rearwards from a top of the striking face, and a back portion extending upwards from the sole and spaced from the striking face, wherein the striking face and the periphery portion form an internal cavity, wherein the damping element resides within the internal cavity, and wherein the rear surface of the damping element is in contact with the periphery portion.

One non-limiting embodiment of the present technology includes a golf club head including a striking face, a periphery portion surrounding and extending rearwards from the striking face, a coordinate system centered at a center of gravity of the golf club head, the coordinate system including a y-axis extending vertically, perpendicular to a ground plane when the golf club head is in an address position at prescribed loft and lie, an x-axis perpendicular to the y-axis and parallel to the striking face, extending towards a heel of the golf club head, and a z-axis, perpendicular to the y-axis and the x-axis and extending through the striking face, a hosel configured to receive a shaft, the hosel located on a heel side of the golf club head, the heel side located opposite a toe side, wherein the striking face comprises a front surface configured to strike a golf ball and a rear surface opposite the front surface, a damping element including a front surface and a rear surface, the rear surface of the damping element opposite the front surface of the damping element, wherein the front surface of the damping element is in contact with the rear surface of the striking face, wherein the striking face comprises a first portion having a substantially constant thickness, wherein the striking face comprises a plurality of scorelines having the same length, and a center face plane parallel to the y-axis and the z-axis, the center face plane located equidistant from a heel-most extent of the plurality of scorelines and a toe-most extent of the plurality of scorelines, wherein the front surface of the damping element contacts the first portion of the striking face, wherein the front surface of the damping element comprises a geometric center.

In an additional non-limiting embodiment of the present technology the geometric center of the front surface of the damping element is aligned with the center face plane.

In an additional non-limiting embodiment of the present technology the geometric center of the front surface of the damping element is located a damping offset distance heelward from the center face plane of 5 mm or less.

In an additional non-limiting embodiment of the present technology the geometric center of the front surface of the damping element is located a damping offset distance toeward from the center face plane of 5 mm or less.

In an additional non-limiting embodiment of the present technology the first portion of the striking face has a thickness greater than 1.5 mm and less than 2.5 mm.

In an additional non-limiting embodiment of the present technology the golf club head further comprises a shelf extending inward from the periphery portion, a back cover attached to the shelf to enclose a cavity in the golf club head, and a back cavity bridge which extends across the cavity from a topline region of the shelf to a toe region of the shelf.

In an additional non-limiting embodiment of the present technology the golf club head further comprises a shelf extending inward from the periphery portion, and a back cover attached to the shelf to enclose a cavity in the golf club head, wherein the shelf includes a protruding section which spans the cavity from a topline region of the shelf to a lower toe region of the shelf.

In an additional non-limiting embodiment of the present technology the golf club head further comprises a shelf extending inward from the periphery portion, and a back cover attached to the shelf to enclose a cavity in the golf club head, wherein the back cover includes a thermoset material.

In an additional non-limiting embodiment of the present technology the rear surface of the striking face includes a thermoset material.

In an additional non-limiting embodiment of the present technology the thermoset material is applied to the rear surface of the striking face in an uncured state, wherein the thermoset material subsequently cures with a thickness between 0.1 mm and 4.0 mm.

In an additional non-limiting embodiment of the present technology the thermoset material includes a filler material.

This summary is provided to introduce a selection of concepts in a simplified form that are further described below in the Detailed Description. This summary is not intended to identify key features or essential features of the claimed subject matter, nor is it intended to be used to limit the scope of the claimed subject matter.

One non-limiting embodiment of the present technology includes a golf club head including: a striking face; a back portion behind the striking face extending from a topline to a sole; a hosel configured to receive a shaft, the hosel located on a heel side of the golf club head, the heel side located opposite a toe side; a coordinate system centered at a center of gravity of the golf club head, the coordinate system including a y-axis extending vertically, perpendicular to a ground plane when the golf club head is in an address position at a prescribed loft and lie, an x-axis perpendicular to the y-axis and parallel to the striking face, extending towards the heel side of the golf club head, and a z-axis, perpendicular to the y-axis and the x-axis and extending through the striking face; a plurality of scorelines having the same length on the striking face; a center face plane parallel to the y-axis and the z-axis, the center face plane located equidistant from a heel-most extent of the plurality of scorelines and a toe-most extent of the plurality of scorelines; a damping element including a front surface and a rear surface, the rear surface of the damping element opposite the front surface of the damping element; wherein the striking face includes a front surface configured to strike a golf ball and a rear surface opposite the front surface; wherein the front surface of the damping element contacts the rear surface of the striking face; wherein the striking face includes a first portion having a substantially constant thickness; wherein the front surface of the damping element contacts the first portion of the striking face; and wherein the rear surface of the damping element contacts the back portion of the golf club head.

In an additional non-limiting embodiment of the present technology the damping element has an elastic modulus of about 40 GPa or greater.

In an additional non-limiting embodiment of the present technology the damping element has an elastic modulus of about 70 GPa or greater.

In an additional non-limiting embodiment of the present technology the damping element is made from metal.

In an additional non-limiting embodiment of the present technology the damping element is made from aluminum, steel, or titanium.

In an additional non-limiting embodiment of the present technology the damping element further includes an epoxy or a lubricant at the front surface of the damping element.

In an additional non-limiting embodiment of the present technology the damping element further includes an epoxy or a lubricant at the rear surface of the damping element.

In an additional non-limiting embodiment of the present technology the damping element is hemispherical in shape.

In an additional non-limiting embodiment of the present technology the first portion of the striking face has a thickness greater than 1.5 mm and less than 2.5 mm.

In an additional non-limiting embodiment of the present technology at least a portion of the damping element overlaps the center face plane.

One non-limiting embodiment of the present technology includes a golf club head including: a striking face; a back portion behind the striking face extending from a topline to a sole; a hosel configured to receive a shaft, the hosel located on a heel side of the golf club head, the heel side located opposite a toe side; a coordinate system centered at a center of gravity of the golf club head, the coordinate system including a y-axis extending vertically, perpendicular to a ground plane when the golf club head is in an address position at a prescribed loft and lie, an x-axis perpendicular to the y-axis and parallel to the striking face, extending towards the heel side of the golf club head, and a z-axis, perpendicular to the y-axis and the x-axis and extending through the striking face; a plurality of scorelines having the same length on the striking face; a center face plane parallel to the y-axis and the z-axis, the center face plane located equidistant from a heel-most extent of the plurality of scorelines and a toe-most extent of the plurality of scorelines; a damping element including a front surface and a rear surface, the rear surface of the damping element opposite the front surface of the damping element; wherein the striking face includes a front surface configured to strike a golf ball and a rear surface opposite the front surface; wherein the front surface of the damping element contacts against the rear surface of the striking face; wherein the striking face includes a first portion having a substantially constant thickness; wherein the front surface of the damping element contacts the first portion of the striking face; wherein the rear surface of the damping element contacts the back portion of the golf club head; wherein the front surface of the damping element includes a geometric center; and wherein at least a portion of the damping element overlaps the center face plane.

In an additional non-limiting embodiment of the present technology the back portion of the golf club head includes an adjustment mechanism configured to adjust a compression of the damping element against the striking face.

In an additional non-limiting embodiment of the present technology the adjustment mechanism includes an adjustment driver and an adjustment receiver, wherein the adjustment receiver is configured to receive the adjustment driver by threaded engagement.

In an additional non-limiting embodiment of the present technology the damping element has an elastic modulus of about 40 GPa or greater.

In an additional non-limiting embodiment of the present technology the damping element has an elastic modulus of about 70 GPa or greater.

In an additional non-limiting embodiment of the present technology the damping element is made from aluminum, steel, or titanium.

In an additional non-limiting embodiment of the present technology the first portion of the striking face has a thickness greater than 1.5 mm and less than 2.5 mm.

In an additional non-limiting embodiment of the present technology the damping element further includes an epoxy or a lubricant at the front surface of the damping element.

In an additional non-limiting embodiment of the present technology the striking face includes a second portion, the second portion of the striking face located heelward of the center face plane, the second portion of the striking face having a thickness which tapers from a maximum thickness at a thick end of the second portion to a minimum thickness at a thin end of the second portion, wherein the thick end is located toeward of the thin end.

In an additional non-limiting embodiment of the present technology the striking face includes a third portion, the third portion of the striking face located toeward of the center face plane, the third portion of the striking face having a thickness which tapers from a maximum thickness at a heel end of the third portion to a minimum thickness at a toe end of the third portion.

BRIEF DESCRIPTION OF THE DRAWINGS

Non-limiting and non-exhaustive examples are described with reference to the following Figures.

FIG. 14G illustrates a cross sectional view of a damping element similar to that of FIG. 14A but the center of the front portion is offset from a center of the rear portion.

FIG. 14H illustrates a cross sectional view of a damping element similar to that of FIG. 14B but the center of the front portion is offset from a center of the rear portion.

FIG. 14I illustrates a cross sectional view of a damping element similar to that of FIG. 14C but the center of the front portion is offset from a center of the rear portion.

FIG. 14J illustrates a cross sectional view of a damping element which necks down in diameter between the front portion and the rear portion.

FIG. 14K illustrates a cross sectional view of a damping element which necks down in diameter between the front portion and the rear portion.

FIG. 14L illustrates a cross sectional view of a damping element similar to that of FIG. 14J but includes a first material and a second material.

FIG. 83 illustrates a perspective view of the support arm and weight members of the golf club head of FIG. 79.

FIG. 84 illustrates a cross sectional view of the golf club head with an additional embodiment of a damping element.

FIG. 85 illustrates a perspective view of the damping element of the golf club head of FIG. 84.

FIG. 86 depicts a perspective view of a golf club head.

FIG. 87 depicts an additional perspective view of the golf club head of FIG. 86.

FIG. 88 depicts a perspective view of the golf club head of FIG. 86 missing the striking face.

FIG. 89 depicts an additional perspective view of the golf club head of FIG. 86 missing the striking face.

FIG. 90 depicts a cross sectional view T-T of the golf club head of FIG. 86.

FIG. 91 depicts a perspective view of the golf club head of FIG. 86 including a back cover.

FIG. 92 depicts a perspective view of the back cover.

FIG. 93 depicts an additional perspective view of the back cover.

FIG. 94 depicts a cross sectional view V-V of the golf club head of FIG. 92.

Figure 93:
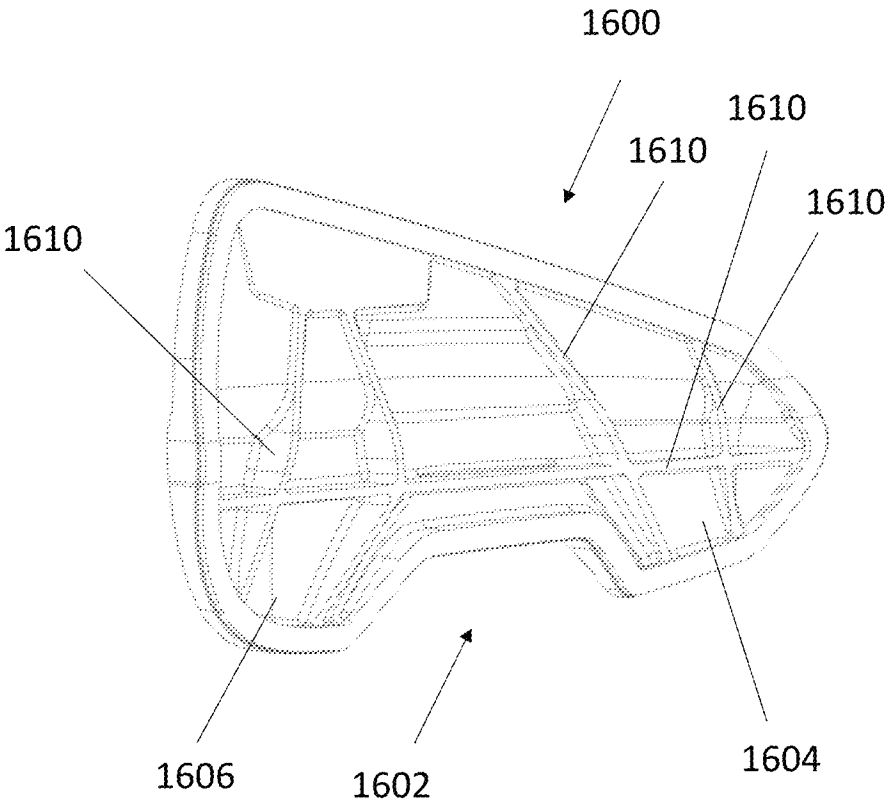
Figure 94:
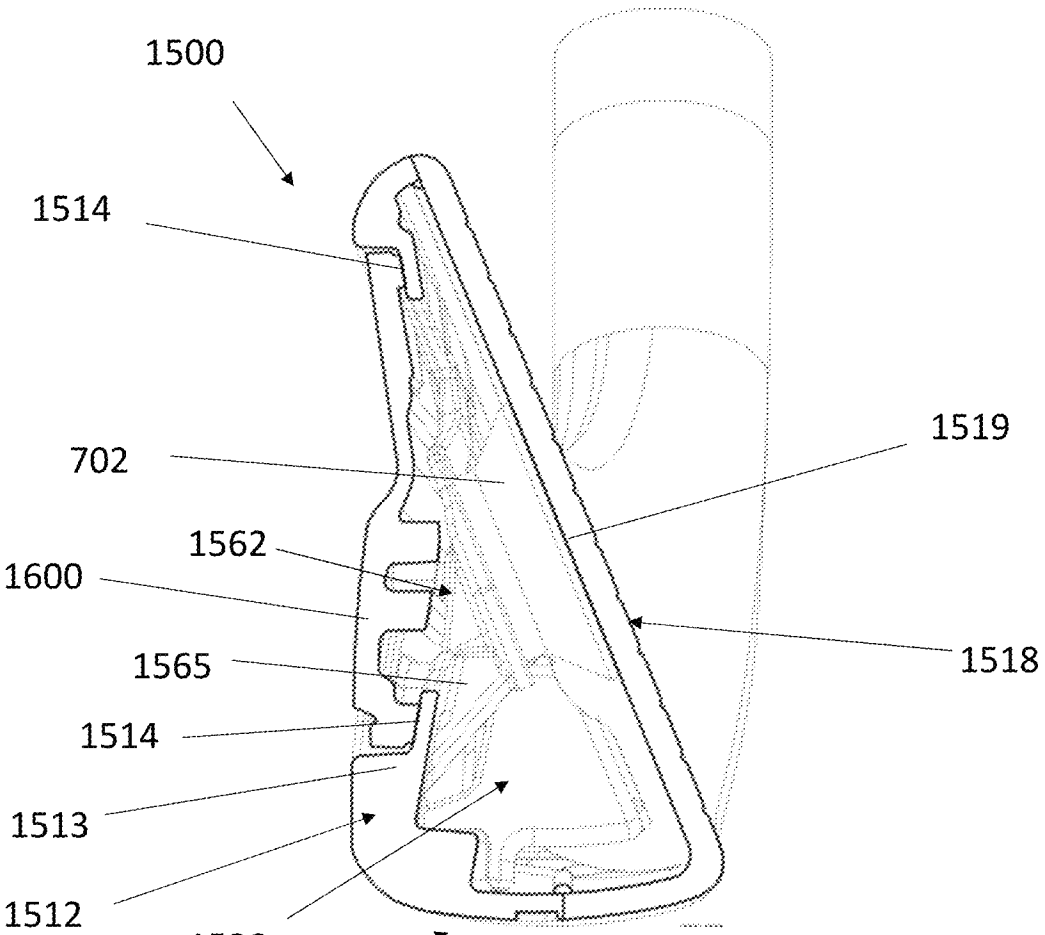
Figure 95:
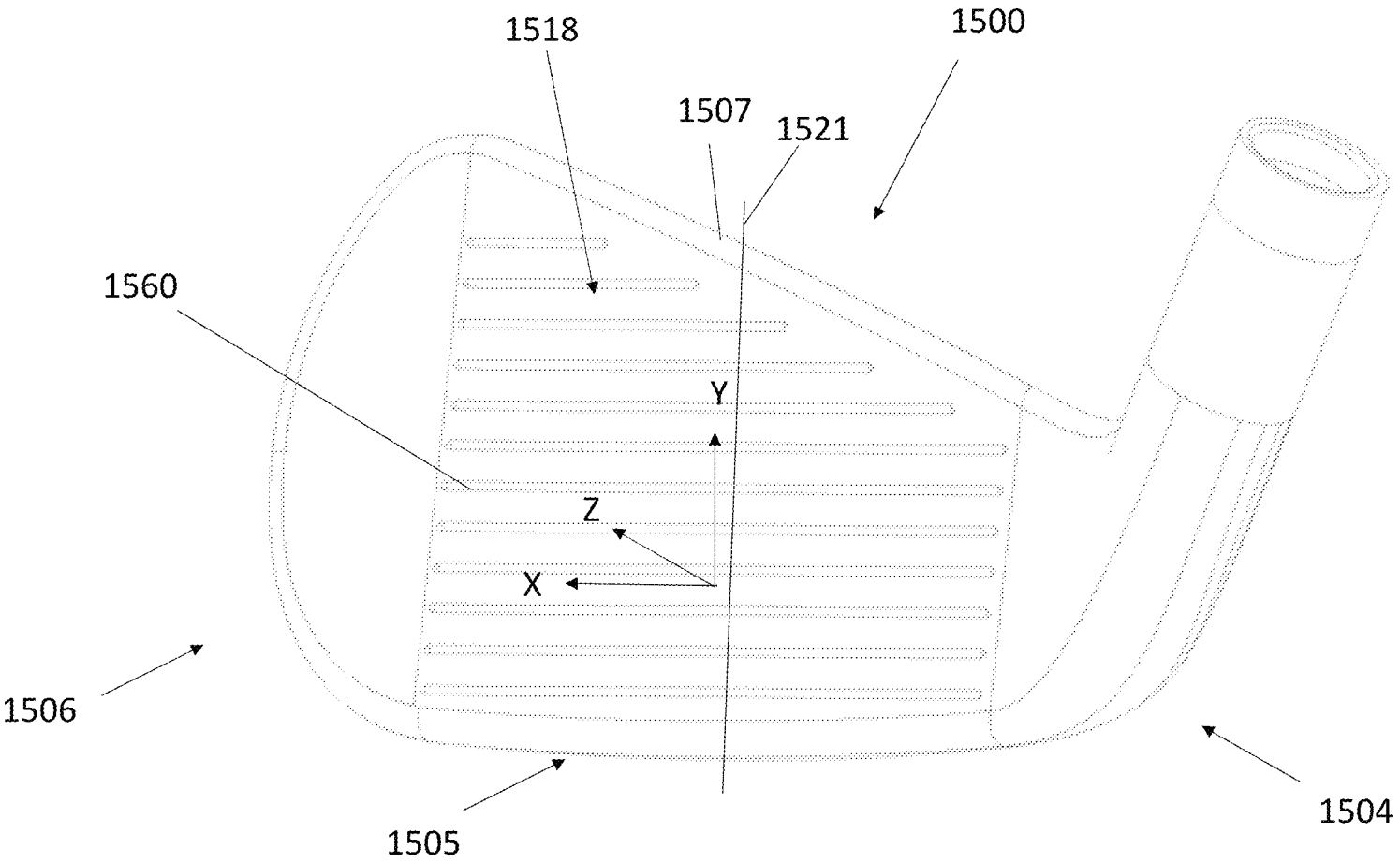

FIG. 95 depicts the golf club head of FIGS. 86-94 having a tapered heel portion.

Figure 96:
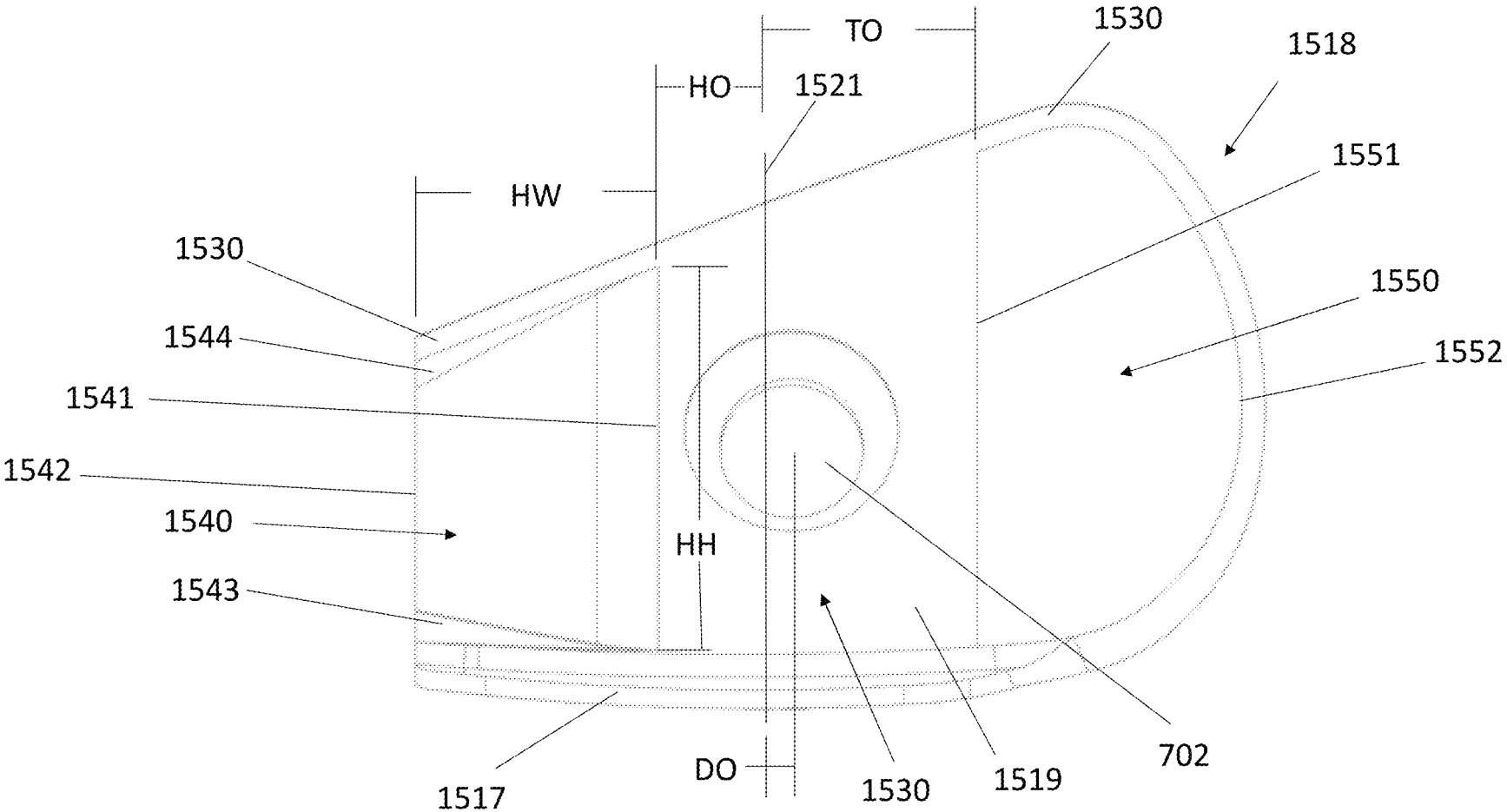

FIG. 96 depicts a rear view of the striking face and damping element of the golf club head of FIG. 95.

Figure 97:
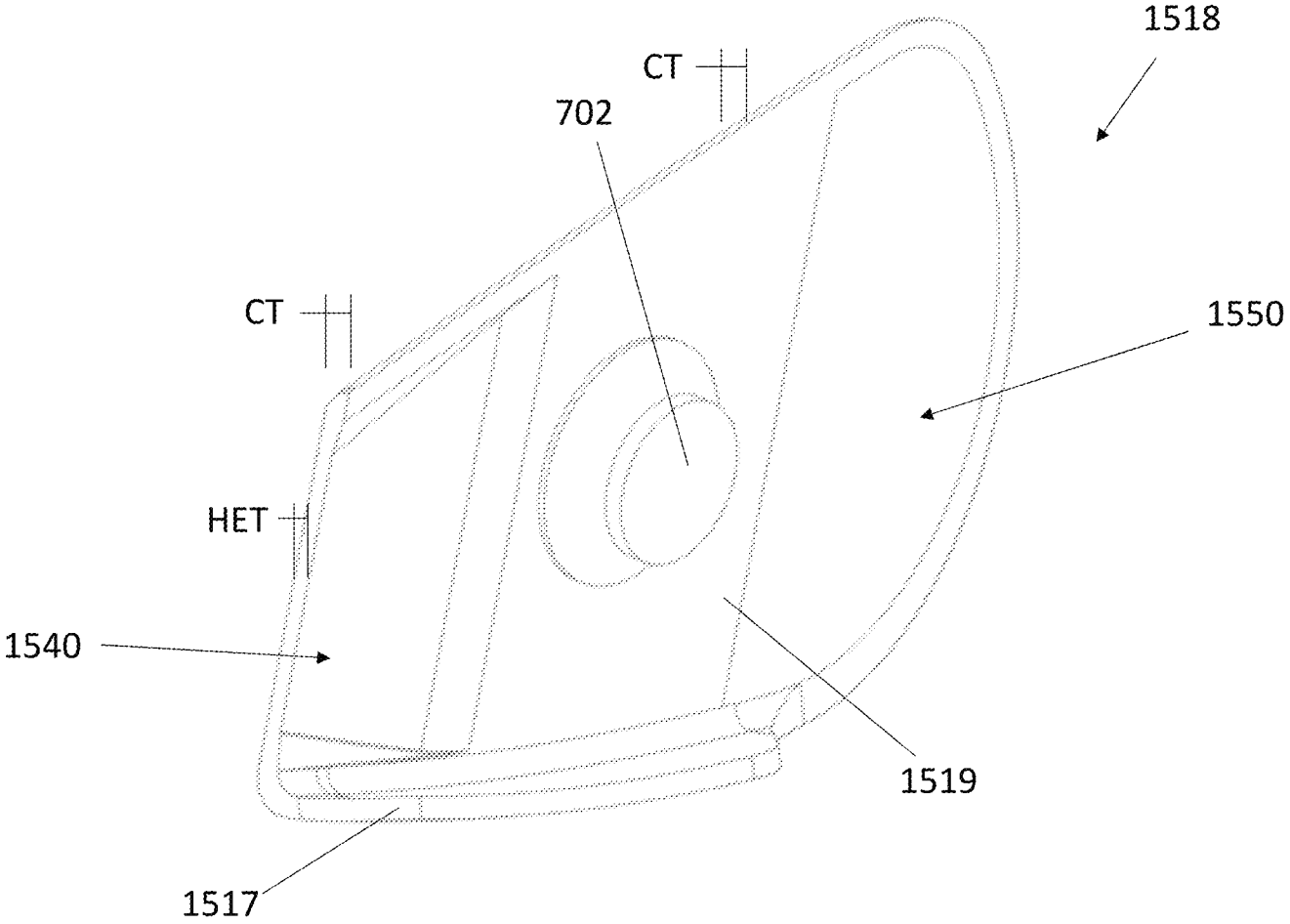

FIG. 97 depicts a perspective view of the striking face and damping element of FIG. 96.

Figure 98:
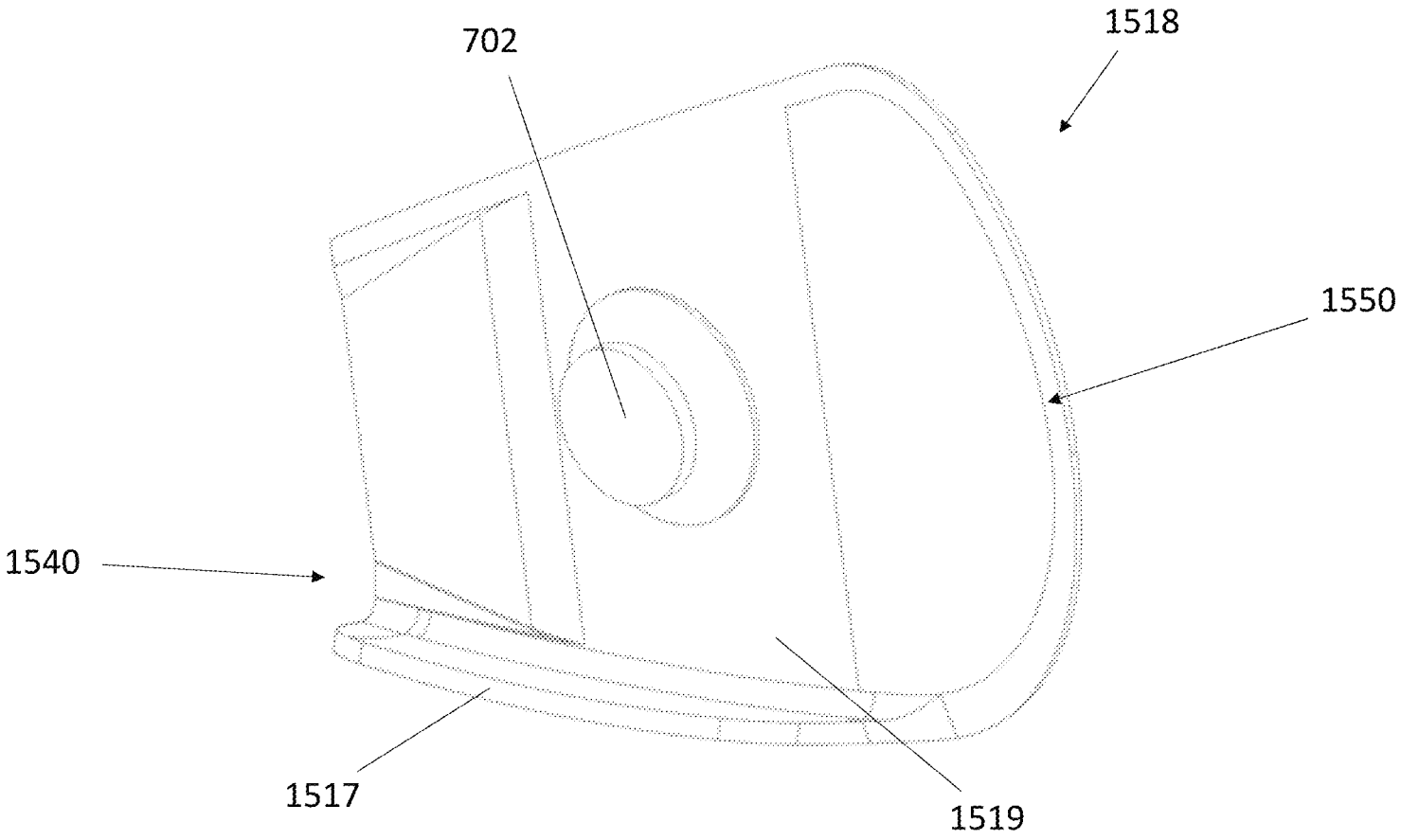

FIG. 98 depicts an additional perspective view of the striking face and damping element of FIG. 96.

Figure 99:
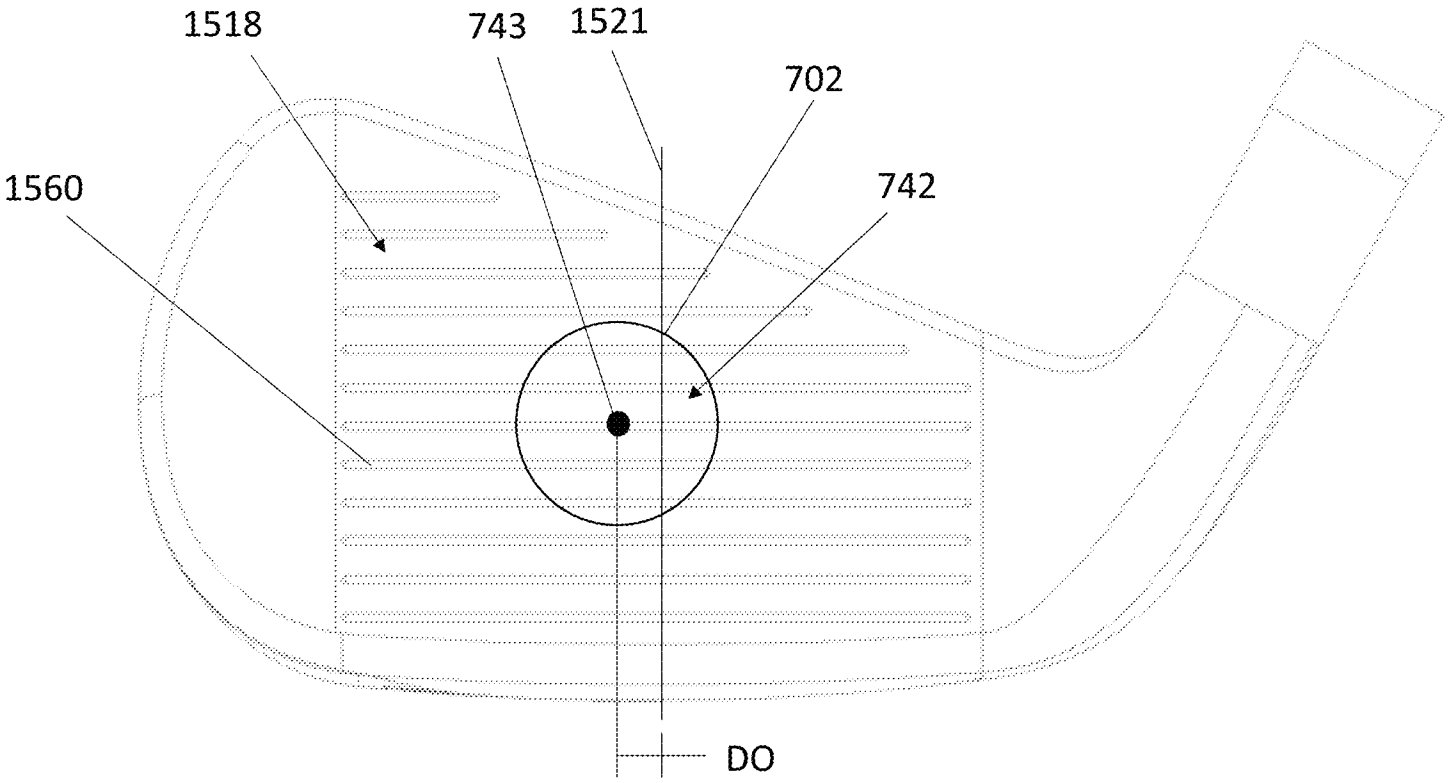

FIG. 99 depicts a front view of the golf club head of FIG. 95 including the supported region.

Figure 100:
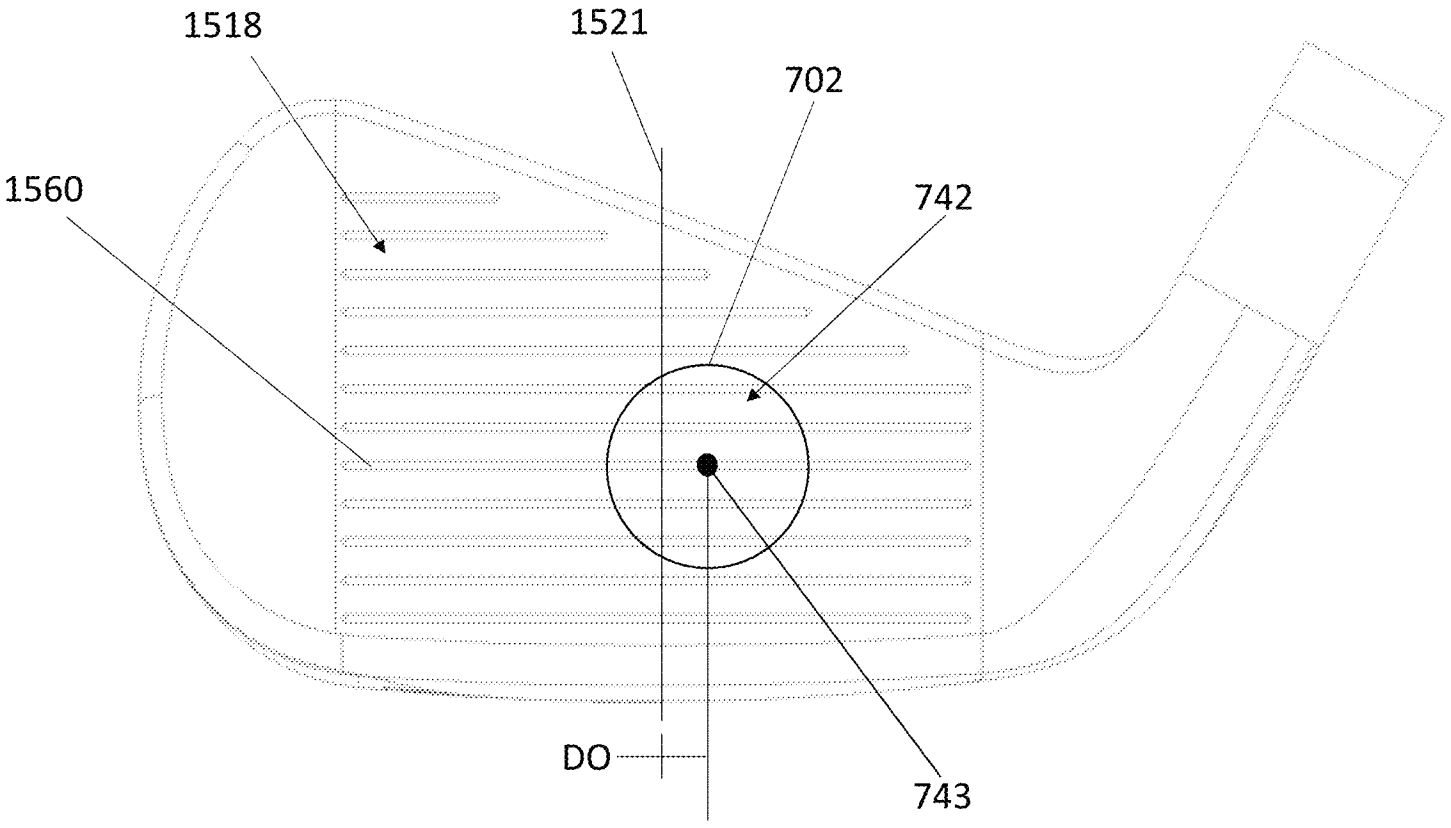

FIG. 100 depicts a front view of another embodiment of the golf club head of FIG. 95 including the supported region.

Figure 101:
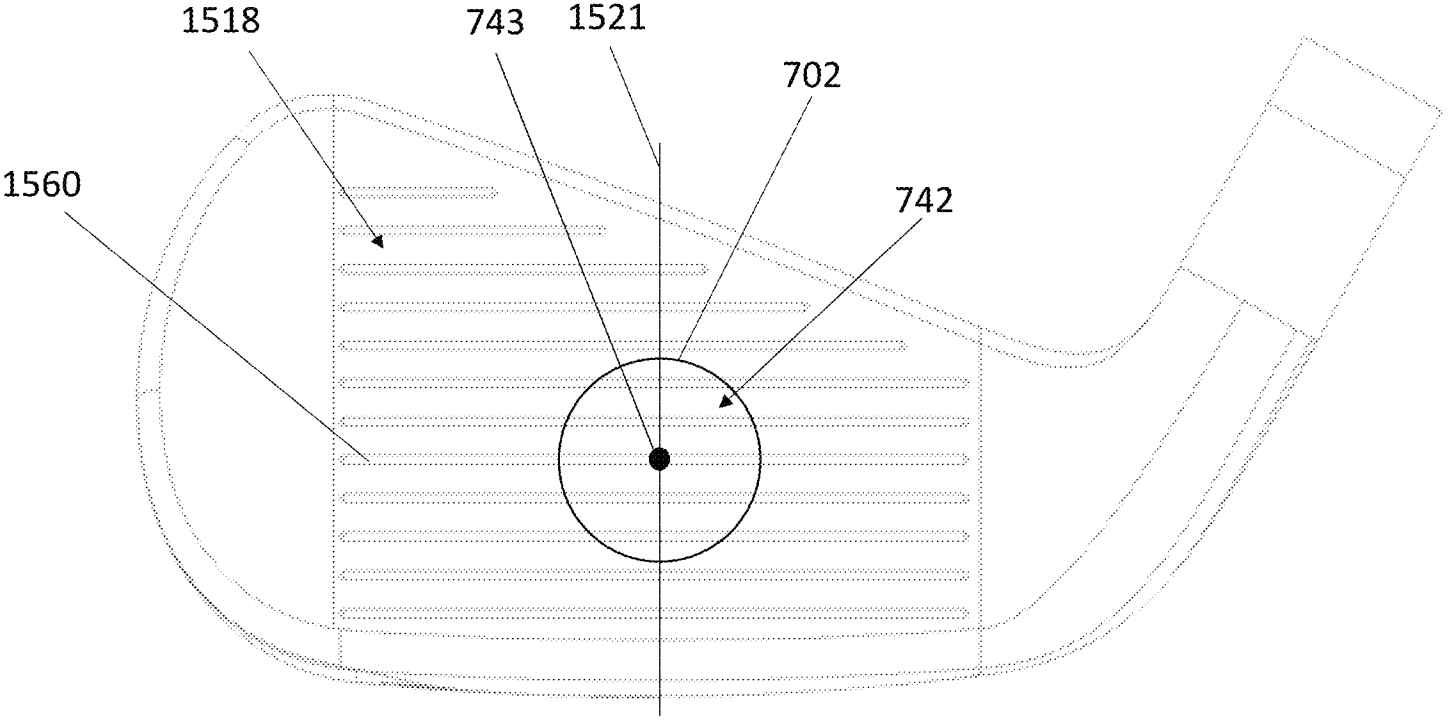

FIG. 101 depicts a front view of another embodiment of the golf club head of FIG. 95 including the supported region.

Figure 86:
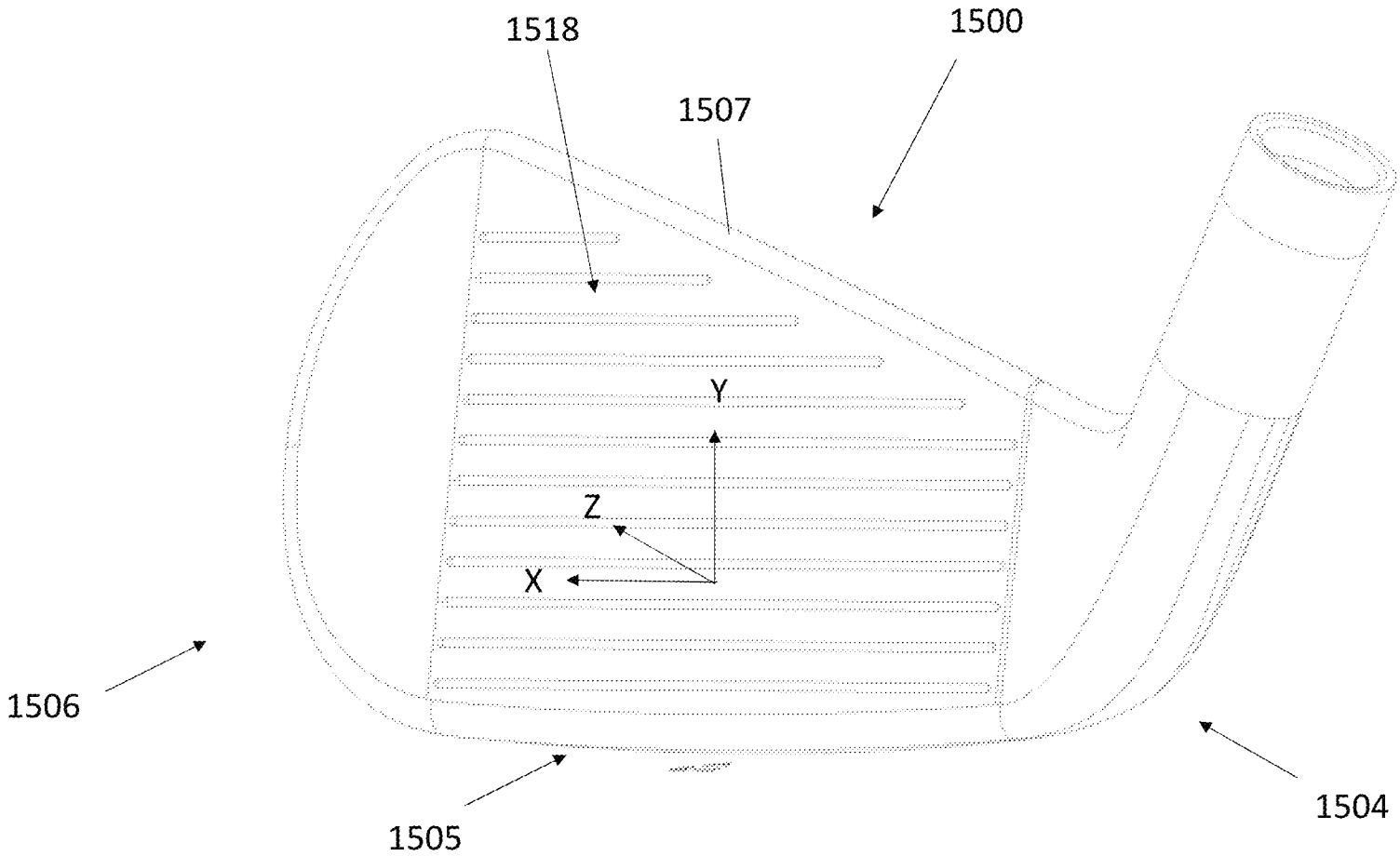
Figure 102:
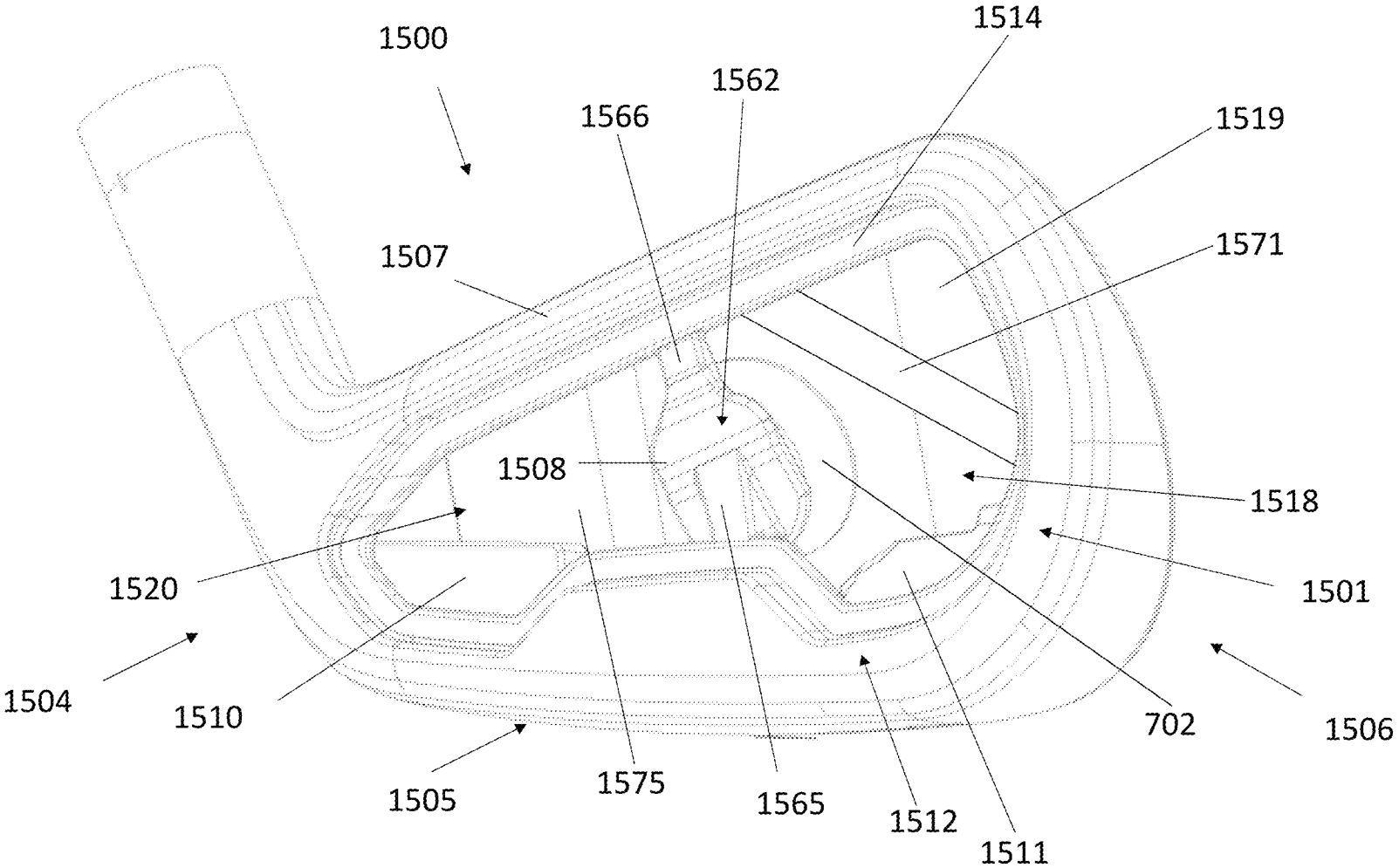

FIG. 102 depicts a perspective view of another embodiment of the golf club head of FIG. 86.

Figure 103:
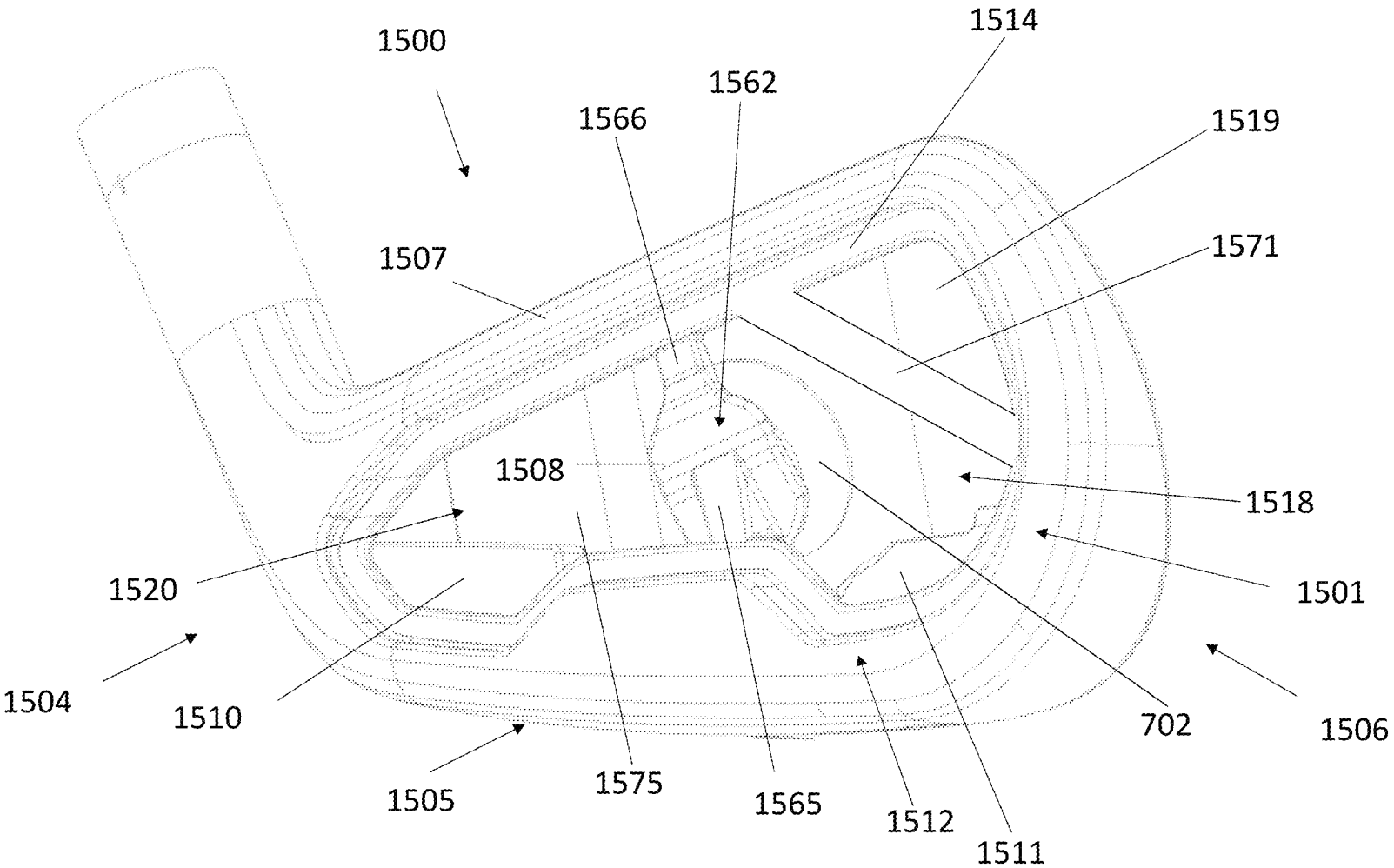

FIG. 103 depicts a perspective view of another embodiment of the golf club head of FIG. 86.

Figure 104:
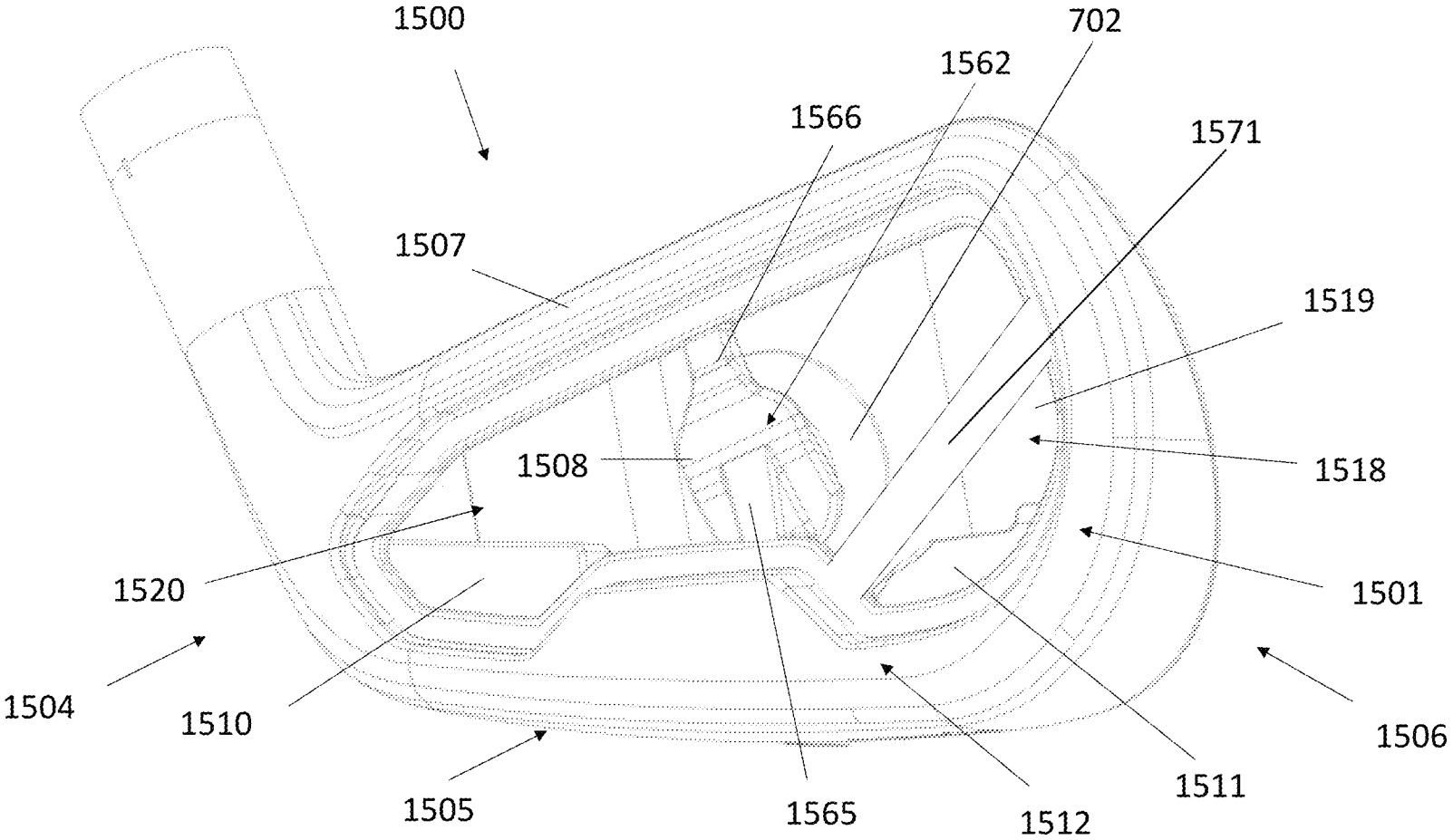

FIG. 104 depicts a perspective view of another embodiment of the golf club head of FIG. 86.

Figure 105:
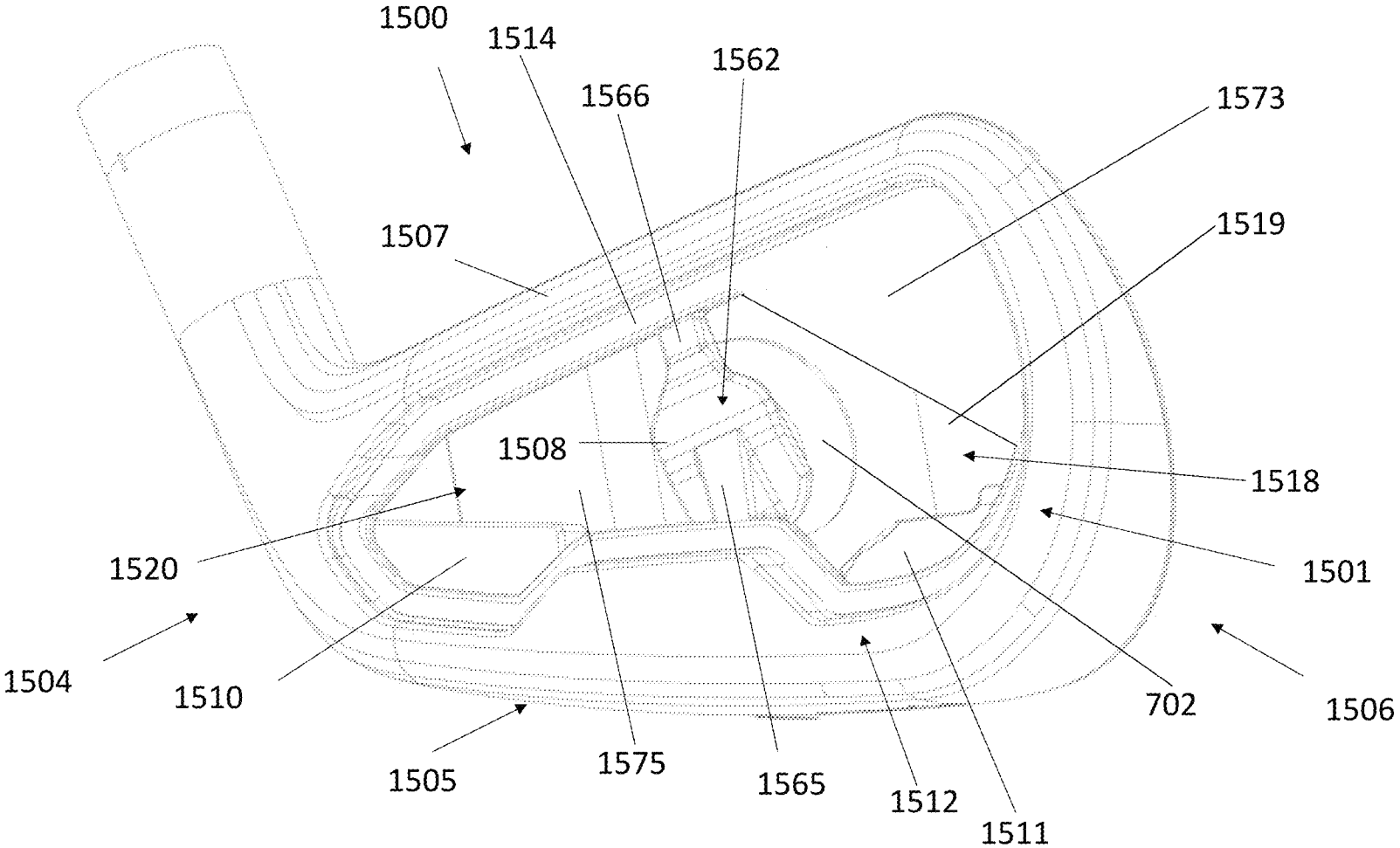

FIG. 105 depicts a perspective view of another embodiment of the golf club head of FIG. 86.

Figure 106:
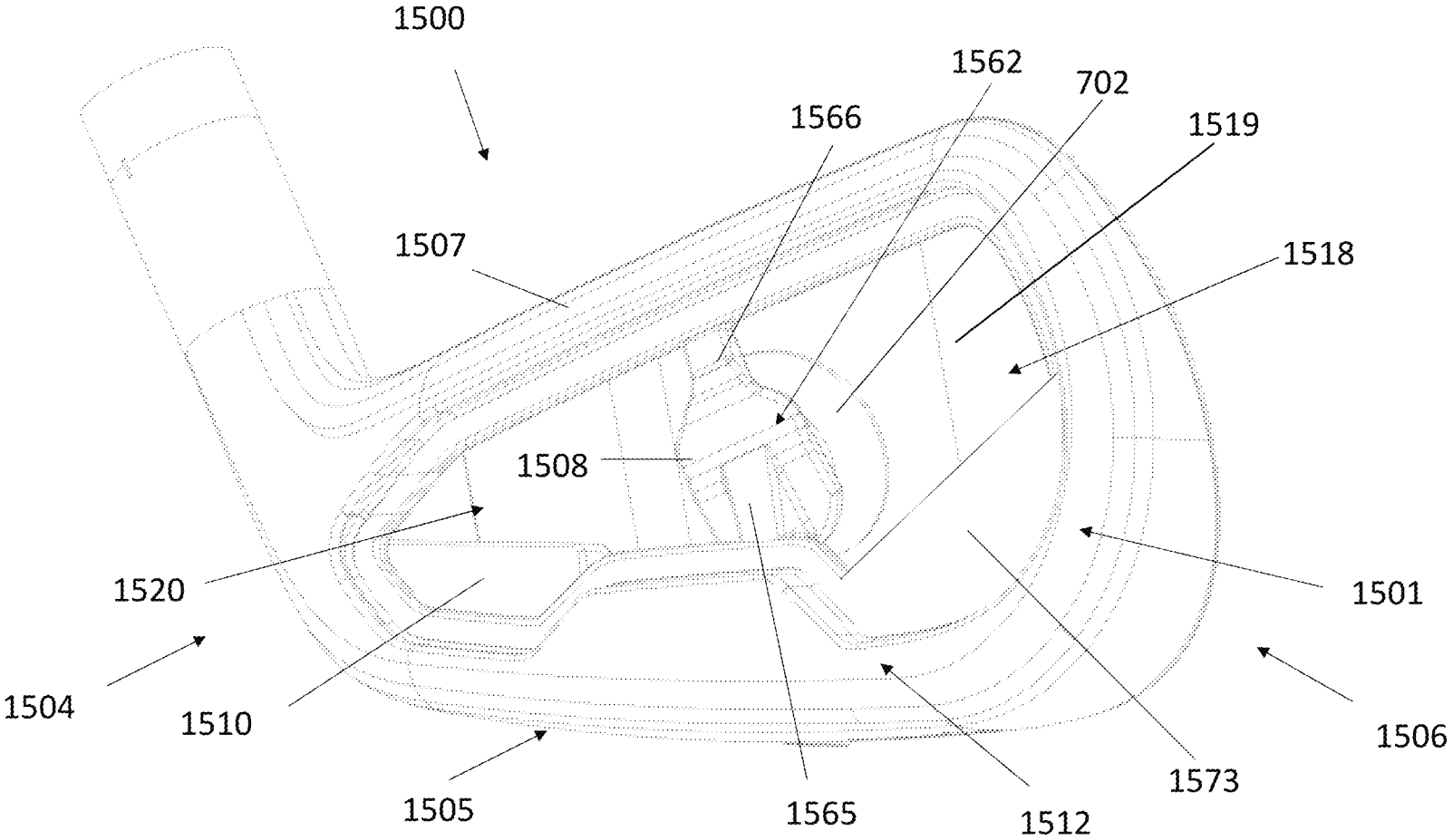

FIG. 106 depicts a perspective view of another embodiment of the golf club head of FIG. 86.

DETAILED DESCRIPTION

The technologies described herein contemplate an iron-type golf club head that incorporates a damping element to promote more uniform ball speed across the striking face of the golf club. Traditional thin-faced iron-type golf clubs generally produce less uniform launch velocities across the striking face due to increased compliance at the geometric center of the striking face. For example, when a golf club strikes a golf ball, the striking face of the club deflects and then springs forward, accelerating the golf ball off the striking face. While such a design may lead to large flight distances for a golf ball when struck in the center of the face, any off-center strike of golf ball causes significant losses in flight distance of the golf ball. In comparison, an extremely thick face causes more uniform ball flight regardless of impact location, but a significant loss in launch velocities. The present technology incorporates a damping element between a back portion of the hollow iron and the rear surface of the striking face. By including the damping element, the magnitude of the launch velocity may be reduced for strikes at the center of the face while improving uniformity of launch velocities across the striking face. In some examples, the compression of the damping element between the back portion and the striking face may also be adjustable to allow for a golfer or golf club fitting professional to alter the deflection of the striking face when striking a golf ball.

Figure 1B:
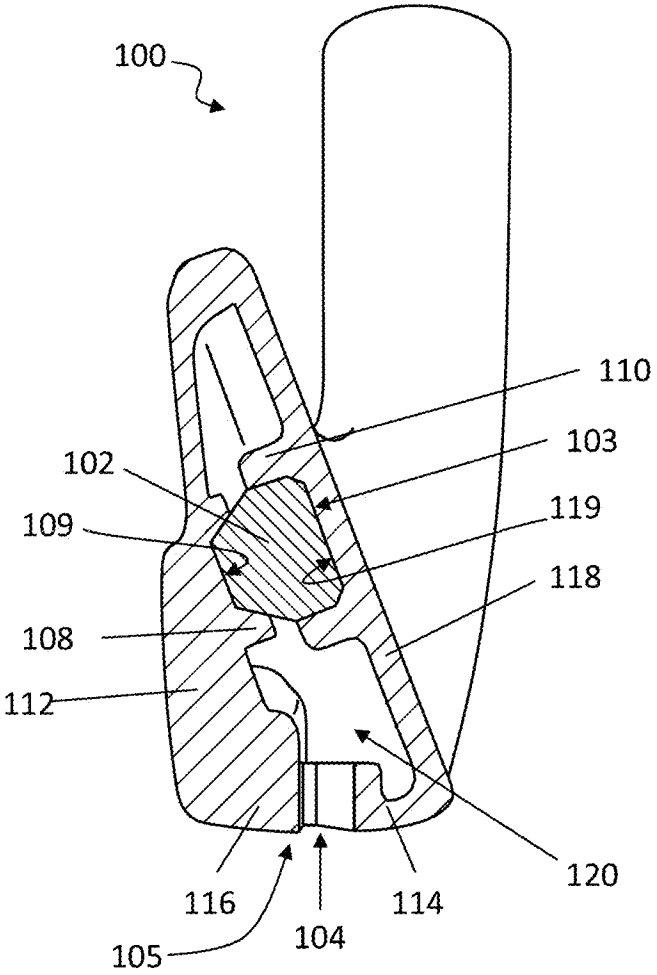
FIGS. 1A-1B depict section views of a golf club head having a damping element.
Figure 1A:
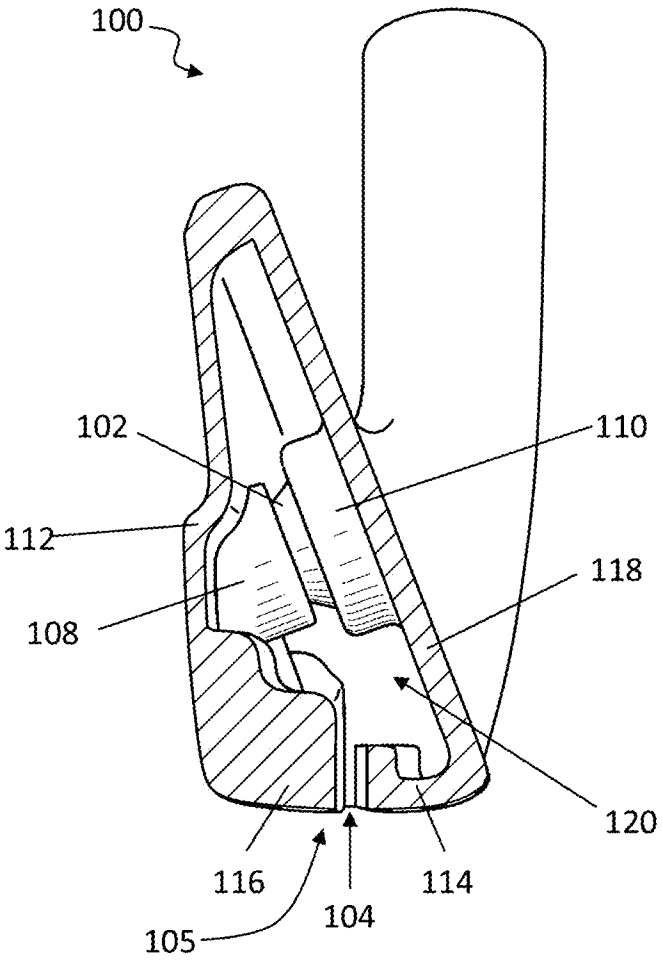
Figure 1C:
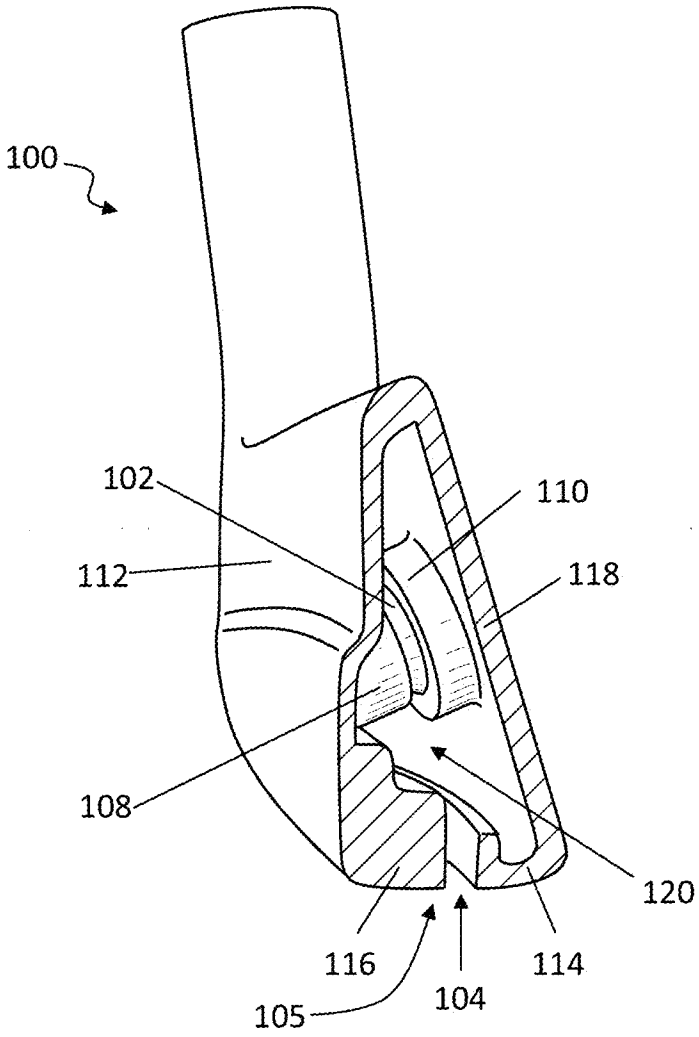
FIG. 1C depicts a perspective section view of the golf club head depicted in FIGS. 1A-1B.

FIGS. 1A-1B depict section views depict section views of a golf club head 100 having a damping element 102. FIG. 1C depicts a perspective section view of the golf club head 100. FIGS. 1A-1C are described concurrently. The club head 100 includes a striking face 118 and a back portion 112. A cavity 120 is formed between the striking face 118 and the back portion 112. A damping element 102 is disposed in the cavity 120 between the striking face 118 and the back portion 112. A rear portion of the damping element 102 is held in place by a cradle 108. The cradle 108 is attached to the back portion 112 of the golf club head 100, and the cradle 108 includes a recess 109 to receive the rear portion of the damping element 102. The lip of the cradle 108 prevents the damping element 102 from sliding or otherwise moving out of position. The damping element 102 may have a generally frustoconical shape, as shown in FIGS. 1A-1B. In other examples, the damping element 102 may have a cylindrical, spherical, cuboid, or prism shape. The recess 109 of the cradle 108 is formed to substantially match the shape of the rear portion of the damping element 102. For example, with the frustoconical damping element 102, the recess 109 of the cradle 108 is also frustoconical such that the surface of the rear portion of the damping element 102 is in contact with the interior walls of the recess 109 of the cradle 108. The cradle 108 may be welded or otherwise attached onto the back portion 112, or the cradle 108 may be formed as part of the back portion 112 during a casting or forging process. The back portion 112 may also be machined to include the cradle 108.

A front portion 103 of the damping element 102 contacts the rear surface 119 of the striking face 118. The front portion 103 of the damping element 102 may be held in place on the rear surface 119 of the striking face 118 by a securing structure, such as flange 110. The flange 110 protrudes from the rear surface 119 of the striking face 118 into the cavity 120. The flange 110 receives the front portion 103 of the damping element 102 to substantially prevent the damping element 102 from sliding along the rear surface 119 of the striking face 118. The flange 110 may partially or completely surround the front portion 103 of the damping element 102. Similar to the cradle 108, the flange 110 may be shaped to match the shape of the front portion 103 of the damping element 102 such that the surface of the front portion 103 of the damping element 102 is in contact with the interior surfaces of the flange 110. The flange 110 may be welded or otherwise attached to the rear surface 119 of the striking face 118. The flange 110 may also be cast or forged during the formation of the striking face 118. For instance, where the striking face 118 is a face insert, the flange 110 may be incorporated during the casting or forging process to make the face insert. In another example, the flange 110 and the striking face 118 may be machined from a thicker face plate. Alternative securing structures other than the flange 110 may also be used. For instance, two or more posts may be included on rear surface 119 of the striking face 118 around the perimeter of the front portion 103 of the damping element 102. As another example, an epoxy may be used to secure the damping element 102 to the rear surface 119 of the striking face 118. The epoxy may also provide acoustic damping for desired sound characteristics. In other embodiments, no securing structure is utilized and the damping element 102 is generally held in place due to the compression of the damping element 102 between the cradle 108 and the rear surface 119 of the striking face 118.

In the example depicted in FIGS. 1A-1C, the damping element 102 is disposed behind the approximate geometric center of the striking face 118. In traditional thin face golf clubs, strikes at the geometric center of the striking face 118 display the largest displacement of the striking face 118, and thus the greatest ball speeds. By disposing the damping element 102 at the geometric center of the striking face 118, the deflection of the striking face 118 at that point is reduced, thus reducing the ball speed. Portions of the striking face 118 not backed by the damping element 102, however, continue to deflect into the cavity 120 contributing to the speed of the golf ball. As such, a more uniform distribution of ball speeds resulting from ball strikes across the striking face 118 from the heel to the toe may be achieved. In other examples, the damping element 102 may be disposed at other locations within the club head 100.

The elasticity of the damping element 102 also affects the deflection of the striking face 118. For instance, a material with a lower elastic modulus allows for further deflection of the striking face 118, providing for higher maximum ball speeds but less uniformity of ball speeds. In contrast, a material with a higher elastic modulus further prevents deflection of the striking face 118, providing for lower maximum ball speeds but more uniformity of ball speeds. With a material having a higher elastic modulus, speed retention and carry distance vary less with off center shots relative to center shots for improved forgiveness. Different types of materials are discussed in further detail below with reference to Tables 2-3.

The golf club head 100 also includes a sole 105 having a sole channel 104 in between a front sole portion 114 and a rear sole portion 116. The sole channel 104 extends along the sole 105 of the golf club head 100 from a point near the heel to a point near the toe thereof. While depicted as being a hollow channel, the sole channel 104 may be filled or spanned by a plastic, rubber, polymer, or other material to prevent debris from entering the cavity 120. The sole channel 104 allows for additional deflection of the lower portion of the striking face 118. By allowing for further deflection of the lower portion of the striking face 118, increased ball speeds are achieved from ball strikes at lower portions of the striking face 118, such as ball strikes off the turf. Accordingly, the damping element 102 and the sole channel 104 in combination with one another provide for increased flight distance of a golf ball for turf strikes along with more uniform ball speeds across the striking face 118.

Figure 2B:
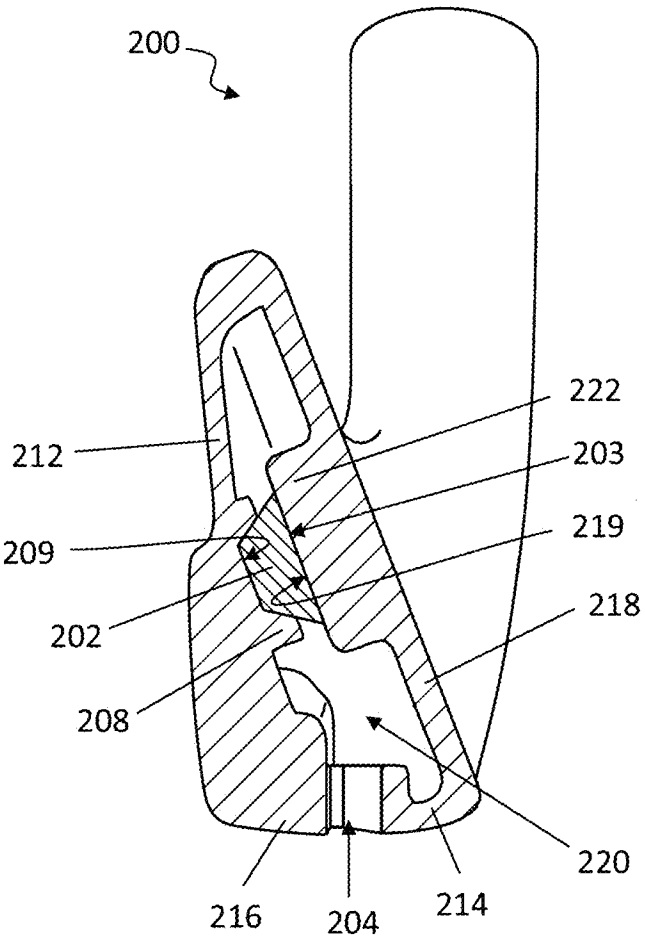
FIGS. 2A-2B depict section views of a golf club head having a damping element and a striking face with a thickened center portion.
Figure 2A:
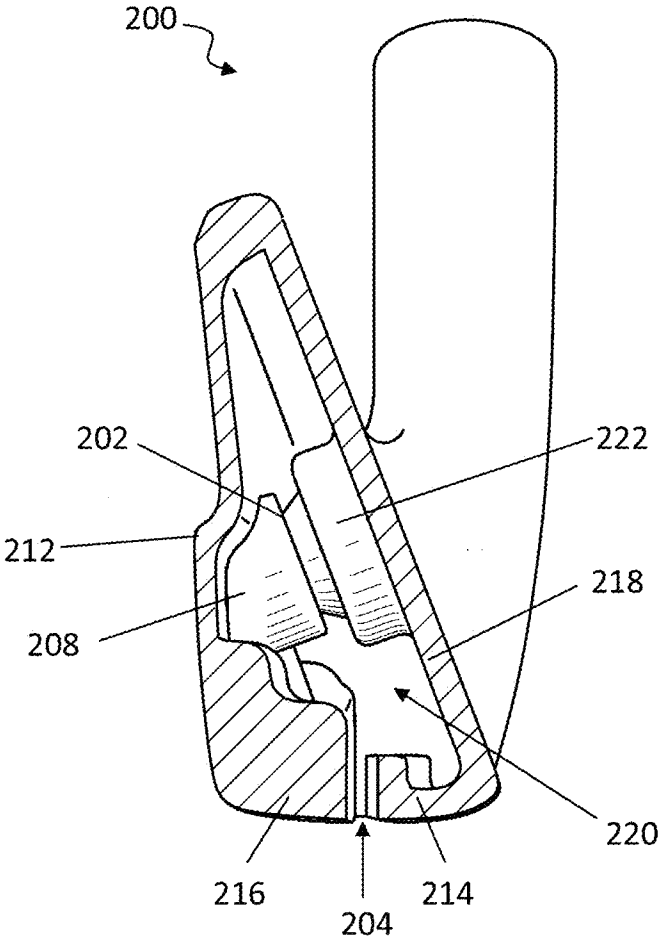

FIGS. 2A-2B depict sections views of a golf club head 200 having a damping element 202 and a striking face 218 with a thickened center portion 222. Golf club head 200 is similar to golf club head 100 discussed above with reference to FIGS. 1A-1C, except a thickened portion 222 of the striking face 218 is utilized rather than a flange 110. The thickened portion 222 of the striking face 218 protrudes into the cavity 220. The front portion 203 of the damping element 202 contacts the rear surface 219 of the thickened portion 222. The rear portion of the damping element 202 is received by a recess 209 in a cradle 208, which is attached to the back portion 212 and substantially similar to the cradle 108 discussed above with reference to FIGS. 1A-1C. Due the thickened portion 222 of the striking face 218, the damping element 202 may be shorter in length than the damping element 102 in FIGS. 1A-1C. The golf club head 200 also includes a sole channel 204 disposed between a front sole portion 214 and a rear sole portion 216. The sole channel 204 also provides benefits similar to that of sole channel 104 described in FIGS. 1A-1C and may also be filled with or spanned by a material.

Figure 3B:
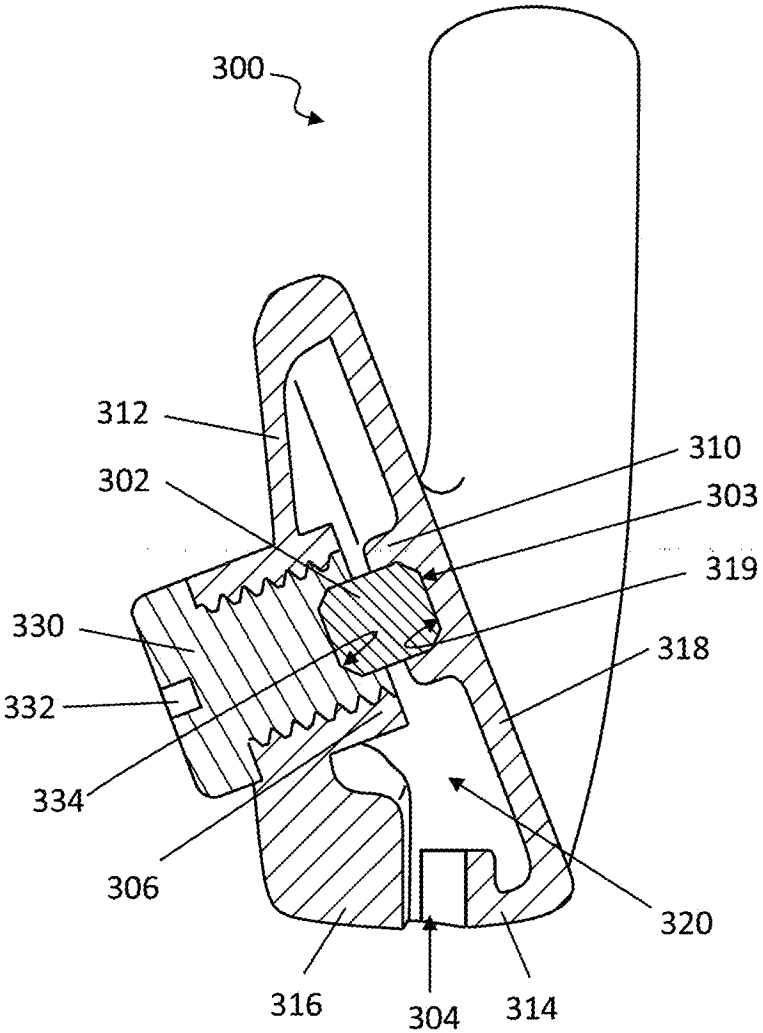
FIGS. 3A-3B depict section views of a golf club head having a damping element and an adjustment mechanism to adjust the compression of the damping element.
Figure 3A:
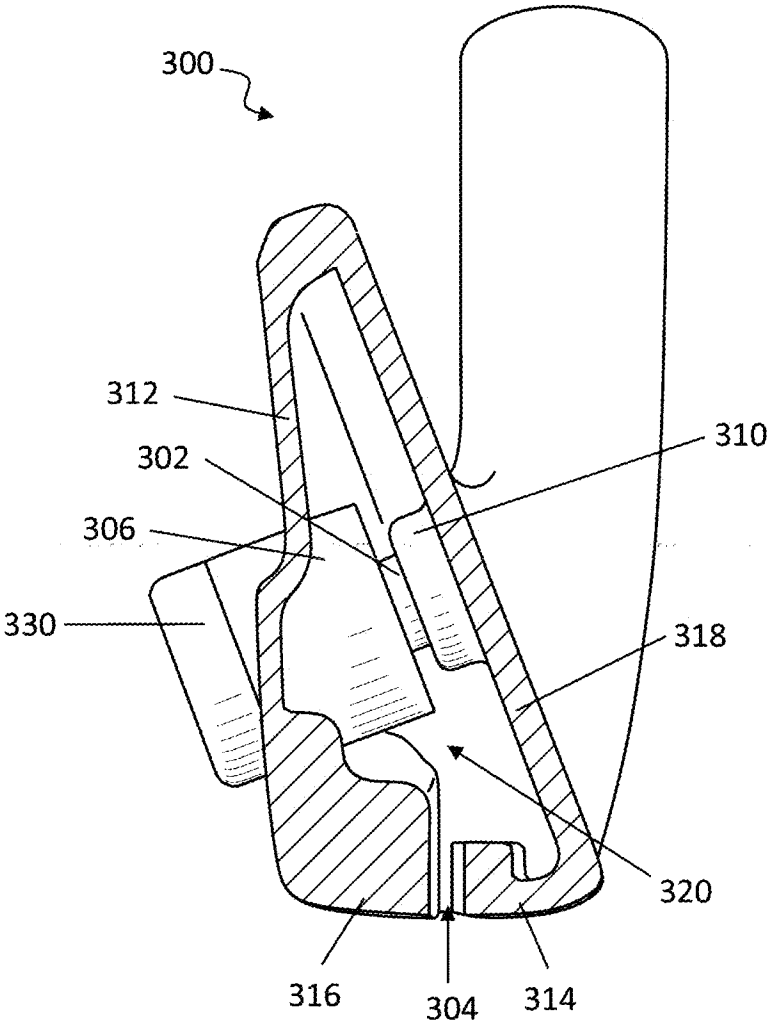

FIGS. 3A-3B depict section views of a golf club head 300 having a damping element 302 and an adjustment mechanism to adjust the compression of the damping element 302. The golf club head 300 includes a striking face 318 and a back portion 312, and a cavity 320 is formed between the back portion 312 and the striking face 318. Similar to the golf club head 100 described above with reference to FIGS. 1A-1C, a flange 310 is disposed on the rear surface 319 of the striking face 318, and the flange 310 receives the front portion 303 of the damping element 302. In the example depicted in FIGS. 3A-3B, the damping element 302 has a generally cylindrical shape. In other examples, however, the damping element 302 may have a conical, frustoconical, spherical, cuboid, or prism shape.

The golf club head 300 also includes an adjustment mechanism. The adjustment mechanism is configured to adjust the compression of the damping element 302 against the rear surface 319 of the striking face 318. In the embodiment depicted in FIGS. 3A-3B, the adjustment mechanism includes an adjustment receiver 306 and an adjustment driver 330. The adjustment receiver 306 may be a structure with a through-hole into the cavity 320, and the adjustment driver 330 may be a threaded element or screw, as depicted. The through-hole of the adjustment receiver 306 includes a threaded interior surface for receiving the threaded element 330. The adjustment receiver 306 may be formed as part of the forging or casting process of the back portion 312 or may also be machined and tapped following the forging and casting process. The threaded element 330 includes an interface 334, such as a recess, that contacts or receives a rear portion of the damping element 302. The threaded element 330 also includes a screw drive 332 that is at least partially external to the golf club head 300 such that a golfer can access the screw drive 332. When the threaded element 330 is turned via screw drive 332, such as by a screwdriver, Allen wrench, or torque wrench, the threaded element 330 moves further into or out of the cavity 320. In some examples, the interface 334 that contacts or receives the rear portion of the damping element 302 may be lubricated so as to prevent twisting or spinning of the damping element 302 when the threaded element 330 is turned. As the threaded element 330 moves further into the cavity 320, the compression of the damping element 302 against the rear surface 319 of the striking face 318 increases, thus altering a performance of the damping element 302.

A higher compression of the damping element 302 against the rear surface 319 of the striking face 318 further restricts the deflection of the striking face 318. In turn, further restriction of the deflection causes more uniform ball speeds across the striking face 318. However, the restriction on deflection also lowers the maximum ball speed from the center of the striking face 318. By making the compression of the damping element 302 adjustable with the adjustment mechanism, the golfer or a golf-club-fitting professional may adjust the compression to fit the particular needs of the golfer. For example, a golfer that desires further maximum distance, but does not need uniform ball speed across the striking face 318, can reduce the initial set compression of the damping element 302 by loosening the threaded element 330. In contrast, a golfer that desires uniform ball speed across the striking face 318 can tighten the threaded element 330 to increase the initial set compression of the damping element 302.

While the adjustment mechanism is depicted as including a threaded element 330 and a threaded through-hole in FIGS. 3A-3B, other adjustment mechanisms could be used to adjust the compression of the damping element 302 against the rear surface 319 of the striking face 318. For instance, the adjustment mechanism may include a lever where rotation of the lever alters the compression of the damping element 302. The adjustment mechanism may also include a button that may be depressed to directly increase the compression of the damping element 302. Other types of adjustment mechanisms may also be used.

The golf club head 300 also includes a sole channel 304 between a front sole portion 314 and a rear sole portion 316, similar to the sole channel 104 discussed above with reference to FIGS. 1A-1C. The sole channel 304 also provides benefits similar to that of sole channel 104 and may also be filled with or spanned by a material.

The golf club head 300 may also be created or sold as a kit. In the example depicted where the adjustment mechanism is a threaded element 330, such as a screw, the kit may include a plurality of threaded elements 330. Each of the threaded elements 330 may have a different weight, such that the golfer can select the desired weight. For example, one golfer may prefer an overall lighter weight for the head of an iron, while another golfer may prefer a heavier weight.

The plurality of threaded elements 330 may also each have different weight distributions. For instance, different threaded elements 330 may be configured so as to distribute, as desired, the weight of each threaded element 330 along a length thereof. The plurality of threaded elements 330 may also have differing lengths. By having differing lengths, each threaded elements 330 may have a maximum compression that it can apply to the damping element 302. For instance, a shorter threaded elements 330 may not be able to apply as much force onto the damping element 302 as a longer threaded elements 330, depending on the configuration of the adjustment receiver 306. The kit may also include a torque wrench for installing the threaded elements 330 into the adjustment receiver 306. The torque wrench may include preset settings corresponding to different compression or performance levels.

Figure 4B:
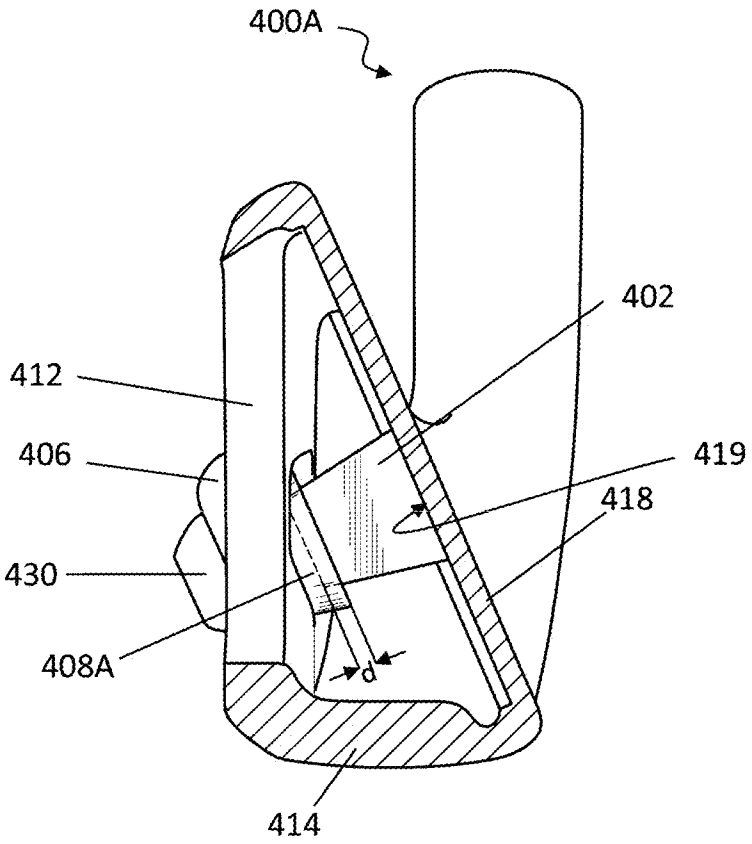
FIG. 4B depicts a section view of the golf club head of FIG. 4A.
Figure 4A:
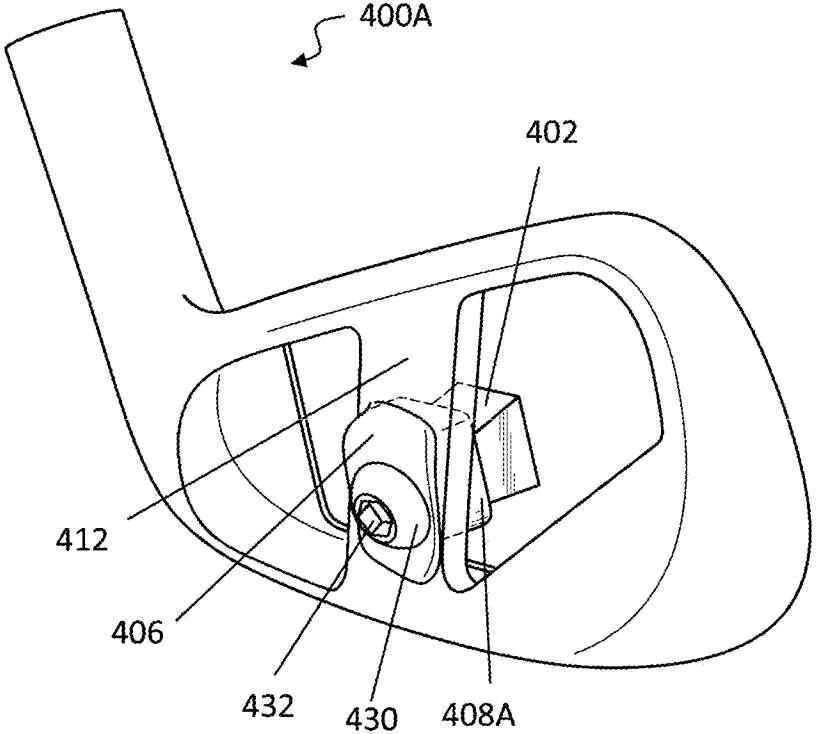
FIG. 4A depicts a perspective view of another example of a golf club head having a damping element and an adjustment mechanism to adjust the compression of the damping element.

FIG. 4A depicts a perspective view of another example of a golf club head 400A having a damping element 402 and an adjustment mechanism to adjust the compression of the damping element 402. FIG. 4B depicts a section view of the golf club head 400A. The golf club 400A includes striking face 418 and a back portion 412 with a cavity 420 formed there between. Like the adjustment mechanism in FIGS. 3A-3B, the adjustment mechanism in golf club head 400A includes an adjustment receiver 406 and an adjustment driver 430. In the example depicted, the adjustment receiver 406 is a structure having a threaded through-hole for accepting the adjustment driver 430, and the adjustment driver 430 is a screw. In some embodiments, the adjustment receiver 406 may be defined by a threaded through-hole through the back portion 412, without the need for any additional structure.

The tip of the screw 430 is in contact with a cradle 408A that holds a rear portion of the damping element 402. As the screw 430 is turned, the lateral movement of the screw 430 causes the cradle 408A to move towards or away from the striking face 418. Accordingly, in some examples, the screw 430 extends substantially orthogonal to the rear surface 419 of the striking face 418. Because the cradle 408A holds the rear portion of the damping element 402, movement of the cradle 408A causes a change in the compression of the damping element 402 against the rear surface 419 of the striking face 418. As such, the compression of the damping element 402 may be adjusted by turning the screw 430 via screw drive 432, similar to manipulation of the threaded element 330 in golf club head 300 depicted in FIGS. 3A-3B.

Figure 4C:
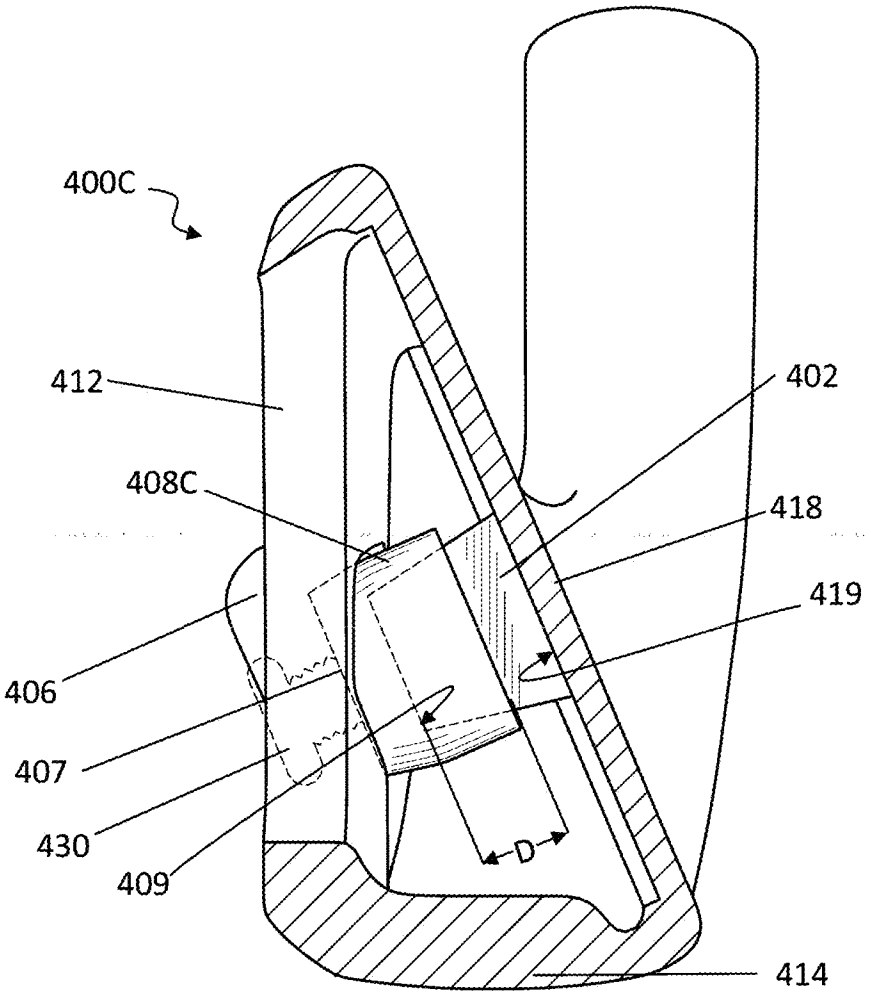
FIG. 4C depicts a section view of another example of a golf club having a damping element and an adjustment mechanism to adjust the compression of the damping element.

FIG. 4C depicts a section view of another example of a golf club 400C having a damping element 402 and an adjustment mechanism to adjust the compression of the damping element 402. The golf club head 400C is substantially similar to the golf club head 400A depicted in FIGS. 4A-4B, except golf club head 400C includes a larger cradle 408C having a depth D greater than a depth of a comparatively smaller cradle (e.g., the cradle 408A of FIGS. 4A-4B having a depth d). The larger cradle 408C encompasses more the damping element 402 than a smaller cradle. By encompassing a larger portion of the damping element 402, the cradle 408C further limits the deformation of the damping element 402 upon a strike of a golf ball by golf club head 400C. Limitation of the deformation of the damping element 402 also may limit the potential maximum deflection of the striking face 418, and therefore may reduce the maximum ball speed for the golf club head 400C while increasing the uniformity of speeds across the striking face 418. The larger cradle 408C does not come into contact with the rear surface 419 of the striking face 418 at maximum deflection thereof. The cradle 408C itself may be made of the same material as the back portion 412, such as a steel. The cradle 408C may also be made from a titanium, a composite, a ceramic, or a variety of other materials.

The size of the cradle 408C may be selected based on the desired ball speed properties. For instance, the cradle 408C may encompass approximately 25% or more of the volume of the damping element 402, as shown in FIG. 4C. In other examples, the cradle 408C may encompass between approximately 25%-50% of the volume of the damping element 402. In yet other examples, the cradle 408C may encompass approximately 10%-25% or less than approximately 10% of the volume of the damping element 402. In still other examples, the cradle 408C may encompass more than 50% of the volume of the damping element 402. For the portion of the damping element 402 encompassed by the cradle 408C, substantially the entire perimeter surface of that portion of the damping element 402 may contact the interior surfaces of the recess 409 of the cradle 408C.

The connection between the cradle 408C and the adjustment driver 430 can also be seen more clearly in FIG. 4C. The tip of the adjustment driver 430, which may be a flat surface, contacts the rear surface 407 of the cradle 408C. Thus, as the adjustment driver 430 moves into the cavity 420, the cradle 408C and the damping element 402 are pushed towards the striking face 418. Conversely, as the adjustment driver 430 is backed out of the cavity 420, the cradle 408C maintains contact with the adjustment driver 430 due to the force exerted from the damping element 402 resulting from the compression thereof. In some embodiments, the surface of the tip of the screw 430 and/or the rear surface 407 of the cradle 408C may be lubricated so as to prevent twisting of the cradle 408C. In other examples, the tip of the adjustment driver 430 may be attached to the cradle 408C such that the cradle 408C twists with the turning of the adjustment driver 430. In such an embodiment, the damping element 402 may be substantially cylindrical, conical, spherical, or frustoconical, and the interior 409 of the cradle 408C may be lubricated to prevent twisting of the damping element 402. In another example, the rear surface 419 of the striking face 418 and/or the front surface of the damping element 402 in contact with the rear surface 419 of the striking face 418 may be lubricated so as to allow for spinning of the damping element 402 against the rear surface 419 of the striking face 418.

While the golf club heads 400A and 400C are depicted with a continuous sole 414 rather than a sole channel like the golf club head 300 of FIGS. 3A-3B, other embodiments of golf club heads 400A and 400C may include a sole channel. In addition, golf club heads 400A and 400C may also be sold as kits with a plurality of screws and/or a torque wrench, similar to the kit discussed above for golf club head 300. An additional back plate may be added to the aft portion of the golf club heads 400A and 400C, while still leaving a portion of the screw exposed for adjustment.

Simulated results of different types of golf club heads further demonstrate ball speed uniformity across the face of the golf club heads including a damping element. Table 1 indicates ball speed retention across the face of a golf club head for several different example golf club heads. Example 1 is a baseline hollow iron having a 2.1 mm face thickness with a sole channel. Example 2 is a hollow iron with a 2.1 mm face with a rigid rod extending from the back portion to the striking face, also including a sole channel. Example 3 is a hollow iron with a striking face having a thick center (6.1 mm) and a thin perimeter (2.1 mm), also having a sole channel. Example 4 is a golf club head having a damping element similar to golf club head 100 depicted in FIGS.

1A-1C. The "Center" row indicates ball speeds resulting from a strike in the center of the golf club head, the "½" Heel" row indicates the loss of ball speed from a strike a half inch from the center of the club head towards the heel, and the "½" Toe" row indicates the loss of ball speed from a strike a half inch from the center of the club head towards the toe. All values in Table 1 are in miles per hour (mph).

TABLE 1

| Impact Location | Example 1 | Example 2 | Example 3 | Example 4 |
|---|---|---|---|---|
| Center | 134.1 | 132.8 | 133.8 | 133.6 |
| ½" Heel (drop from center) | −1.0 | −0.4 | −0.9 | −0.7 |
| ½" Toe (drop from center) | −6.9 | −6.5 | −6.8 | −6.7 |

From the results in Table 1, the golf club head with the damping element (Example 4) displays a relatively high ball speed from the center of the face, while also providing a reduced loss of ball speed from strikes near the toe or the heel of the golf club.

In addition, as mentioned above, the type of material utilized for any of the damping elements discussed herein has an effect on the displacement of the striking face. For instance, a damping element with a greater elastic modulus will resist compression and thus deflection of the striking face, leading to lower ball speeds. For example, for a golf club head similar to golf club head 400A, Table 2 indicates ball speeds achieved from using materials with different elasticity properties. All ball speeds were the result of strikes at the center of the face.

TABLE 2

| Material | Elastic Modulus (GPa) | Ball Speed (mph) |
|---|---|---|
| Material A | 0.41 | 132.2 |
| Material B | 0.58 | 132.2 |
| Material C | 4.14 | 132.0 |
| Material D | 41.4 | 131.0 |

From the results in Table 2, a selection of material for the damping element can be used to fine tune the performance of the golf club. Any of the materials listed in Table 2 are acceptable for use in forming a damping element to be used in the present technology.

The different types of materials also have effect on the ball speed retention across the striking face. For example, for a golf club head similar to golf club head 400A, Table 3 indicates ball speeds achieved across the striking face from heel to toe for the different materials used as the damping element. The materials referenced in Table 3 are the same materials from Table 2. All speeds in Table 3 are in mph.

TABLE 3

| Material | ½" Toe Impact | Center Impact | ½" Heel Impact |
|---|---|---|---|
| No Damping Element | 128.7 | 132.2 | 129.4 |
| Material A (0.41 GPa) | 128.7 | 132.2 | 129.4 |
| Material C (4.1 GPa) | 128.7 | 132.0 | 129.3 |
| Material D (41 GPa) | 127.9 | 131.0 | 128.7 |

From the results in Table 3, materials having a higher elastic modulus provide for better ball speed retention across the striking face, but lose maximum ball speed for impacts at the center of the face. For some applications, a range of elastic moduli for the damping element from about 4 to about 15 GPa may be used. In other applications, a range of elastic moduli for the damping element from about 1 to about 40 or about 50 GPa may be used. To achieve the goal of having the carry distance of off center shots closer to the carry distance of center shots, the damping element material may have an elastic modulus of about 40 GPa or greater, and more preferably about 70 GPa or greater. The damping material may be a metal such as aluminum, steel, or titanium to achieve the higher elastic modulus for more consistent carry distances across the striking face. Although the maximum ball speed for impacts at the center decreases when the damping element has a higher elastic modulus, the speed retention across the striking face is improved. This is desirable for golfers who want more consistent carry distance from strikes across the striking face rather than maximizing overall carry distance.

As mentioned above with reference to FIGS. 4A-4C, the size of the cradle may also have an impact on the ball speed. For a smaller cradle, such as cradle 408A in FIGS. 4A-4B, and a damping element made of a 13 GPa material, a loss of about 0.2 mph is observed for a center impact as compared to the same club with no damping element. For a larger cradle that is about 5 mm deeper, such as cradle 408C in FIG. 4C, and a damping element also made of a 13 GPa material, a loss of about 0.4 mph is observed for a center impact as compared to the same club with no damping element. For the same larger cradle and a damping element made of a 0.4 GPa material, a loss of only about 0.2 mph is observed for a center impact as compared to the same club with no damping element.

San Diego Plastics, Inc. of National City, CA offers several plastics having elastic moduli ranging from 2.6 GPa to 13 GPa that would all be acceptable for use. The plastics also have yield strengths that are also acceptable for use in the golf club heads discussed herein. Table 4 lists several materials offered by San Diego Plastics and their respective elastic modulus and yield strength values.

TABLE 4

| | ABS | Tecaform Acetal | PVC | Tecapeek | Tecapeek 30% Carbon Fiber |
|---|---|---|---|---|---|
| Thermoplastic Elastic Modulus (GPa) | 2.8 | 2.6 | 2.8 | 3.6 | 13 |
| Thermoplastic Compressive Yield Strength (GPa) | 0.077 | 0.031 | 0.088 | 0.118 | 0.240 |

Figure 5B:
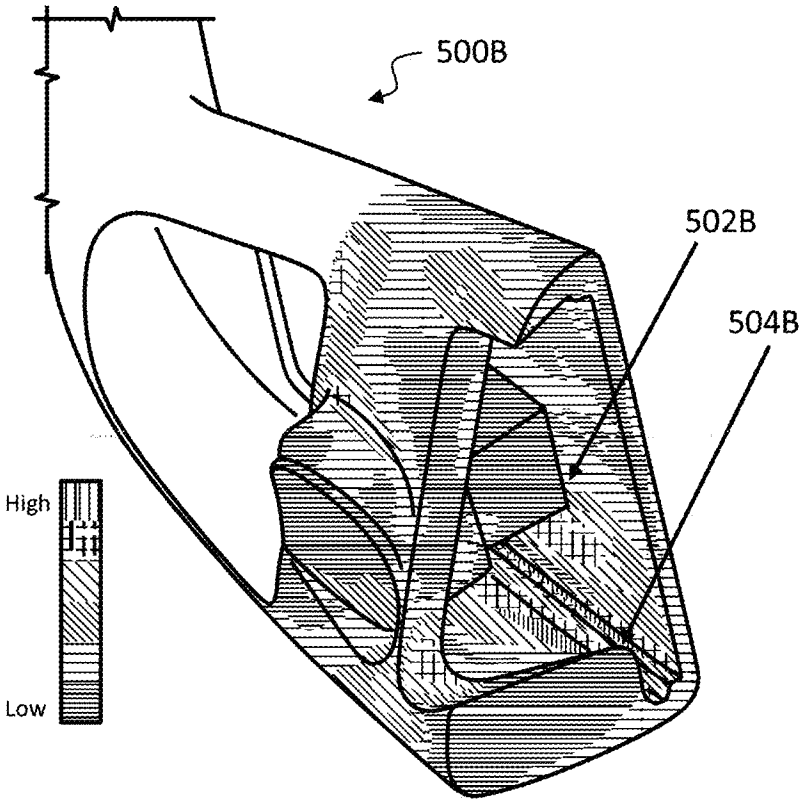
FIG. 5B depicts a stress contour diagram for a golf club head with a damping element.
Figure 5A:
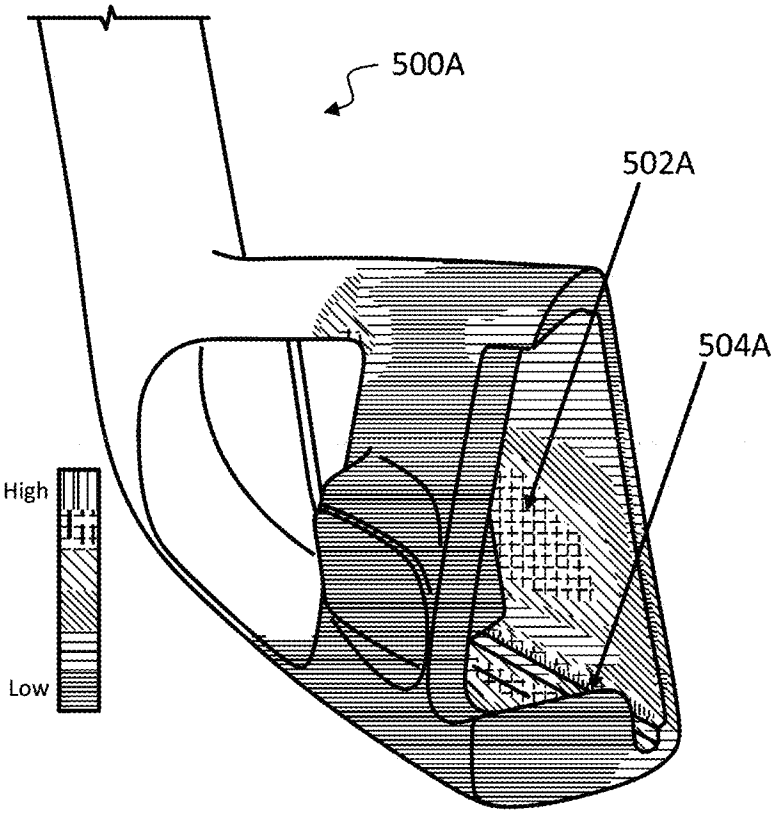
FIG. 5A depicts a stress contour diagram for a golf club head without a damping element.

The inclusion of a damping element also provide benefits in durability for the club face by reducing stress values displayed by the striking face upon impact with a golf ball. FIG. 5A depicts a stress contour diagram for a golf club head 500A without a damping element, and FIG. 5B depicts a stress contour diagram for a golf club head 500B with a damping element. In the golf club head 500A, the von Mises stress at the center of the face 502A is about 68% of the maximum von Mises stress, which occurs at the bottom face edge 504A. Without a damping element, the von Mises stress levels are high and indicate that the club face may be susceptible to failure and/or early deterioration. In the golf club head 500B, for a damping element having an elastic modulus of 0.41 GPa, the von Mises stress for the face near the edge of the damping element 502B is reduced by about 16% and the maximum von Mises stress occurring at the bottom face edge 504B is reduced by about 18%. These von Mises stresses are still relatively high, but are significantly reduced from those of the golf club head 500A. For a golf club head 500B with a damping element having an elastic modulus of about 13 GPa, the von Mises stress for the face near the edge of the damping element 502B is reduced by about 50% and the maximum von Mises stress occurring at the bottom face edge 504B is reduced by about 56%. Such von Mises stress values are lower and are indicative of a more durable golf club head that may be less likely to fail.

Figure 6A:
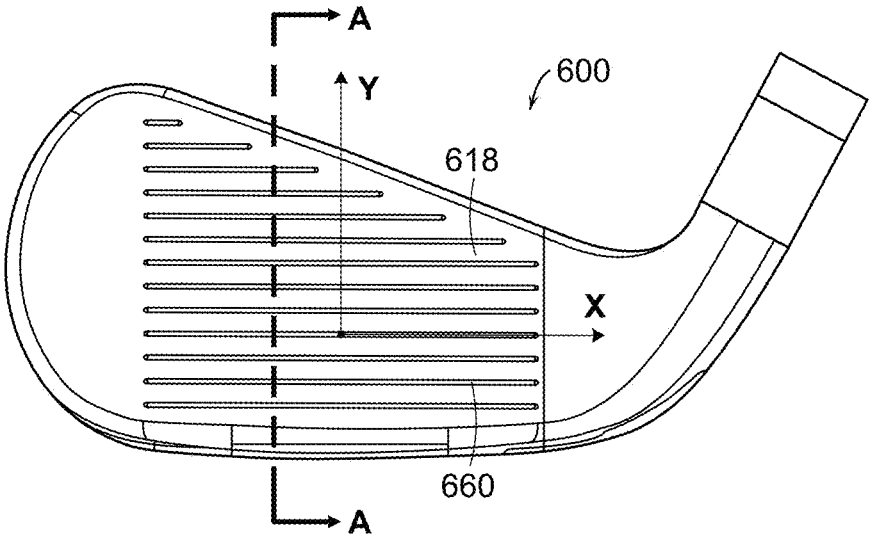
FIG. 6A depicts a front view of the golf club head.
Figure 6B:
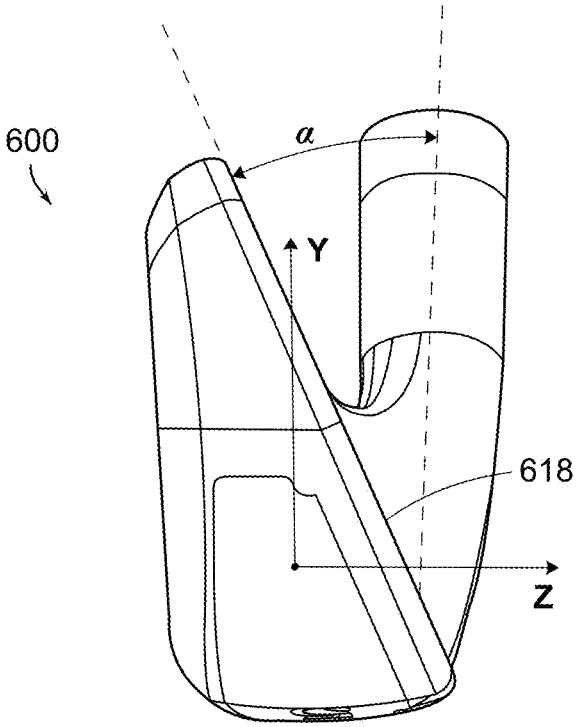
FIG. 6B depicts a toe view of the golf club head of FIG. 6A.
Figure 6C:
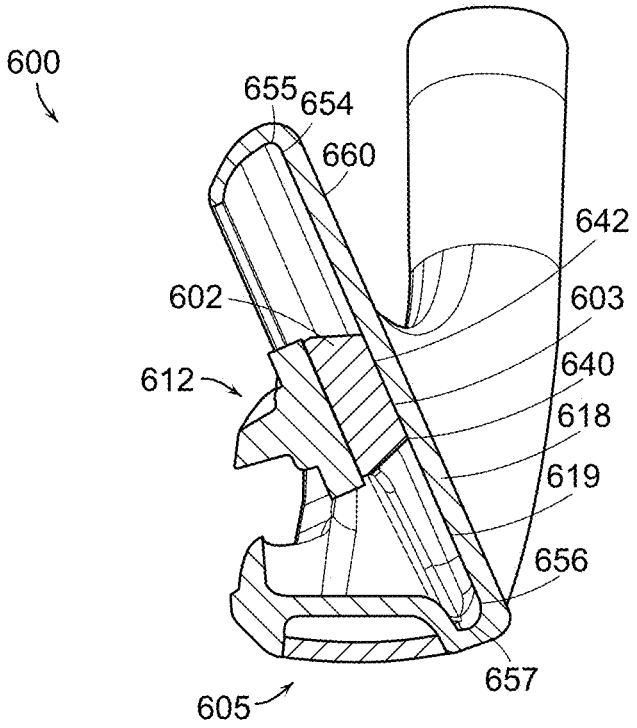
FIG. 6C depicts a section view A-A of the golf club head of FIG. 6A.
Figure 6D:
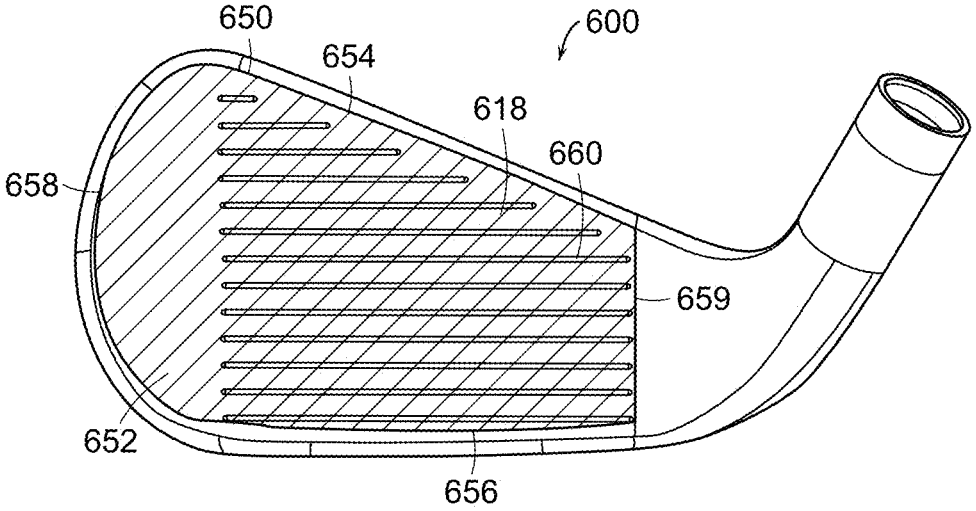
FIG. 6D depicts a perspective view of the golf club head of FIG. 6A oriented perpendicular to the striking face.
Figure 6E:
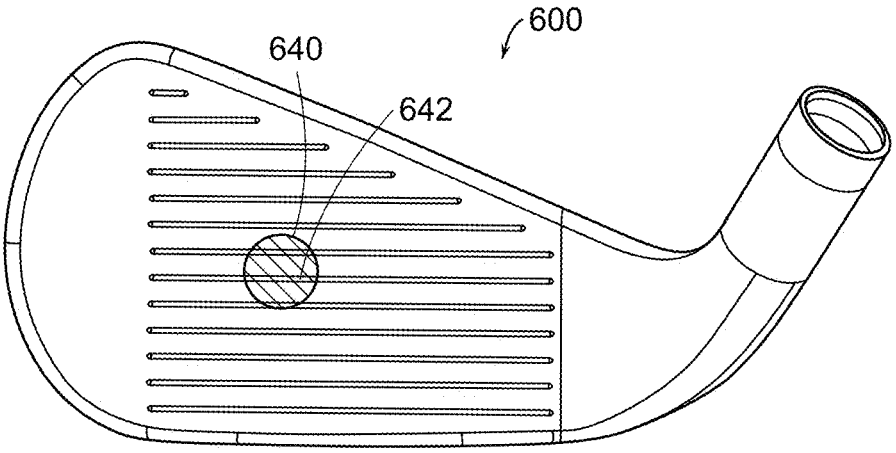
FIG. 6E depicts a perspective view of the golf club head of FIG. 6A oriented perpendicular to the striking face including the supported region.

FIGS. 6A-6E depict a golf club head 600 having a damping element 602. FIG. 6A depicts a front view of the golf club head 600. FIG. 6B depicts a toe view of the golf club head 600 of FIG. 6A. FIG. 6C depicts a section view A-A of the golf club head 600 of FIG. 6A. FIG. 6D depicts a perspective view of the golf club head 600 of FIG. 6A oriented perpendicular to the striking face 618. FIG. 6E depicts a perspective view of the golf club head 600 of FIG. 6A oriented perpendicular to the striking face 618 including the supported region 642. The golf club head 600 includes a striking face 618 configured to strike a ball, a sole 605 located at the bottom of the golf club head 600, and a back portion 612.

As illustrated in FIGS. 6A and 6B, the golf club head 600 includes a coordinate system centered at the center of gravity (CG) of the golf club head 600. The coordinate system includes a y-axis which extends vertically, perpendicular to a ground plane when the golf club head 600 is in an address position at prescribed lie and loft α. The coordinate system includes an x-axis, perpendicular to the y-axis, parallel to the striking face 618, and extending towards the heel of the golf club head 600. The coordinate system includes a z-axis, perpendicular to the y-axis and x-axis and extending through the striking face 618. The golf club head 600 has a rotational moment of inertia about the y-axis (MOI-Y), a value which represents the golf club head's resistance to angular acceleration about the y-axis.

A damping element 602 is disposed between the striking face 618 and the back portion 612. The striking face 618 includes a rear surface 619. The front portion 603 of the damping element 602 contacts the rear surface 619 of the striking face 618. As illustrated in FIGS. 6C and 6E, the striking face 618 includes a supported region 642, the portion of the rear surface 619 supported by the damping element 602, which is defined as the area inside the supported region perimeter 640 defined by the outer extent of the front portion 603 of the damping element 602 in contact with the rear surface 619 of the striking face 618. The supported region 642 is illustrated with hatching in FIG. 6E. The supported region 642 wouldn't normally be visible from the front of the golf club head 600 but was added for illustrative purposes.

The striking face 618 includes a striking face area 652, which is defined as the area inside the striking face perimeter 650 as illustrated in FIG. 6D. As illustrated in FIG. 6C, the striking face perimeter is delineated by an upper limit 654 and a lower limit 656. The upper limit 654 is located at the intersection of the substantially flat rear surface 619 and the upper radius 655 which extends to the top line of the golf club head 600. The lower limit 656 is located at the intersection of the substantially flat rear surface 619 and the lower radius 657 which extends to the sole 605 of the golf club head 600. The striking face perimeter is similarly delineated 658 (as illustrated in FIG. 6D) at the toe of the golf club head 600 (not illustrated in cross section). The heel portion of the striking face perimeter is defined by a plane 659 extending parallel to the y-axis and the x-axis offset 1 millimeter (mm) towards the heel from the heel-most extent of the scorelines 660 formed in the striking face 618. The striking face area 652 is illustrated with hatching in FIG. 6D. The limits 654, 656 of the striking face perimeter have been projected onto the striking face 618 in FIG. 6D for ease of illustration and understanding.

A plurality of golf club heads much like golf club head 600 described herein can be included in a set, each golf club head having a different loft α. Each golf club head can also have additional varying characteristics which may include, for example, MOI-Y, Striking Face Area, Area of Supported Region, and the Unsupported Face Percentage. The Unsupported Face Percentage is calculated by dividing the Area of Supported Region by the Striking Face Area and multiplying by 100% and subtracting it from 100%. An example of one set of iron type golf club heads is included in Table 5 below. The set in Table 5 includes the following lofts: 21, 24, 27, and 30. Other sets may include a greater number of golf club heads and/or a wider range of loft α values, or a smaller number of golf club heads and/or a smaller range of loft α values. Additionally, a set may include one or more golf club heads which include a damping element and one or more golf club heads which do not include a damping element.

TABLE 5

| Loft of Iron (Degrees) | MOI-Y (kg*mm$^2$) | Striking Face Area (mm$^2$) | Area of Supported Region (mm$^2$) | Unsupported Face Percentage (%) |
|---|---|---|---|---|
| 21 | 270 | 2809 | 74 | 97.37 |
| 24 | 272 | 2790 | 74 | 97.35 |
| 27 | 276 | 2777 | 74 | 97.34 |
| 30 | 278 | 2742 | 74 | 97.30 |

An example of an additional embodiment of set of iron type golf club heads is included in Table 6 below.

TABLE 6

| Loft of Iron (Degrees) | MOI-Y (kg* mm$^2$) | Striking Face Area (mm$^2$) | Area of Supported Region (mm$^2$) | Unsupported Face Percentage (%) |
|---|---|---|---|---|
| 21 | 272 | 2897 | 74 | 97.45 |
| 24 | 278 | 2890 | 74 | 97.44 |
| 27 | 289 | 2878 | 74 | 97.43 |
| 30 | 294 | 2803 | 74 | 97.36 |

If all other characteristics are held constant, a larger the MOI-Y value increases the ball speed of off-center hits. For clubs with a smaller MOI-Y, the decrease in off-center ball speed can be mitigated with a greater unsupported face percentage. By supporting a smaller percentage of the face, more of the face is able to flex during impact, increasing off-center ball speed. Thus, for the inventive golf club set described in Table 5 above, the MOI-Y increases through the set as loft α increases and the unsupported face percentage decreases through the set as loft α increases. This relationship creates consistent off-center ball speeds through a set of golf clubs.

A set of golf clubs can include a first golf club head with a loft greater than or equal to 20 degrees and less than or equal to 24 degrees and a second golf club head with a loft greater than or equal to 28 degrees and less than or equal to 32 degrees. In one embodiment, the set can be configured so that the first golf club head has a larger unsupported face percentage than the second golf club head and the first golf club head has a lower MOI-Y than the second golf club head.

More particular characteristics of embodiments described herein are described below. In some embodiments, the area of the supported region can be greater than 30 millimeters$^2$. In some embodiments, the area of the supported region can be greater than 40 millimeters$^2$. In some embodiments, the area of the supported region can be greater than 60 millimeters$^2$. In some embodiments, the area of the supported region can be greater than 65 millimeters$^2$. In some embodiments, the area of the supported region can be greater than 70 millimeters$^2$. In some embodiments, the area of the supported region can be greater than 73 millimeters$^2$.

In some embodiments, the area of the supported region can be less than 140 millimeters$^2$. In some embodiments, the area of the supported region can be less than 130 millimeters$^2$. In some embodiments, the area of the supported region can be less than 120 millimeters$^2$. In some embodiments, the area of the supported region can be less than 110 millimeters$^2$. In some embodiments, the area of the supported region can be less than 100 millimeters$^2$. In some embodiments, the area of the supported region can be less than 90 millimeters$^2$. In some embodiments, the area of the supported region can be less than 85 millimeters$^2$. In some embodiments, the area of the supported region can be less than 80 millimeters$^2$. In some embodiments, the area of the supported region can be less than 75 millimeters$^2$.

In some embodiments, the unsupported face percentage is greater than 70%. In some embodiments, the unsupported face percentage is greater than 75%. In some embodiments, the unsupported face percentage is greater than 80%. In some embodiments, the unsupported face percentage is greater than 85%. In some embodiments, the unsupported face percentage is greater than 90%. In some embodiments, the unsupported face percentage is greater than 95%. In some embodiments, the unsupported face percentage is greater than 96%. In some embodiments, the unsupported face percentage is greater than 97%.

In some embodiments, the unsupported face percentage is less than 99.75%. In some embodiments, the unsupported face percentage is less than 99.50%. In some embodiments, the unsupported face percentage is less than 99.25%. In some embodiments, the unsupported face percentage is less than 99.00%. In some embodiments, the unsupported face percentage is less than 98.75%. In some embodiments, the unsupported face percentage is less than 98.50%. In some embodiments, the unsupported face percentage is less than 98.25%. In some embodiments, the unsupported face percentage is less than 98.00%. In some embodiments, the unsupported face percentage is less than 97.75%. In some embodiments, the unsupported face percentage is less than 97.50%. In some embodiments, the unsupported face percentage is less than 97.25%. In some embodiments, the unsupported face percentage is less than 97.00%.

Figure 7A:
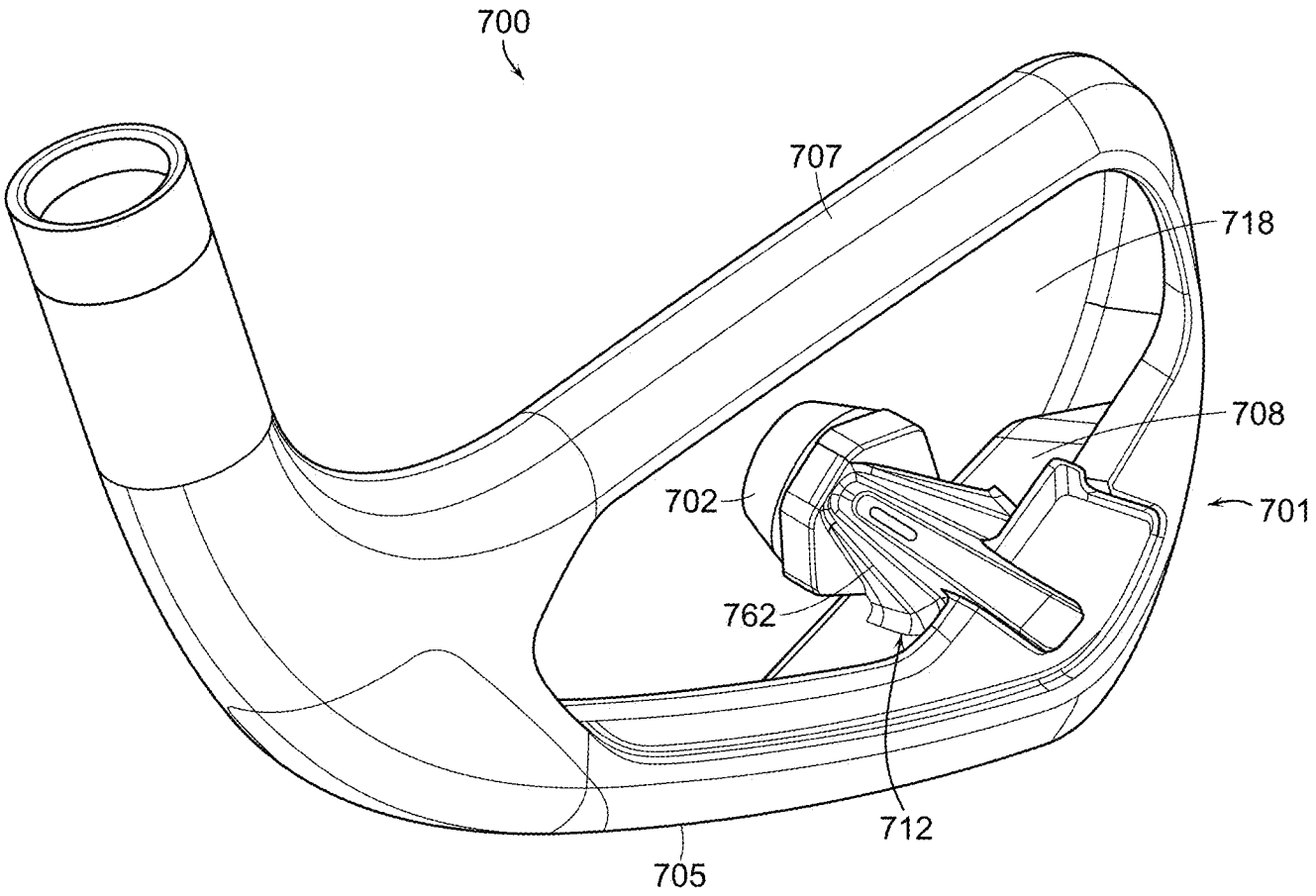
FIG. 7A depicts a perspective view of the golf club head.
Figure 7B:
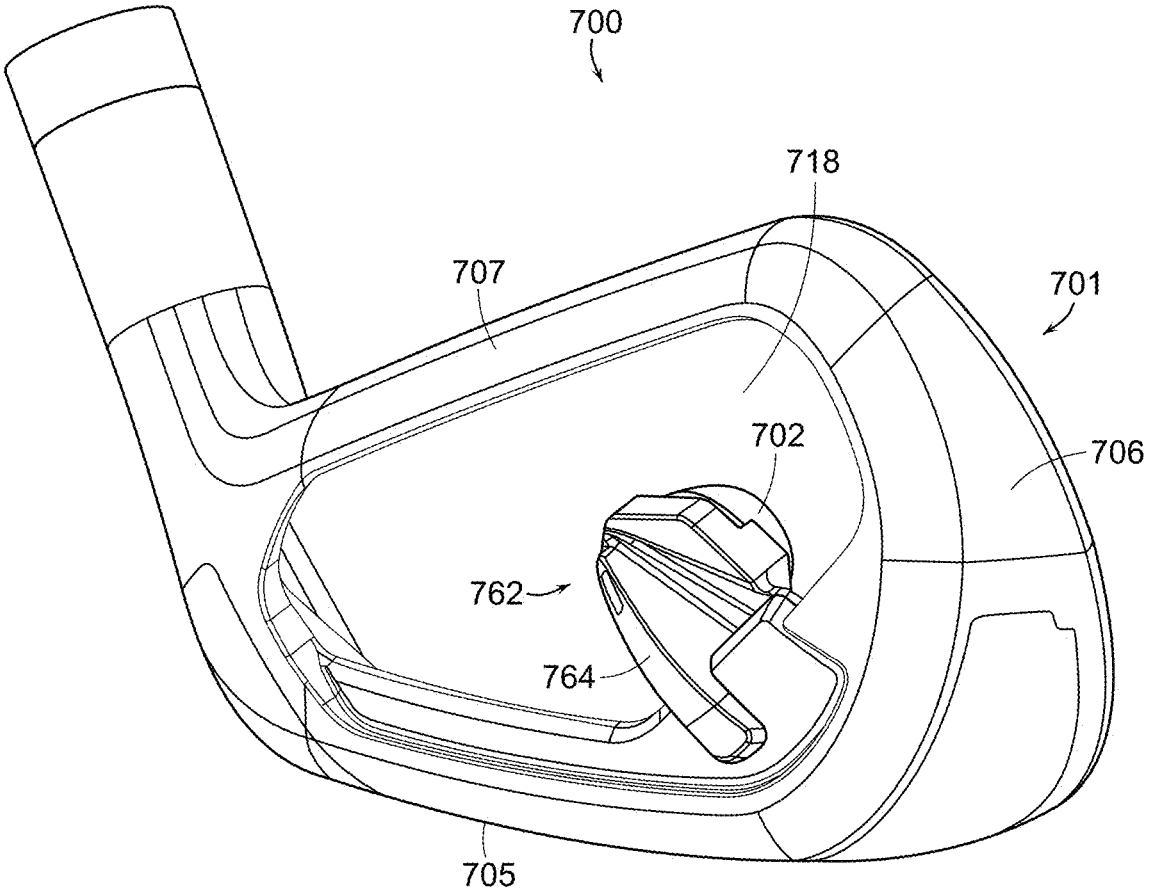
FIG. 7B depicts an additional perspective view of the golf club head of FIG. 7A.
Figure 7C:
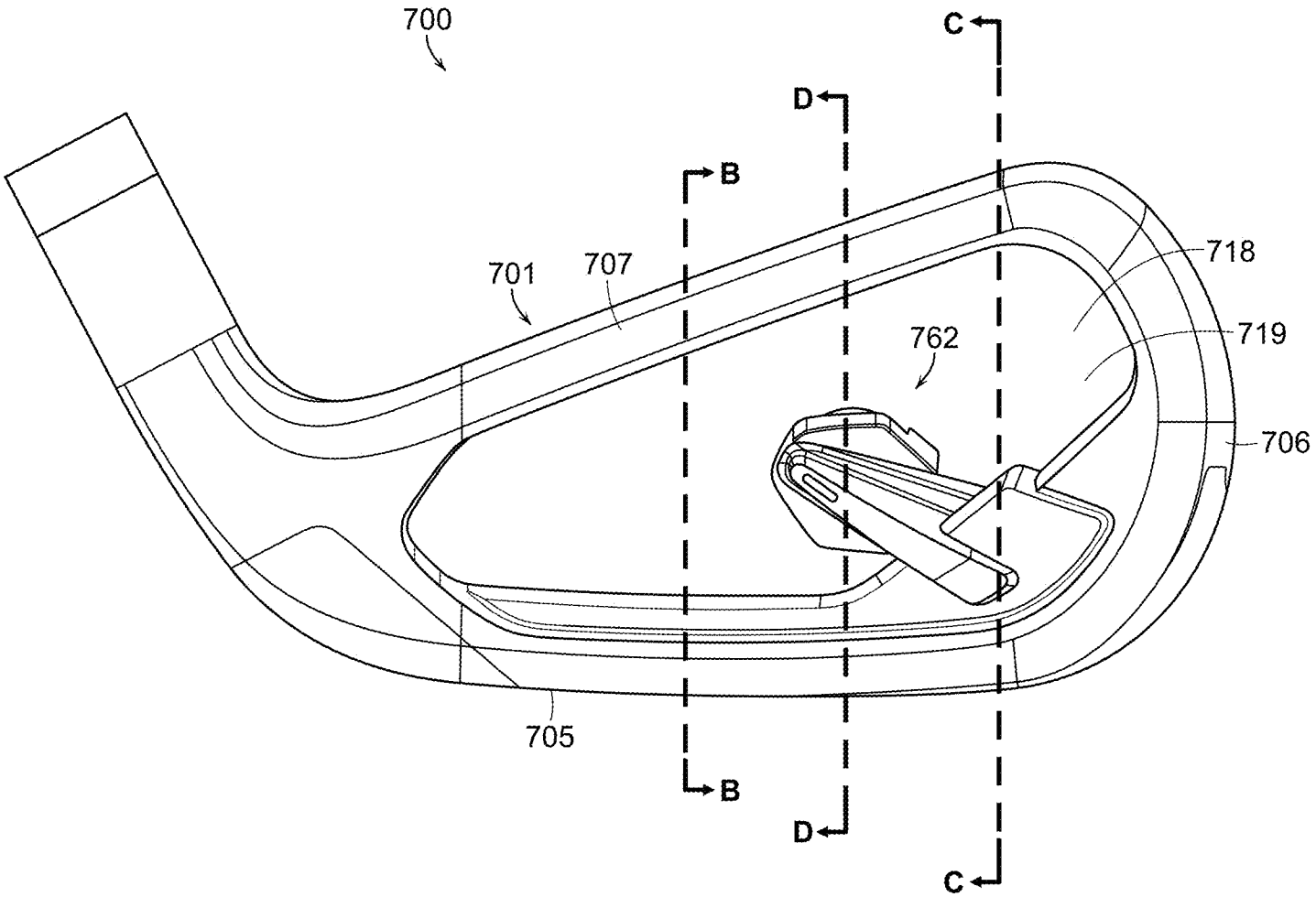
FIG. 7C depicts a rear view of the golf club head of FIG. 7A.
Figure 10:
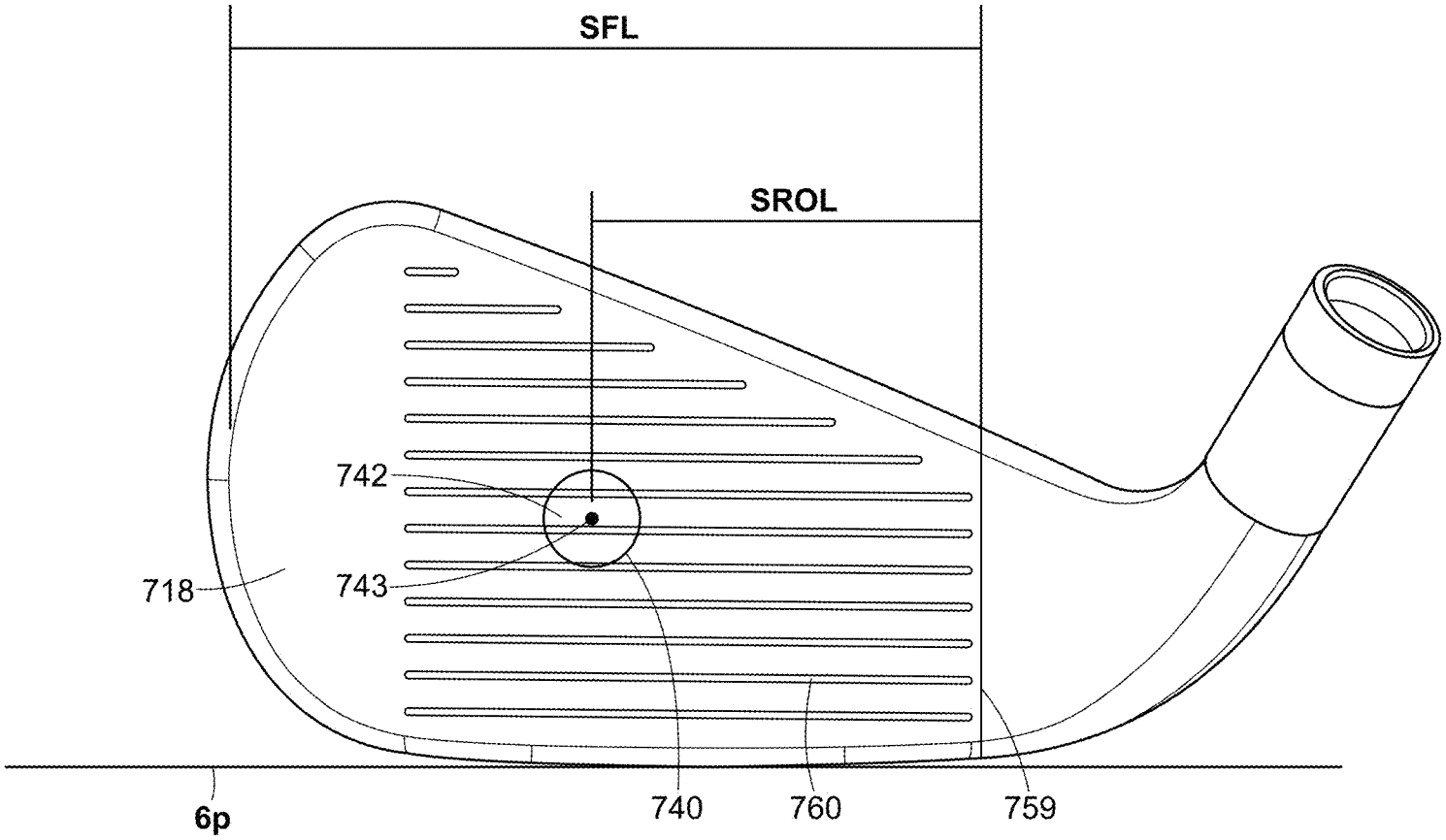
FIG. 10 depicts a perspective view of the golf club head of FIG. 7A oriented perpendicular to the striking face including the supported region.

FIGS. 7A-10 depict a golf club head 700 having a damping element 702. FIG. 7A depicts a perspective view of the golf club head 700. FIG. 7B depicts an additional perspective view of the golf club head 700 of FIG. 7A. FIG. 7C depicts a rear view of the golf club head 700 of FIG. 7A. FIG. 8A depicts a section view B-B of the golf club head 700 of FIG. 7C. FIG. 8B depicts a section view C-C of the golf club head 700 of FIG. 7C. FIG. 8C depicts a section view D-D of the golf club head 700 of FIG. 7C. FIG. 9A depicts an additional section view of the front of the golf club head 700 of FIG. 7A missing the striking face. FIG. 9B depicts the section view from FIG. 9A with the damping element removed. FIG. 10. Depicts a perspective view of the golf club head 700 of FIG. 7A oriented perpendicular to the striking face 718 including the supported region 742. Please note that the golf club head 700 illustrated in FIGS. 7A-10 is an iron-type cavity back golf club but the inventions described herein are applicable to other types of golf club heads as well.

The golf club head 700 includes a damping element 702 disposed between the striking face 718 and the back portion 712. In one embodiment, the damping element 702 is formed from an elastomer. In another embodiment, the damping element 702 may be formed from a metal such as aluminum, steel, or titanium having an elastic modulus of about 70 GPa or greater. The front portion 703 of the damping element 702 contacts the rear surface 719 of the striking face 718. The striking face 718 includes a supported region 742, the portion of the rear surface 719 supported by the damping element 702, which is defined as the area inside the supported region perimeter 740 defined by the outer extent of the front portion 703 of the damping element 702 in contact with the rear surface 719 of the striking face 718. The supported region 742 wouldn't normally be visible from the front of the golf club head 700 but was added in FIG. 10 for illustrative purposes.

The golf club head 700 illustrated in FIGS. 7A-10 is a cavity back construction and includes a periphery portion 701 surrounding and extending rearward from the striking face 718. The periphery portion 701 includes the sole 705, the toe 706, and the topline 707. The periphery portion 701 can also include a weight pad 710. The golf club head 700 also includes a back portion 712 configured to support the damping element 702.

The back portion 712 includes a cantilever support arm 762 affixed to the periphery portion 701. The support arm 762 can include a cradle 708 configured to hold the damping element 702 in place. The cradle 708 can include a lip 709 configured to locate the damping element 702 on the cradle 708 and relative to the striking face 718. The lip 709 can surround a portion of the damping element 702. Additionally, an adhesive can be used between the damping element 702 and the cradle 708 to secure the damping element 702 to the cradle 708.

The support arm 762 extends from the weight pad 710 located at the intersection of the sole 705 and the toe 706 of the periphery portion 701 towards the supported region 742. The support arm 762 is oriented substantially parallel to the rear surface 719 of the striking face 718. The support arm 762 can include a rib 764 to increase the stiffness of the support arm 762. The rib 764 can extend rearwards from the support arm 762 substantially perpendicularly to the rear surface 719 of the striking face 718. One benefit of a cantilever support arm 762 is it provides a lower CG height than an alternative beam design, such as the embodiment illustrated in FIG. 4A, which supported at both ends by the periphery portion.

In order to provide a low CG height the support arm 762 is cantilevered which means it is only affixed to the periphery portion 701 at one end of the support arm 762. The support arm is designed such that the distance H between the highest portion of the support arm 762 and the ground plane GP when the golf club head 700 is in an address position, as illustrated in FIG. 8C, is minimized, while locating the damping element 702 in the optimal position. In one embodiment, H is less than or equal to 50 mm. In an additional embodiment, H is less than 45 mm. In an additional embodiment, H is less than or equal to 40 mm. In an additional embodiment, H is less than or equal to 35 mm. In an additional embodiment, H is less than or equal to 30 mm. In an additional embodiment, H is less than or equal to 29 mm. In an additional embodiment, H is less than or equal to 28 mm.

In one embodiment, the golf club head 700 can have a CG height CGH of less than or equal to 25 mm. In an additional embodiment, the golf club head 700 can have a CG height CGH of less than or equal to 24 mm. In an additional embodiment, the golf club head 700 can have a CG height CGH of less than or equal to 23 mm. In an additional embodiment, the golf club head 700 can have a CG height CGH of less than or equal to 22 mm. In an additional embodiment, the golf club head 700 can have a CG height CGH of less than or equal to 21 mm. In an additional embodiment, the golf club head 700 can have a CG height CGH of less than or equal to 20 mm. In an additional embodiment, the golf club head 700 can have a CG height CGH of less than or equal to 19 mm. In an additional embodiment, the golf club head 700 can have a CG height CGH of less than or equal to 18 mm.

Another advantage to the illustrated support arm 762 is it provides a high MOI-Y due to its orientation. By concentrating mass at the heel end and toe end of the golf club head 700 the MOI-Y can be increased. The support arm 762 is angled to concentrate much of its mass near the toe 706, increasing MOI-Y compared with a back portion located more centrally on the golf club head 700. In one embodiment, the MOI-Y of the golf club head 700 is greater than or equal to 200 kg-mm$^2$. In an additional embodiment, the MOI-Y of the golf club head 700 is greater than or equal to 210 kg-mm$^2$. In an additional embodiment, the MOI-Y of the golf club head 700 is greater than or equal to 220 kg-mm$^2$. In an additional embodiment, the MOI-Y of the golf club head 700 is greater than or equal to 230 kg-mm$^2$. In an additional embodiment, the MOI-Y of the golf club head 700 is greater than or equal to 240 kg-mm$^2$. In an additional embodiment, the MOI-Y of the golf club head 700 is greater than or equal to 250 kg-mm$^2$. In an additional embodiment, the MOI-Y of the golf club head 700 is greater than or equal to 260 kg-mm$^2$. In an additional embodiment, the MOI-Y of the golf club head 700 is greater than or equal to 270 kg-mm$^2$.

Figure 8A:
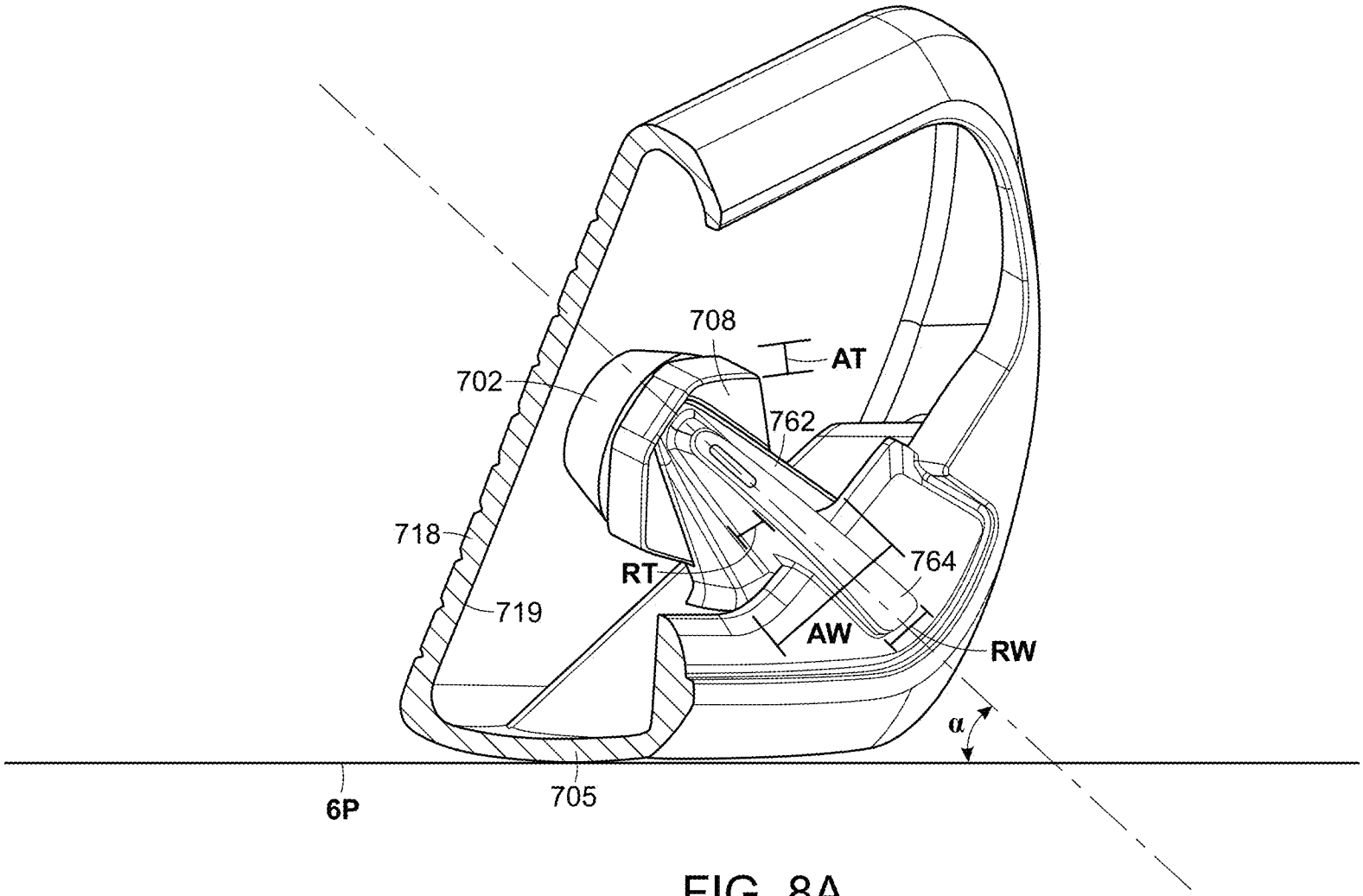
FIG. 8A depicts a section view B-B of the golf club head of FIG. 7C.
Figure 8C:
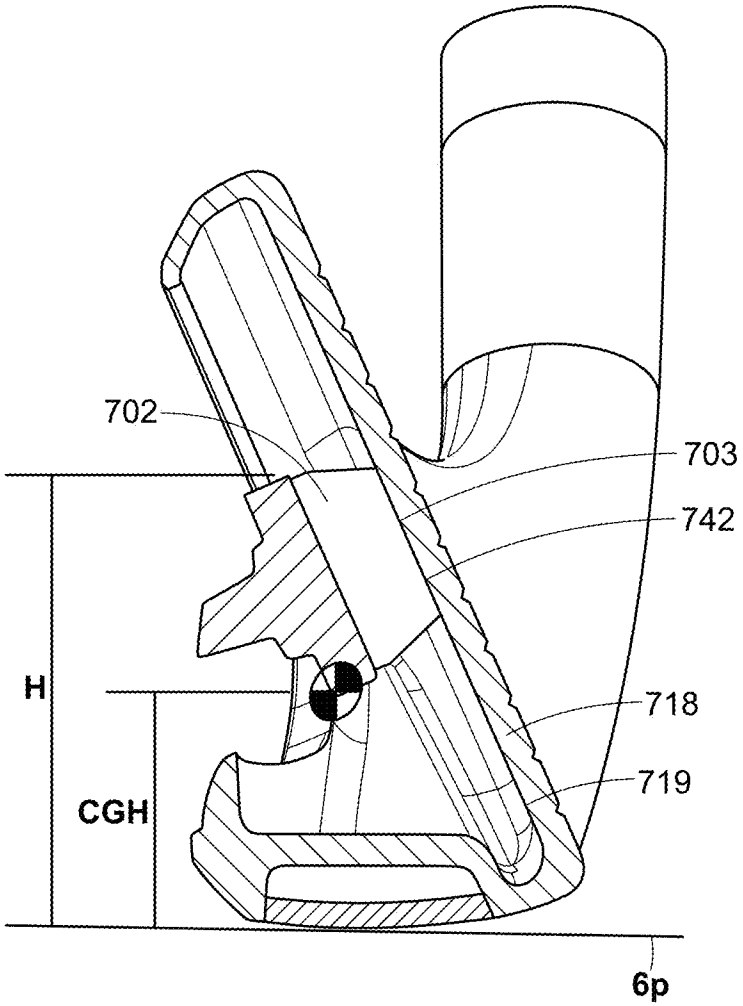
FIG. 8C depicts a section view D-D of the golf club head of FIG. 7C.
Figure 8B:
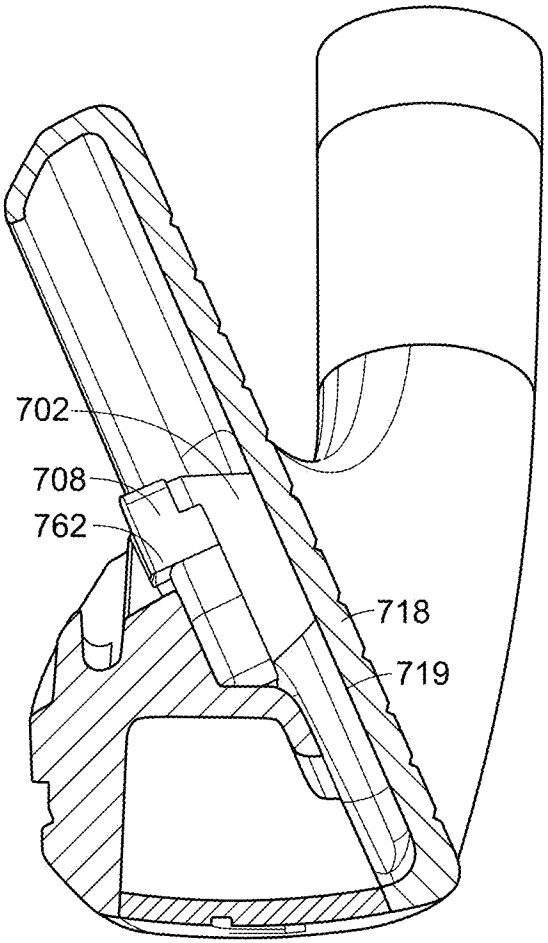
FIG. 8B depicts a section view C-C of the golf club head of FIG. 7C.
Figure 9A:
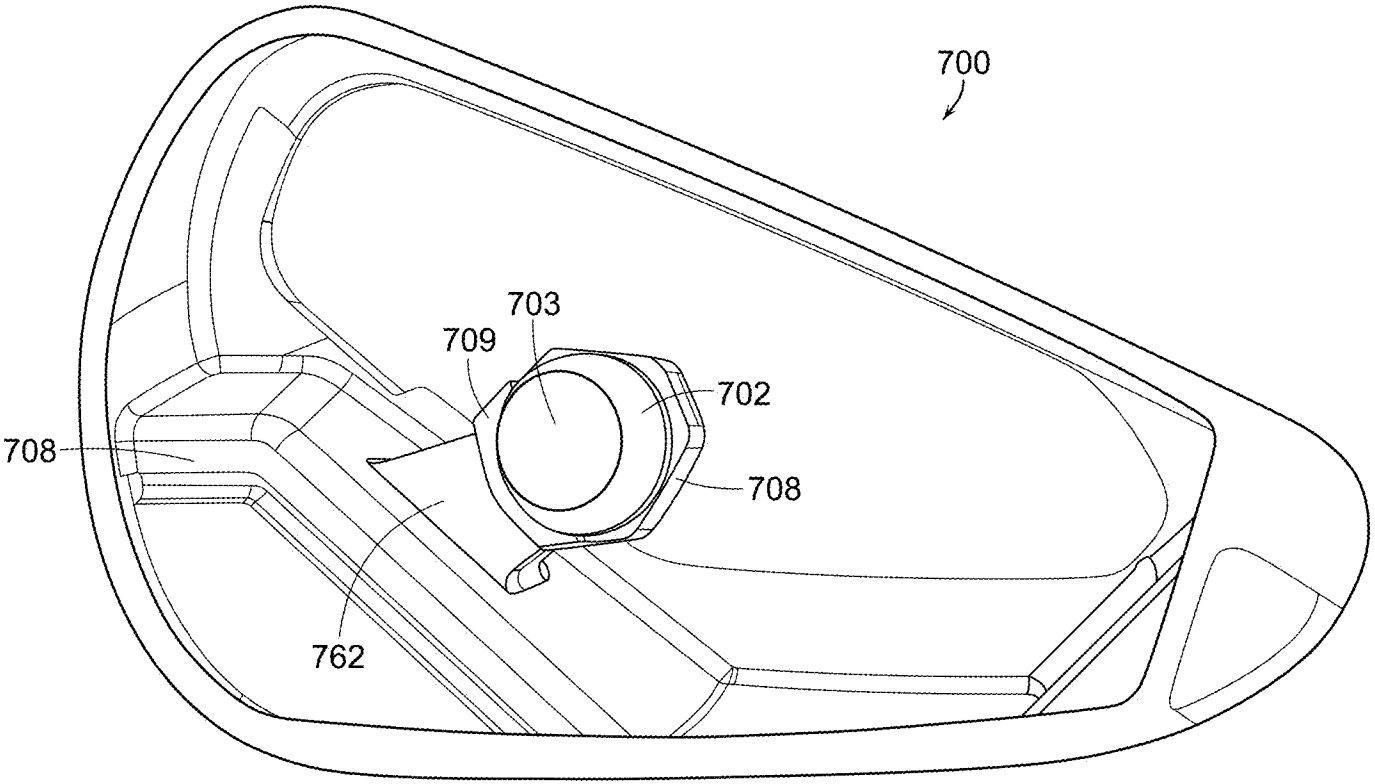
FIG. 9A depicts an additional section view of the front of the golf club head of FIG. 7A missing the striking face.
Figure 9B:
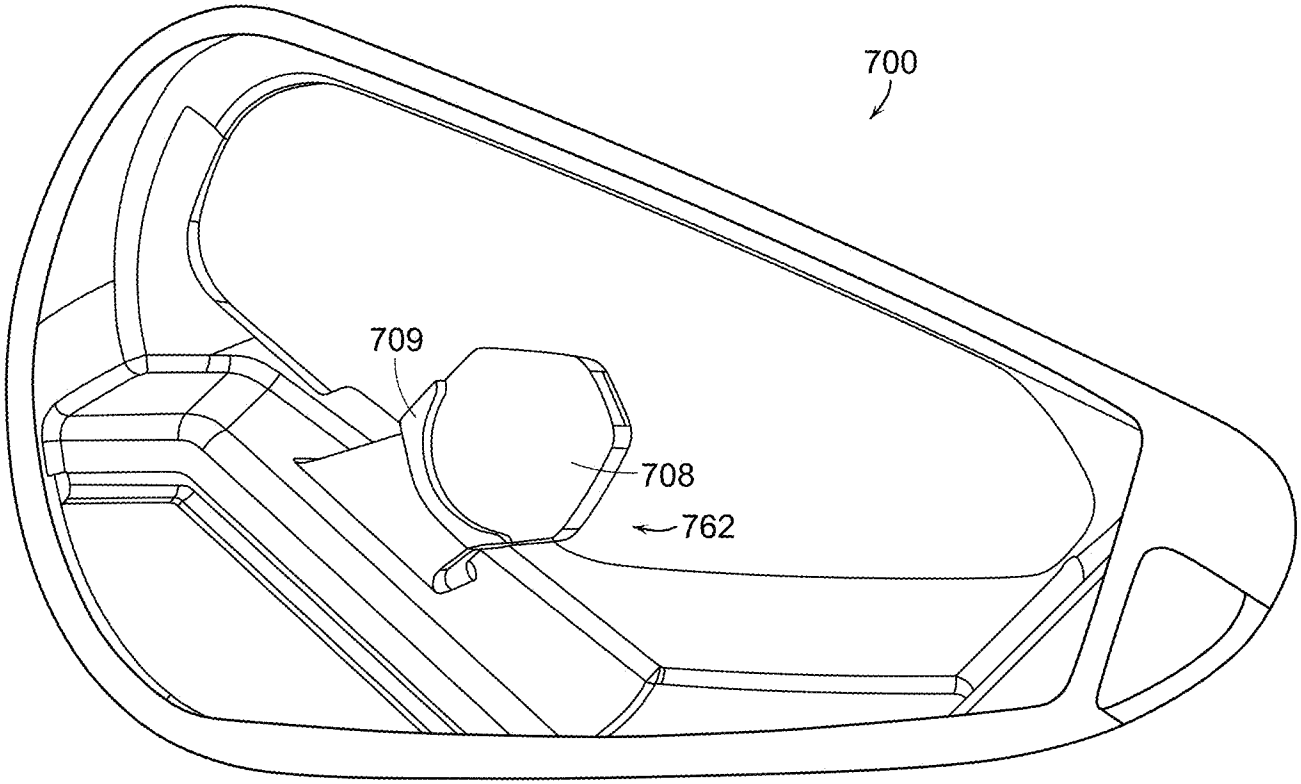
FIG. 9B depicts the section view from FIG. 9A with the damping element removed.

The support arm 762 can include an arm centerline CL, as illustrated in FIG. 8A, which is oriented parallel to the rear surface 719 of the striking face 718 and extends along the center of the support arm 762 from the periphery portion 701 towards the supported region 742. The angle $\alpha$ is measured between the ground plane GP and the centerline CL. In one embodiment, the angle $\alpha$ is greater than or equal to 5 degrees and less than or equal to 45 degrees. In an additional embodiment, the angle $\alpha$ is greater than or equal to 10 degrees and less than or equal to 40 degrees. In an additional embodiment, the angle $\alpha$, is greater than or equal to 15 degrees and less than or equal to 35 degrees. In an additional embodiment, the angle $\alpha$ is greater than or equal to 20 degrees and less than or equal to 30 degrees. In an additional embodiment, the angle $\alpha$ is greater than or equal to 23 degrees and less than or equal to 28 degrees.

The support arm 762 can have an arm width AW measured perpendicularly to the arm centerline CL and parallel to the rear surface 719 of the striking face 718. The arm width AW can vary along the length of the support arm 762. In one embodiment the arm width of at least one portion of the support arm is greater than or equal to 6 mm. In an additional embodiment the arm width of at least one portion of the support arm is greater than or equal to 8 mm. In an additional embodiment the arm width of at least one portion of the support arm is greater than or equal to 10 mm.

The support arm 762 can have an arm thickness AT measured perpendicular to the rear surface 719 of the striking face 718. The arm thickness AT can vary along the length of the support arm 762. In one embodiment the arm thickness AT of at least one portion of the support arm is greater than or equal to 2 mm. In an additional embodiment the arm thickness AT of at least one portion of the support arm is greater than or equal to 3 mm. In an additional embodiment the arm thickness AT of at least one portion of the support arm is greater than or equal to 4 mm. In an additional embodiment the arm thickness AT of at least one portion of the support arm is greater than or equal to 5 mm. In an additional embodiment the arm thickness AT of at least one portion of the support arm is greater than or equal to 6 mm.

The rib 764 of the support arm 762 can have a rib width RW measured perpendicularly to the arm centerline CL and parallel to the rear surface 719 of the striking face 718. The rib width RW can vary along the length of the rib. In one embodiment, the rib width RW of at least a portion of the rib is greater than or equal to 1 mm. In an additional embodiment, the rib width RW of at least a portion of the rib is greater than or equal to 2 mm. In an additional embodiment, the rib width RW of at least a portion of the rib is greater than or equal to 3 mm. In an additional embodiment, the rib width RW of at least a portion of the rib is greater than or equal to 4 mm.

The rib 764 of the support arm 762 can have a rib thickness RT measured perpendicular to the rear surface 719 of the striking face 718. The rib thickness RT can vary along the length of the rib. In one embodiment, the rib thickness RT of at least a portion of the rib is greater than or equal to 2 mm. In an additional embodiment, the rib thickness RT of at least a portion of the rib is greater than or equal to 3 mm. In an additional embodiment, the rib thickness RT of at least a portion of the rib is greater than or equal to 4 mm. In an additional embodiment, the rib thickness RT of at least a portion of the rib is greater than or equal to 5 mm. In an additional embodiment, the rib thickness RT of at least a portion of the rib is greater than or equal to 6 mm.

The supported region 742, as illustrated in FIG. 10, is specifically located on the rear surface 719 of the striking face 718. The striking face heel reference plane 759 extends parallel to the y-axis and the z-axis and is offset 1 mm towards the heel from the heel-most extent of the scorelines 760 formed in the striking face 718. The geometric center 743 of the supported region 742 is located a supported region offset length SROL toeward from the striking face heel reference plane 759 measured parallel to the ground plane GP and parallel to the striking face 718 with the golf club head 700 in an address position. In one embodiment, the supported region offset length SROL is greater than or equal to 20 mm. In an additional embodiment, the supported region offset length SROL is greater than or equal to 22 mm. In an additional embodiment, the supported region offset length SROL is greater than or equal to 24 mm. In an additional embodiment, the supported region offset length SROL is greater than or equal to 26 mm. In an additional embodiment, the supported region offset length SROL is greater than or equal to 27 mm. In an additional embodiment, the supported region offset length SROL is greater than or equal to 28 mm.

The striking face length SFL is measured from the striking face heel reference plane 759 to the toe-most extent of the striking face 718, measured parallel to the ground plane GP and parallel to the striking face 718 with the golf club head 700 in an address position. In one embodiment, the striking face length SFL is greater than or equal to 60 mm. In an additional embodiment, the striking face length SFL is greater than or equal to 65 mm. In an additional embodiment, the striking face length SFL is greater than or equal to 70 mm. In an additional embodiment, the striking face length SFL is greater than or equal to 71 mm. In an additional embodiment, the striking face length SFL is greater than or equal to 72 mm. In an additional embodiment, the striking face length SFL is greater than or equal to 73 mm. In an additional embodiment, the striking face length SFL is greater than or equal to 74 mm.

In one embodiment, the supported region offset ratio, defined as the supported region offset length SROL divided by the striking face length SFL multiplied by 100%, is greater than or equal to 40%. In an additional embodiment, the supported region offset ratio is greater than or equal to 41%. In an additional embodiment, the supported region offset ratio is greater than or equal to 42%. In an additional embodiment, the supported region offset ratio is greater than or equal to 43%. In an additional embodiment, the supported region offset ratio is greater than or equal to 44%. In an additional embodiment, the supported region offset ratio is greater than or equal to 45%. In an additional embodiment, the supported region offset ratio is greater than or equal to 46%. In an additional embodiment, the supported region offset ratio is greater than or equal to 47%. In an additional embodiment, the supported region offset ratio is greater than or equal to 48%. In an additional embodiment, the supported region offset ratio is greater than or equal to 49%. In an additional embodiment, the supported region offset ratio is greater than or equal to 50%. In an additional embodiment, the supported region offset ratio is greater than or equal to 51%.

An additional benefit of incorporating a supported region 742 is the ability to utilize a thin striking face. In the illustrated embodiments, the striking face 718 has a constant thickness. In other embodiments, the striking face may have a variable thickness. In one embodiment, the thickness of the striking face is less than or equal to 2.5 mm. In an additional embodiment, the thickness of the striking face is less than or equal to 2.4 mm. In an additional embodiment, the thickness of the striking face is less than or equal to 2.3 mm. In an additional embodiment, the thickness of the striking face is less than or equal to 2.2 mm. In an additional embodiment, the thickness of the striking face is less than or equal to 2.1 mm. In an additional embodiment, the thickness of the striking face is less than or equal to 2.0 mm. In an additional embodiment, the thickness of the striking face is less than or equal to 1.9 mm. In an additional embodiment, the thickness of the striking face is less than or equal to 1.8 mm. In an additional embodiment, the thickness of the striking face is less than or equal to 1.7 mm. In an additional embodiment, the thickness of the striking face is less than or equal to 1.6 mm. In an additional embodiment, the thickness of the striking face is less than or equal to 1.5 mm. In an additional embodiment, the thickness of the striking face is less than or equal to 1.4 mm.

Figure 11B:
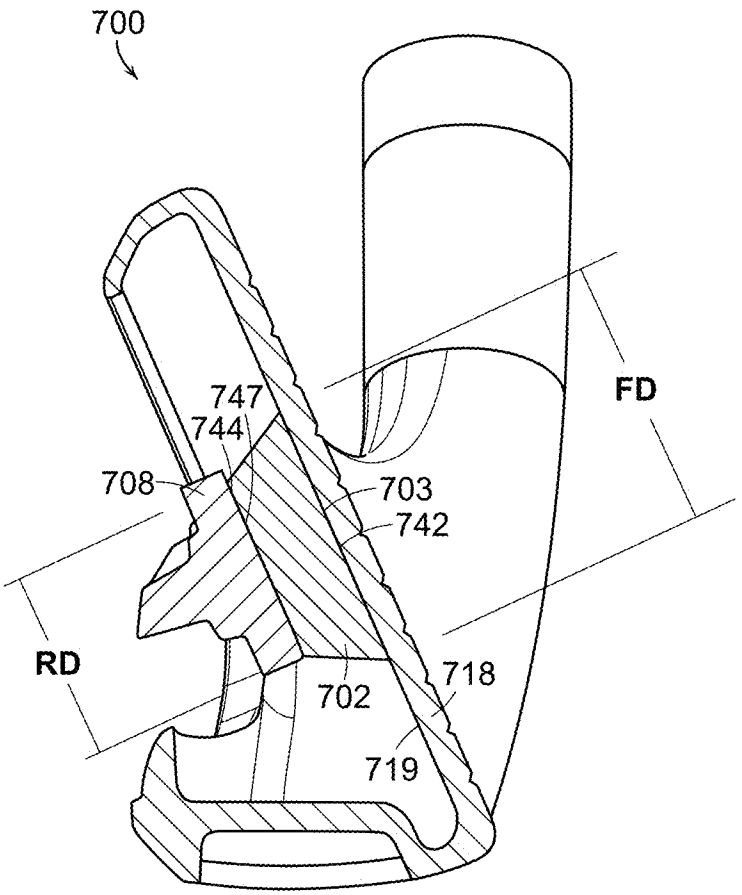
FIG. 11B depicts a cross sectional view of the golf club head of FIG. 7C including an additional embodiment of a damping element.
Figure 11A:
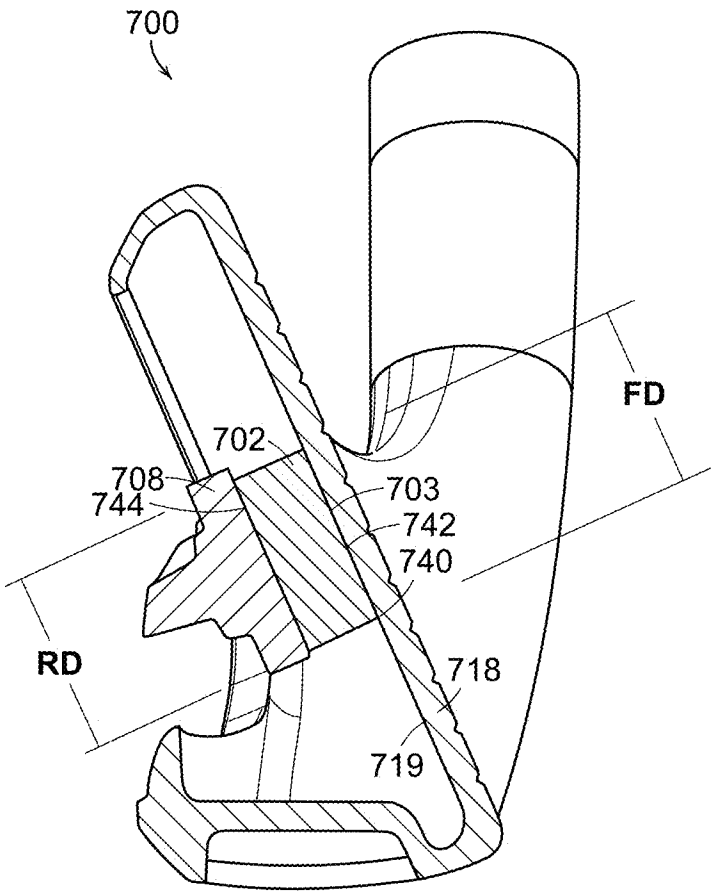
FIG. 11A depicts a cross sectional view of the golf club head of FIG. 7C including an additional embodiment of a damping element.

FIGS. 11A-11D depict the golf club head 700 of FIG. 7A having additional embodiments of a damping element 702. FIG. 11A illustrates a cross sectional view of the golf club head 700 including an additional embodiment of a damping element 702. The damping element 702 of FIG. 11A is circular similar to the embodiment illustrated in FIG. 7A. The front portion 703 of the damping element 702, which abuts the rear surface 719 of the striking face 718, has a front diameter FD and the rear portion 744, which abuts the cradle 708, has a rear diameter RD. The front diameter FD is substantially similar or equal to the rear diameter RD of the damping element 702 illustrated in FIG. 11A.

FIG. 11B illustrates a cross sectional view of the golf club head 700 including an additional embodiment of a damping element 702. The damping element 702 of FIG. 11B is circular. The front diameter FD is greater than rear diameter RD of the damping element 702 illustrated in FIG. 11B. The rear portion 744 of the damping element 702 in contact with the cradle 708 has a rear support region 747, which has an area.

Figure 11D:
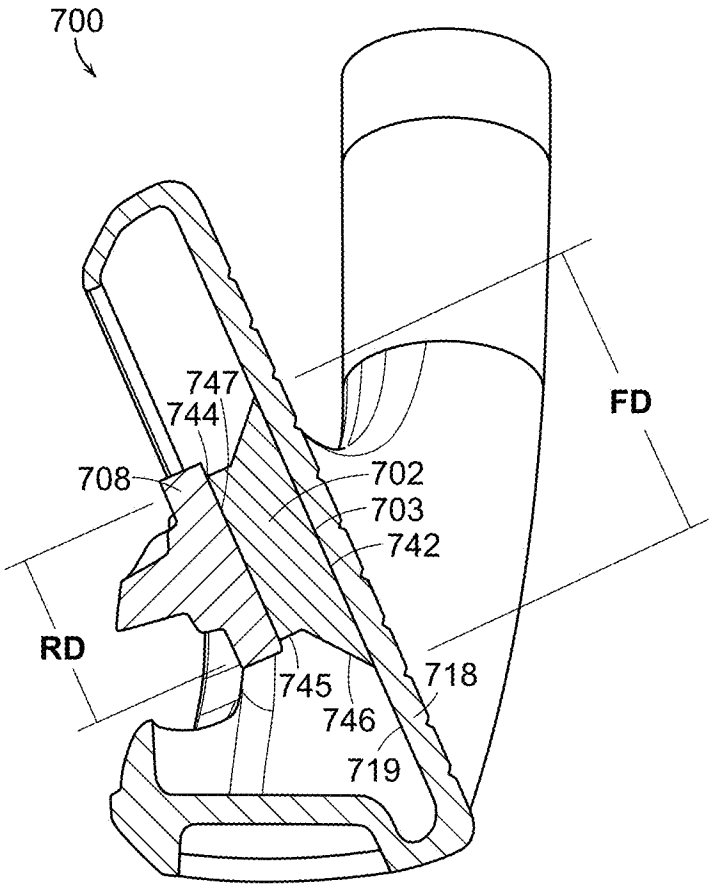
FIG. 11D depicts a cross sectional view of the golf club head of FIG. 7C including an additional embodiment of a damping element.
Figure 11C:
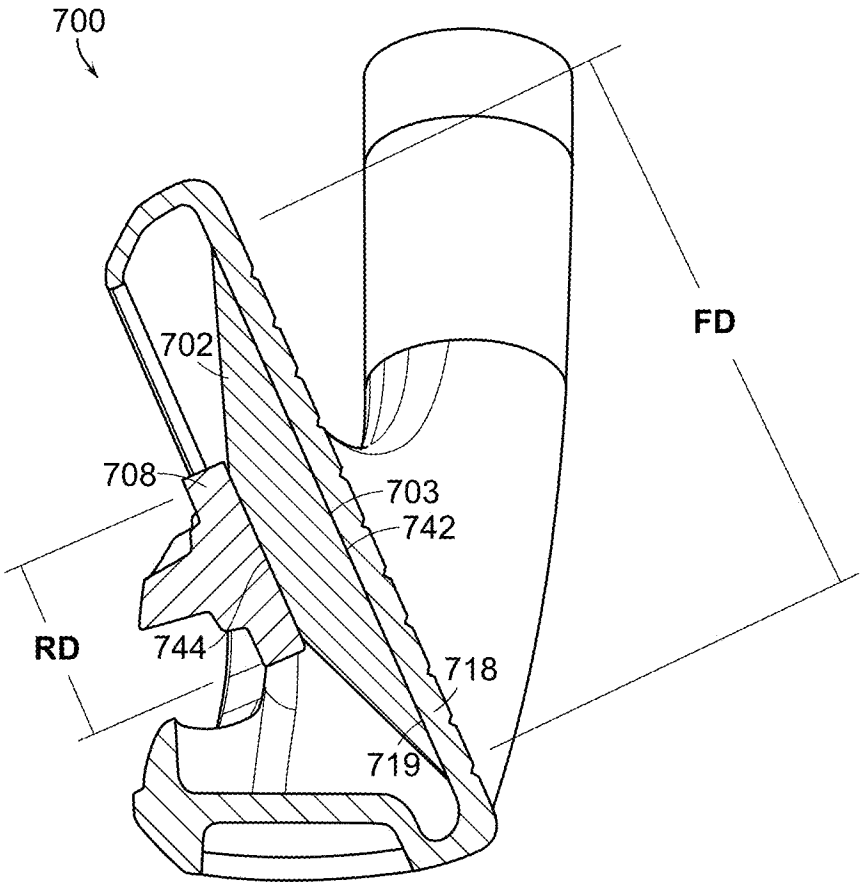
FIG. 11C depicts a cross sectional view of the golf club head of FIG. 7C including an additional embodiment of a damping element.

FIG. 11C illustrates a cross sectional view of the golf club head 700 including an additional embodiment of a damping element 702. The damping element 702 of FIG. 11C is circular. The front diameter FD is greater than rear diameter RD of the damping element 702 illustrated in FIG. 11C.

FIG. 11D illustrates a cross sectional view of the golf club head 700 including an additional embodiment of a damping element 702. The damping element 702 of FIG. 11D is circular. The front diameter FD is greater than rear diameter RD of the damping element 702 illustrated in FIG. 11D. Additionally, the rear portion 744 has a constant diameter region 745 aft of the tapered region 746 extending towards the striking face 718. In one embodiment, the rear diameter RD is approximately 12.5 mm and the front diameter FD is approximately 18.5 mm.

The enlarged front portion 703 and thus enlarged supported region 742 offered by the embodiments of the damping elements 702 illustrated in FIGS. 11B, 11C, and 11D offer advantages. These advantages include more consistent off-center ball speeds, reduced sound energy, particularly above 3800 Hz.

In one embodiment, the area of the supported region can be greater than 75 millimeters$^2$. In an additional embodiment, the area of the supported region can be greater than 100 millimeters$^2$. In an additional embodiment, the area of the supported region can be greater than 125 millimeters$^2$. In an additional embodiment, the area of the supported region can be greater than 150 millimeters$^2$. In an additional embodiment, the area of the supported region can be greater than 175 millimeters$^2$. In an additional embodiment, the area of the supported region can be greater than 200 millimeters$^2$. In an additional embodiment, the area of the supported region can be greater than 225 millimeters$^2$. In an additional embodiment, the area of the supported region can be greater than 250 millimeters$^2$. In an additional embodiment, the area of the supported region can be greater than 255 millimeters$^2$. In an additional embodiment, the area of the supported region can be greater than 260 millimeters$^2$. In an additional embodiment, the area of the supported region can be greater than 50 millimeters$^2$ and less than 1000 millimeters. In an additional embodiment, the area of the supported region can be greater than 100 millimeters' and less than 1000 millimeters. In an additional embodiment, the area of the supported region can be greater than 150 millimeters' and less than 1000 millimeters. In an additional embodiment, the area of the supported region can be greater than 200 millimeters' and less than 1000 millimeters. In an additional embodiment, the area of the supported region can be greater than 250 millimeters' and less than 1000 millimeters.

In one embodiment, the ratio of the front diameter FD divided by the rear diameter RD is greater than 1.2. In an additional embodiment, the ratio of the front diameter FD divided by the rear diameter RD is greater than 1.4. In an additional embodiment, the ratio of the front diameter FD divided by the rear diameter RD is greater than 1.6. In an additional embodiment, the ratio of the front diameter FD divided by the rear diameter RD is greater than 1.8. In an additional embodiment, the ratio of the front diameter FD divided by the rear diameter RD is greater than 2.0. In an additional embodiment, the ratio of the front diameter FD divided by the rear diameter RD is greater than 3.0. In an additional embodiment, the ratio of the front diameter FD divided by the rear diameter RD is greater than 4.0.

In one embodiment, the area of the supported region 742 is greater than the area of the rear support region 747. In one embodiment, the ratio of the supported region 742 divided by the area of the rear supported region 747 is greater than 1.2. In an additional embodiment, the ratio of the supported region 742 divided by the area of the rear supported region 747 is greater than 1.4. In an additional embodiment, the ratio of the supported region 742 divided by the area of the rear supported region 747 is greater than 1.6. In an additional embodiment, the ratio of the supported region 742 divided by the area of the rear supported region 747 is greater than 1.8. In an additional embodiment, the ratio of the supported region 742 divided by the area of the rear supported region 747 is greater than 2.0. In an additional embodiment, the ratio of the supported region 742 divided by the area of the rear supported region 747 is greater than 2.5. In an additional embodiment, the ratio of the supported region 742 divided by the area of the rear supported region 747 is greater than 3.0. In an additional embodiment, the ratio of the supported region 742 divided by the area of the rear supported region 747 is greater than 3.5. In an additional embodiment, the ratio of the supported region 742 divided by the area of the rear supported region 747 is greater than 4.0. In an additional embodiment, the ratio of the supported region 742 divided by the area of the rear supported region 747 is greater than 5.0. In an additional embodiment, the ratio of the supported region 742 divided by the area of the rear supported region 747 is greater than 6.0. In an additional embodiment, the ratio of the supported region 742 divided by the area of the rear supported region 747 is greater than 7.0. In an additional embodiment, the ratio of the supported region 742 divided by the area of the rear supported region 747 is greater than 8.0. In an additional embodiment, the ratio of the supported region 742 divided by the area of the rear supported region 747 is greater than 9.0. In an additional embodiment, the ratio of the supported region 742 divided by the area of the rear supported region 747 is greater than 10.0.

The contact energy absorption factor is defined as the ratio of the front diameter FD divided by the diameter of a golf ball, which is approximately 42.75 mm. In one embodiment, the contact energy absorption factor is greater than 0.1. In an additional embodiment, the contact energy absorption factor is greater than 0.2. In an additional embodiment, the contact energy absorption factor is greater than 0.3. In an additional embodiment, the contact energy absorption factor is greater than 0.4. In an additional embodiment, the contact energy absorption factor is greater than 0.5. In an additional embodiment, the contact energy absorption factor is greater than 0.6. In an additional embodiment, the contact energy absorption factor is greater than 0.7. In an additional embodiment, the contact energy absorption factor is greater than 0.8. In an additional embodiment, the contact energy absorption factor is greater than 0.9. In an additional embodiment, the contact energy absorption factor is greater than 1.0. In an additional embodiment, the contact energy absorption factor is less than 0.2. In an additional embodiment, the contact energy absorption factor is less than 0.3. In an additional embodiment, the contact energy absorption factor is less than 0.4. In an additional embodiment, the contact energy absorption factor is less than 0.5. In an additional embodiment, the contact energy absorption factor is less than 0.6. In an additional embodiment, the contact energy absorption factor is less than 0.7. In an additional embodiment, the contact energy absorption factor is less than 0.8. In an additional embodiment, the contact energy absorption factor is less than 0.9. In an additional embodiment, the contact energy absorption factor is less than 1.0.

In additional embodiments, the damping elements 702 may not be circular. They may have additional shapes which may include square, rectangular, octagonal, etc.

Figure 12A:
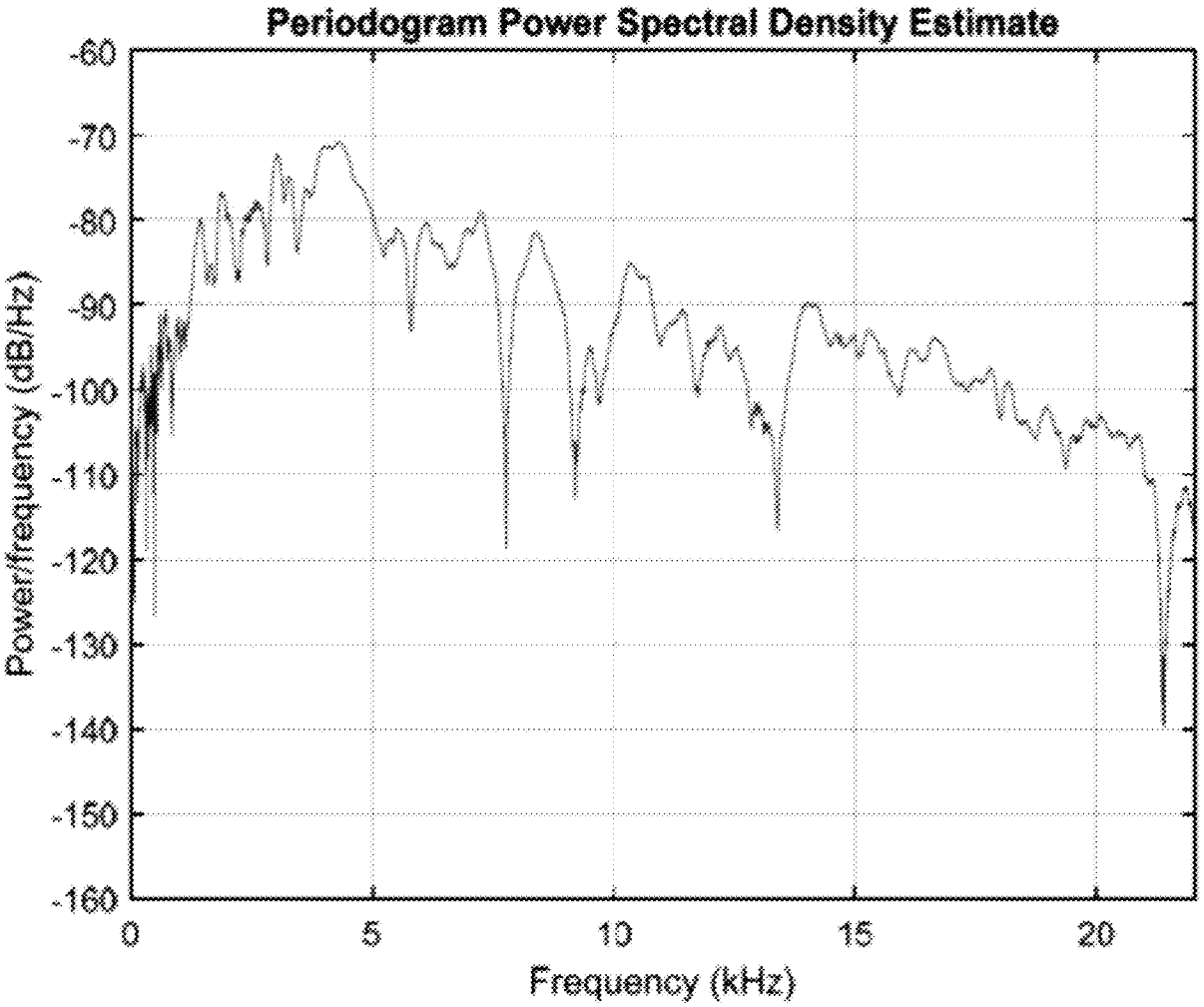
FIG. 12A depicts the periodogram power spectral density estimate of the golf club head depicted in FIG. 11A.
Figure 12B:
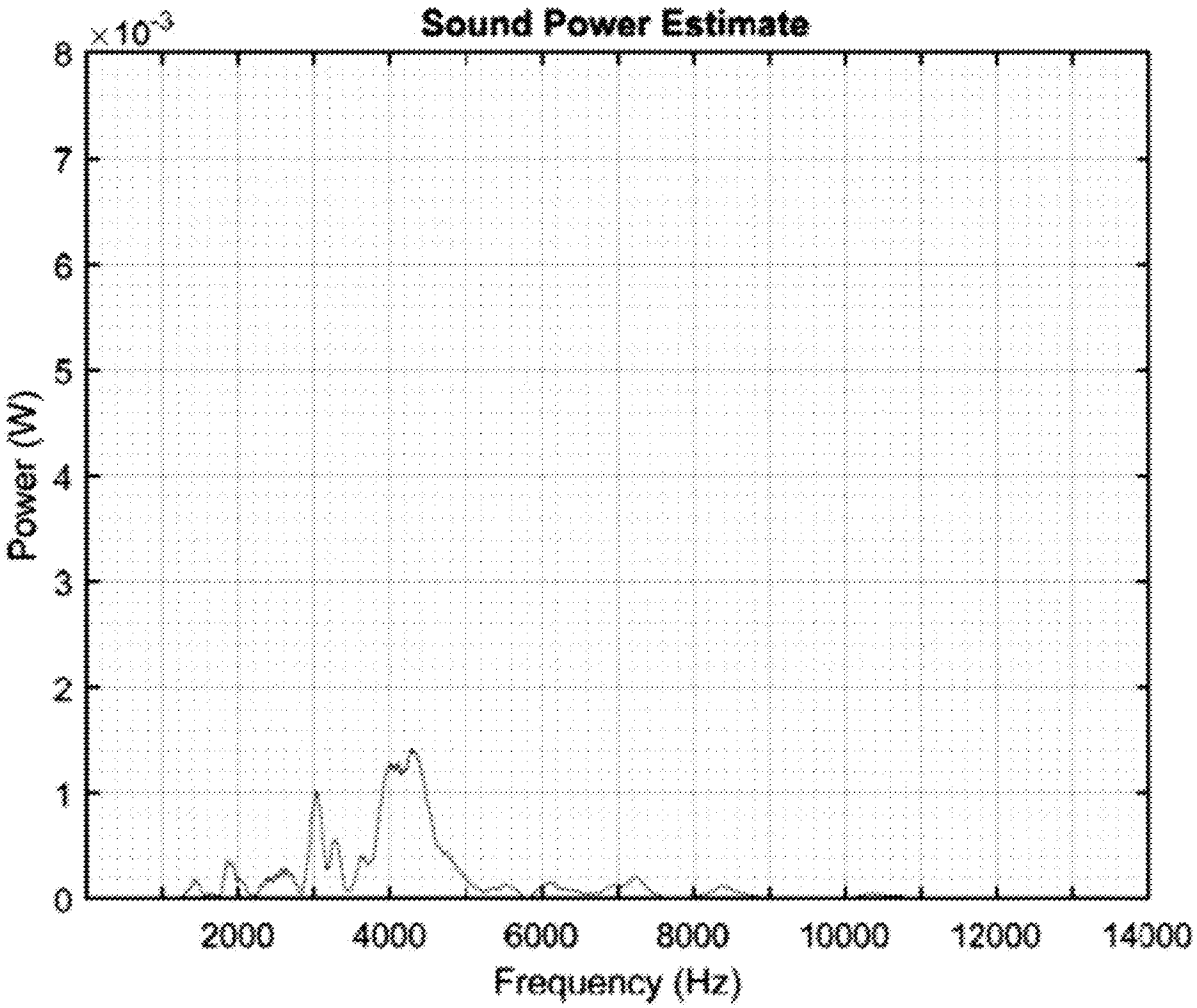
FIG. 12B depicts the sound power estimate of the golf club head depicted in FIG. 11A.
Figure 13A:
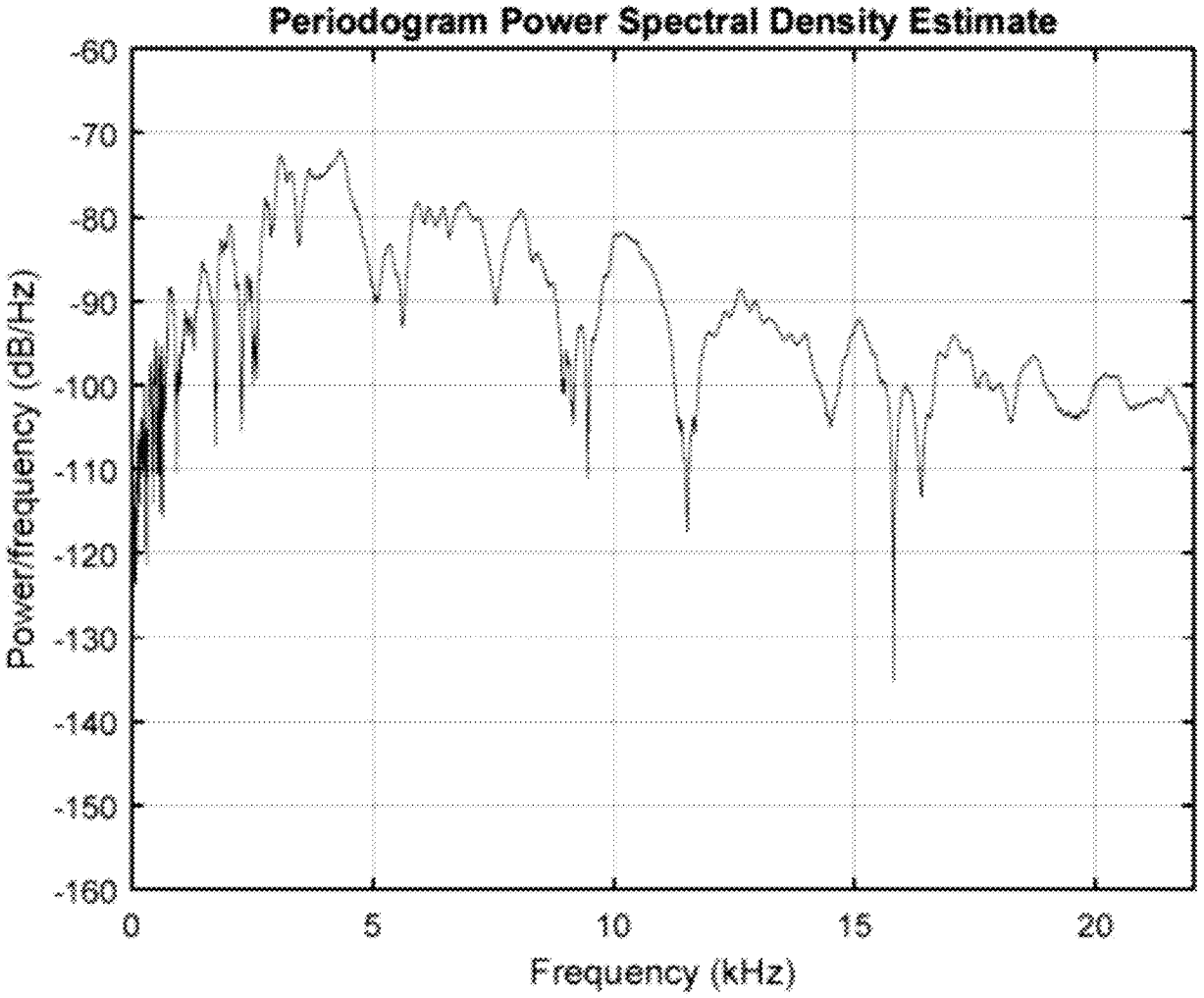
FIG. 13A depicts the periodogram power spectral density estimate of the golf club head depicted in FIG. 11D.
Figure 13B:
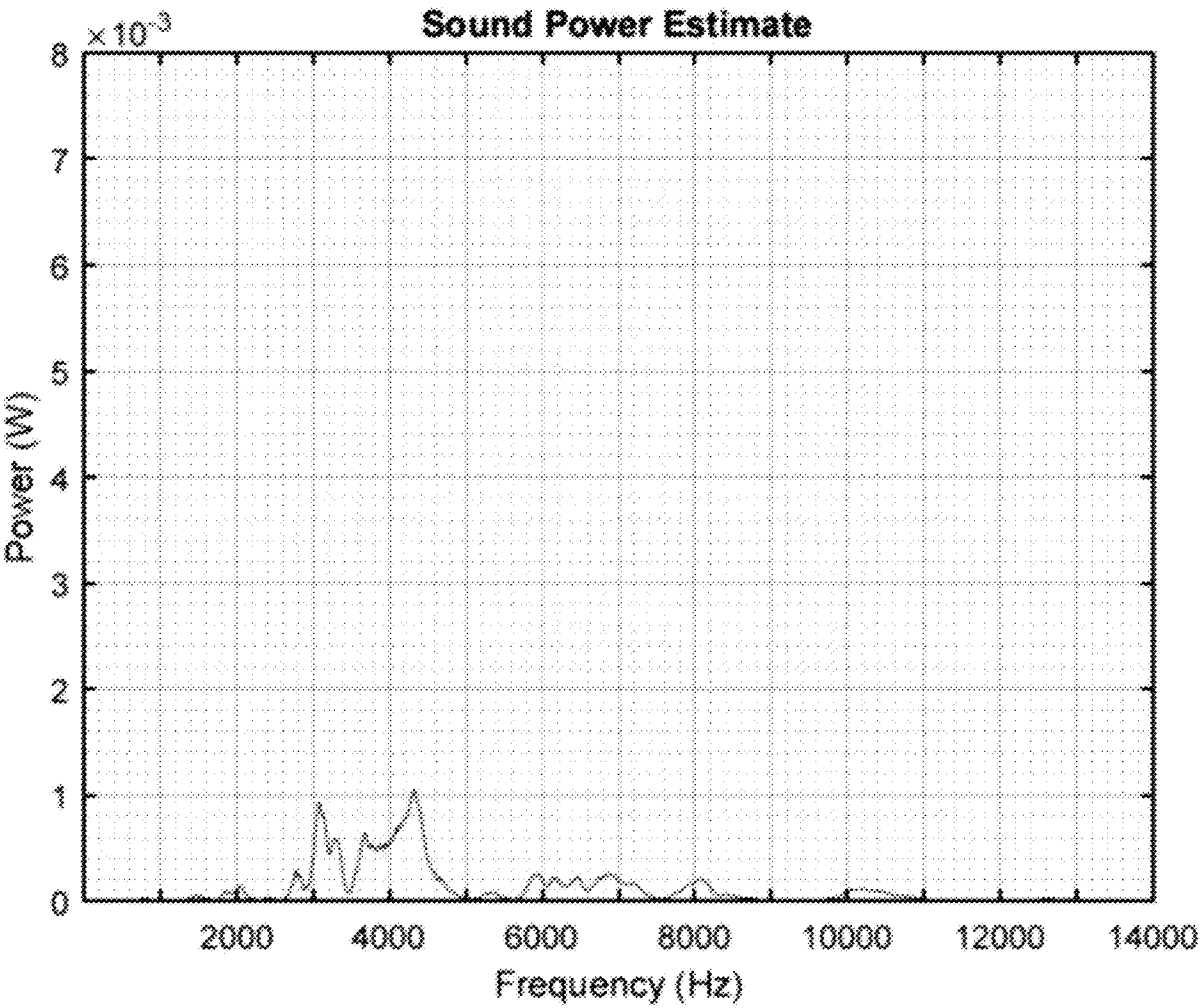
FIG. 13B depicts the sound power estimate of the golf club head depicted in FIG. 11D.

Identical golf club heads with different damping elements were subjected to acoustic testing to determine the effectiveness of different embodiments of damping elements. The testing was performed with each club head striking a Titleist ProV1 golf ball with a club head speed at impact of approximately 95 miles per hour. The acoustic qualities of the embodiments illustrated in FIGS. 11A and 11D were recorded when each golf club head struck a golf ball. FIGS. 12A and 12B reflect the recording of the golf club head utilizing the cylindrical damping element embodiment illustrated in FIG. 11A striking a golf ball and FIGS. 13A and 13B reflect the recording of the golf club head utilizing the tapered damping element embodiment illustrated in FIG. 11D striking a golf ball. FIG. 12A illustrates the periodogram power spectral density estimate of the FIG. 11A cylindrical embodiment. FIG. 12B illustrates the sound power estimate of the FIG. 11A cylindrical embodiment. FIG. 13A illustrates the periodogram power spectral density estimate of the FIG. 11D tapered embodiment. FIG. 13B illustrates the sound power estimate of the FIG. 11D tapered embodiment.

As illustrated in FIGS. 12A and 12B, the dominant frequency for the cylindrical damping element 702 of FIG. 11A is 4,279.7 HZ. As illustrated in FIGS. 13A and 13B, the dominant frequency for the tapered damping element 702 of FIG. 11D is 4317.4 Hz. Generally, when an iron type golf club head strikes a golf ball, sound frequencies produced between approximately 1,000 Hz and 3,800 Hz are produced by golf club and golf ball interaction and golf ball resonances while sound frequencies above approximately 3,800 Hz are produced solely by the golf club head. Thus, the first sound power peak in the sound power estimate graphs of FIGS. 12B and 13B correlates primarily to the golf ball and the subsequent sound power peak correlates to the vibration of the striking face of the golf club head. As illustrated in FIGS. 12B and 13B the peak sound power estimate below 3,800 Hz, corresponding to the golf ball, is approximately $1.00\times10^{-3}$ watts. As illustrated in FIG. 12B, the sound power generated by the golf club head utilizing the cylindrical damping element embodiment illustrated in FIG. 11A peaks at approximately $1.40\times10^{-3}$ watts. As illustrated in FIG. 13B, the sound power generated by the golf club head utilizing the tapered damping element embodiment illustrated in FIG. 11D peaks at approximately $1.04\times10^{-3}$ watts. Sound power levels correlate directly with the loudness of the sound produced by the golf club striking a golf ball. Therefore, it is evident that the sound produced by the golf club head utilizing the cylindrical damping element embodiment illustrated in FIG. 11A is significantly less loud than the golf club head utilizing the tapered damping element embodiment illustrated in FIG. 11D.

Additionally, the sound power generated by the golf club head utilizing the cylindrical damping element embodiment illustrated in FIG. 11A divided by the sound power generated by the golf ball is approximately 1.40. The sound power generated by the golf club head utilizing the cylindrical damping element embodiment illustrated in FIG. 11D divided by the sound power generated by the golf ball is approximately 1.04. In some embodiments, it is preferable to have the sound power generated by the golf club head divided by the sound power generated by the golf ball to be less than 1.50. In some embodiments, it is preferable to have the sound power generated by the golf club head divided by the sound power generated by the golf ball to be less than 1.40. In some embodiments, it is preferable to have the sound power generated by the golf club head divided by the sound power generated by the golf ball to be less than 1.30. In some embodiments, it is preferable to have the sound power generated by the golf club head divided by the sound power generated by the golf ball to be less than 1.20. In some embodiments, it is preferable to have the sound power generated by the golf club head divided by the sound power generated by the golf ball to be less than 1.10. In some embodiments, it is preferable to have the sound power generated by the golf club head divided by the sound power generated by the golf ball to be less than 1.00.

FIGS. 14A-L depict additional embodiments of a damping element 702 damping element. These embodiments are designed with variable compressive stiffness, spring rate, or flexural modulus. This can be achieved through various geometries as well as combinations of various co-molded materials of different durometers.

Figure 14A:
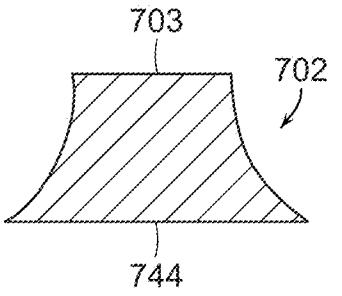
FIG. 14A illustrates a cross sectional view of a damping element having a larger rear portion than front portion.
Figure 14B:
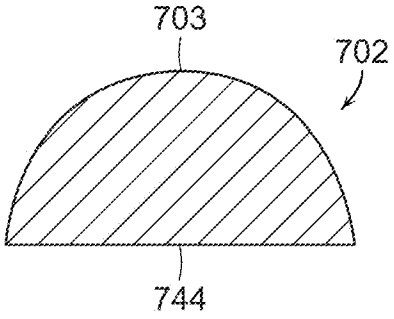
FIG. 14B illustrates a cross sectional view of a damping element having a larger rear portion than front portion.
Figure 14C:
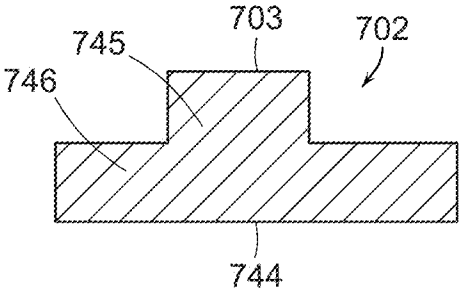
FIG. 14C illustrates a cross sectional view of a damping element having a larger rear portion than front portion.
Figure 14D:
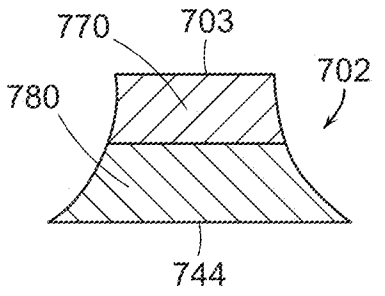
FIG. 14D illustrates a cross sectional view of a damping element similar to that of FIG. 14A but includes a first material and a second material.
Figure 14E:
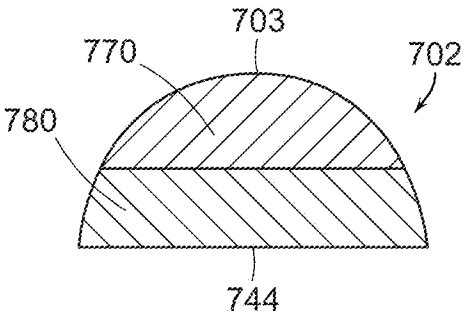
FIG. 14E illustrates a cross sectional view of a damping element similar to that of FIG. 14B but includes a first material and a second material.
Figure 14F:
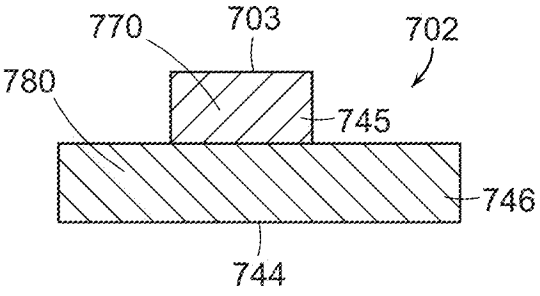
FIG. 14F illustrates a cross sectional view of a damping element similar to that of FIG. 14C but includes a first material and a second material.

FIG. 14A illustrates a cross sectional view of a damping element 702 having a larger rear portion 744 than front portion 703. The front portion 703 and rear portion 744 are substantially planar. FIG. 14B illustrates a cross sectional view of a damping element 702 having a larger rear portion 744 than front portion 703. The rear portion 744 is substantially planar and the front portion 703 is hemispherical. FIG. 14C illustrates a cross sectional view of a damping element 702 having a larger rear portion 744 than front portion 703. The damping element 702 includes a front constant diameter region 746 and a rear constant diameter region 745, where the rear constant diameter region 746 has a larger diameter than the front constant diameter region 745. FIG. 14D illustrates a cross sectional view of a damping element 702 similar to that of FIG. 14A but includes a first material 770 and a second material 780. In one embodiment, the first material 770 can be stiffer than the second material 780. In an additional embodiment, the second material 780 can be stiffer than the first material 770. FIG. 14E illustrates a cross sectional view of a damping element 702 similar to that of FIG. 14B but includes a first material 770 and a second material 780. FIG. 14F illustrates a cross sectional view of a damping element 702 similar to that of FIG. 14C but includes a first material 770 and a second material 780.

FIG. 14G illustrates a cross sectional view of a damping element 702 similar to that of FIG. 14A but the center of the front portion 703 is offset from a center of the rear portion 744. The offset can be towards the topline, towards, the sole, towards the toe, towards the heel, or any combination thereof. FIG. 14H illustrates a cross sectional view of a damping element 702 similar to that of FIG. 14B but the center of the front portion 703 is offset from a center of the rear portion 744. FIG. 14I illustrates a cross sectional view of a damping element 702 similar to that of FIG. 14C but the center of the front portion 703 is offset from a center of the rear portion 744. FIG. 14J illustrates a cross sectional view of a damping element 702 which necks down in diameter between the front portion 703 and the rear portion 744. FIG. 14K illustrates a cross sectional view of a damping element 702 which necks down in diameter between the front portion 703 and the rear portion 744. FIG. 14L illustrates a cross sectional view of a damping element 702 similar to that of FIG. 14J but includes a first material 770 and a second material 780.

Any of these embodiments of damping element 702 described herein can be flipped, such that the rear portion 744 abuts the rear surface of the striking face rather than the front portion. Additionally, the embodiments illustrated in FIGS. 14A-14L are circular when viewed from a front view in a preferred embodiment. In other embodiments, the damping elements may comprise different shapes. In some embodiments, the flexural modulus of the first material can be greater than the flexural modulus of the second material.

Figure 15A:
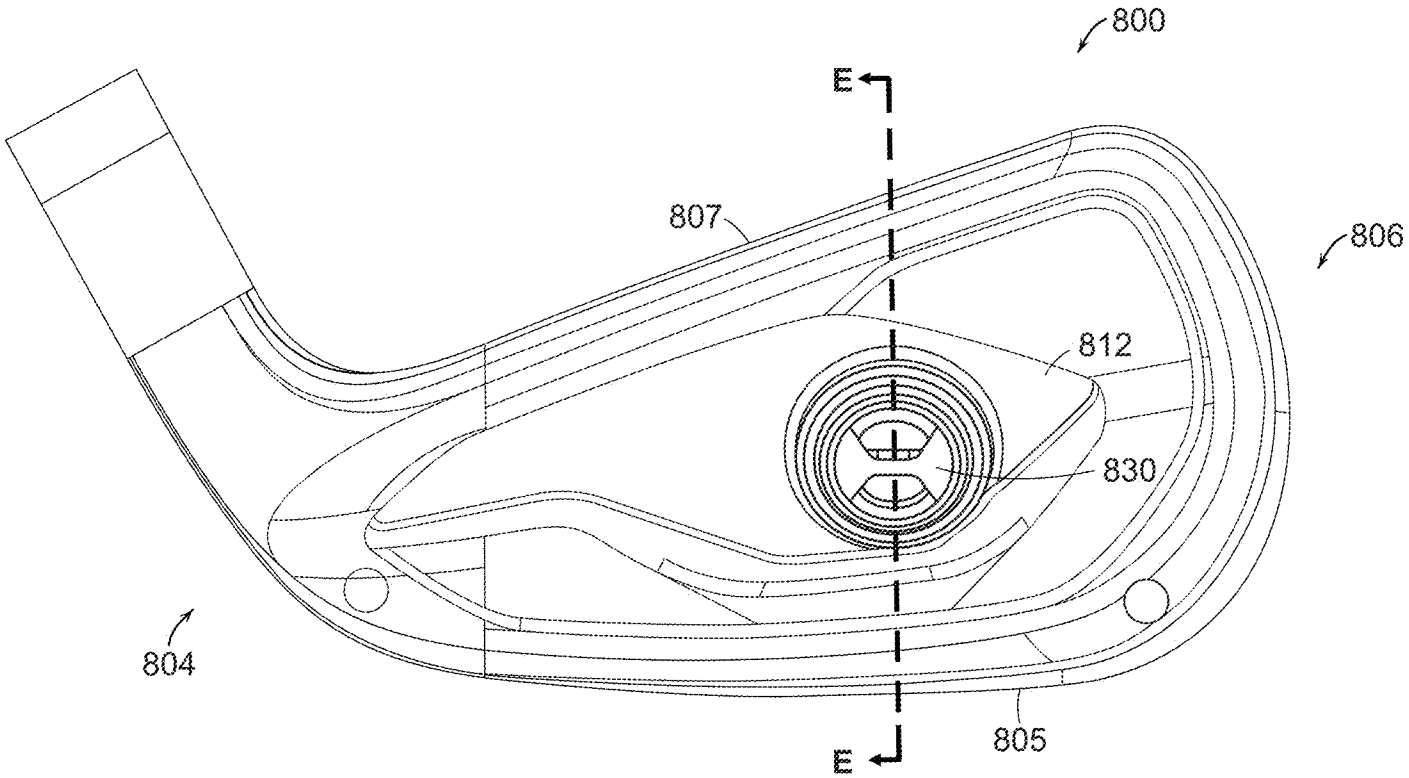
FIG. 15A depicts a rear view of the golf club head.
Figure 15B:
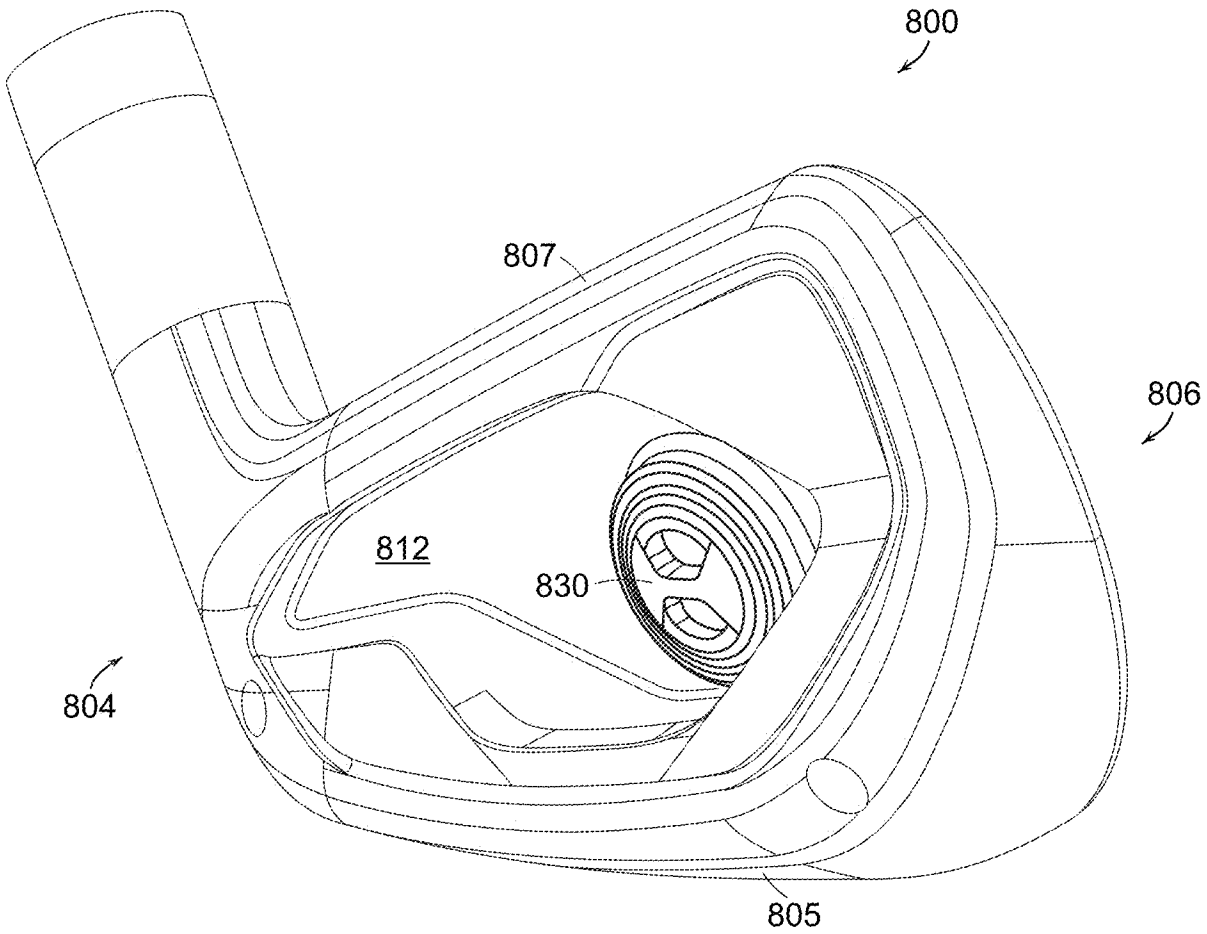
FIG. 15B depicts a perspective view of the golf club head of FIG. 15A.
Figure 15C:
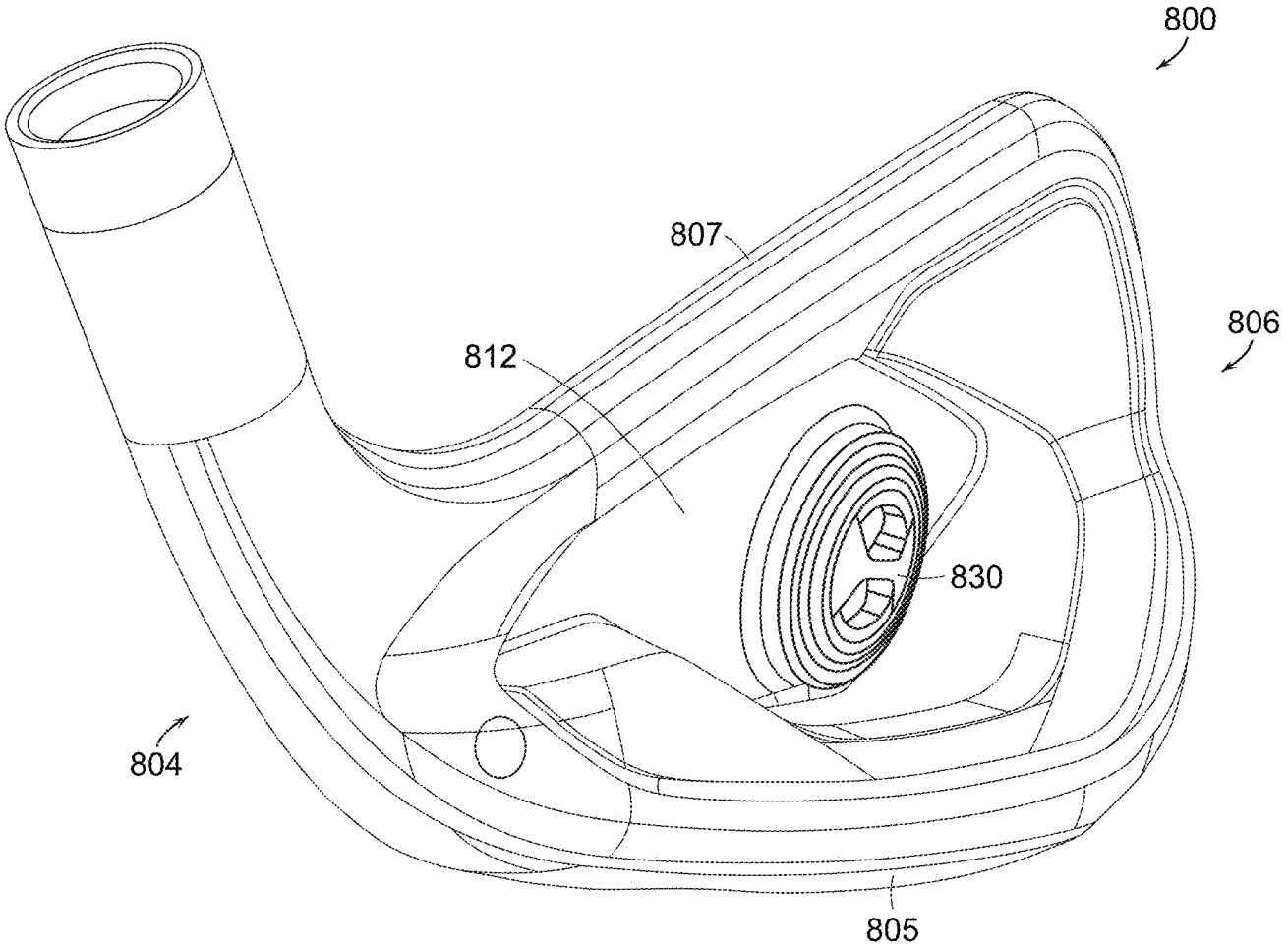
FIG. 15C depicts an additional perspective view of the golf club head of FIG. 15A.
Figure 16:
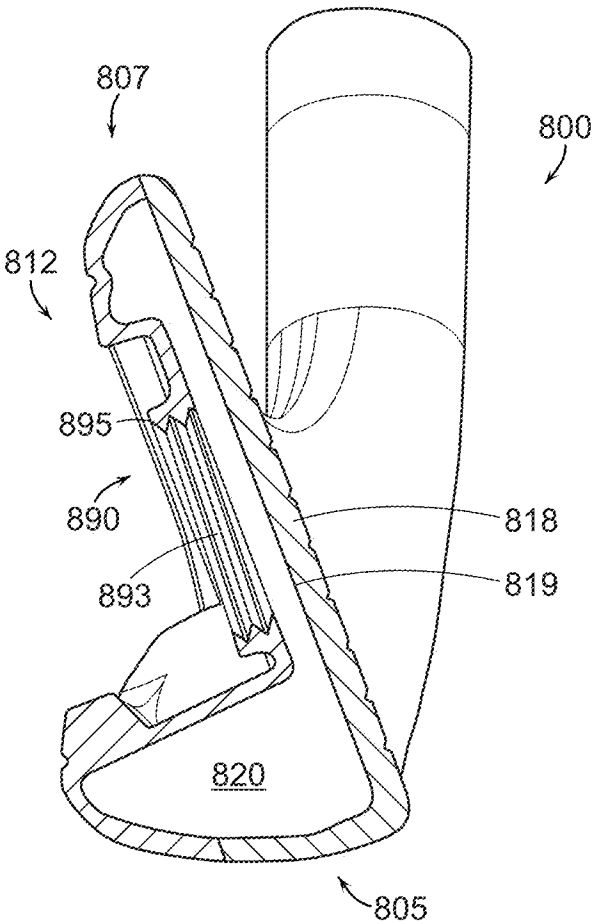
FIG. 16 depicts the section view E-E of the golf club head of FIG. 15D without the adjustment driver and damping element installed.
Figure 15D:
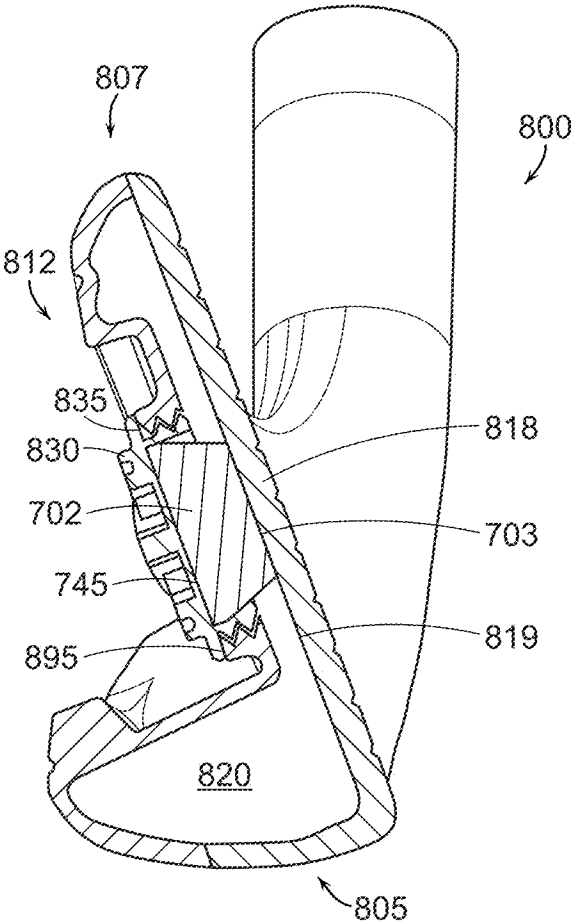
FIG. 15D depicts a section view E-E of the golf club head of FIG. 15A.
Figure 17C:
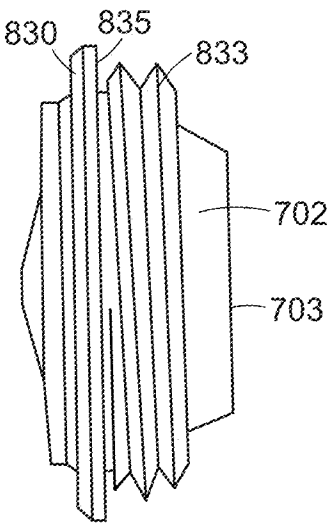
FIG. 17C depicts a side view of the adjustment driver and damping element of the golf club head of FIG. 15A.
Figure 17B:
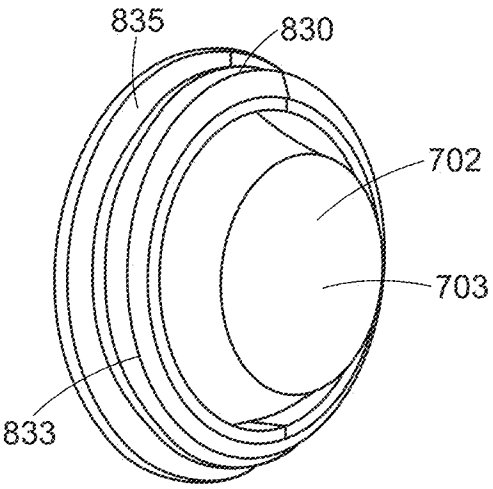
FIG. 17B depicts an additional perspective view of the adjustment driver and damping element of the golf club head of FIG. 15A.
Figure 17A:
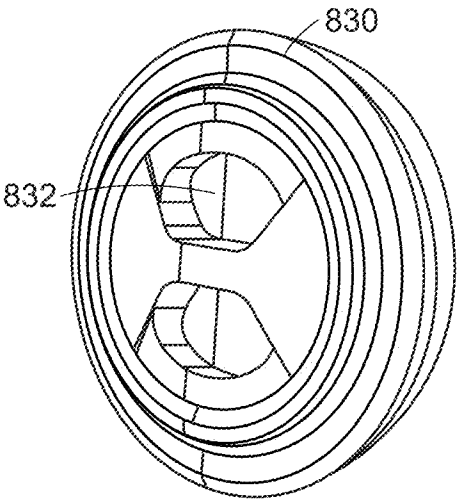
FIG. 17A depicts a perspective view of the adjustment driver and damping element of the golf club head of FIG. 15A.
Figure 17E:
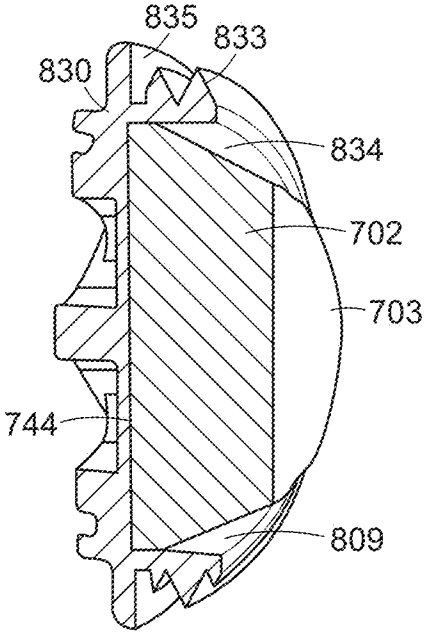
FIG. 17E depicts an additional perspective of the section view of the adjustment driver and damping element of FIG. 17A.
Figure 17D:
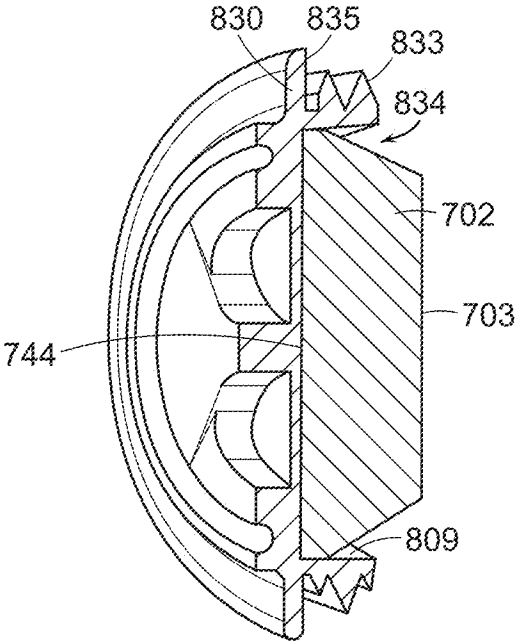
FIG. 17D depicts a section view of the adjustment driver and damping element of FIG. 17A.

FIGS. 15A-15D depict a golf club head 800 having a damping element 702. FIG. 15A depicts a rear view of the golf club head 800. FIG. 15B depicts a perspective view of the golf club head 800 of FIG. 15A. FIG. 15C depicts an additional perspective view of the golf club head 800 of FIG. 15A. FIG. 15D depicts a section view E-E of the golf club head 800 of FIG. 15A. FIG. 16 depicts the section view E-E of the golf club head 800 of FIG. 15D without the adjustment driver 830 and damping element 702 installed. FIG. 17A depicts a perspective view of the adjustment driver 830 and damping element 702 of the golf club head 800 of FIG. 15A. FIG. 17B depicts an additional perspective view of the adjustment driver 830 and damping element 702 of the golf club head 800 of FIG. 15A. FIG. 17C depicts a side view of the adjustment driver 830 and damping element 702 of the golf club head 800 of FIG. 15A. FIG. 17D depicts a section view of the adjustment driver 830 and damping element 702 of FIG. 17A. FIG. 17E depicts an additional perspective of the section view of the adjustment driver 830 and damping element 702 of FIG. 17A.

As illustrated in FIGS. 15D and 16, the golf club head 800 includes a striking face 818 having a rear surface 819. The golf club head 800 also includes a back portion 812 configured to support the damping element 702. The golf club head 800 is made with a hollow body construction and the back portion 812 covers a substantial portion of the back of the golf club head 800. The back portion 812 is located behind the striking face 818 and extends between the topline 807 and the sole 805 and from the heel 804 to the toe 806 forming a cavity 820. The damping element 702 is disposed within the cavity 820. As illustrated in FIG. 15D. the striking face 818 can be formed separately and welded to the rest of the golf club head 800. More specifically, the separately formed striking face portion can include a portion of the sole, forming an L-shaped striking face portion. In other embodiments, the striking face 818 may be formed integrally with the rest of the golf club.

The golf club head 800 includes an adjustment driver 830 much like the adjustment driver 330 described earlier and illustrated in FIGS. 3A and 3B. The golf club head 800 also includes a damping element 702 disposed between the striking face 818 and the adjustment driver 830. The damping element 702 can take the form of any of the damping elements described herein. The adjustment driver 830 is configured to retain the damping element 702 between the adjustment driver 830 and the striking face 818, with the front portion 703 of the damping element 702 contacting the rear surface 819 of the striking face 818 and the rear portion 744 of the damping element 702 contacting the adjustment driver 830. The adjustment driver can include an interface 834 configured to retain the damping element 702. The interface 834 can include a recess with a lip 809 surrounding at least a portion of the damping element 702 as illustrated in FIGS. 15D and 17A-17E.

The golf club head 800 can include an adjustment receiver 890, much like the adjustment receiver 306 illustrated in FIGS. 3A and 3B. As illustrated in FIG. 16, the adjustment receiver 890 can include an aperture formed in the back portion 812 of the golf club head 800. The aperture can include a threaded portion 893. Additionally, the adjustment receiver 890 can include a receiver shelf 895 for the adjustment driver 830 to engage when it is installed in the adjustment receiver 890 as illustrated in FIG. 15D. The adjustment driver 830, as illustrated in FIGS. 15D and 17A-17E, can include a threaded portion 833 configured to engage the threaded portion 893 of the adjustment receiver 890. Additionally, the adjustment driver 830 can include a flange 835 configured to engage the receiver shelf 895 of the adjustment receiver 890 when the adjustment driver 830 is installed in the adjustment receiver 890. The receiver shelf 895 and flange 835 help to ensure the damping element properly and consistently engages the rear surface 819 of the striking face 818 and provides the support necessary for optimal performance. While the adjustment driver 330 discussed earlier is configured such that it may be adjusted after assembly, the preferred embodiment of the adjustment driver 830 illustrated in FIGS. 15A-15D and 17A-17E is configured to be installed to a set position during assembly and remain in that position. The receiver shelf 895 and flange 835 help to ensure the adjustment driver 830 is installed consistently and that the damping element properly and consistently engages the rear surface 819 of the striking face 818 and provides the support necessary for optimal performance. The adjustment driver 830 can also include a screw drive 832 configured to receive a tool and allow the adjustment driver 830 to be rotated relative to the golf club head 800. Finally, the adjustment driver 830 can have a mass. In some embodiments, the mass of the golf club head can be adjusted by swapping out the adjustment driver 830 for another adjustment driver 830 having a different mass. The difference in mass can be achieved through the use of different materials for different adjustment drivers such as aluminum, brass, polymers, steel, titanium, tungsten, etc. In another embodiment, not illustrated, mass elements could be added to the adjustment driver to change the mass. In one embodiment, mass elements could be added to the recess of the adjustment driver. Additionally, the mass element added to the recess could also be used to change the distance between the rear portion of the damping element and the rear surface of the striking face, altering the compression of the damping element.

Figure 18:
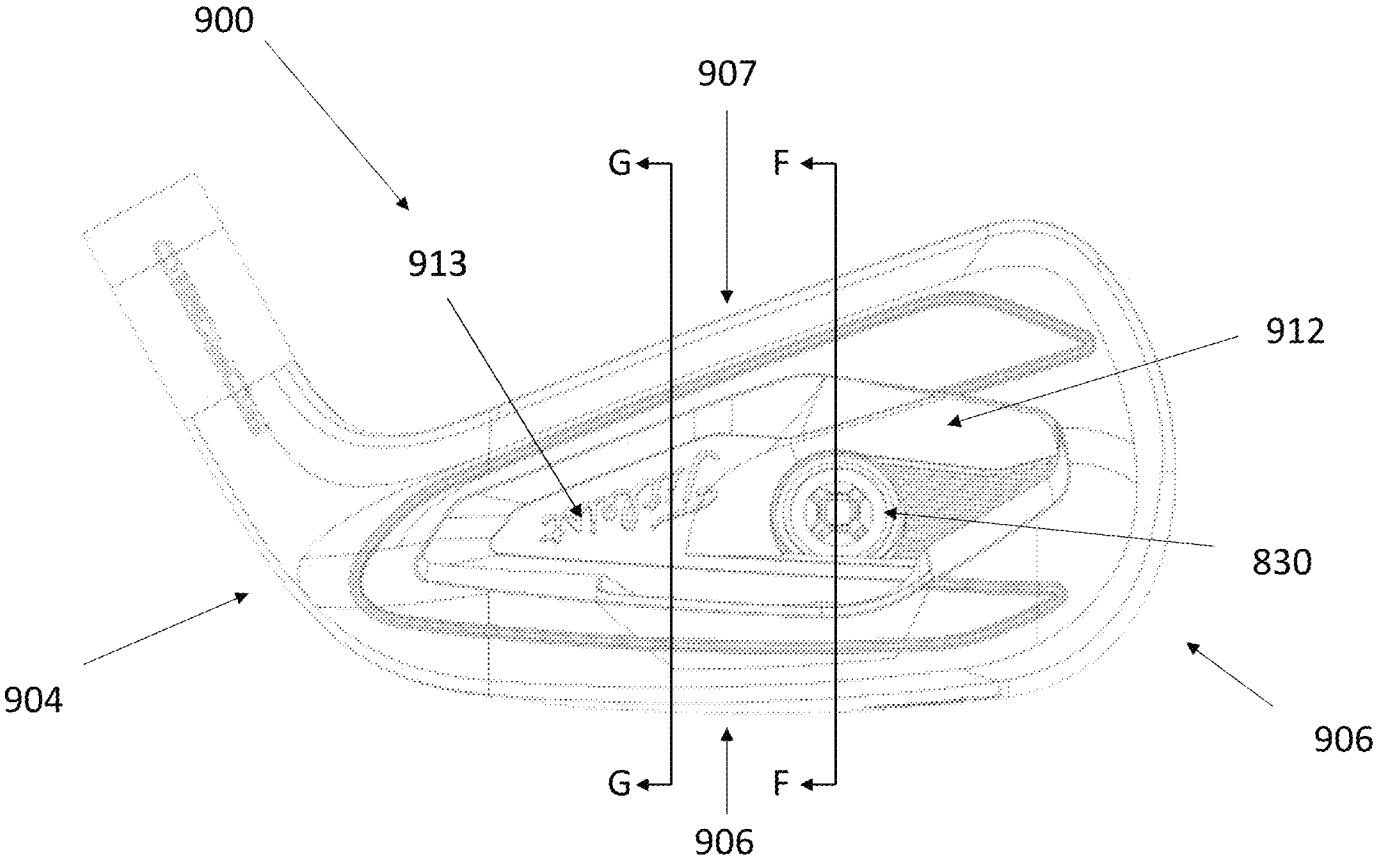
FIG. 18 depicts a rear view of the golf club head.
Figure 19:
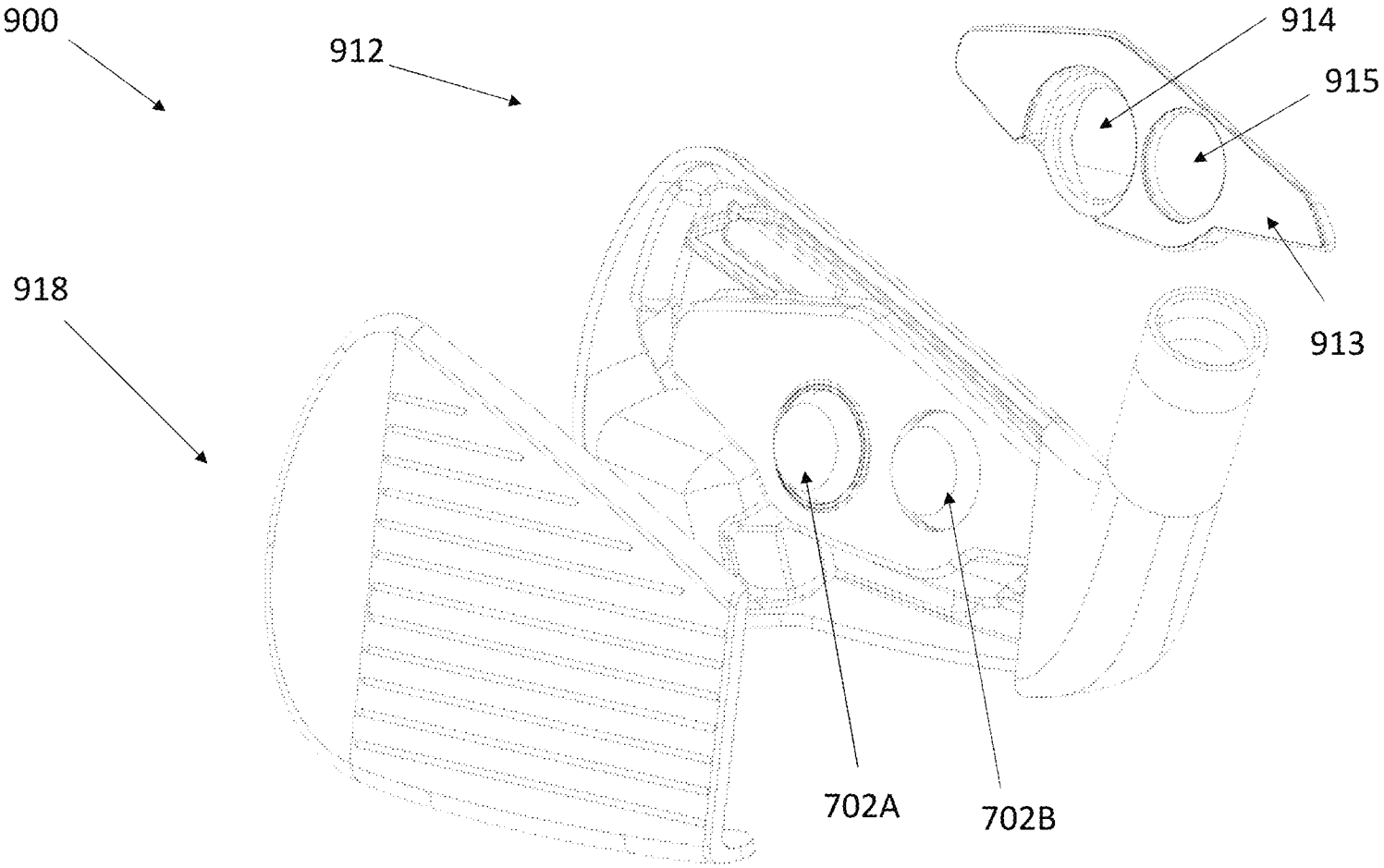
FIG. 19 depicts an exploded view of the golf club head of FIG. 18.
Figure 21:
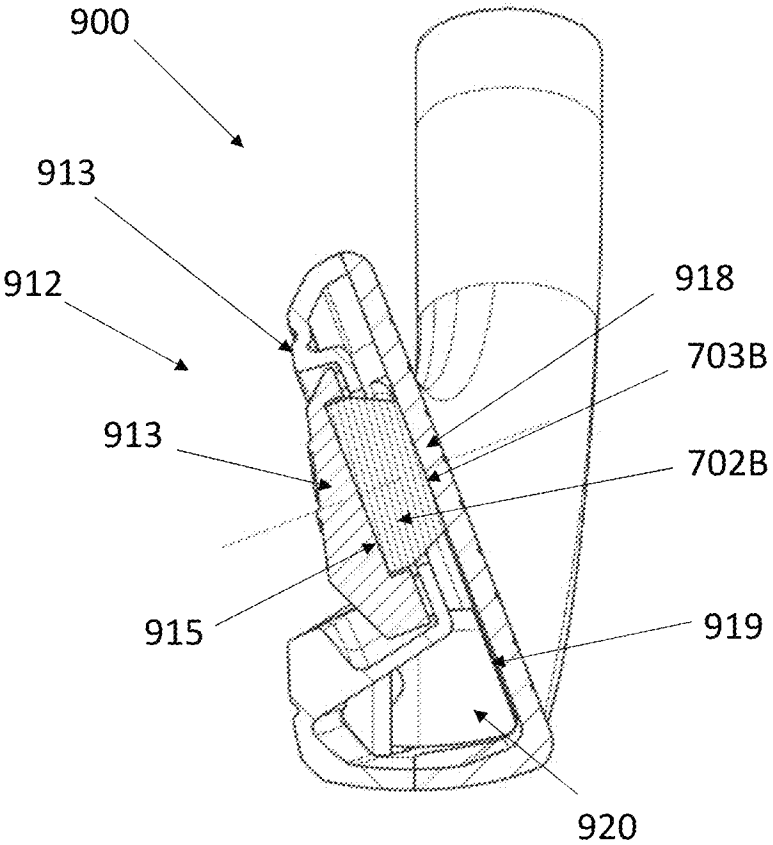
FIG. 21 depicts a section view G-G of the golf club head.
Figure 20:
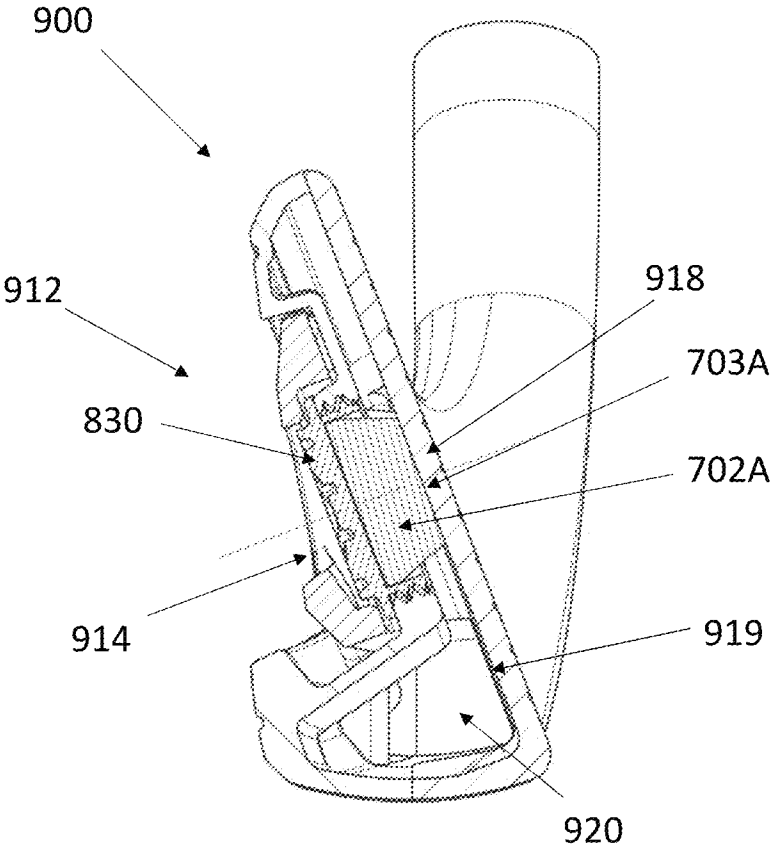
FIG. 20 depicts a section view F-F of the golf club head.
Figure 22:
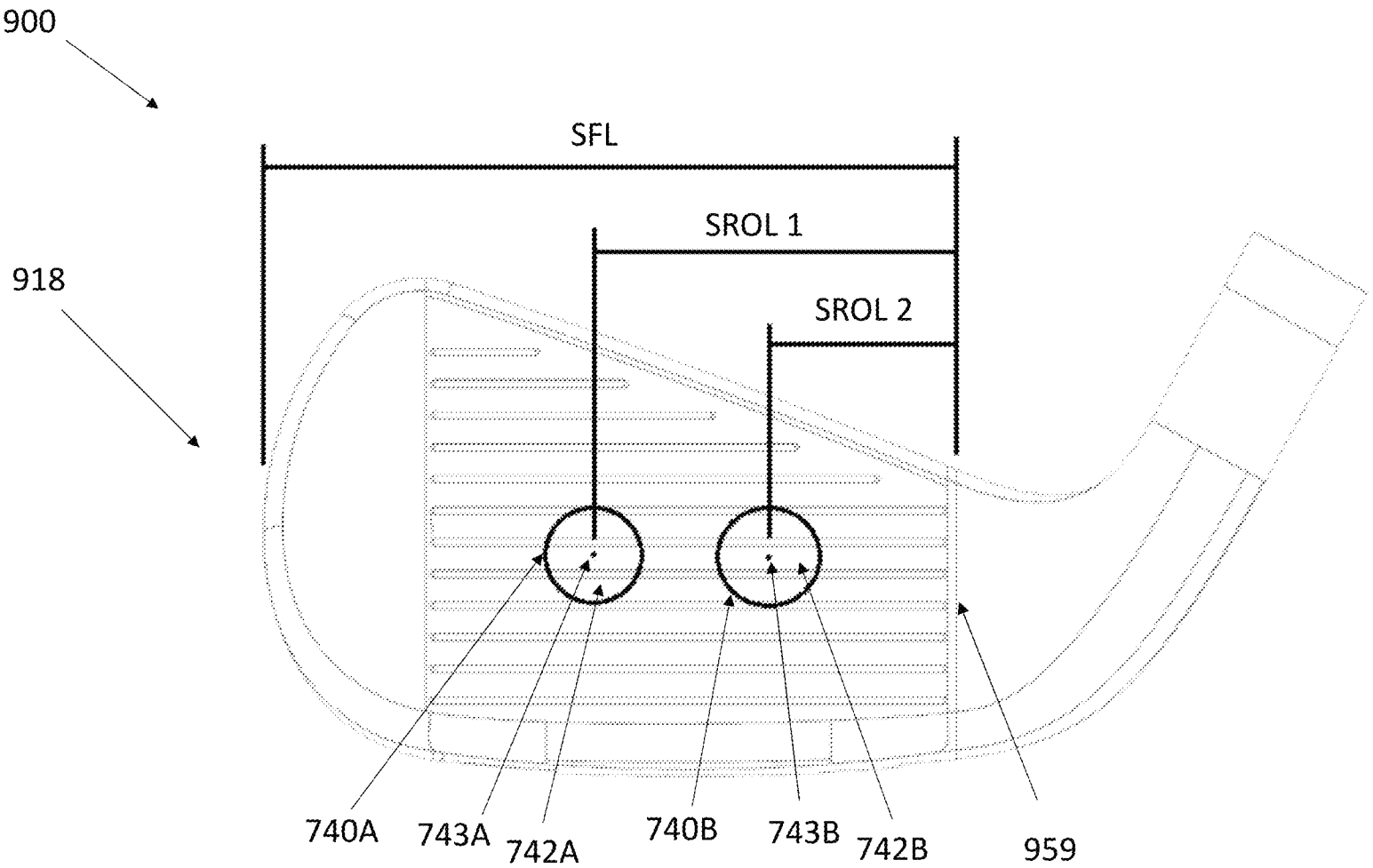
FIG. 22 depicts a frontal view of the golf club head of FIG. 18, including the supported regions.

FIGS. 18-22 depict a golf club head 900 similar to the golf club head 800 depicted in FIGS. 15A-15D. Golf club head 900 however includes a second damping element 702B in addition to a first damping element 702A. FIG. 18 depicts a rear view of the golf club head 900. FIG. 19 depicts an exploded view of the golf club head 900 of FIG. 18. FIG. 20 depicts a section view F-F of the golf club head 900. FIG. 21 depicts a section view G-G of the golf club head 900. FIG. 22 depicts a frontal view of the golf club head 900 of FIG. 18, including the supported regions.

As illustrated in FIGS. 18-22, the golf club head 900 includes a striking face 918 having a rear surface 919. The golf club head 900 also includes a back portion 912 configured to support the first damping element 702A and the second damping element 702B. The first damping element 702A can be the same as the damping element described earlier. The first damping element 702A and a second damping element 702B can each take the form of any of the damping elements described herein. They may take the same form, or they make take different forms. The golf club head 900 is made with a hollow body construction and the back portion 912 covers a substantial portion of the back of the golf club head 900. The back portion 912 is located behind the striking face 918 and extends between the topline 917 and the sole 905 from the heel 904 to the toe 906 forming a cavity 920. In the preferred illustrated embodiments the first damping element 702A is spaced from and does not contact the second damping element 702B. In an alternative embodiment, the first damping element 702A may be spaced closely to and contact the second damping element 702B.

Much like golf club head 800, the golf club head 900 includes an adjustment driver 830 configured to retain the first damping element 702A. The front portion 703A of the first damping element 702A contacts the rear surface 919 of the striking face 918. The back portion 912 of the golf club head 900 includes a back cover M. In the illustrated embodiment, the back cover 913 includes a recess 915 configured to retain the second damping element 702B such that the front portion 703B of the second damping element 702B contacts the rear surface 919 of the striking face 918. The back cover 913 also includes an aperture 914 for the adjustment driver 830. In one embodiment, the second damping element 702B is attached to the back cover 913 with an adhesive. Additionally, the back cover 913 can be attached to the rest of the golf club head 900 with an adhesive, which may include, for example, double sided tape. In one embodiment, the striking face 918 of the golf club head 900 is made from a high density material such as steel, whereas the back cover 913 is made from a low density material, such as plastic, which may include for example, acrylonitrile butadiene styrene. In an alternative embodiment, the back cover may also be made of a high density material.

As illustrated in FIG. 22, the striking face includes a plurality of supported regions. The first supported region 742A is defined by the portion of the rear surface 919 of the striking face 918 supported by the first damping element 702A, which is defined by the area inside the first supported region perimeter 740A defined by the outer extent of the front portion 703A of the first damping element 702A in contact with the rear surface 919 of the striking face 918. The second supported region 742B is defined by the portion of the rear surface 919 of the striking face 918 supported by the second damping element 702B, which is defined by the area inside the second supported region perimeter 740B defined by the outer extent of the front portion 703B of the second damping element 702B in contact with the rear surface 919 of the striking face 918. The first supported region 742A and second supported region 742B wouldn't normally be visible from the front of the golf club head 900 but was added in FIG. 22 for illustrative purposes.

The first geometric center 743A of the first supported region 742A is located a first supported region offset length SROL 1 toeward from the striking face heel reference plane 959, measured parallel to the ground plane and parallel to the striking face 918 with the golf club head 900 in an address position. The second geometric center 743B of the second supported region 742B is located a second supported region offset length SROL 2 toeward from the striking face heel reference plane 959, measured parallel to the ground plane and parallel to the striking face 918 with the golf club head 900 in an address position.

In a preferred embodiment, SROL 1 is approximately 36.0 mm and SROL 2 is approximately 17.6 mm. In a preferred embodiment SROL 1 is greater than SROL 2. In a preferred embodiment, SROL 1 divided by SROL2 is greater than 1.0. In a preferred embodiment, SROL 1 divided by SROL2 is greater than 1.25. In a preferred embodiment, SROL 1 divided by SROL2 is greater than 1.50. In a preferred embodiment, SROL 1 divided by SROL2 is greater than 1.75. In a preferred embodiment, SROL 1 divided by SROL2 is greater than 2.0. In an alternative embodiment, not illustrated, SROL 2 is greater than SROL 1.

In one embodiment, the first damping element 702A is made of the same material as the second damping element 702B and thus has the same hardness. In an additional embodiment, the first damping element 702A is made of a material which has a greater hardness than the material of the second damping element 702B. In an alternative embodiment, the material of the first damping element 702A has a lower modulus than the material of the second damping element 702B. In one embodiment, the first damping element 702A has a Shore A 50 durometer and the second damping element has a Shore A 10 durometer. In one embodiment, the first damping element 702A has a Shore A durometer greater than 25 and the second damping element has a Shore A durometer less than 25.

It should be noted that the first damping element could be housed, structured, or supported similarly to the second damping element and also the second damping element could be housed, structured, or supported similarly to the first damping element. Additionally, the first damping element and second damping element could be housed, structured, or supported in any fashion described throughout this disclosure.

Figure 24:
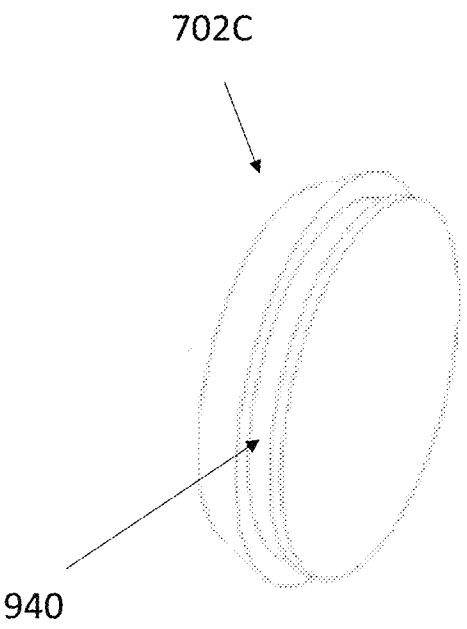
FIG. 24 depicts the second damping element illustrated in FIG. 23.
Figure 23:
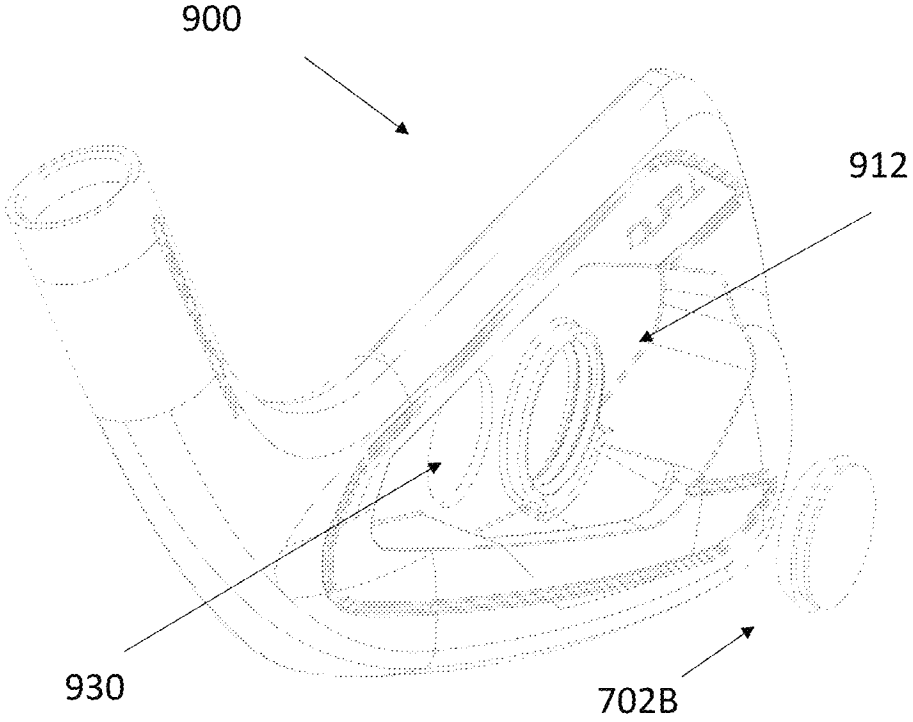
FIG. 23 depicts a perspective view of golf club head and an additional embodiment of the second damping element.
Figure 25:
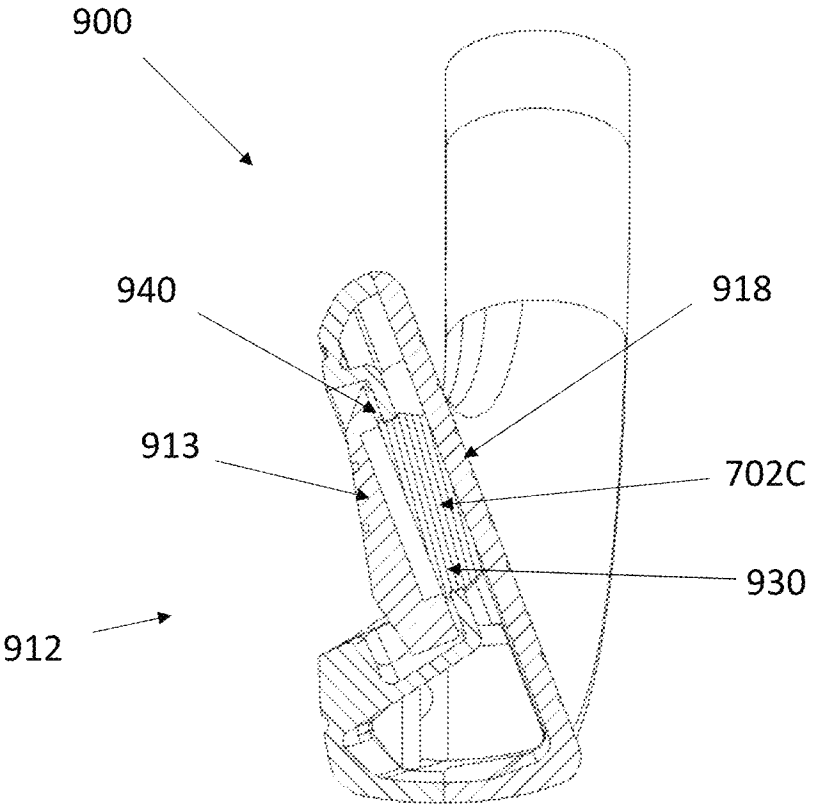
FIG. 25 depicts a section view F-F of the golf club head including the second damping element illustrated in FIGS. 23 and 24.

FIG. 23 depicts a perspective view of golf club head 900 and an additional embodiment of the second damping element 702C. The second damping element 702C is illustrated in an exploded fashion behind the golf club head 900. FIG. 24 depicts the second damping element 702C illustrated in FIG. 23. FIG. 25 depicts a section view F-F of the golf club head 900 including the second damping element 702C illustrated in FIGS. 23 and 24. The back portion 912 of the golf club head 900 includes an aperture 930 configured to receive the second damping element 702C, or alternatively the second damping element 702B. The second damping element 702C, as illustrated in FIGS. 23-25, includes an annular groove 940 formed therein configured to engage the perimeter of the aperture 930 of the back portion 912 of the golf club head 900 and secure the second damping element 702C to the gold club head 900. Portions of the second damping element 702C can be configured to deform as the second damping element 702C is installed in the aperture 930 of the golf club head 900 until the groove 940 engages the aperture 930.

Additional embodiments of golf club heads will be described below which incorporate various damping elements, many of them applied to the back surface of the striking face. The damping elements described below can include any of the damping elements described herein, including their materials, properties, geometry, and features, as well as the additional details which will be described below. The damping elements help reduce vibrations and improve the sound produced by the golf club head when it strikes a golf ball by making it more pleasing to the golfer's ear.

Figure 27:
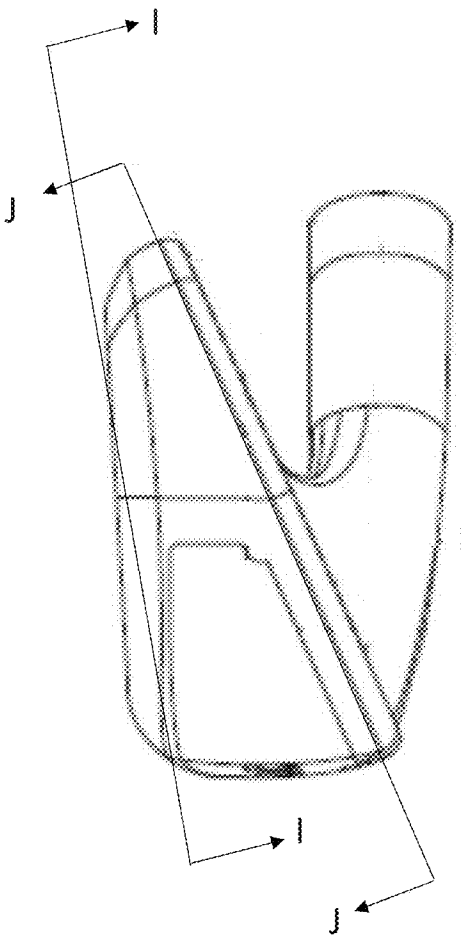
FIG. 27 depicts a side view of the golf club head of FIG. 26.
Figure 26:
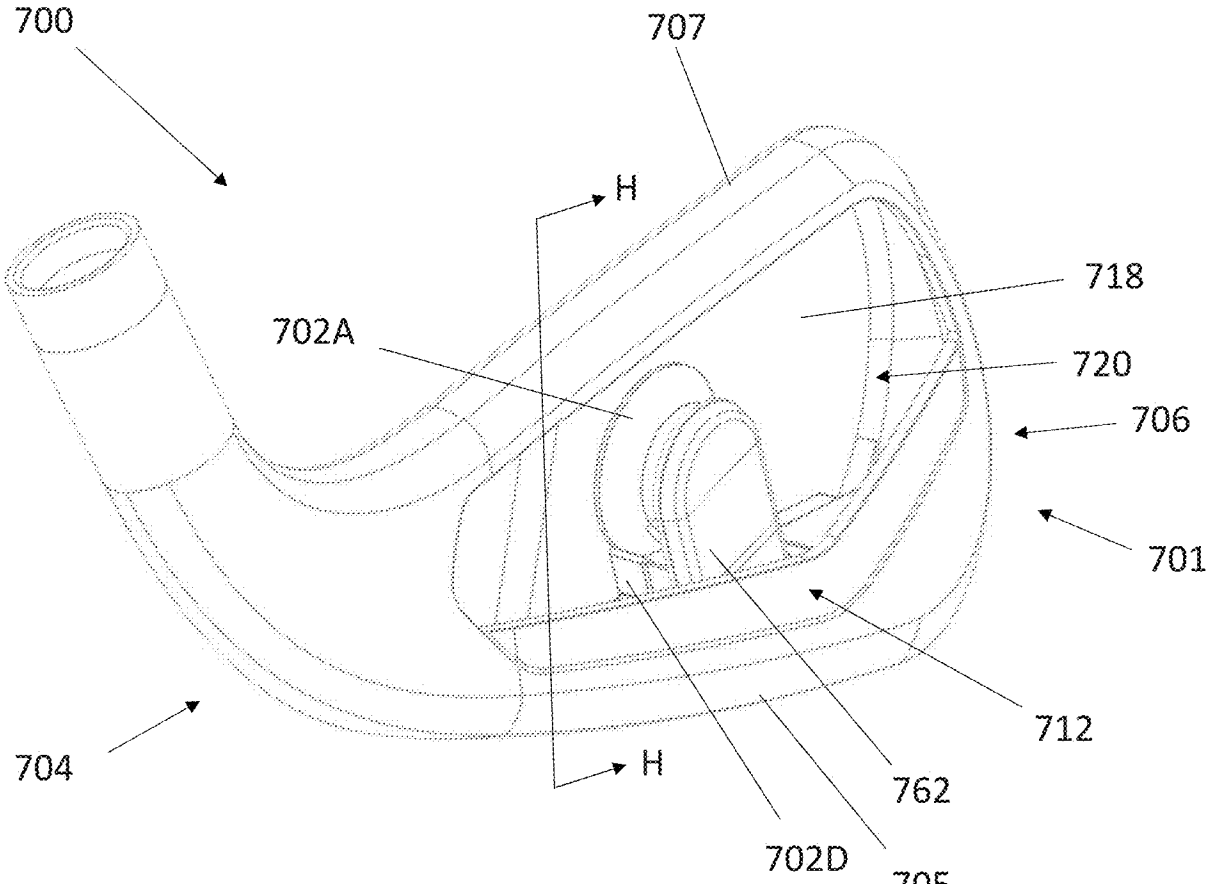
FIG. 26 depicts a perspective view of an additional embodiment of a golf club head.
Figure 29:
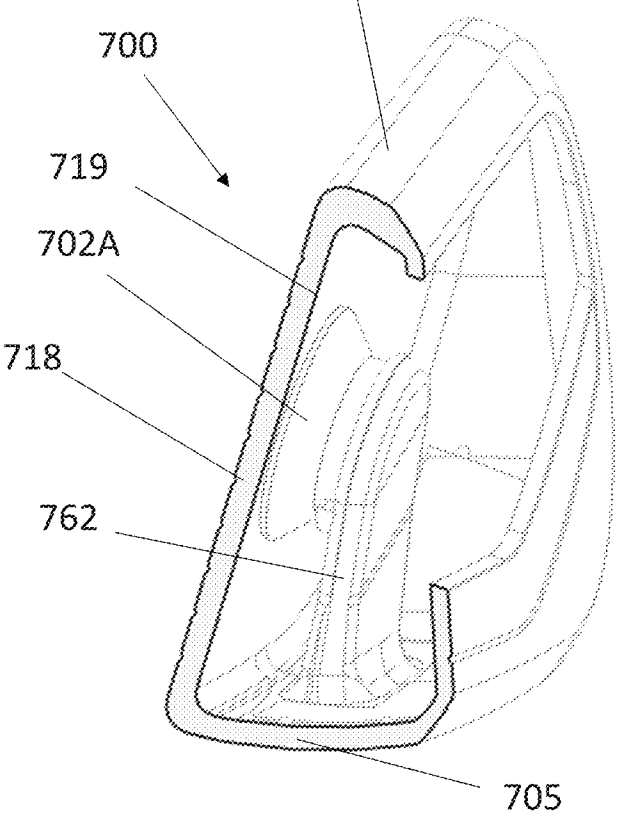
FIG. 29 depicts a section view H-H of the golf club head of FIG. 26 missing the weight member and the second damping element.
Figure 28:
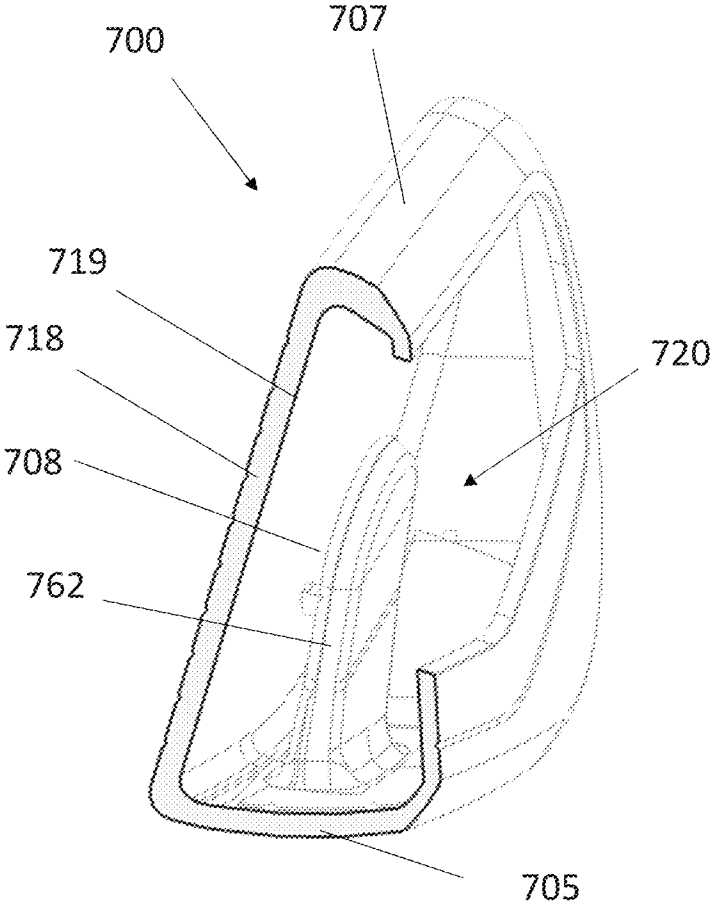
FIG. 28 depicts a section view H-H of the golf club head of FIG. 26 missing the weight member, the second damping element, and the first damping element.
Figure 31:
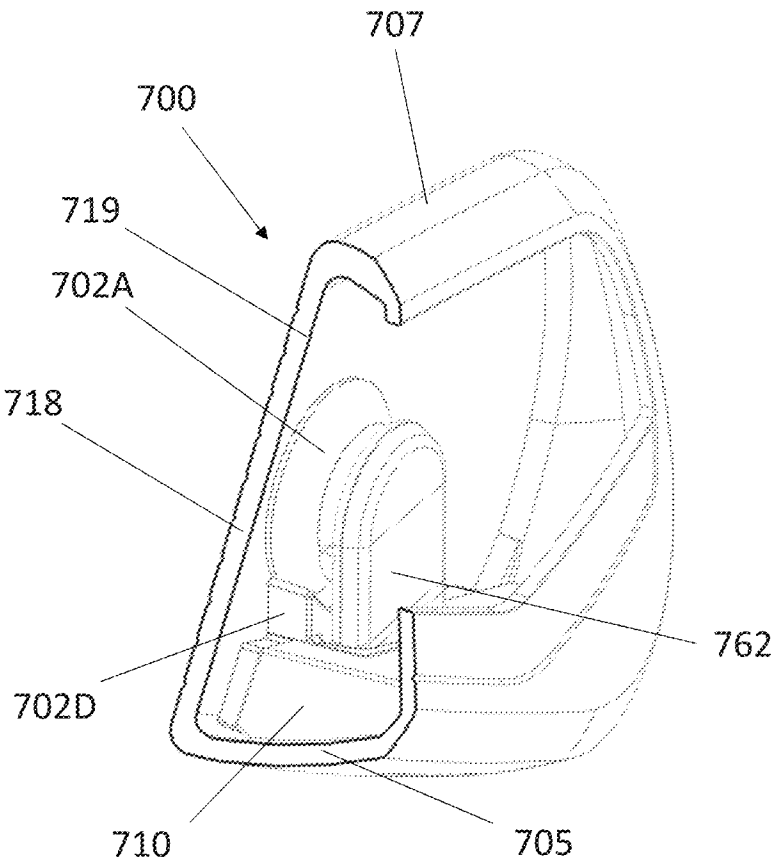
FIG. 31 depicts a section view H-H of the golf club head of FIG. 26.
Figure 30:
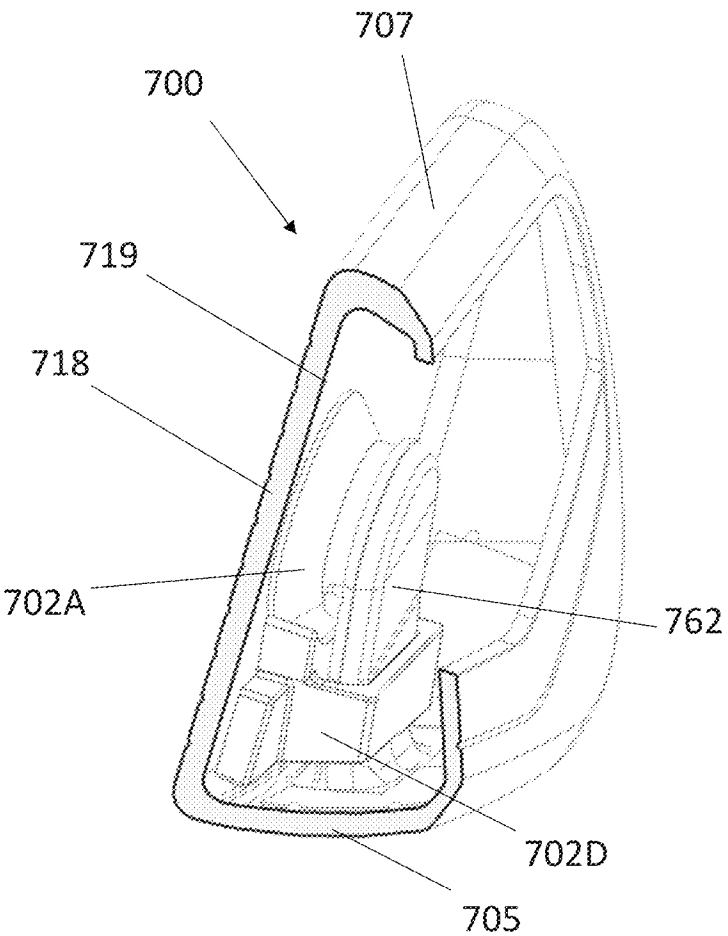
FIG. 30 depicts a section view H-H of the golf club head of FIG. 26 missing the weight member.
Figure 32:
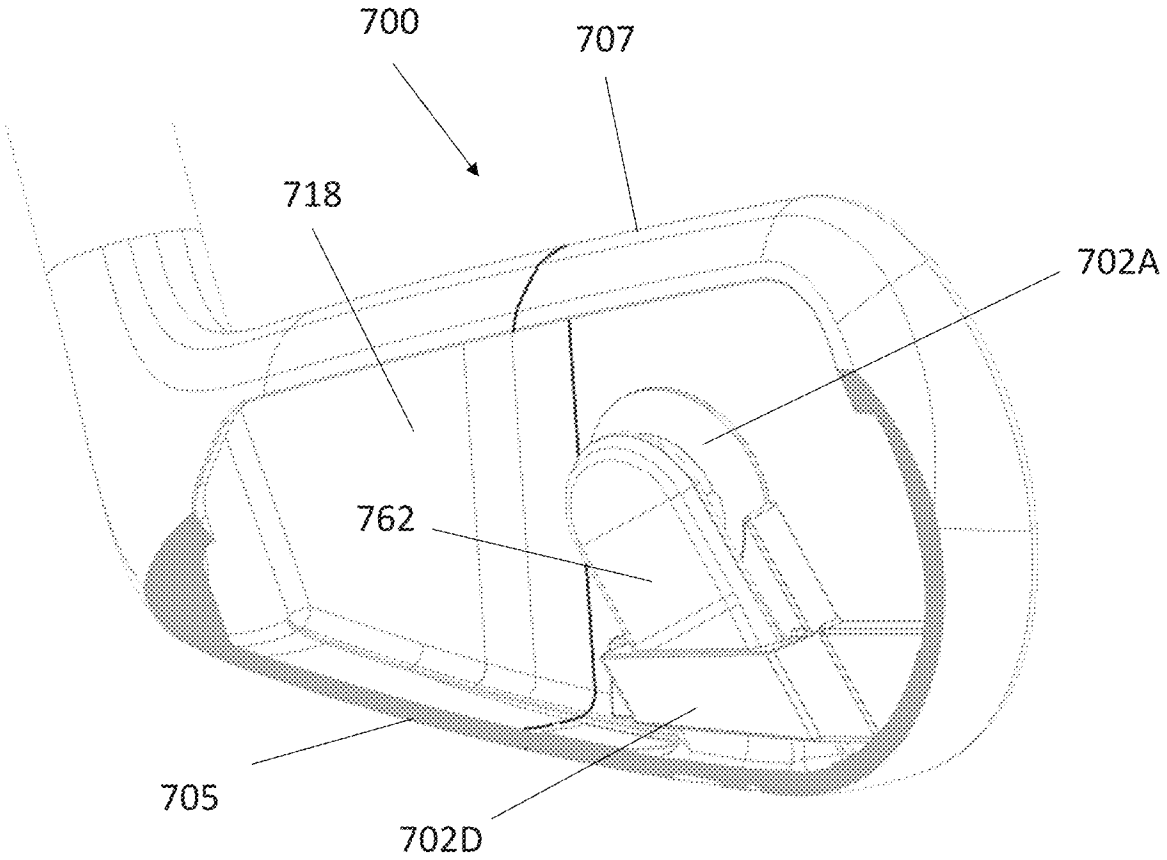
FIG. 32 depicts a section view I-I of the golf club head of FIG. 27 missing the weight member.
Figure 33:
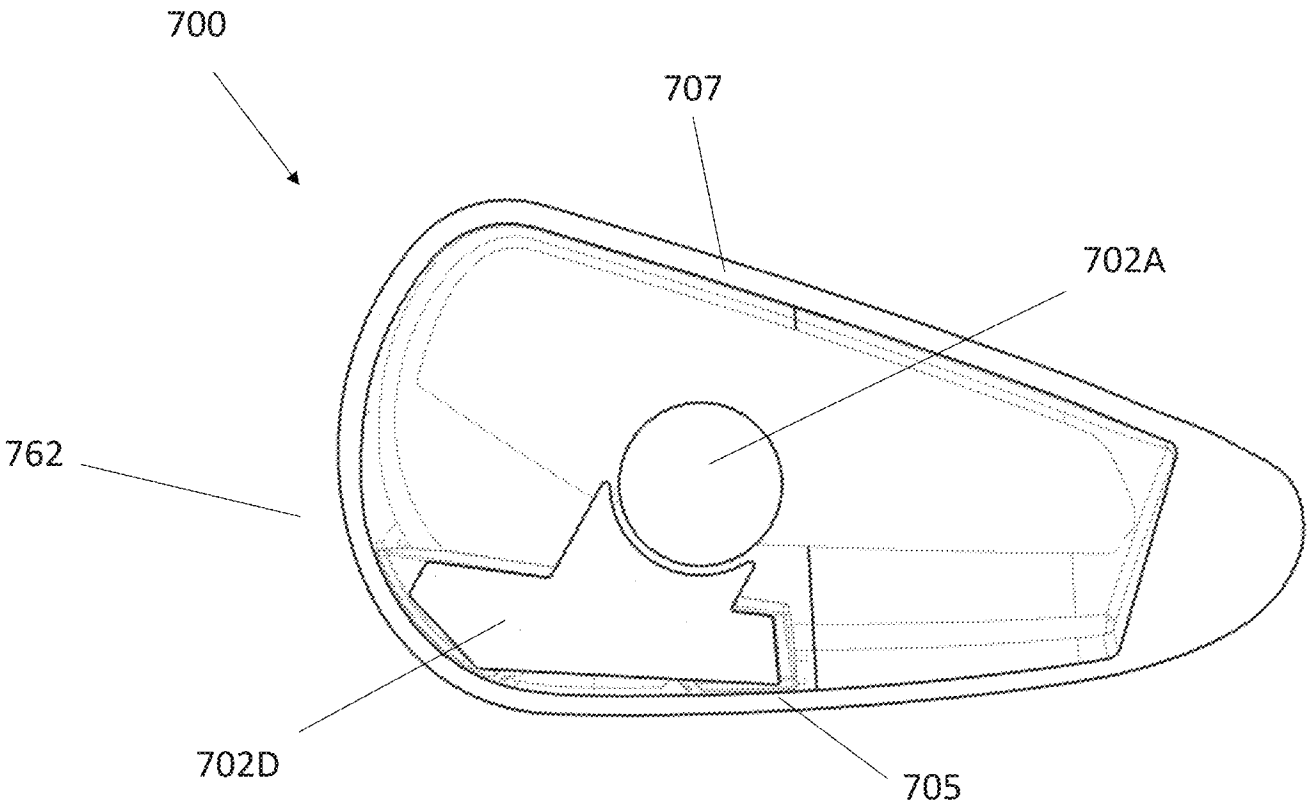
FIG. 33 depicts a section view J-J of the golf club head of FIG. 27.
Figure 35:
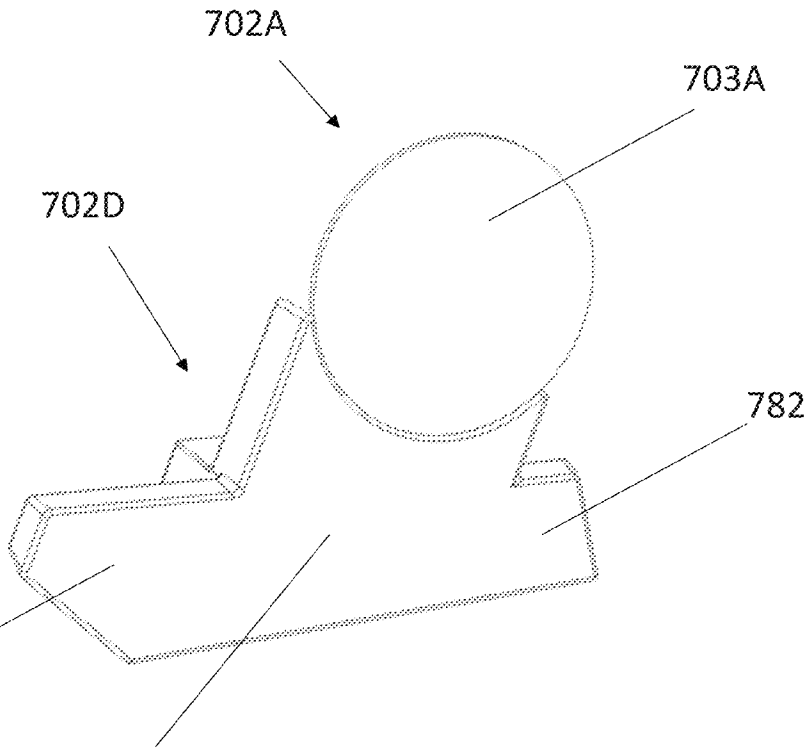
FIG. 35 depicts an additional perspective view of the first damping element and second damping element of the golf club head of FIG. 26.
Figure 34:
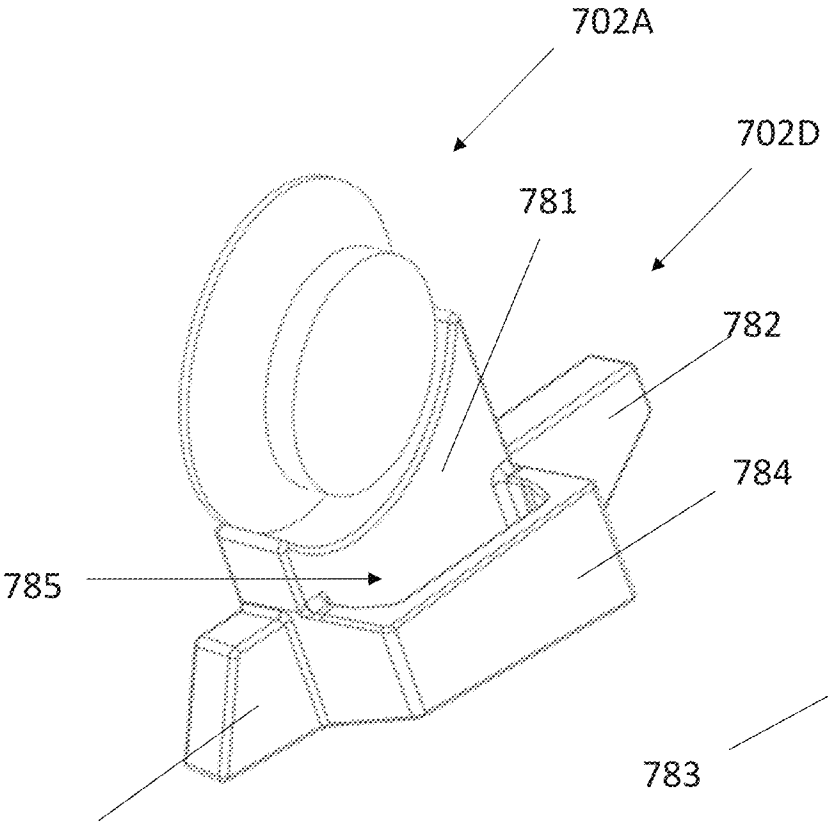
FIG. 34 depicts a perspective view of the first damping element and second damping element of the golf club head of FIG. 26.
Figure 37:
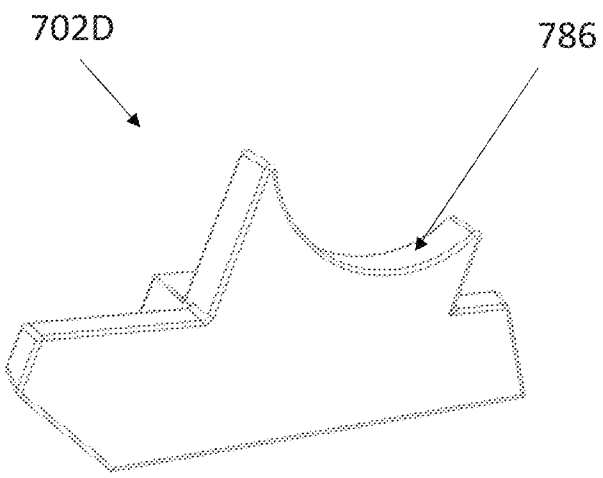
FIG. 37 depicts an additional perspective view of the second damping element of the golf club head of FIG. 26.
Figure 36:
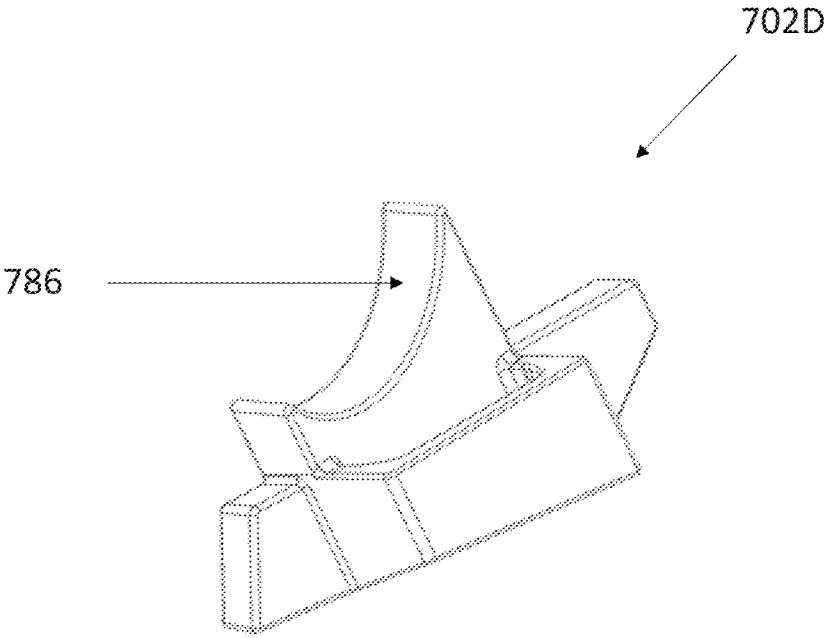
FIG. 36 depicts a perspective view of the second damping element of the golf club head of FIG. 26.

FIGS. 26-33 depict an additional embodiment of a golf club head 700 having a first damping element 702A and a second damping element 702D. FIG. 26 depicts a perspective view of the golf club head 700. FIG. 27 depicts a side view of the golf club head 700 of FIG. 26. FIG. 28 depicts a section view H-H of the golf club head 700 of FIG. 26 missing the weight member 710, the second damping element 702D, and the first damping element 702A. FIG. 29 depicts a section view H-H of the golf club head 700 of FIG. 26 missing the weight member 710 and the second damping element 702D. FIG. 30 depicts a section view H-H of the golf club head 700 of FIG. 26 missing the weight member 710. FIG. 31 depicts a section view H-H of the golf club head 700 of FIG. 26. FIG. 32 depicts a section view I-I of the golf club head 700 of FIG. 27 missing the weight member 710. FIG. 33 depicts a section view J-J of the golf club head 700 of FIG. 27. FIGS. 34 and 35 depict perspective views of the first damping element 702A and second damping element 702D. FIGS. 36 and 37 depict perspective views of the second damping element 702D.

The golf club head 700 illustrated in FIGS. 26-33 is an iron having a cavity back construction and includes a periphery portion 701 surrounding and extending rearward from the striking face 718. The periphery portion 701 includes the sole 705, the toe 706, and the topline 707. The periphery portion 701 can also include a weight member 710. The periphery portion can also include a back portion 712, which may partially enclose the cavity 720, as illustrated in FIG. 26. In other embodiments, the back portion can substantially enclose the cavity, as illustrated in FIG. 15A. The periphery portion 701 of the golf club head 700 can include a cantilever support arm affixed to and extending from the sole 705. As illustrated in FIG. 28, the support arm 762 can extend substantially parallel to the striking face 718. As illustrated in FIG. 29, the golf club head 700 can include a first damping element 702A disposed between the rear surface 719 of the striking face 718 and the cantilever support arm 762. As illustrated in FIG. 26, the first damping element 702A includes a front surface 703A which contacts a central portion of the striking face 718. The damping element 702A can support the striking face 718 and offer damping properties, as described above. In other embodiments, the back portion can substantially enclose the cavity, as illustrated in FIG. 15A. In such embodiments, the first damping element can be disposed between the rear surface of the striking face and the back portion.

As illustrated in FIGS. 26 and 30-33, the golf club head can include a second damping element 702D, which is shown along with the first damping element 702A in FIGS. 34 and 35, and in isolation in FIGS. 36 and 37. As illustrated, a portion of the second damping element 702D can be disposed between the rear surface 719 of the striking face 718 and the support arm 762. The second damping element 702D can be located further from the geometric center of the striking face 718 than the first damping element 702A. More specifically, the second damping element 702D can be located proximate the sole 705. The second damping element 702D includes a front surface 703B in contact with the rear surface 719 of the striking face 718 and a rear surface 781 in contact with the support arm 762. The second damping element 702D can include a toe portion 782 which extends toewards of the support arm 762. The second damping element 702D can include a heel portion 783 which extends heelwards of the support arm 762. The second damping element 702D can include a rear portion 784 which extends around the support arm 762, forming a cavity 785 configured to accept the support arm. In some embodiments, as illustrated in FIG. 31, the golf club head can include a weight member 710 located and spaced rearward of the support arm, and the rear portion 784 of the second damping element 702D can reside between the weight member 710 and the support arm 762. The weight member 710 can be formed integrally with another portion of the golf club head 700, or can be a different material bonded to the golf club head 700. The second damping element 702D can include a relief 786 formed in the top of the damping element 702D configured to complement the shape of the first damping element 702A. The second damping element 702D can be formed of an elastomeric material that is deformable and offers damping properties. In one embodiment, the first damping element 702A has a higher elastic modulus than the second damping element 702D. In an alternative embodiment, the second damping element 702D has a higher elastic modulus than the first damping element 702A. In yet another embodiment, the first damping element 702A has a substantially similar elastic modulus as the second damping element 702D.

In addition to the materials disclosed already, the damping elements, and more specifically the second damping element 702D can comprise a damping foam. In one embodiment, the second damping element 702D may be formed separately from the golf club head and subsequently installed. In another embodiment, the second damping element 702D can be co-molded with the golf club head so as to specifically fit the geometry of that particular club. In other embodiments, the second damping element 702D may be specifically chosen or formed to meet the specific geometry of a particular golf club head.

In an alternative embodiment, not illustrated, the first damping element 702A and second damping element 702D may be formed monolithically out of a single piece of material such that a single damping element includes the features of both the first and second damping elements. In yet another embodiment, more than one piece of material may comprise the first and/or second damping element.

Figure 39:
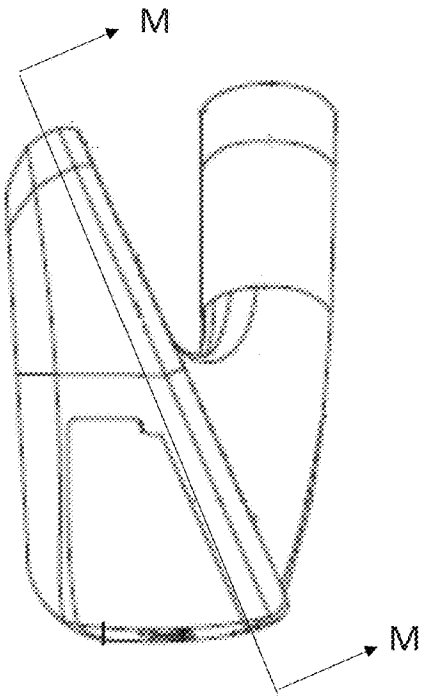
FIG. 39 depicts a side view of the golf club head of FIG. 38.
Figure 38:
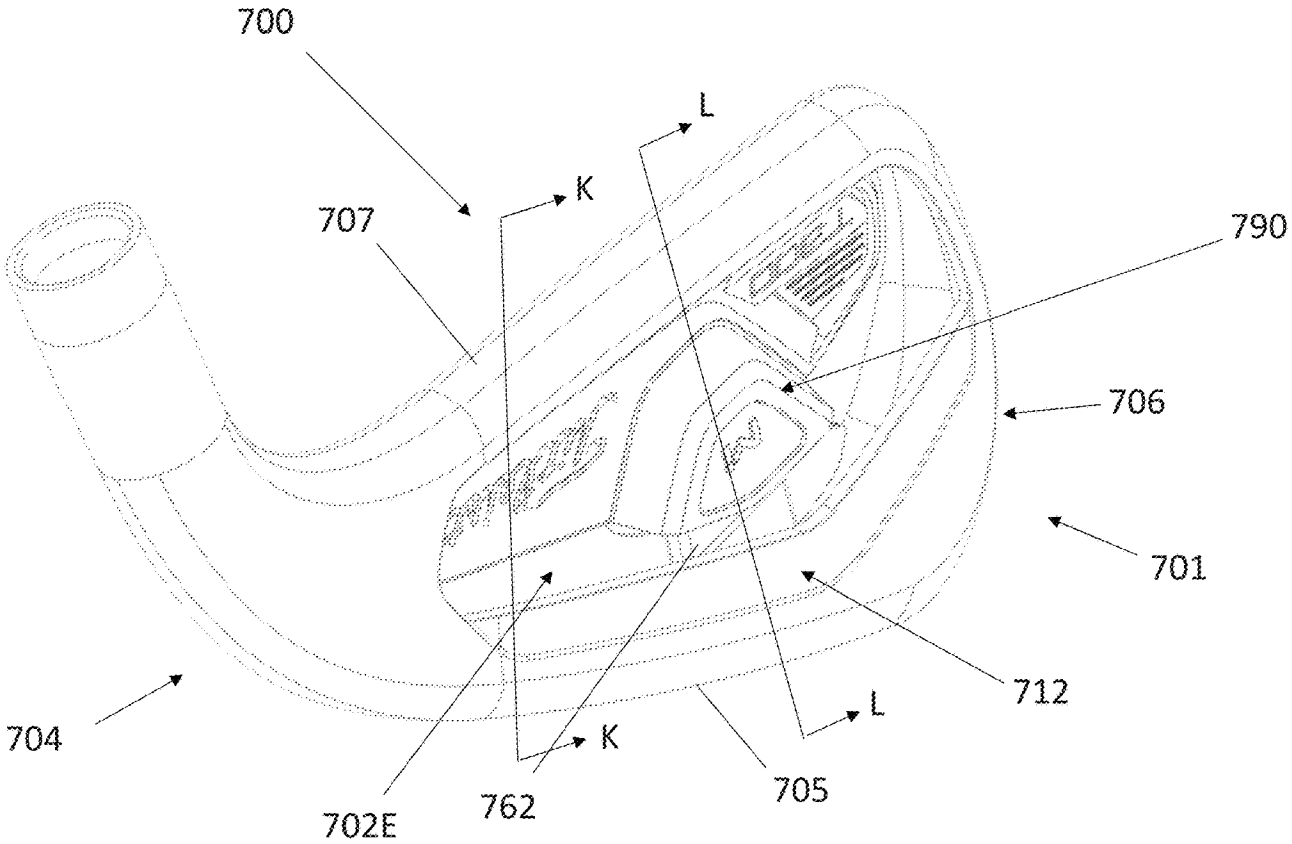
FIG. 38 depicts a perspective view of an additional embodiment of a golf club head.
Figure 40:
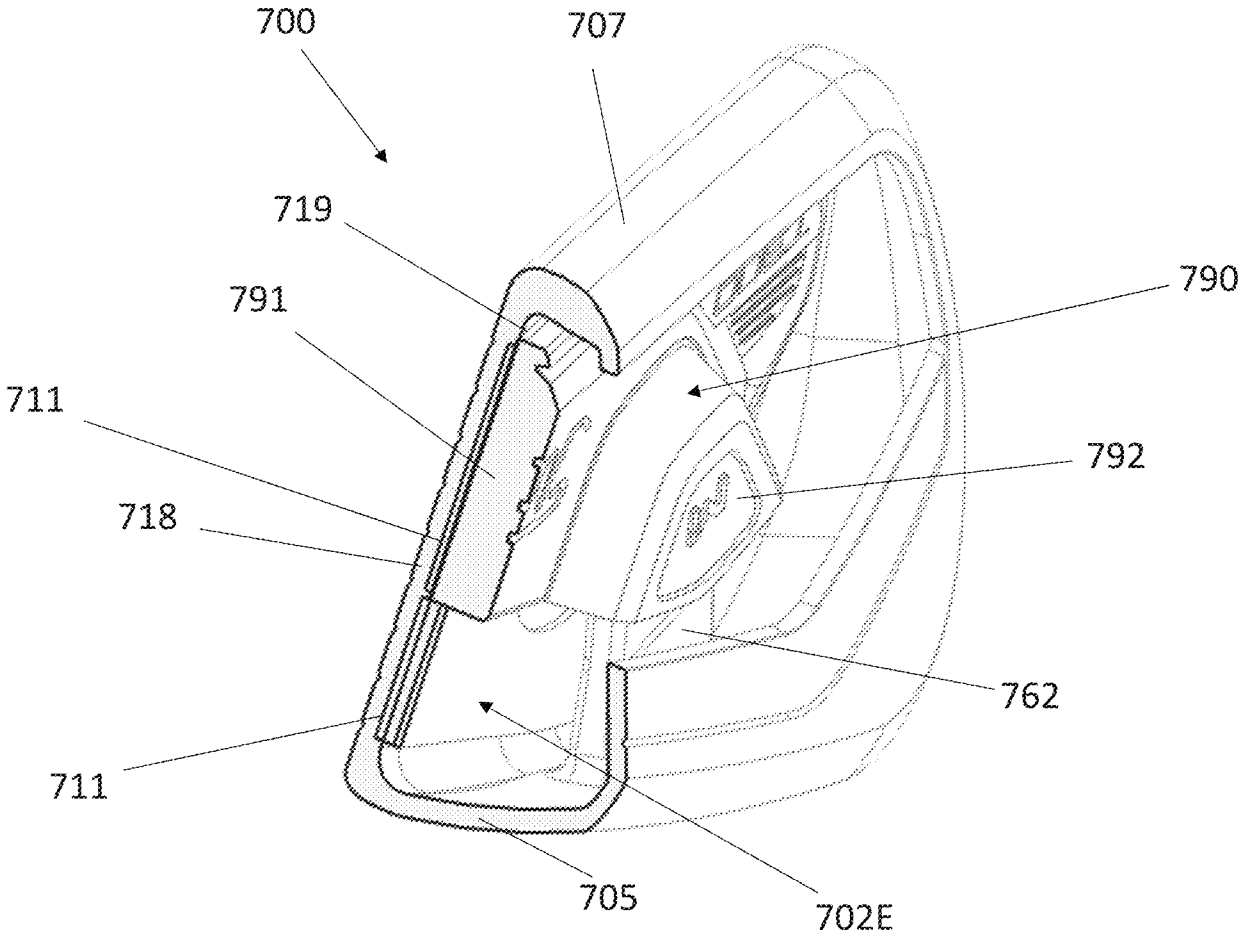
FIG. 40 depicts a section view K-K of the golf club head of FIG. 38.
Figure 42:
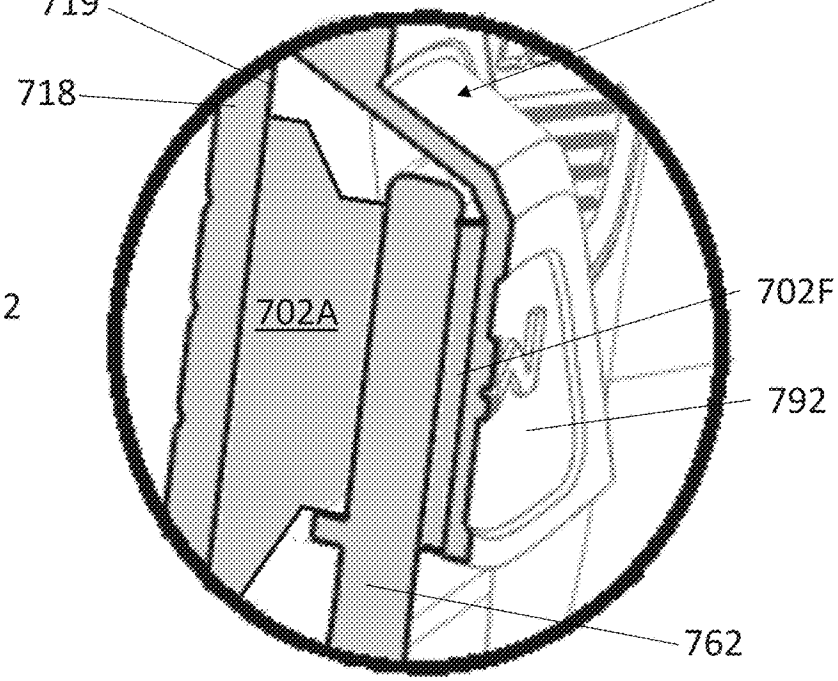
FIG. 42 depicts a detail view of FIG. 41.
Figure 41:
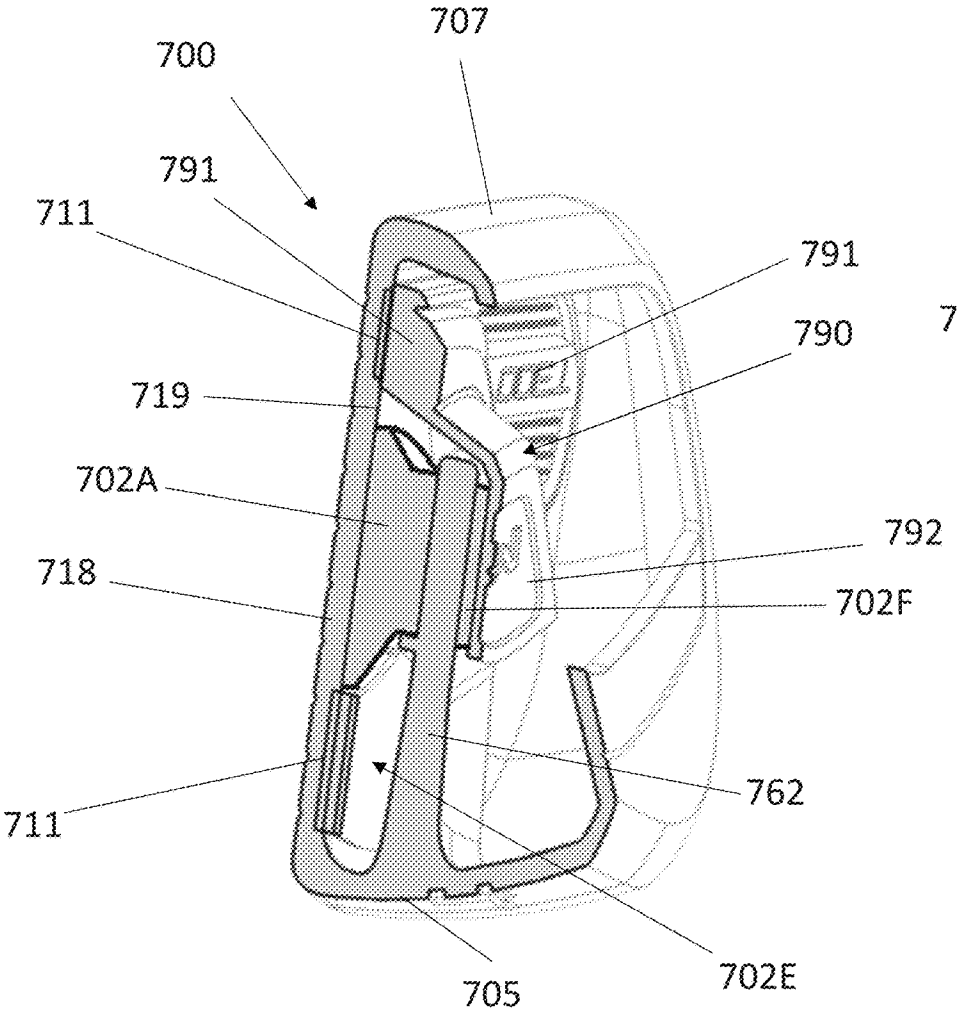
FIG. 41 depicts a section view L-L of the golf club head of FIG. 38.
Figure 43:
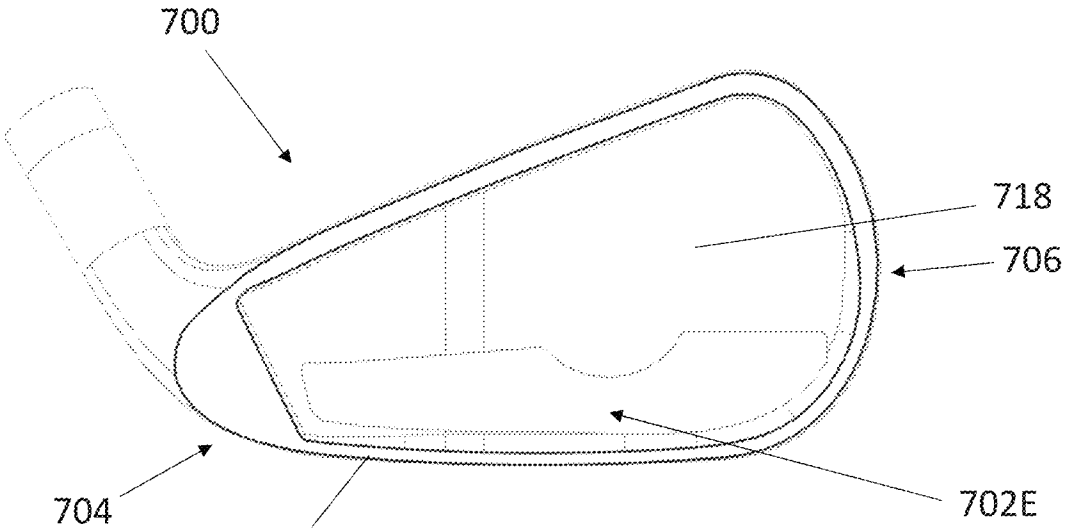
FIG. 43 depicts a section view M-M of the golf club head of FIG. 38 missing the first damping element.
Figure 44:
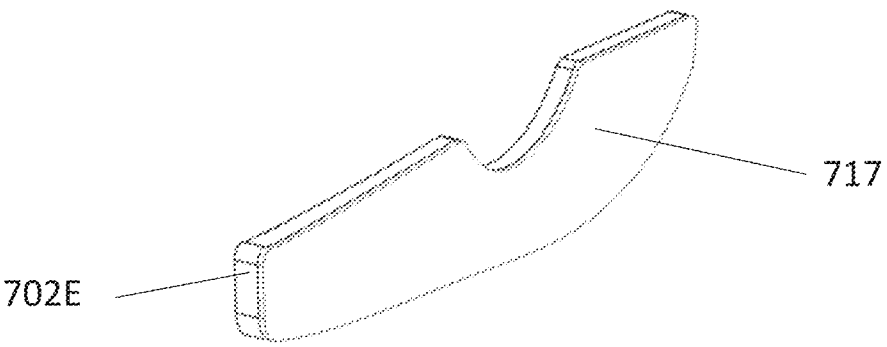
FIG. 44 depicts a perspective view of the second damping element of the golf club head of FIG. 38.

FIGS. 38-42 depict an additional embodiment of a golf club head 700 having a first damping element 702A and a second damping element 702E. FIG. 38 depicts a perspective view of the golf club head 700. FIG. 39 depicts a side view of the golf club head 700 of FIG. 38. FIG. 40 depicts a section view K-K of the golf club head 700 of FIG. 38. FIG. 41 depicts a section view L-L of the golf club head 700 of FIG. 38. FIG. 42 depicts a detail view of FIG. 41. FIG. 43 depicts a section view M-M of the golf club head 700 of FIG. 38 missing the first damping element 702A. FIG. 44 depicts a perspective view of the second damping element 702E of the golf club head 700 of FIG. 38.

The golf club head 700 illustrated in FIGS. 38-43 includes a first damping element 702A similar to the one described above and illustrated in FIGS. 26-33 and a different embodiment of a second damping element 702E than the golf club head illustrated in FIGS. 26-33. The second damping element 702E can be affixed to the rear surface 719 of the striking face 718. In some embodiments, the second damping element 702E can be affixed to the striking face via an adhesive 711. The adhesive 711 could be double sided tape, such as 3M Very High Bond tape, epoxy, glue, or a mechanical form of adhesion such as a fastener, rivet, or backing plate. As illustrated, at least a portion of the second damping element 702E can be located below the first damping element 702A. The second damping element 702E can extend toeward of the first damping element 702A and heelward of the first damping element 702A, and may extend substantially from the heel 704 to the toe 706, as illustrated in FIG. 43. The second damping element 702E can have a relief configured to complement the shape of the first damping element 702A. In an alternative embodiment the second damping element 702E may cover a majority of the rear surface 719 of said striking face 718 which isn't covered by the first damping element 702A.

As illustrated in FIG. 44, a cover 717 can be affixed to the outside surface of the second damping element 702E. The outside surface of the second damping element 702E is located on an opposite side of the second damping element 702E as the striking face 718. In one embodiment, the thickness of the cover 717 is less than the thickness of the second damping element 702E. In one embodiment, the elastic modulus of the cover 717 is higher than the elastic modulus of the second damping element 702E. In one embodiment, the hardness of the cover 717 is higher than the elastic modulus of the second damping element 702E.

The golf club head 700 of FIGS. 38-43 also includes a medallion 790 which improves the appearance of the gold club head 700. Additionally, the medallion 790 can add to the damping qualities of the golf club head 700. As illustrated in FIGS. 38, 40, 41, and 42, a first portion 791 of the medallion 790 is adhered to a rear surface 719 of the striking face 718 and a second portion 792 extends rearwards away from the striking face 718 and behind the support arm 762. In one embodiment, as illustrated in FIGS. 41 and 42, a third damping element 702F is disposed between a rear surface of the support arm 762 and the medallion 790.

Figure 46:
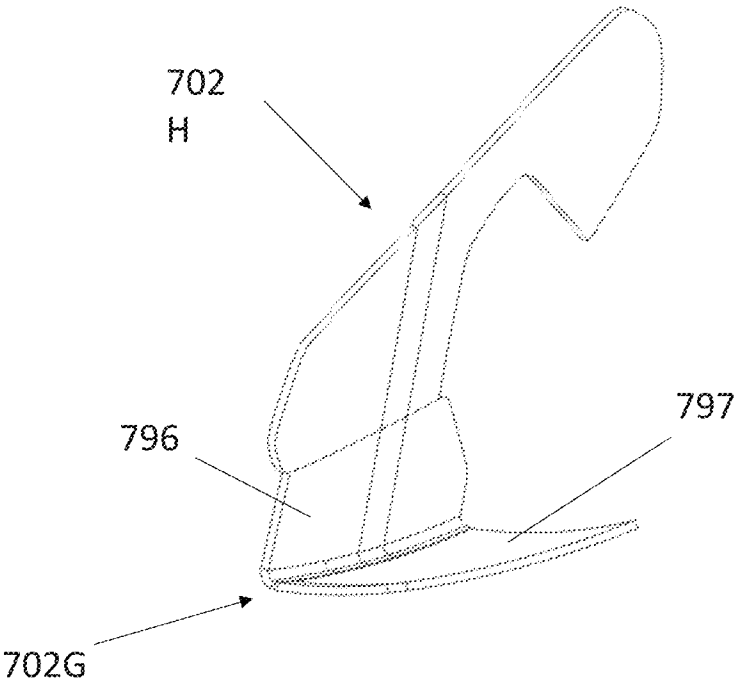
FIG. 46 depicts a perspective view of the second damping element and third damping element of the golf club head of FIG. 45.
Figure 45:
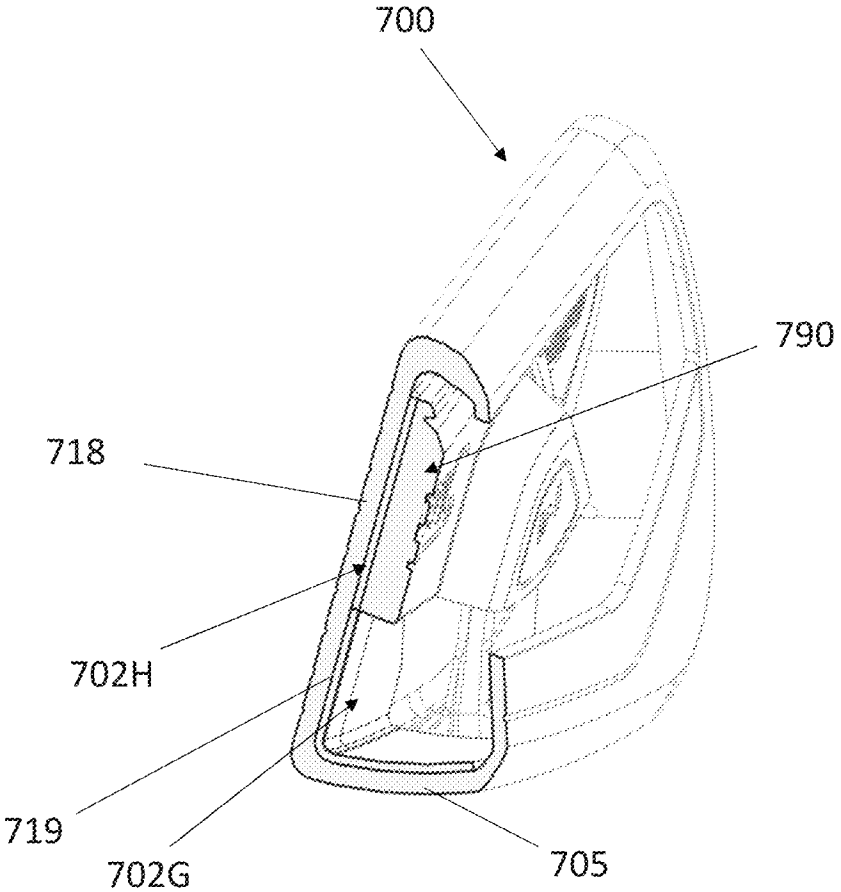
FIG. 45 depicts a section view of an additional embodiment of a golf club head.

FIG. 45 depicts a section view of an additional embodiment of the golf club head 700. FIG. 46 depicts a perspective view of the second damping element 702G and third damping element 702H of the golf club head 700 of FIG. 45. The golf club head 700 includes a first damping element hidden behind the medallion 790, a second damping element 702G and a third damping element 702H. The second damping element 702G is much like the damping element 702E of FIGS. 38-44 in that it has a first portion 796 which is disposed on the rear surface 719 of the striking face 718, except that it also has a second portion 797 which extends rearward from the striking face 718 along the sole 705 in this embodiment. In one embodiment, the golf club head 700 can also include a third damping element 702H, much like the second damping element 702F, except that it covers an upper portion of the rear surface 719 of the striking face 718. In one embodiment, the third damping element 702H is disposed between the rear surface 719 of the striking face 718 and the medallion 790. The third damping element 702H can include a relief configured to complement the shape of the first damping element 702A. In an alternative embodiment, not illustrated, the second damping element 702G and third damping element 702H may be formed monolithically out of a single piece of material such that a single damping element includes the features of both the second and third damping elements. In yet another embodiment, more than one piece of material may comprise the second and/or third damping element.

Additionally, each of the embodiments of golf club heads described herein, particularly in reference to FIGS. 26-46, may include the second damping elements and/or third damping elements described herein without including the first damping element. Additionally, any combination of damping elements described herein may be combined to form a single damping element combining the features of each damping element described herein.

One goal of the damping elements described herein is to dissipate energy of the golf club head after it strikes a golf ball. As the striking face and other portions of the golf club head vibrate, the damping element in contact with those surfaces can dissipate the energy. This can change the sound produced by the golf club head by reducing the loudness and/or duration of the sound produced when the golf club head strikes a golf ball. The damping elements described herein can be formed of a viscoelastic material. Tan $\delta$ represents the ratio of the viscous to elastic response of a viscoelastic material, which is the energy dissipation potential of the material. The greater Tan δ, the more dissipative the material. More specifically, Tan δ=E"/E', where E" is the loss modulus and represents Energy dissipated by the system, and E' is the storage modulus and represents Energy stored elastically by the system. Tan δ varies depending on temperature and the frequency of vibration. The damping elements described herein are preferably formed of a viscoelastic material which has a peak Tan δ between 3 kHz and 9 kHz within a temperature range of 20° C. to 50° C., and more preferably between 5 kHz and 7 kHz. In some embodiments, the damping elements may be formed of different viscoelastic materials, wherein one damping element has a Tan δ which peaks at a higher frequency than another. In reference to specifically to the golf club head 700 of FIGS. 26-37, the first damping element 702A is formed of a first viscoelastic material, the second damping element 702D is formed of a second viscoelastic material, and the Tan δ of the first viscoelastic material peaks at a first frequency, the Tan δ of the second viscoelastic material peaks at a second frequency, and the first frequency is less than the second frequency. This particular arrangement allows the first damping element to be better able to dampen the striking face vibrations and the second damping element to be better able to dampen the support arm vibrations.

Figure 47:
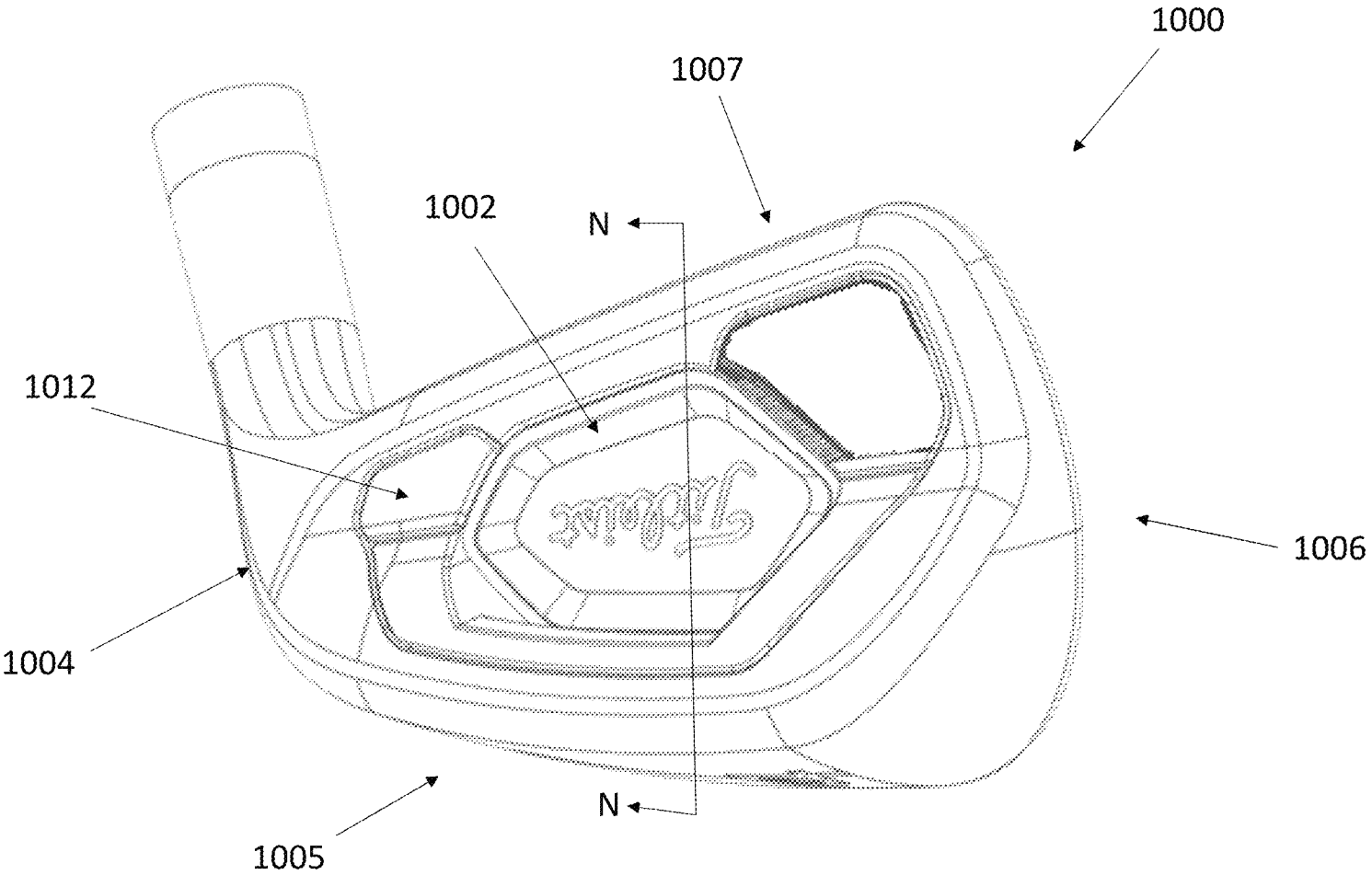
FIG. 47 depicts a perspective view of an additional embodiment of a golf club head.
Figure 49:
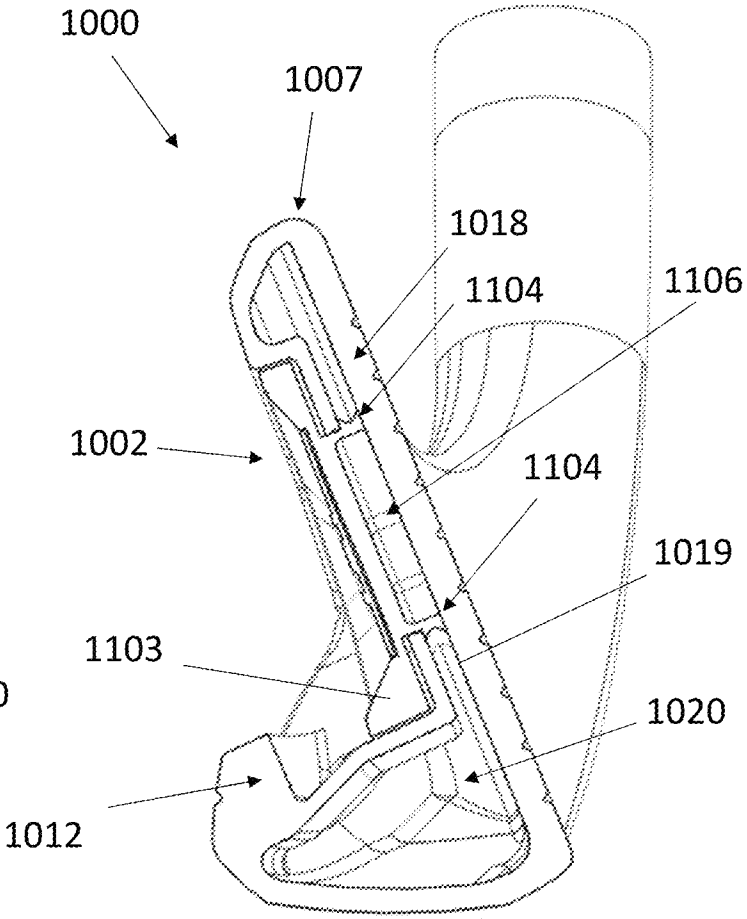
FIG. 49 depicts a side view of cross section N-N of the golf club head of FIG. 47.
Figure 48:
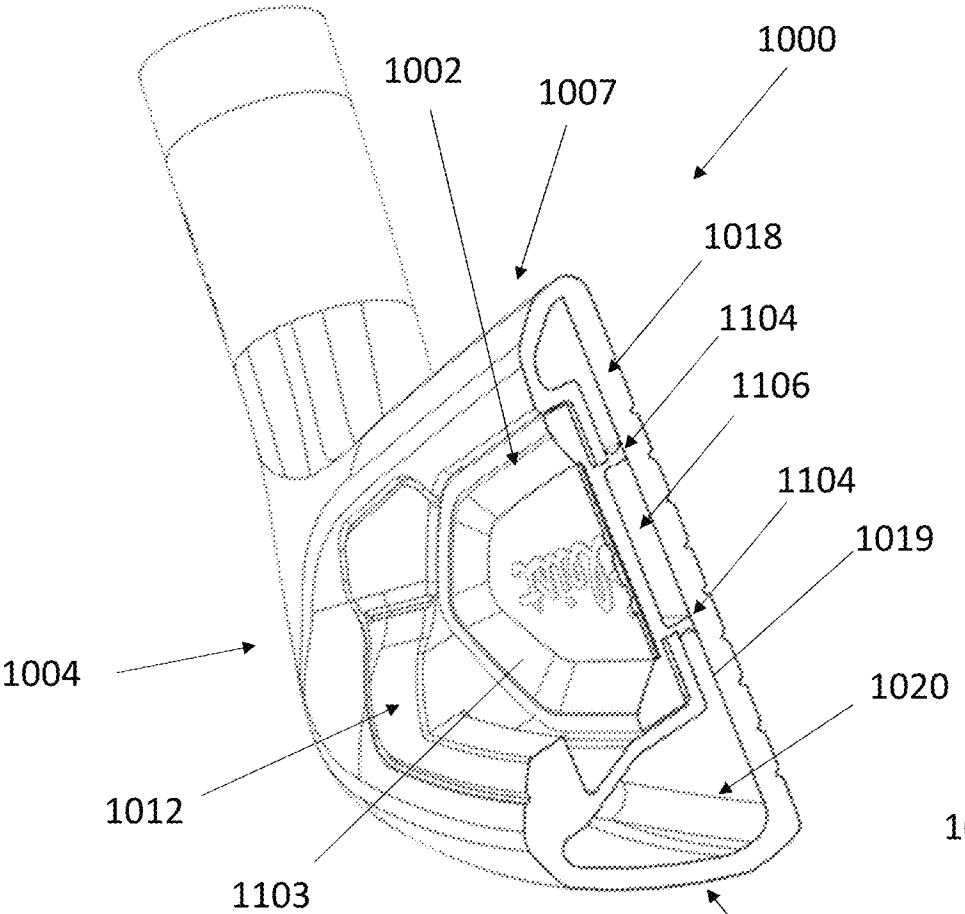
FIG. 48 depicts a perspective view of cross section N-N of the golf club head of FIG. 47.
Figure 50:
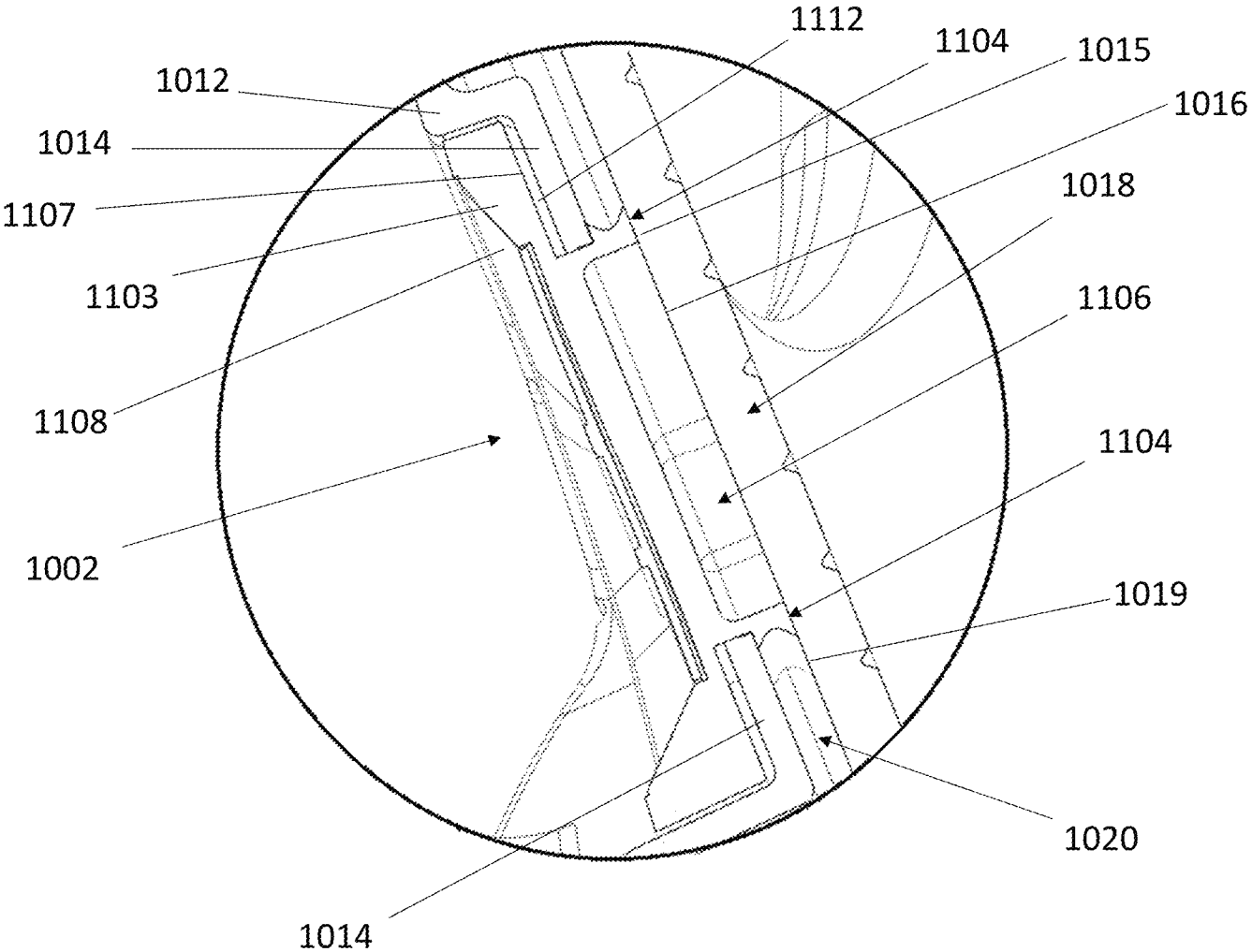
FIG. 50 depicts a detail view of the golf club head of FIG. 49.
Figure 51:
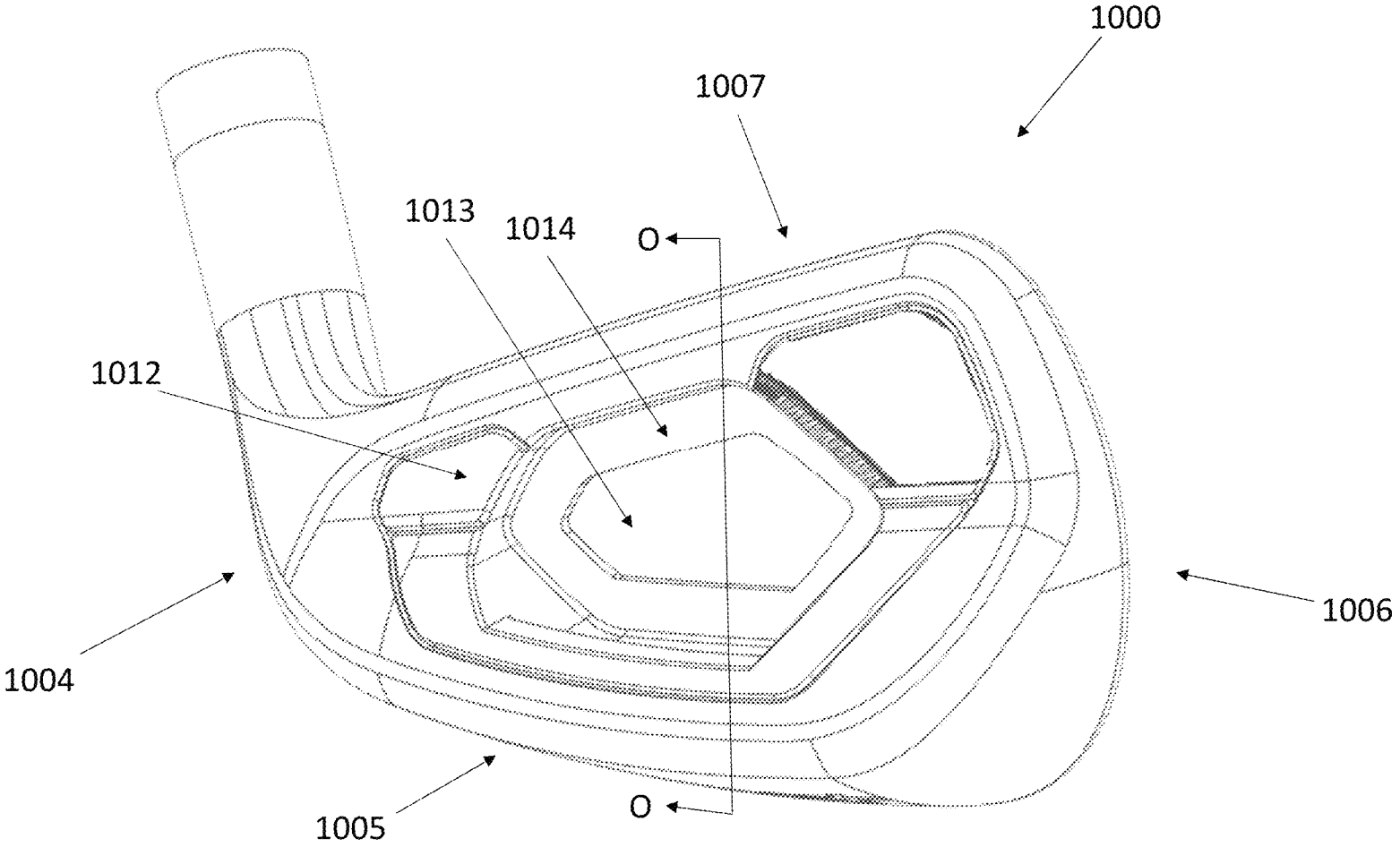
FIG. 51 depicts a perspective view of the golf club head of FIG. 47 missing the damping element.
Figure 53:
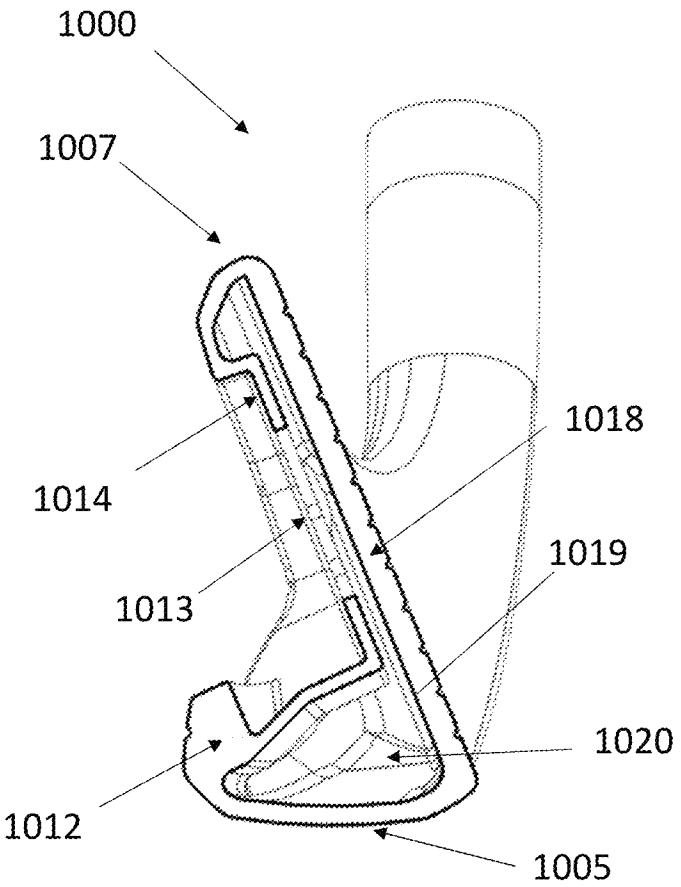
FIG. 53 depicts a side view of cross section O-O of the golf club head of FIG. 51.
Figure 52:
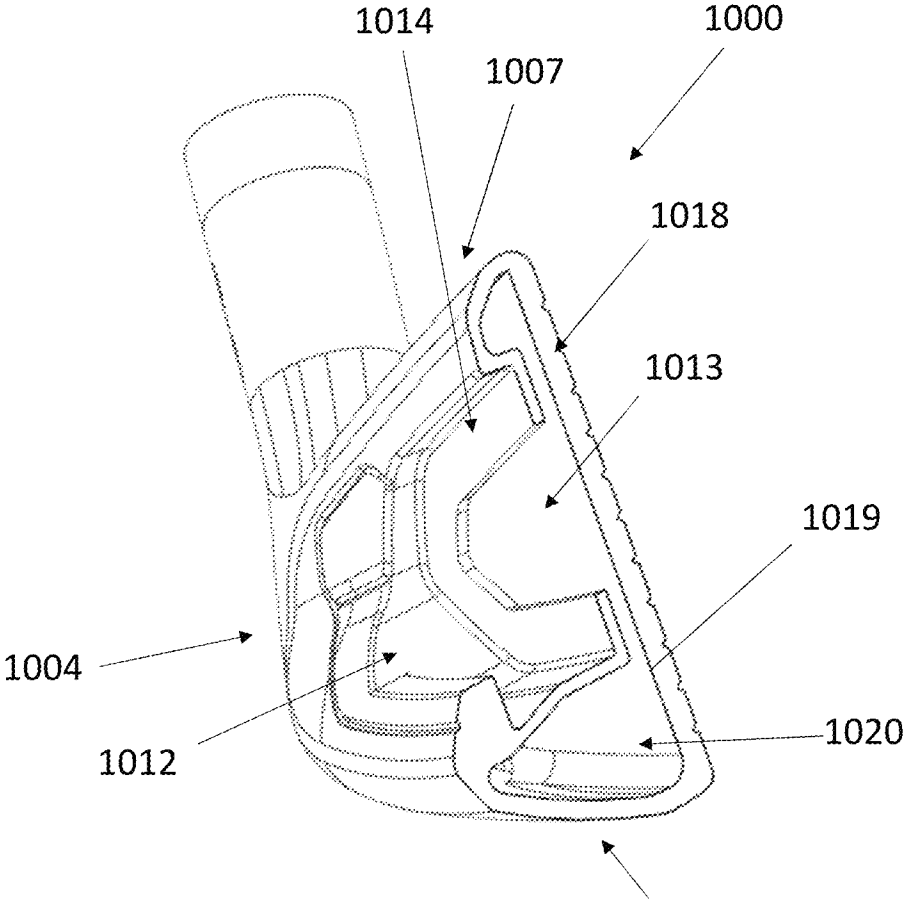
FIG. 52 depicts a perspective view of cross section O-O of the golf club head of FIG. 51.
Figure 55:
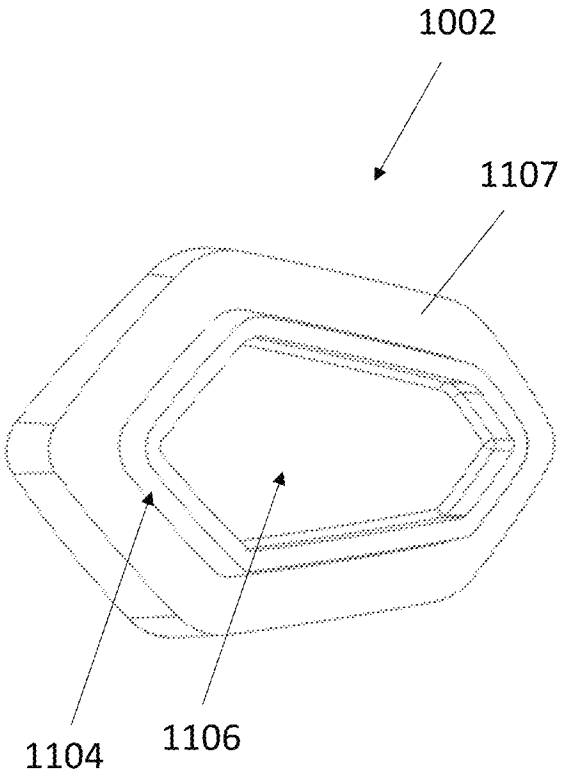
FIG. 55 depicts an additional perspective view of the damping element of the golf club head 1000 of FIG. 47.
Figure 54:
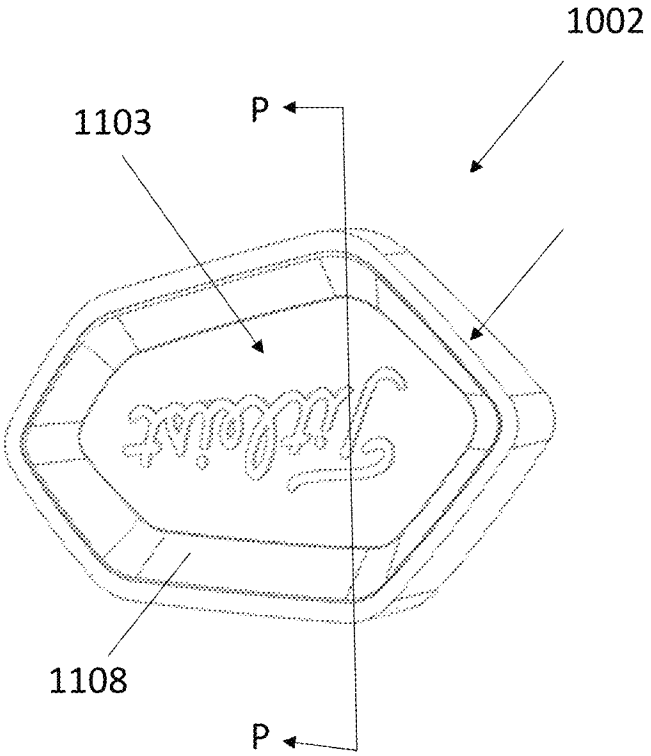
FIG. 54 depicts a perspective view of the damping element of the golf club head of FIG. 47.
Figure 57:
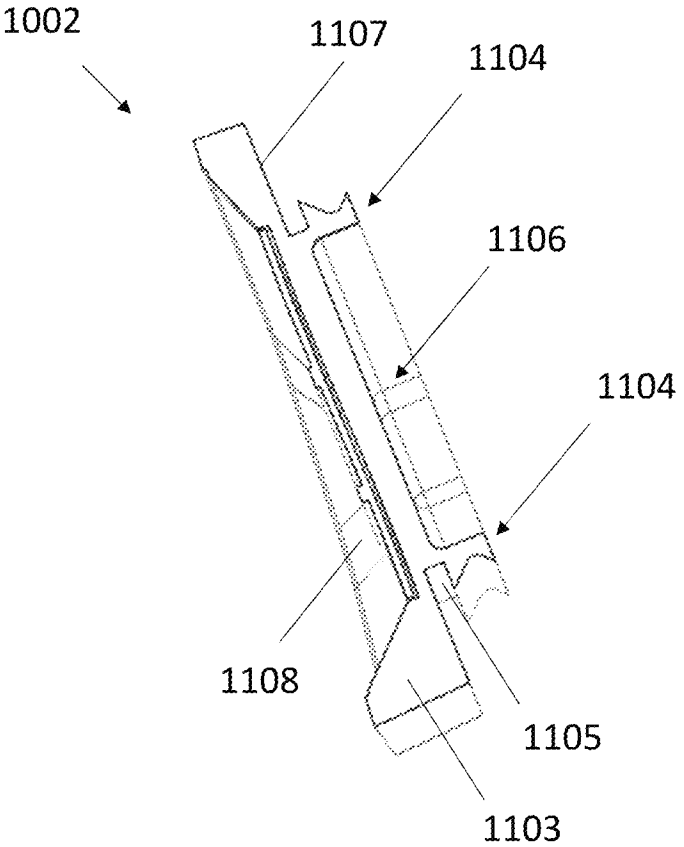
FIG. 57 depicts a side view of cross section P-P of the damping element of FIG. 54.
Figure 56:
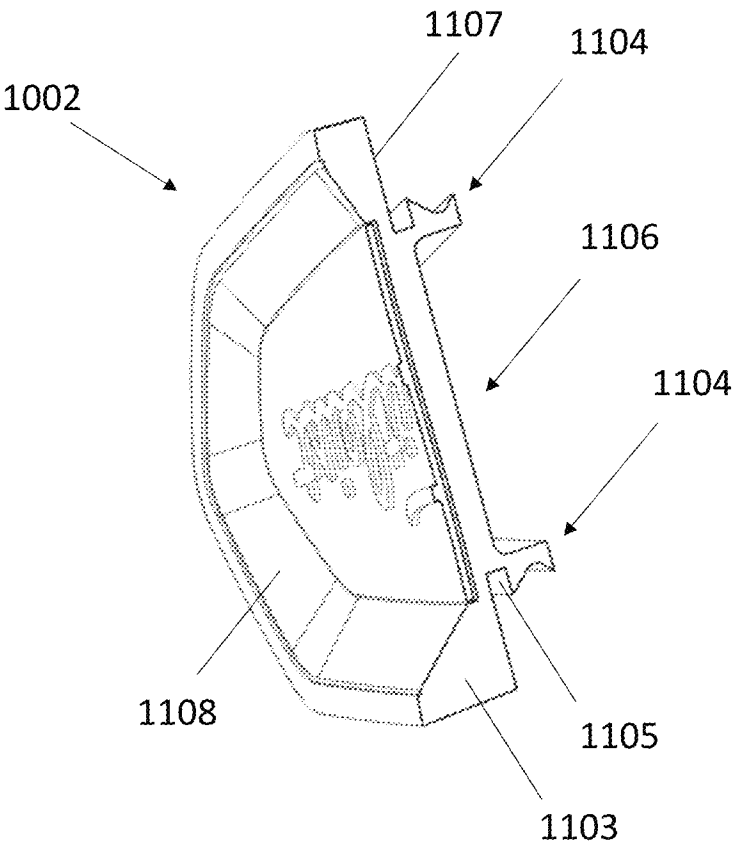
FIG. 56 depicts a perspective view of cross section P-P of the damping element of FIG. 54.
Figure 58:
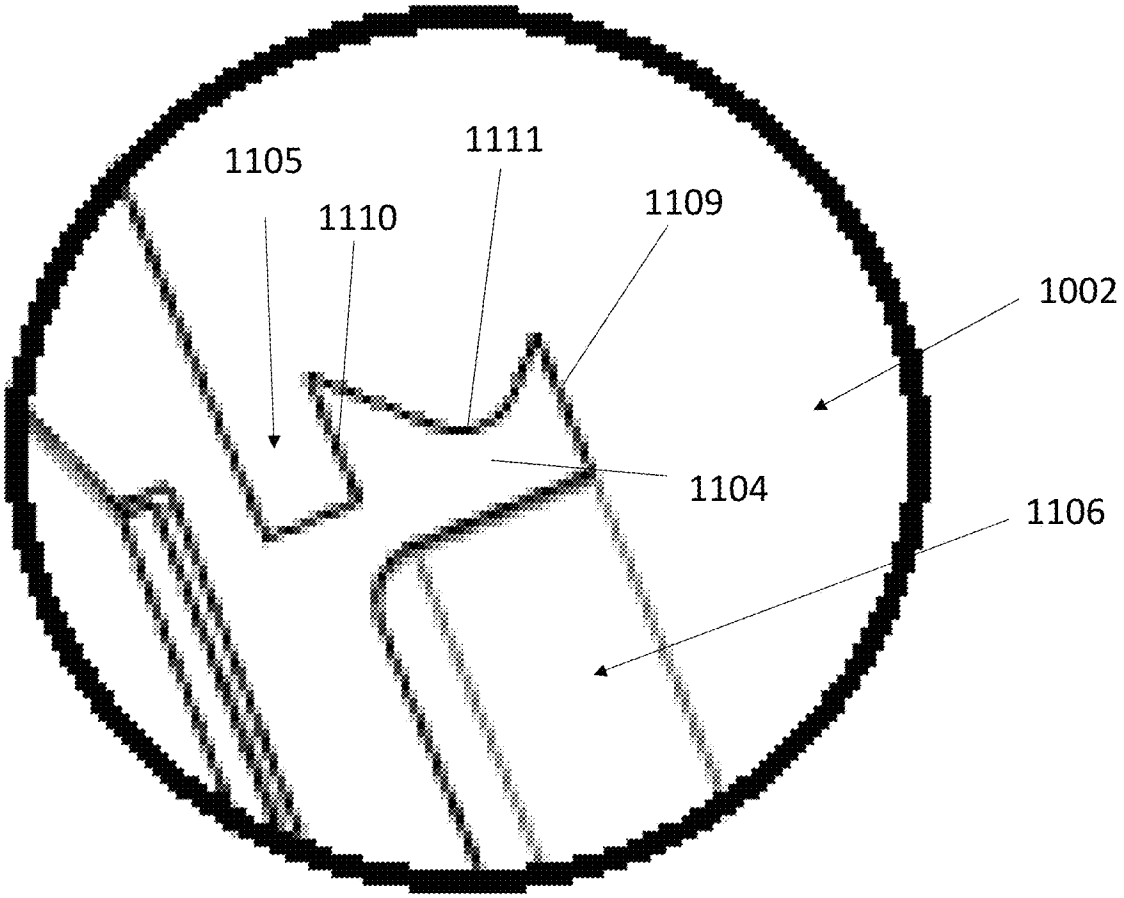
FIG. 58 depicts a detail view of the damping element of FIG. 57.

FIGS. 47-58 depict an additional embodiment of a golf club head 1000 including a damping element 1002. FIG. 47 depicts a perspective view of an additional embodiment of a golf club head 1000. FIG. 48 depicts a perspective view of cross section N-N of the golf club head 1000 of FIG. 47. FIG. 49 depicts a side view of cross section N-N of the golf club head 1000 of FIG. 47. FIG. 50 depicts a detail view of the golf club head 1000 of FIG. 49. FIG. 51 depicts a perspective view of the golf club head 1000 of FIG. 47 missing the damping element 1002. FIG. 52 depicts a perspective view of cross section O-O of the golf club head 1000 of FIG. 51. FIG. 53 depicts a side view of cross section O-O of the golf club head 1000 of FIG. 51. FIG. 54 depicts a perspective view of the damping element 1002 of the golf club head 1000 of FIG. 47. FIG. 55 depicts an additional perspective view of the damping element 1002 of the golf club head 1000 of FIG. 47. FIG. 56 depicts a perspective view of cross section P-P of the damping element 1002 of FIG. 54. FIG. 57 depicts a side view of cross section P-P of the damping element 1002 of FIG. 54. FIG. 58 depicts a detail view of the damping element 1002 of FIG. 57.

The golf club head 1000 includes a striking face 1018 having a rear surface 1019. The golf club head 1000 includes a back portion 1012 configured to support a damping element 1002. The illustrated golf club head 1000 is a hollow body construction and the back portion 1012 covers a substantial portion of the back of the golf club head 1000. The back portion 1012 is located behind the striking face 1018 and extends between the topline 1017 and the sole 1005 from the heel 1004 to the toe 1006 forming a cavity 1020.

As illustrated in FIGS. 51-53, the back portion 1012 of the golf club head 1000 can include an aperture 1013. The aperture 1013 can be surrounded by a shelf 1014. The aperture 103 is configured to receive the damping element 1002 and shelf 1014 is configured to engage and retain the damping element 1002 as illustrated in FIGS. 48-50.

As illustrated in FIGS. 54-57, the damping element 1002 includes an exterior portion 1103 and a damping portion 1104. The exterior portion 1103 resides primarily behind the back portion 1012 of the golf club head 1000. The damping portion 1104 resides primarily within the cavity 1020 of the golf club head 1000 and is configured to abut the rear surface 1019 of the striking face 1018 as illustrated in FIGS. 48-50. A channel 1105 is formed between the exterior portion 1103 and the damping portion 1104, the channel 1105 configured to engage the shelf 1014 of the rear portion 1012 of the golf club head 1000. As illustrated in FIGS. 48, 49, 55, and 57 the damping element 1002 can include a recess formed inside the damping portion 1104 and extending up to the exterior portion 1103. In an alternative embodiment, not illustrated, the damping element 1002 may not include the recess 1106.

The exterior portion 1103 of the damping element 1002 can include a flange surface 1107 configured to abut the shelf 1014 of the golf club head 1000. The exterior portion 1103 can also include an outside surface 1108 opposite the flange surface 1107. The outside surface 1108 can be exterior and thus be designed such that it is aesthetically appealing to the golfer and take the place of a conventional medallion. In some embodiments, as illustrated in FIG. 50, an adhesive 1112 can reside between said flange surface 1107 of said damping element 1002 and said shelf 1014 of said back portion 1012.

As illustrated in FIGS. 48-50, at least a portion of the damping portion 1104 of the damping element 1002 resides between the shelf 1014 and the rear surface 1019 of the striking face 1018, contacting both the shelf 1014 and the rear surface 1019. As illustrated in FIG. 58, the damping portion 1104 of the damping element 1002 can include a front surface 1109 configured to abut the rear surface 1019 of the striking face 1018 and a rear surface 1110 configured to abut the shelf 1014.

In the illustrated embodiments, the damping portion 1104 and the exterior portion 1103 of the damping element are formed monolithically and of the same material. In other, non-illustrated embodiments, the damping portion 1104 and exterior portion 1103 can be formed of different materials and affixed to one another. The damping portion 1104, and thus in the preferred embodiment, the damping element 1102 in its entirety, can be formed of any of the materials disclosed herein when referring to the damping elements. Those materials may also include a silicone with a shore A durometer between approximately 50 and 70, which may also have an approximate compression set of 10%, 70 hours, at 212 degrees F., which may also have a tensile strength of approximately 1400 psi. The damping element 1102 is configured to deform as the striking face 1018 deforms upon impact with a golf ball, similar to the other damping elements described herein. As illustrated in FIG. 58, the damping portion 1104 can also include relief 1111 configured to aid in the ability of the damping portion 1104 to deform and absorb energy during impact.

As illustrated in FIG. 50, the striking face can have a central unsupported area 1016 surrounded by a supported area 1015. The supported area 1015 is defined by the portion of the rear surface 1019 of the striking face 1018 in contact with the front surface 1109 of the damping portion 1104 of the damping element 1002. The central unsupported area 1016 is defined by the portion of the rear surface 1019 of the striking face 1018 located centrally of said supported area 1015.

In one embodiment, the central unsupported area 1016 can be greater than 100 $mm^2$. In an additional embodiment, the central unsupported area 1016 can be greater than 200 $mm^2$. In an additional embodiment, the central unsupported area 1016 can be greater than 300 $mm^2$. In an additional embodiment, the central unsupported area 1016 can be greater than 400 $mm^2$. In an additional embodiment, the central unsupported area 1016 can be greater than 500 $mm^2$. In one embodiment, the supported area 1015 can be less than 300 $mm^2$. In one embodiment, the supported area 1015 can be less than 250 $mm^2$. In an additional embodiment, the supported area 1015 can be less than 200 $mm^2$. In an additional embodiment, the supported area 1015 can be less than 150 $mm^2$. In an additional embodiment, the supported area 1015 can be less than 125 $mm^2$. In an additional embodiment, the supported area 1015 can be less than 100 $mm^2$. In one embodiment, a ratio of the central unsupported area 1016 divided by the supported area 1015 is greater than or equal to 1.0. In an additional embodiment, a ratio of the central unsupported area 1016 divided by the supported area 1015 is greater than or equal to 1.5. In one embodiment, a ratio of the central unsupported area 1016 divided by the supported area 1015 is greater than or equal to 2.0. In one embodiment, a ratio of the central unsupported area 1016 divided by the supported area 1015 is greater than or equal to 2.5. In one embodiment, a ratio of the central unsupported area 1016 divided by the supported area 1015 is greater than or equal to 3.0. In one embodiment, a ratio of the central unsupported area 1016 divided by the supported area 1015 is greater than or equal to 3.5. In one embodiment, a ratio of the central unsupported area 1016 divided by the supported area 1015 is greater than or equal to 4.0. In one embodiment, a ratio of the central unsupported area 1016 divided by the supported area 1015 is greater than or equal to 4.5. In one embodiment, a ratio of the central unsupported area 1016 divided by the supported area 1015 is greater than or equal to 5.0.

Figure 60:
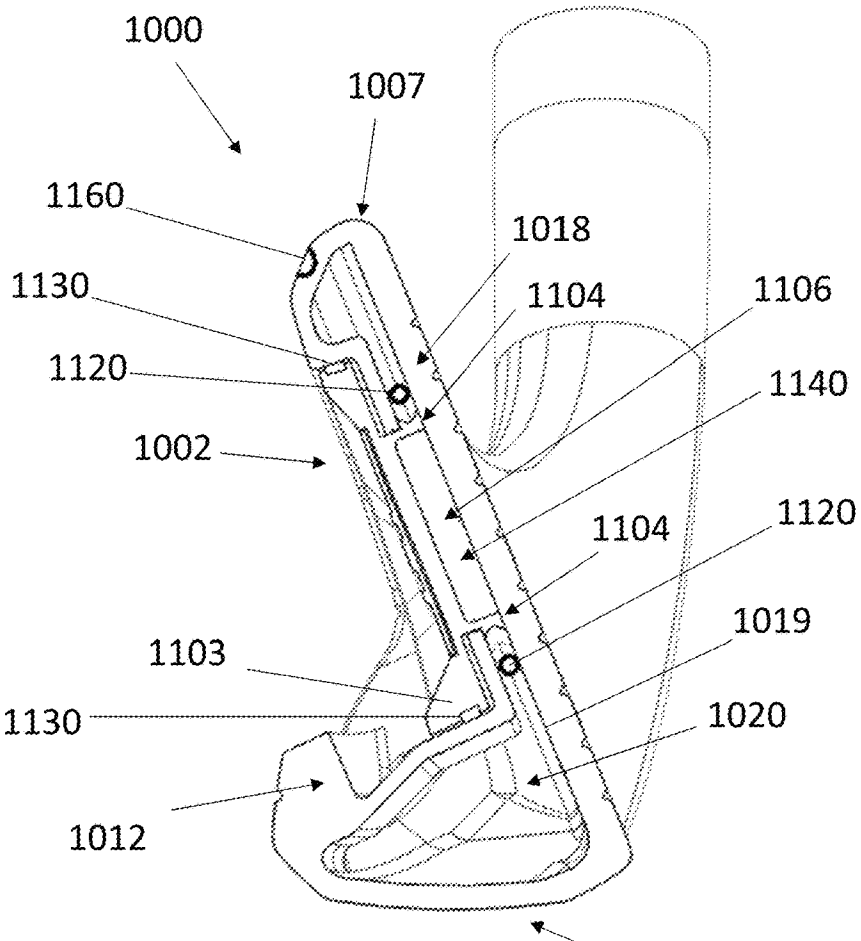
FIG. 60 depicts a side view of cross section Q-Q view of the golf club head of FIG. 59.
Figure 59:
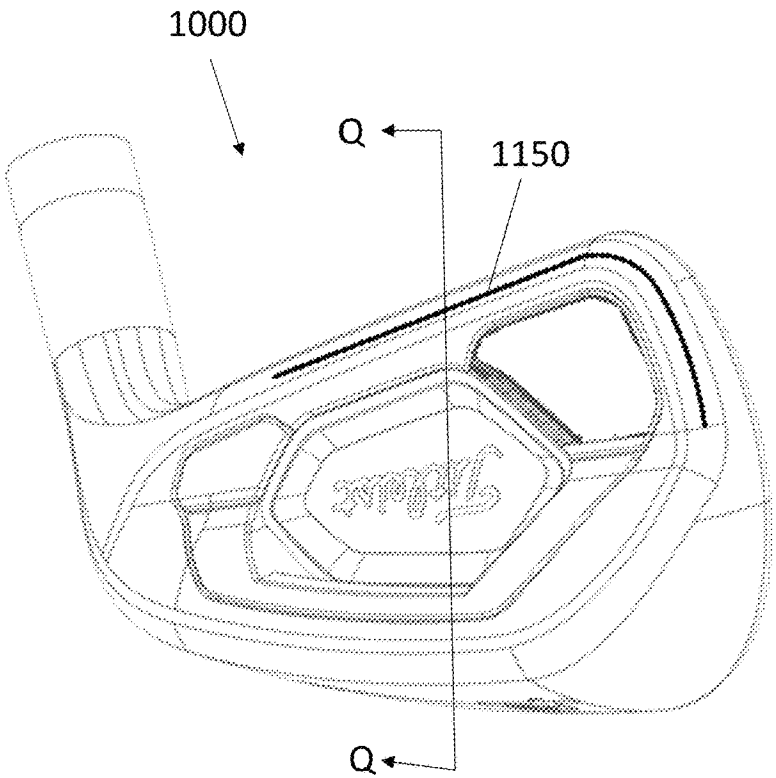
FIG. 59 depicts a perspective view of an additional embodiment of a golf club head.

FIG. 59 depicts a perspective view of an additional embodiment of a golf club head 1000. FIG. 60 depicts a side view of cross section Q-Q view of the golf club head 1000 of FIG. 59. The golf club head 100 illustrated in FIGS. 59 and 60 includes a few additional features. In one embodiment, the golf club head 1000 includes a second damping element 1120. In the illustrated embodiment, the second damping element 1120 is an o-ring shaped elastomer which resides between the striking face 1018 and the back portion 1012. The second damping element 1120 can form a continuous loop, surrounding the damping element 1002. In some embodiments, the back portion may include a relief configured to receive a portion of the second damping element.

In one embodiment, the golf club head can include a third damping element 1130. The third damping element can reside around the top (illustrated in FIG. 60), bottom (illustrated in FIG. 60), heel side (not illustrated), and toe side (not illustrated) of the exterior portion 1103 of the damping element 1102 between the exterior portion 1103 and the back portion 1012 of the golf club head.

In one embodiment, the golf club head 1000 includes a fourth damping element 1140. The fourth damping element 1140 can reside within the recess 1106 of the damping element 1102. In one embodiment, the fourth damping element 1140 can comprise hot melt. In another embodiment it could include an elastomer. In another embodiment it could include a rubber. In another embodiment it could include a foam. In another embodiment, the fourth damping element 1140 could be a metal having an elastic modulus of about 70 GPa or greater. In another embodiment, the fourth damping element 1140 could be softer and thus have a lower hardness value than the damping element 1002. In one embodiment, the fourth damping element 1140 could be formed of a silicone.

In one embodiment, the golf club head 1000 includes a fifth damping element 1150. The golf club head can include a slot configured to receive the fifth damping element 1150 which is preferably a rubber. In one embodiment the slot can be formed in the back portion 1112 of the golf club head. In another embodiment the slot can be formed in one or more of the following: the back portion 1112, the topline 1007, the toe 1006, the sole 1005.

Figure 61:
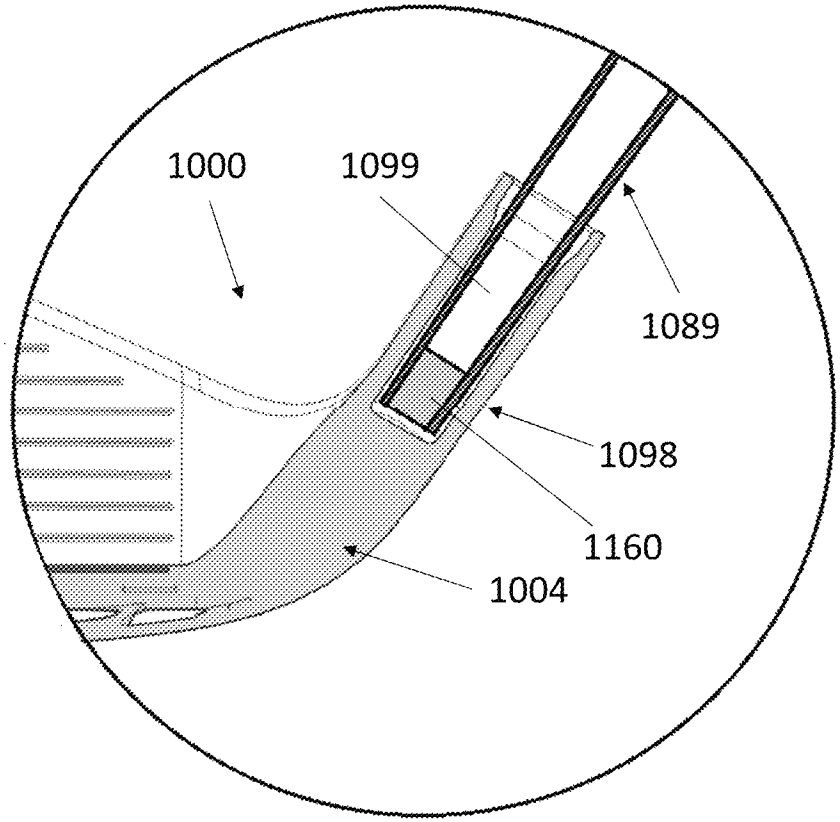
FIG. 61 illustrates an additional cross section view of the golf club head of FIG. 59 including a golf club shaft and a sixth damping element.

FIG. 61 illustrates an additional cross section view of the golf club head 1000 of FIG. 59 including a golf club shaft 1089 and a sixth damping element 1160. The hosel 1098 of the golf club head includes a hosel bore 1099 configured to receive a shaft 1089. In one embodiment, the hosel bore 1099 can also receive a sixth damping element 1160 which can take the form of a plug as illustrated in FIG. 60.

Figure 63:
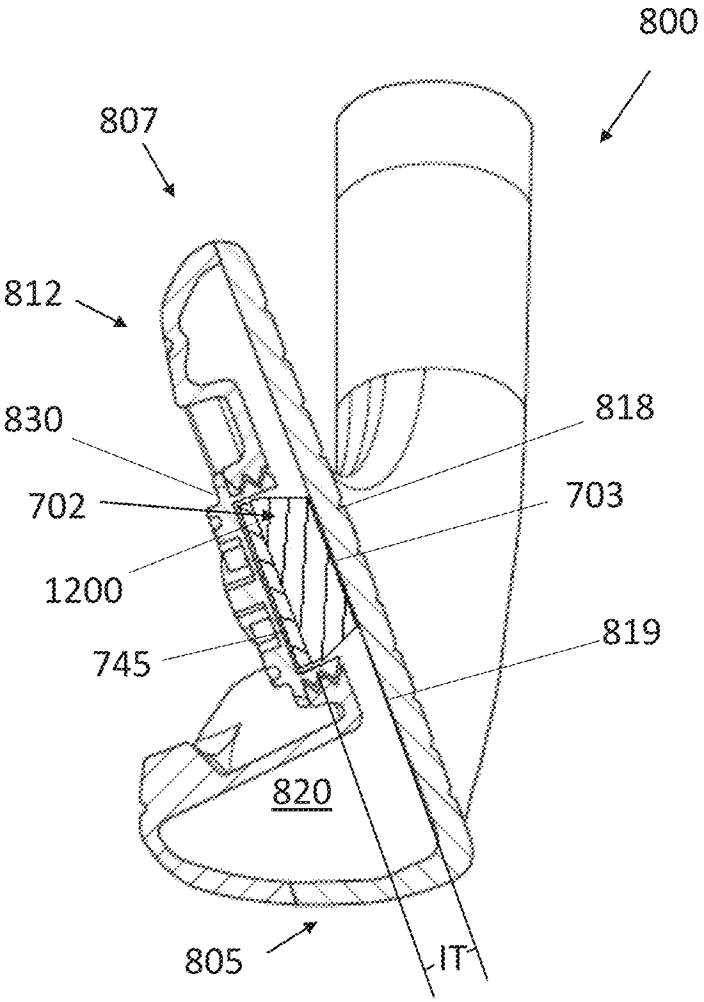
FIG. 63 depicts a section view E-E of the golf club head of FIG. 15A including an additional embodiment of a damping element.
Figure 62:
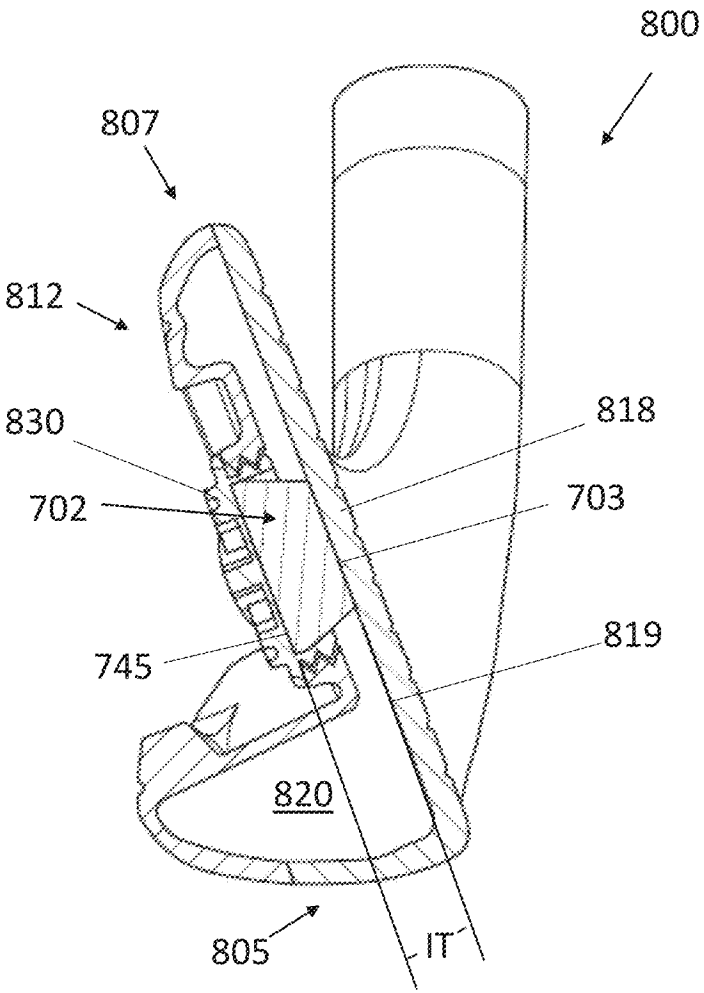
FIG. 62 depicts a section view E-E of the golf club head of FIG. 15A including an additional embodiment of a damping element.
Figure 65:
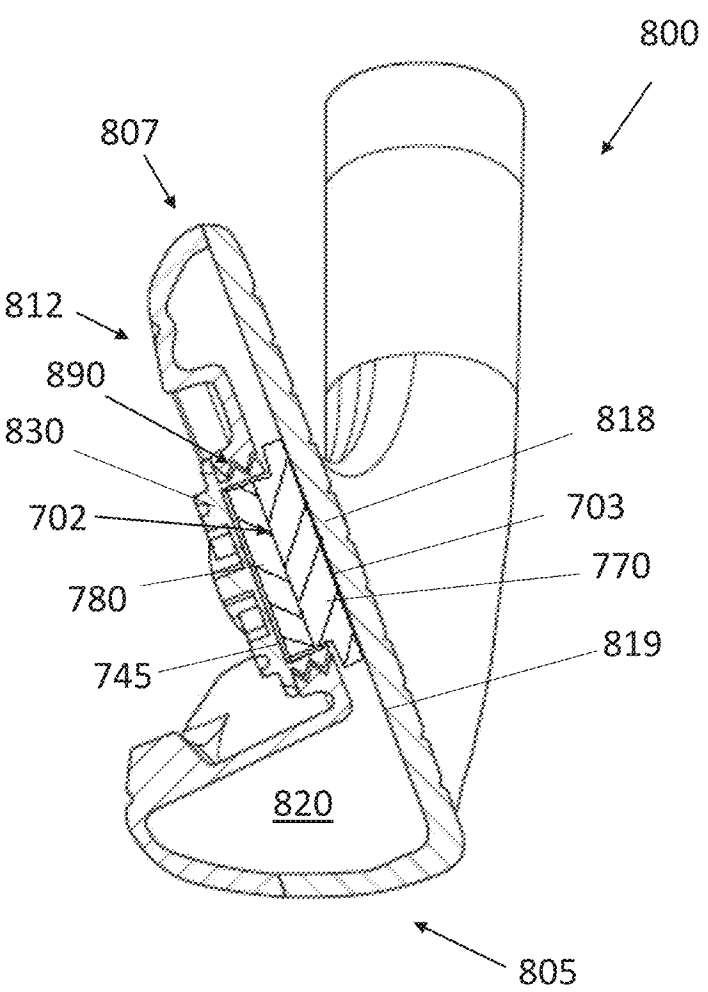
FIG. 65 depicts a section view E-E of the golf club head of FIG. 15A including an additional embodiment of a damping element.
Figure 64:
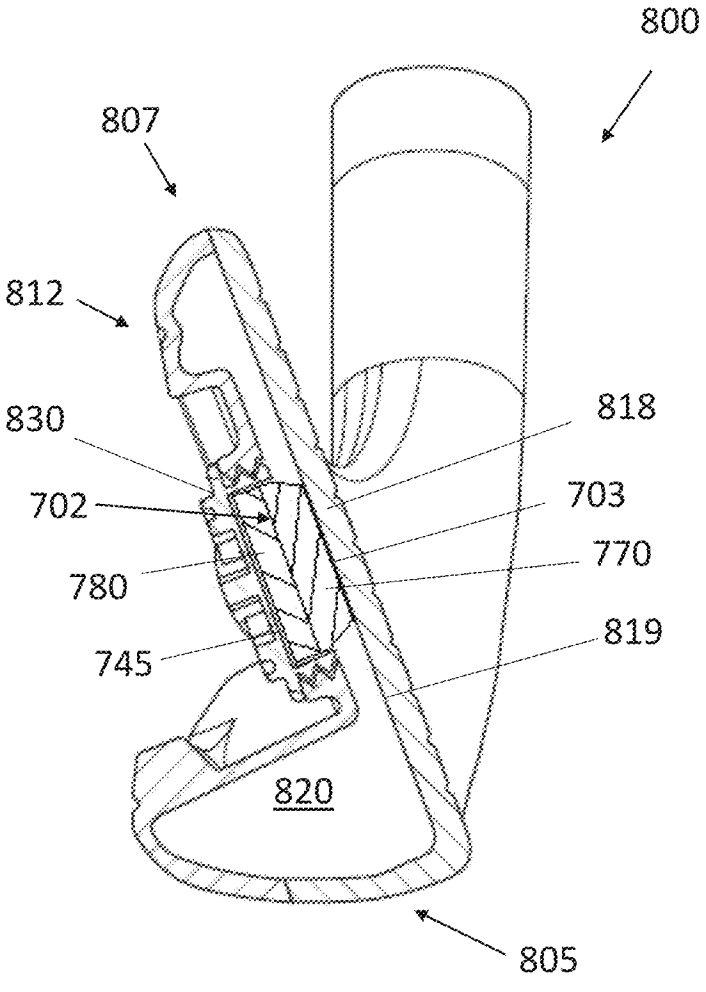
FIG. 64 depicts a section view E-E of the golf club head of FIG. 15A including an additional embodiment of a damping element.
Figure 66:
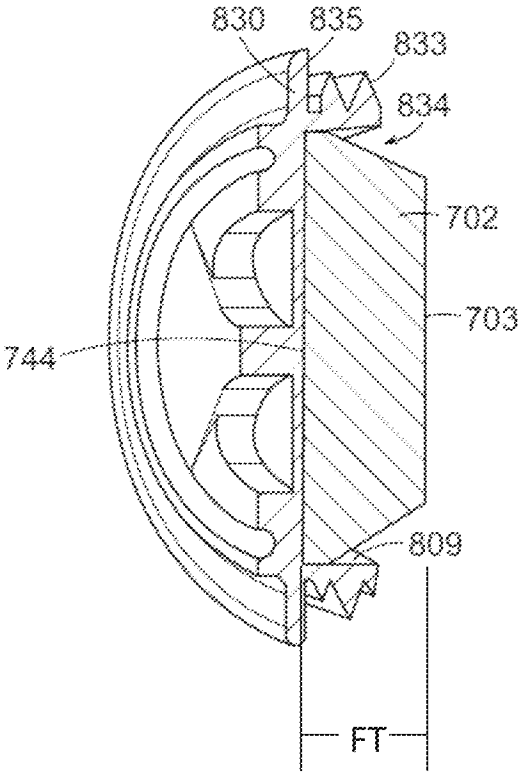
FIG. 66 depicts the damping element and adjustment driver of the golf club head of FIG. 62.

FIGS. 62-65 depicts additional embodiments of the damping element 702 of the golf club head 800 described above and illustrated in FIGS. 15A-17E. FIG. 62 depicts a section view E-E of the golf club head 800 of FIG. 15A including an additional embodiment of a damping element 702. FIG. 63 depicts a section view E-E of the golf club head 800 of FIG. 15A including an additional embodiment of a damping element 702. FIG. 64 depicts a section view E-E of the golf club head 800 of FIG. 15A including an additional embodiment of a damping element 702. FIG. 65 depicts a section view E-E of the golf club head 800 of FIG. 15A including an additional embodiment of a damping element 702. FIG. 66 depicts the damping element 702 and adjustment driver 830 of the golf club head 800 of FIG. 62.

As illustrated in FIGS. 62-65 the golf club head 800 includes a striking face 818 having a rear surface 819. The golf club head 800 also includes a back portion 812 configured to support the damping element 702. The golf club head 800 is made with a hollow body construction and the back portion 812 covers a substantial portion of the back of the golf club head 800. The back portion 812 is located behind the striking face 818 and extends between the topline 807 and the sole 805 and from the heel to the toe forming a cavity 820. The damping element 702 is disposed within the cavity 820.

The back portion of the golf club head 800 includes an adjustment driver 830. The damping element 702 is disposed between the striking face 818 and the adjustment driver 830. The adjustment driver 830 is configured to retain the damping element 702 between the adjustment driver 830 and the striking face 818, with the front portion 703 of the damping element 702 contacting the rear surface 819 of the striking face 818 and the rear portion 744 of the damping element 702 contacting the adjustment driver 830.

As illustrated in FIG. 66, the damping element 702 has a free thickness FT. As illustrated in FIG. 62, the damping element 702 has an installed thickness IT. In some embodiments, the free thickness FT and the installed thickness IT of the damping element 702 can be substantially the same. In this case, there would be little to no preload of the damping element 702 against the rear surface 819 of the striking face 818. In other embodiments, the installed thickness IT can be lower than the free thickness FT, creating a preload force on the rear surface 819 of the striking face 818. This preload force can change the coefficient of restitution of the striking face 818, a value that effects how fast a golf ball will leave the striking face when struck by the golf club head at a particular club head speed. In some embodiments, the back portion 812, including the adjustment driver 830, can be configured to have a particular installed thickness IT, to achieve a particular coefficient of restitution. Multiple versions of the adjustment driver 830 may be available to fine tune the coefficient of restitution to a desired value. In an additional embodiment, multiple versions of the damping element 702 may be available with different free thicknesses FT, to achieve a particular coefficient of restitution. Alternatively, the material of the damping element 702 could be altered to change its stiffness, thus altering the coefficient of restitution of the golf club head.

As illustrated in FIG. 63, the adjustment driver 830 can also include a spacer 1200 configured to alter the installed thickness IT of the damping element 702. By changing the thickness of the spacer 1200, the installed thickness IT can be varied, thus varying the coefficient of restitution of the golf club head.

As illustrated in FIG. 64, the damping element 702 can include a first material 770 and a second material 780. Multiple material damping elements were described above in reference to FIGS. 14D, 14E, 14F, and 14L. In the embodiment illustrated in FIG. 64 the first material 770 is in contact with the rear surface 819 of the striking face 818 and the second material 780 is in contact with the adjustment driver 830. In one embodiment, the first material can have a higher hardness than the second material. In another embodiment, the second material could have a higher hardness than the first material. In a preferred embodiment, the first material can have a Shore A hardness value which is less than the Shore A hardness value of the second material. In a more preferred embodiment, the first material can have a Shore A hardness value less than 50 and the second material can have a Shore A hardness value of greater than 15. In a more preferred embodiment, the first material can have a Shore A hardness value less than 40 and the second material can have a Shore A hardness value of greater than 25. In a more preferred embodiment, the first material can have a Shore A hardness value less than 30 and the second material can have a Shore A hardness value of greater than 35. In a more preferred embodiment, the first material can have a Shore A hardness value less than 20 and the second material can have a Shore A hardness value of greater than 40. In a more preferred embodiment, the first material can have a Shore A hardness value less than 15 and the second material can have a Shore A hardness value of greater than 45. By including multiple materials, not only can the face be supported and the coefficient of restitution be altered, but additional benefits including reduced vibration for better feel and sound can be attained.

As illustrated in FIG. 65, the golf club head 800 and damping element 702 can be configured such that the damping element 702 substantially deforms in shape when installed in the golf club head 800. Similar to the embodiment in FIG. 64, the damping element 702 of FIG. 65 can include a first material 770 and a second material 770. The damping element 702 has a substantial difference between the free thickness FT and the installed thickness IT such that the damping element 702 is preloaded against the rear surface 819 of the striking face 818. In one embodiment, the free thickness FT of the damping element is at least 5% larger than the installed thickness IT. In an additional embodiment, the free thickness FT of the damping element is at least 10% larger than the installed thickness IT. In an additional embodiment, the free thickness FT of the damping element is at least 15% larger than the installed thickness IT. In an additional embodiment, the free thickness FT of the damping element is at least 20% larger than the installed thickness IT. In some embodiments, as illustrated in FIG. 65, a portion of the damping element 702 can deform such that the diameter of its front portion 703 abutting the rear surface 819 of the striking face 818 when installed in the golf blue had 800 is greater than the diameter of the adjustment receiver 890 through which the damping element 702 was installed.

Figure 67:
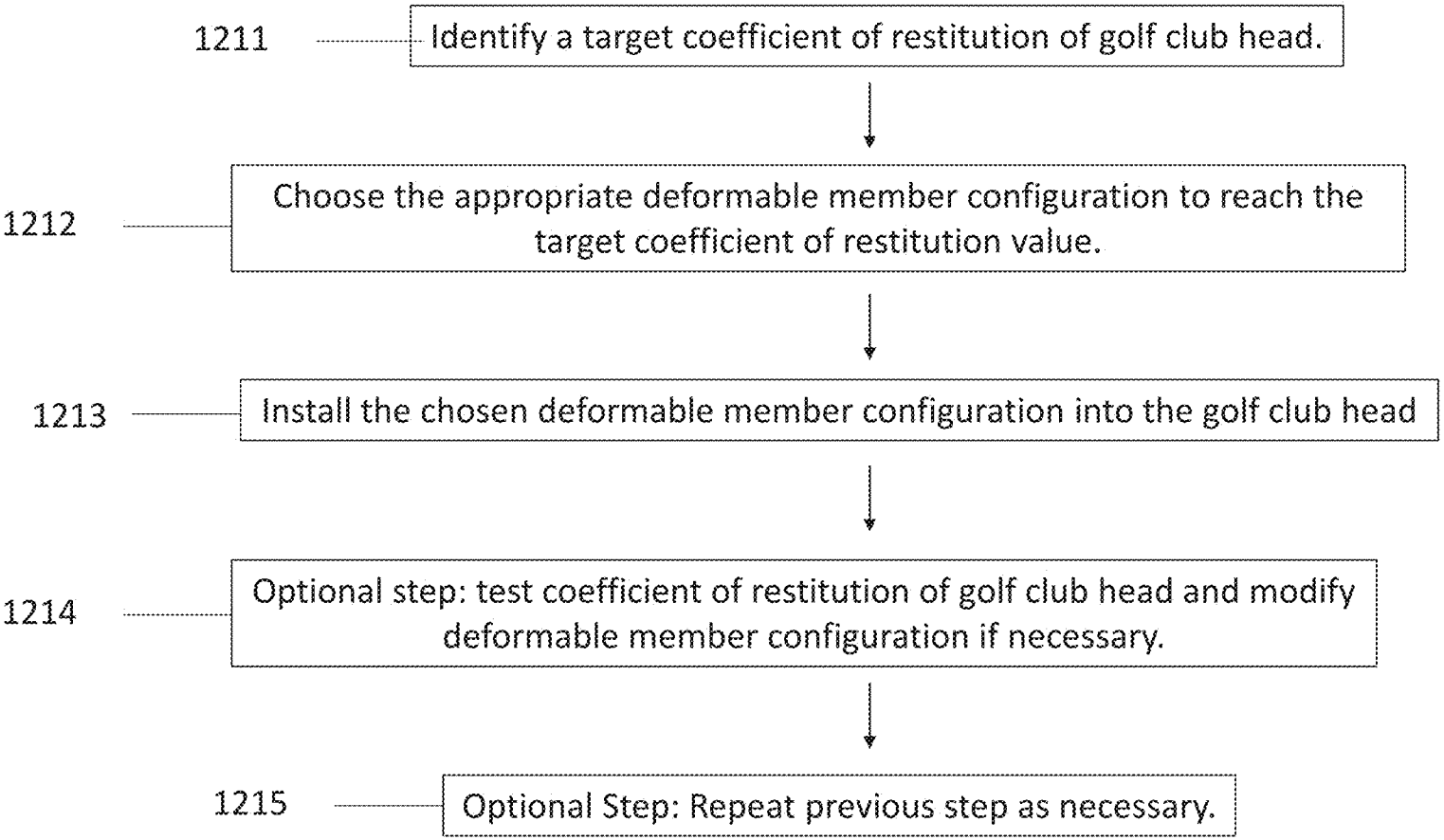
FIG. 67 depicts a method of manufacturing a golf club head.

One method of utilizing the embodiments described herein is outlined in FIG. 67. During construction of the golf club head 800, one can identify a target coefficient of restitution of the golf club head 1211, then they can choose appropriate damping element configuration to reach the target coefficient of restitution value 1212, then they can install the chosen damping element configuration into the golf club head 1213, then they can optionally test the coefficient of restitution of the golf club head and modify the damping element configuration if necessary 1214, then they can optionally repeat the prior step as necessary 1215. Alternatively, rather than utilizing coefficient of restitution as a measurement and target value for the golf club head, the characteristic time can be utilized, which is analogous to the coefficient of restitution and easier to measure.

While the methods and damping elements 702 described above in reference to FIGS. 62-67 were illustrated and described in the context of the golf club head 800, they could be utilized in any of the golf club head embodiments described herein.

As noted above, the golf club head 700 illustrated in FIGS. 26-33 include a second damping element 702D. The second damping element 702D can be disposed between the rear surface 719 of the striking face 718 and the support arm 762. Additionally, there may be at least one weight member 710 and the second damping element 702D can be disposed between the rear surface 719 of the striking face 718 and the weight member 710 or between the support arm 762 and the weight member 710. It was also noted that the second damping element 702D could be formed separately from the golf club head and subsequently installed or it could be co-molded with the golf club head so as to specifically fit the geometry of the particular club. The co-molding process could include a pour-in filler material that sets after being inserted into the golf club head. The pour-in filler material could use a first ingredient and a second ingredient that begin to cure once mixed together and inserted into the golf club head. Additionally, the second damping element 702D could include a combination of both a pre-formed member installed into the golf club head in addition to a poured-in portion. The poured-in portion can aid in taking up any gaps between the pre-formed member and the striking face 718, the support arm 762, the weight member 710, or the back portion 712 of the golf club head 700. The poured-in portion could reduce any inconsistencies between clubs due to part and assembly tolerances and ensure flush contact with intended surfaces of the golf club head. Examples of pourable filler materials which could be used in a golf club head include Flex Seal™ liquid rubber or Dip Seal™ cellulose based plastic coating. In another embodiment, rather than a pour-in rubber material a foam material can be used. The foam could be pre-formed, a pour-in cast in place foam, or a combination of the two. Additionally, a pour-in cast in place foam could be used in addition to a pre-formed elastomer member, much like discussed above. An adhesive could be used in conjunction with any of the embodiments and combinations above to help secure the damping elements in place.

Figure 68:
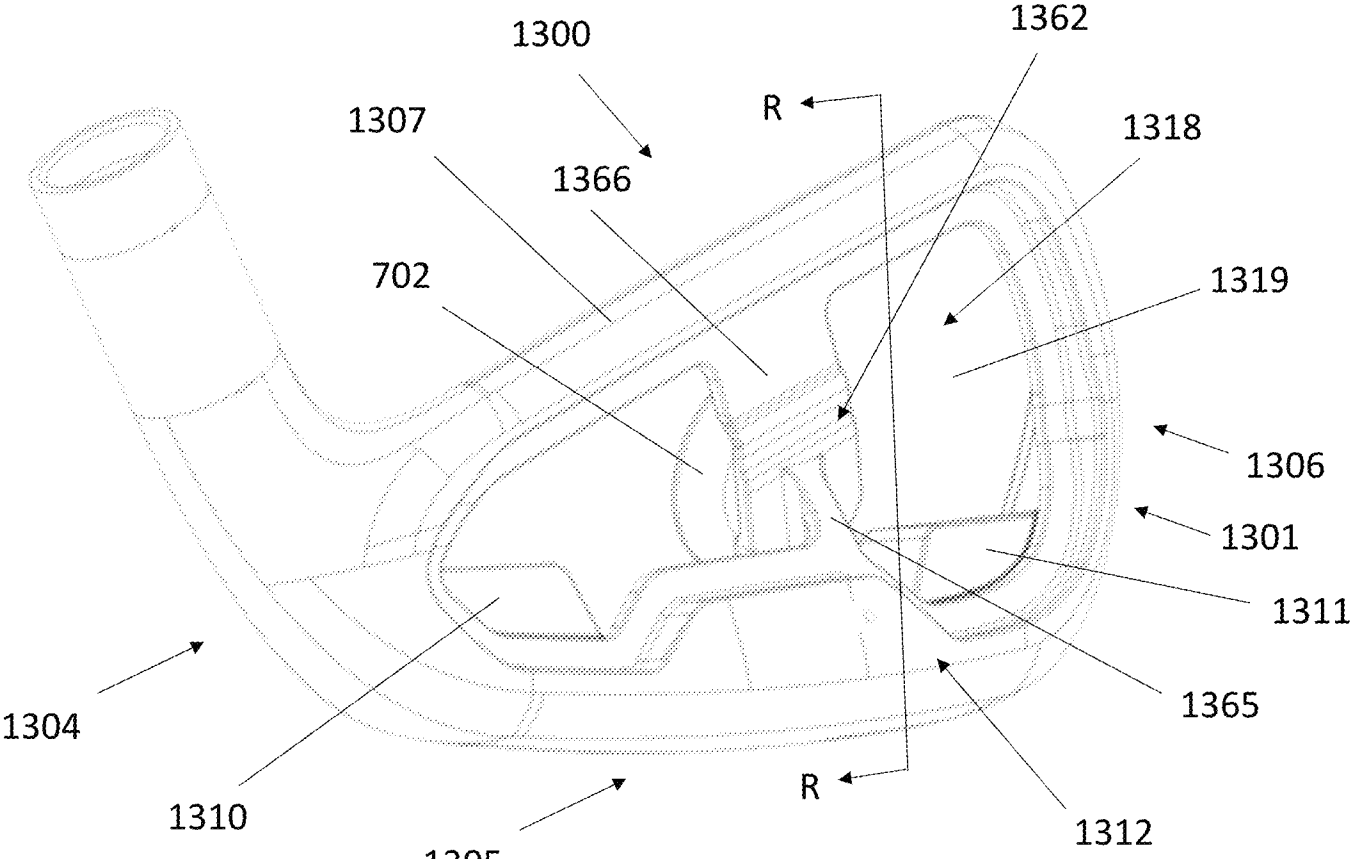
FIG. 68 depicts a perspective view of a golf club head.
Figure 70:
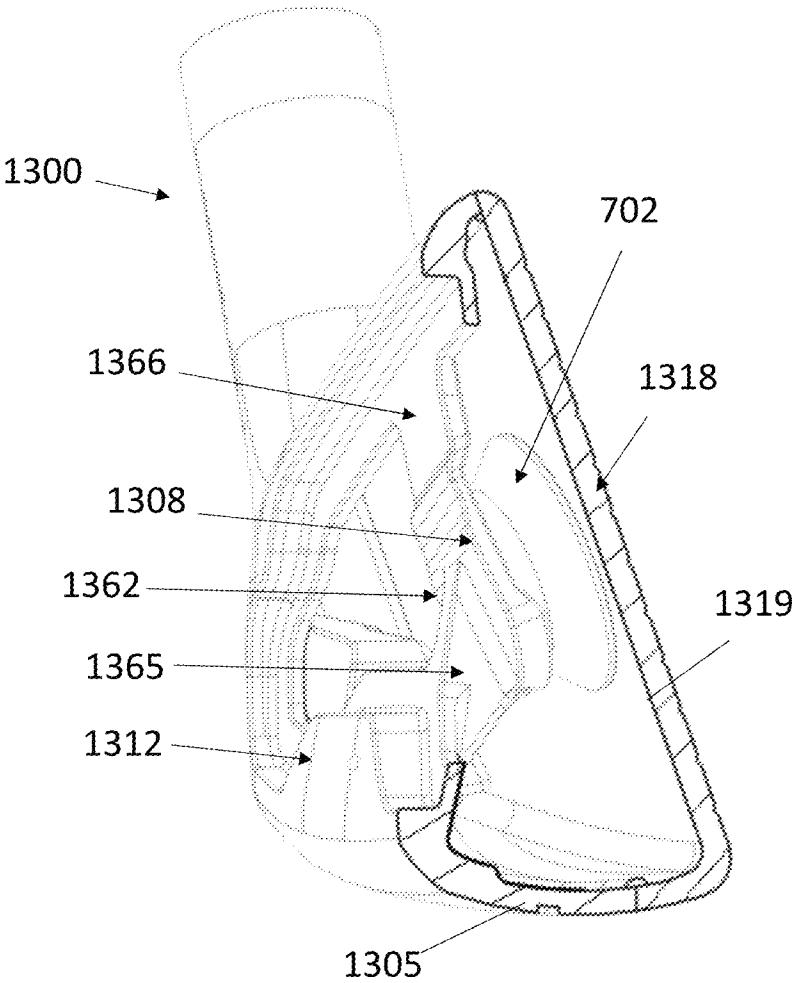
FIG. 70 depicts a perspective view of section view R-R of the golf club head of FIG. 69.
Figure 69:
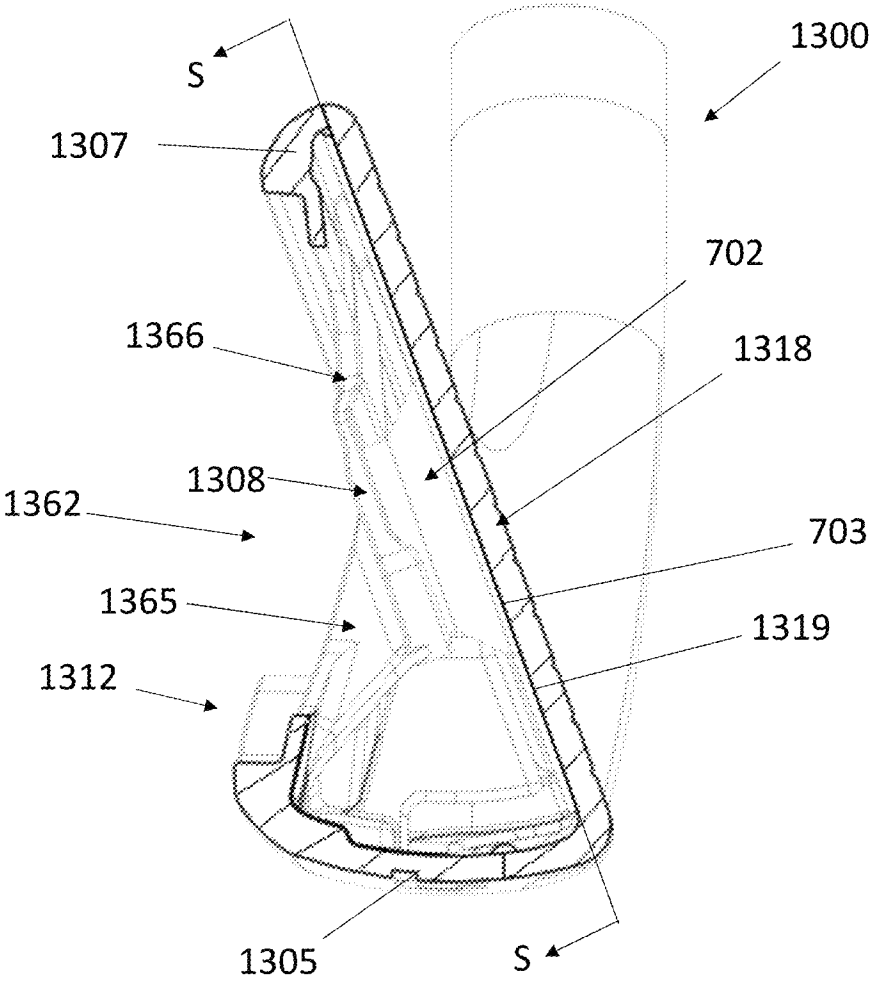
FIG. 69 depicts a section view R-R of the golf club head of FIG. 68 missing a weight member.
Figure 71:
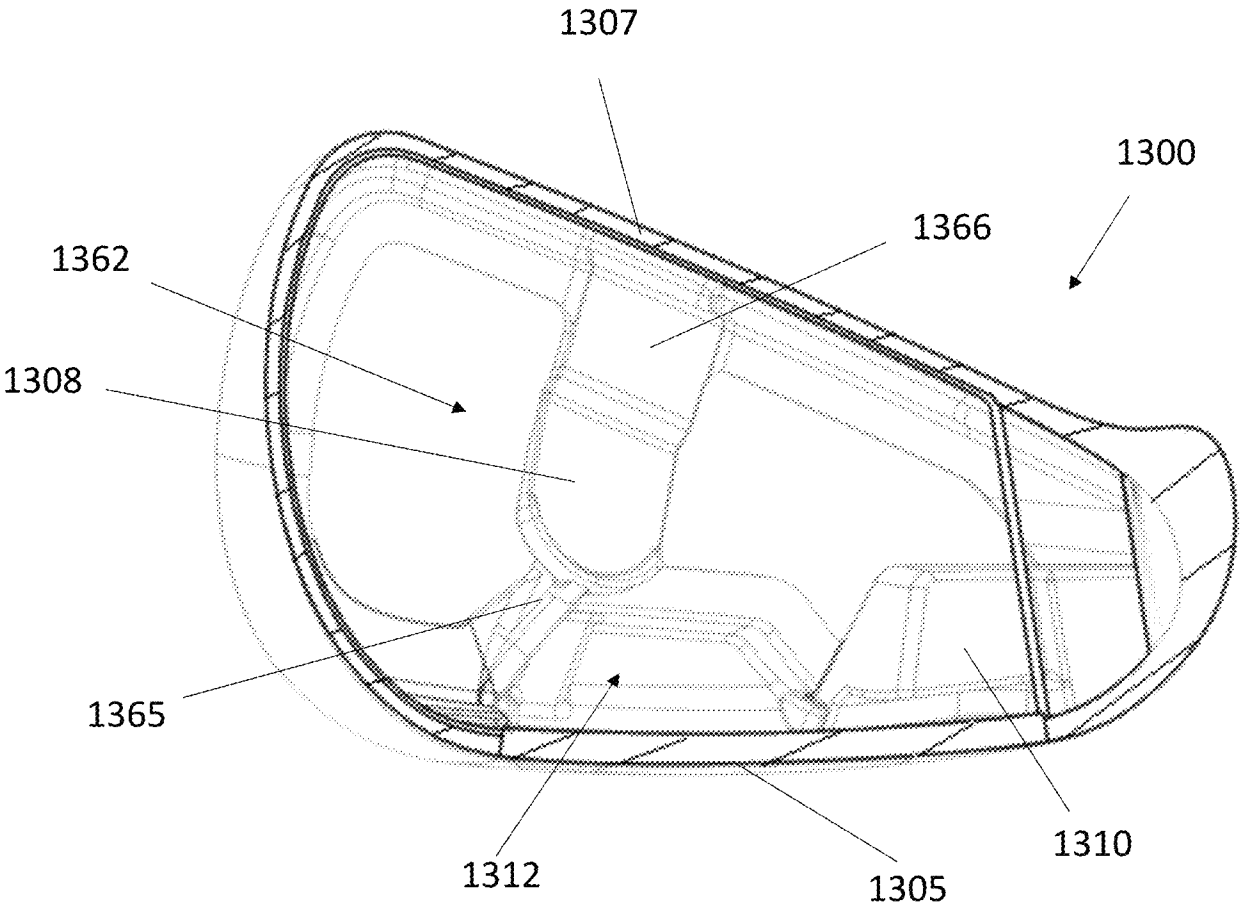
FIG. 71 depicts a section view S-S of the golf club head of FIG. 68 missing the weight member and damping element.

FIGS. 68-71 depict an additional embodiment of a golf club head 1300 having a damping element 702. FIG. 68 depicts a perspective view of a golf club head 1300. FIG. 69 depicts a section view R-R of the golf club head 1300 of FIG. 68 missing a weight member 1311. FIG. 70 depicts a perspective view of section view R-R of the golf club head 1300 of FIG. 69. FIG. 71 depicts a section view S-S of the golf club head 1300 of FIG. 68 missing the weight member 1311 and damping element 702. The golf club head 1300 of FIGS. 68-71 shares many features and qualities with the golf club head 700 depicted in FIGS. 26-33 and described above while incorporating some unique features.

The golf club head 1300 illustrated in FIGS. 68-71 is an iron having a cavity back construction and includes a periphery portion 1301 surrounding and extending rearward from the striking face 1318. The periphery portion 1301 includes the sole 1305, the toe 1306, the heel 1304, and the topline 1307. The periphery portion 701 can also include one or more weight members 1310, 1311. The periphery portion 1301 can also include a back portion 1312, which may partially enclose the cavity 1320. The periphery portion 1301 of the golf club head 1300 can include a support arm 1366. As illustrated in FIGS. 68-71, the support arm 1366 can extend from the sole 1305 to the topline 1307. The support arm 1366 can include a first portion 1365, a cradle 1308, and a second portion 1366. The first portion 1365 extends from the sole 1305. The first portion 1365 may be at least partially incorporated into the back portion 1312, as illustrated. The first portion 1365 is connected to the cradle 1308 which is configured to support a damping element 702 disposed between the rear surface 1319 of the striking face 1318 and the cradle 1308 of the support arm 1362. The second portion 1366 extends between the topline 1307 and the cradle 1308. The damping element 702 can support the striking face 1318 and offer damping properties, as discussed above. In other embodiments, the golf club head 1300 could also incorporate additional damping elements like the embodiments described above. In other embodiments, the back portion can substantially enclose the cavity. In other embodiments, an additional member such as a medallion can be affixed to the back portion of the golf club head. In some embodiments, the medallion can cover the support arm 1365 and damping element 702 from view.

As illustrated, the first portion 1365 is substantially thicker in a fore-aft direction than it is in the heel-toe direction and the second portion 1366 is substantially thicker in a heel-toe direction than it is in the fore-aft direction. In another embodiment, this could be reversed. In another embodiment, both the first portion 1365 and the second portion 1365 can be substantially thicker in a fore-aft direction than in the heel-toe direction. In another embodiment, both the first portion 1365 and the second portion 1365 can be substantially thicker in a heel-toe direction than it in the fore-aft direction.

Figure 72:
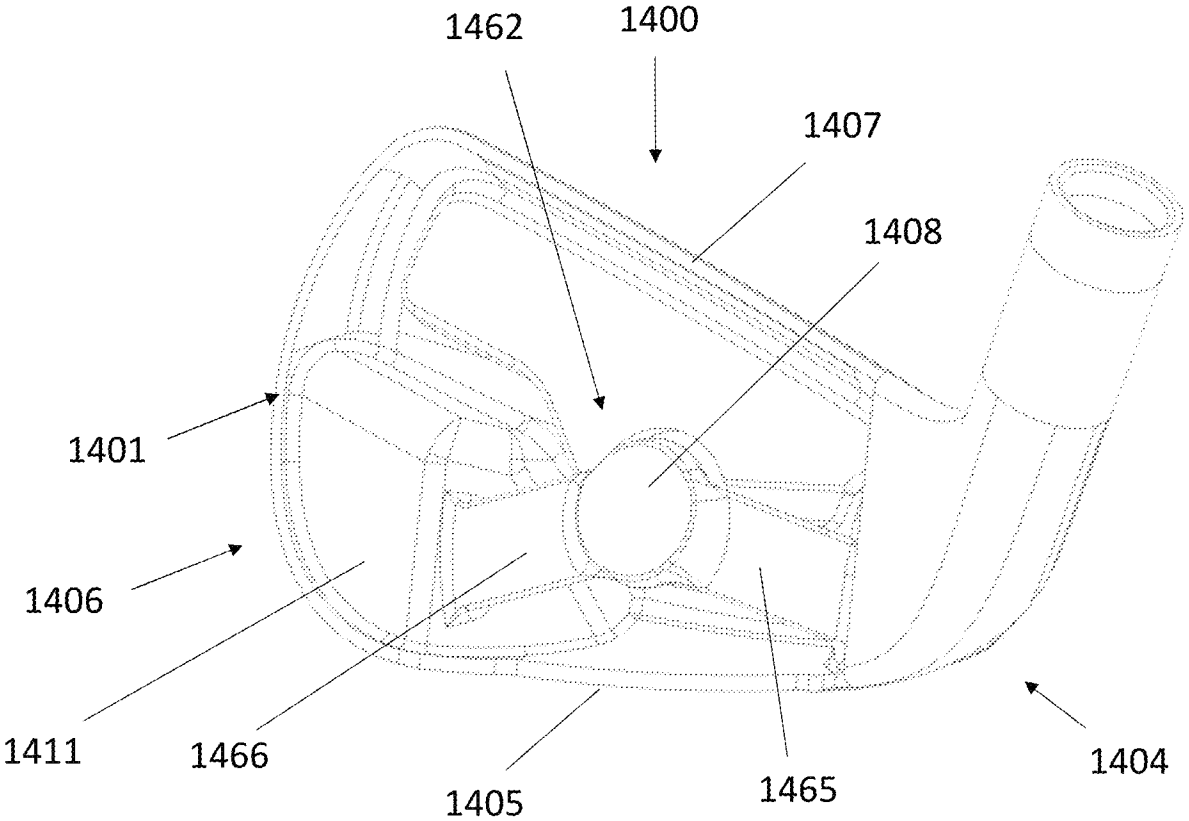
FIG. 72 depicts a perspective view golf club head missing the striking face and damping element.
Figure 73:
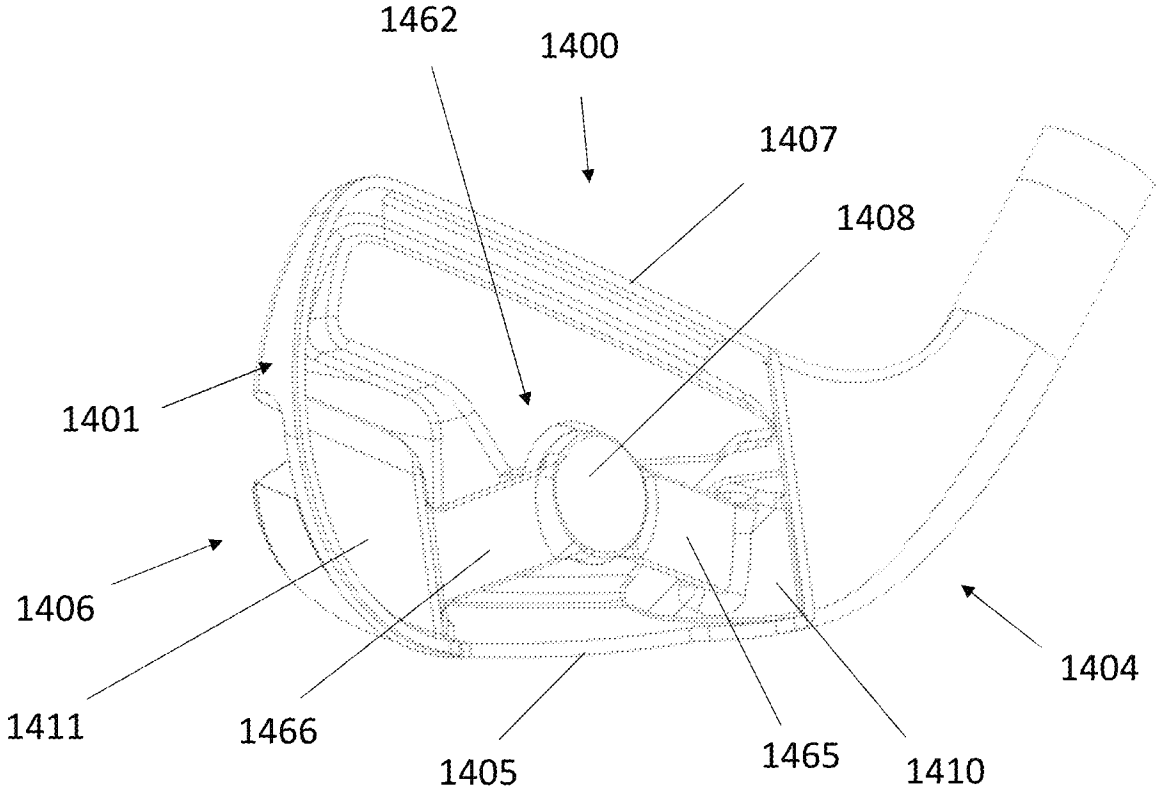
FIG. 73 depicts an additional perspective view of the golf club head of FIG. 72, also missing the striking face and damping element.

FIGS. 72 and 73 depict an additional embodiment of a golf club head 1400 which is an alternative construction to the golf club head 1300 depicted in FIGS. 68-71. FIG. 72 depicts a perspective view golf club head 1400 missing the striking face and damping element. FIG. 73 depicts an additional perspective view of the golf club head 1400 of FIG. 72, also missing the striking face and damping element. The golf club head 1400 of FIGS. 72 and 73 shares many features and qualities with the golf club head 1300 depicted in FIGS. 68-71 and described above. The primary difference between the embodiments is the support arm 1462. The golf club head 1400 includes a support arm 1462 that is arranged substantially horizontally as opposed to the substantially vertical support arm 1362 of the golf club head 1300. The first portion 1465 and second portion 1466 extend from the periphery portion 1401 and each connect to the cradle 1408 which is configured to support a damping element 702. The first portion 1465 extends from a heel side 1404 of the golf club head 1400. The heel side 1404 of the golf club head 1400 may include a weight member 1410 and the first portion 1465 can extend from the weight member 1410 toe-ward to the cradle 1408. The second portion 1466 extends from a toe side 1406 of the golf club head 1400. The toe side 1406 of the golf club head 1400 may include a weight member 1411 and the second portion 1466 can extend from the weight member 1411 heel-ward to the cradle 1408. In an alternative embodiment, the golf club head 1400 may not include a damping element. In such an embodiment, the support arm may contact the rear surface of the striking face directly. Alternatively, the support arm may be offset from the rear surface of the striking face a small distance, 0.5 mm for example, such that when a golf ball impacts the striking face it deflects into the support arm which then reduces the striking face deflection and supports it in a central location.

The first portion 1465 of the support arm is angled upwards from the heel side 1404 towards the cradle 1408 measured relative to the x-axis. In some embodiments, the first portion 1465 can be angled upwards greater than 5 degrees. In another embodiment, the first portion 1465 can be angled upwards greater than 10 degrees. In another embodiment, the first portion 1465 can be angled upwards greater than 15 degrees. In another embodiment, the first portion 1465 can be angled upwards greater than 20 degrees. In another embodiment, the first portion 1465 can be angled upwards greater than 25 degrees. In another embodiment, the first portion 1465 can be angled upwards greater than 30 degrees. The second portion 1466 of the support arm is angled upwards from the toe side 1406 towards the cradle 1408 measured relative to the x-axis. In some embodiments, the second portion 1466 can be angled upwards greater than 5 degrees. In another embodiment, the second portion 1466 can be angled upwards greater than 10 degrees. In another embodiment, the second portion 1466 can be angled upwards greater than 15 degrees. In another embodiment, the second portion 1466 can be angled upwards greater than 20 degrees. In another embodiment, the second portion 1466 can be angled upwards greater than 25 degrees. In another embodiment, second portion 1466 can be angled upwards greater than 30 degrees.

Figure 74:
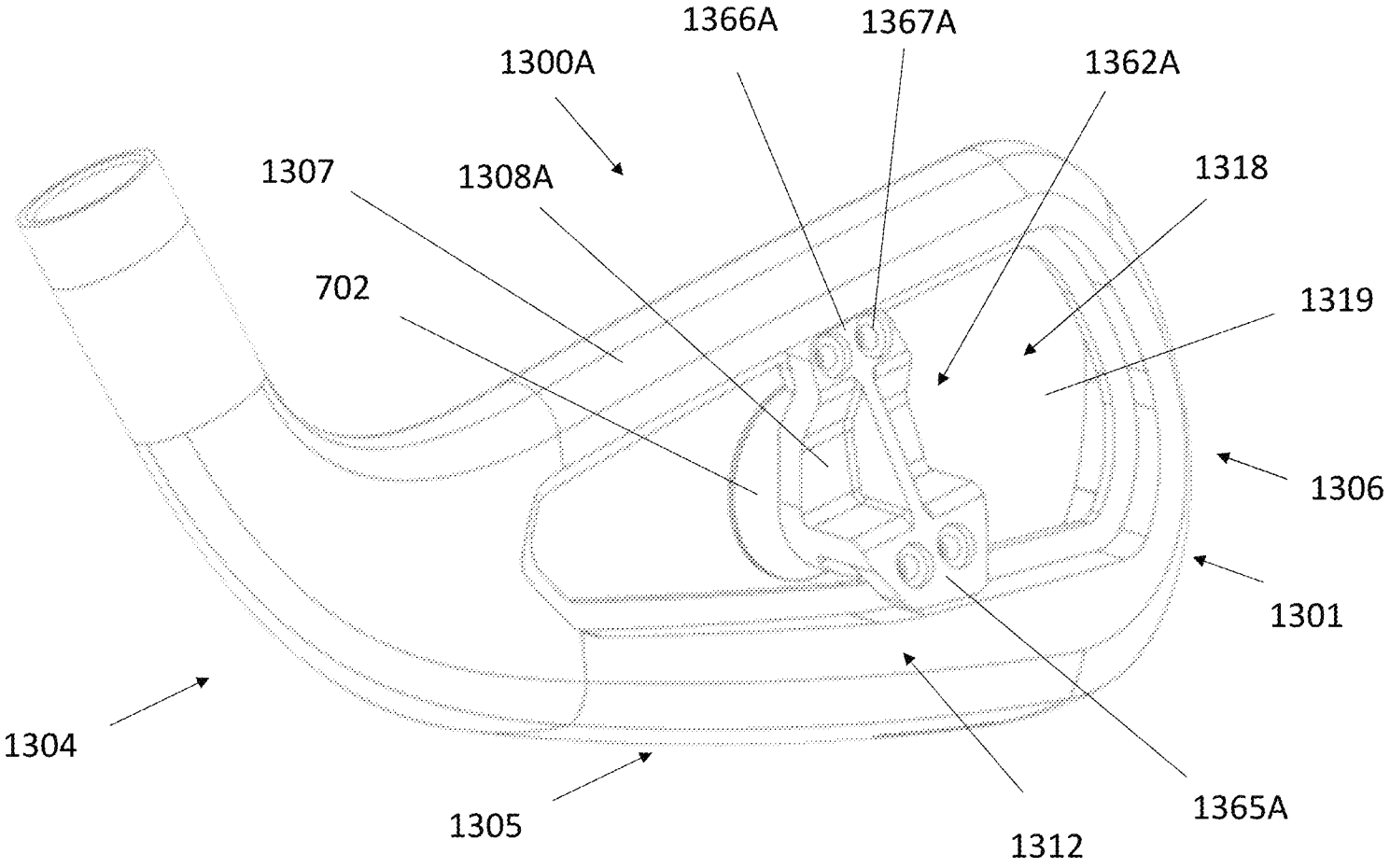
FIG. 74 illustrates a perspective view of an additional embodiment of a golf club head.
Figure 76:
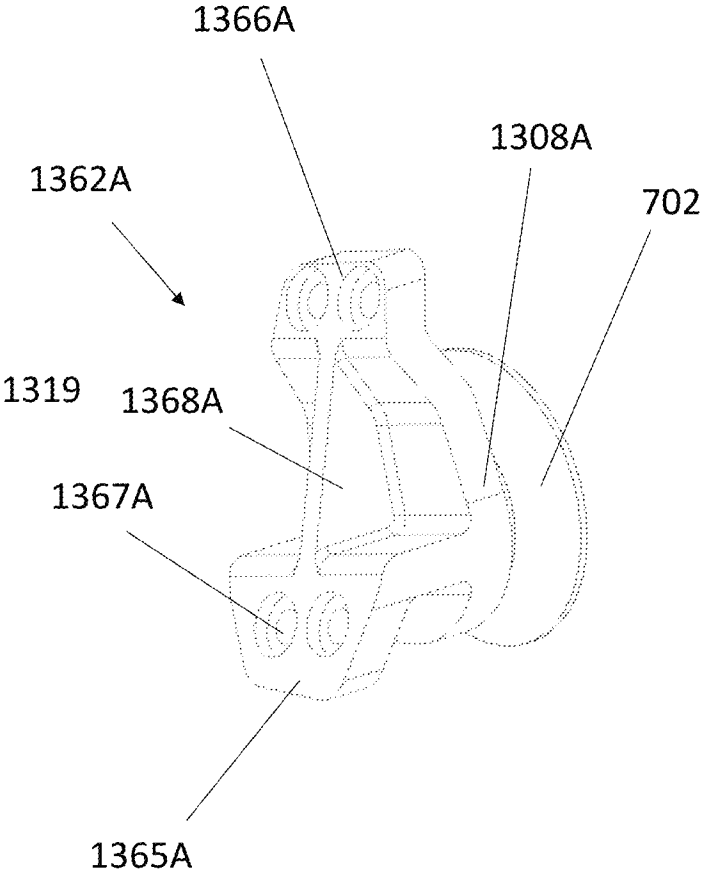
FIG. 76 illustrates a perspective view of the support arm and damping element of the golf club head of FIG. 74.
Figure 75:
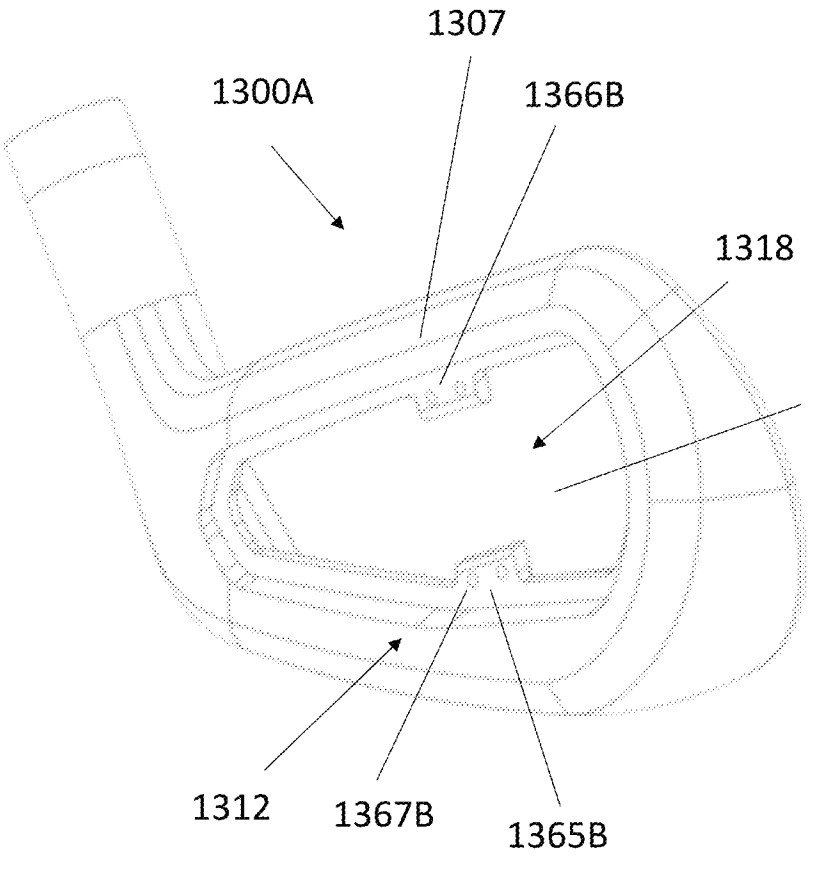
FIG. 75 illustrates a perspective view of the golf club head of FIG. 74 missing the support arm and damping element.
Figure 78:
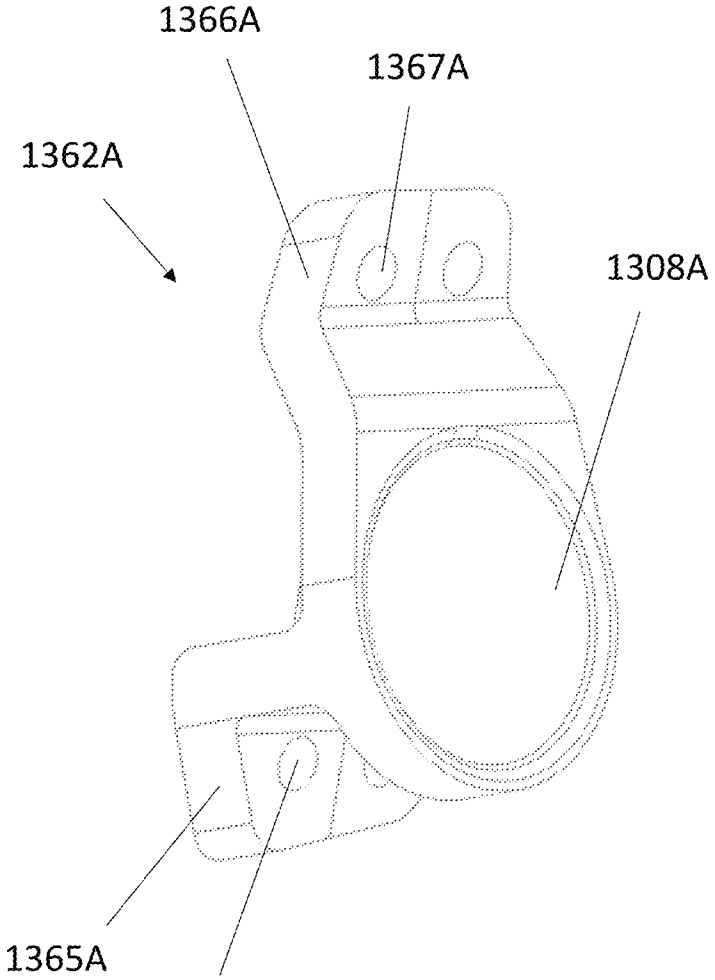
FIG. 78 illustrates a perspective view of the support arm of the golf club head of FIG. 74.
Figure 77:
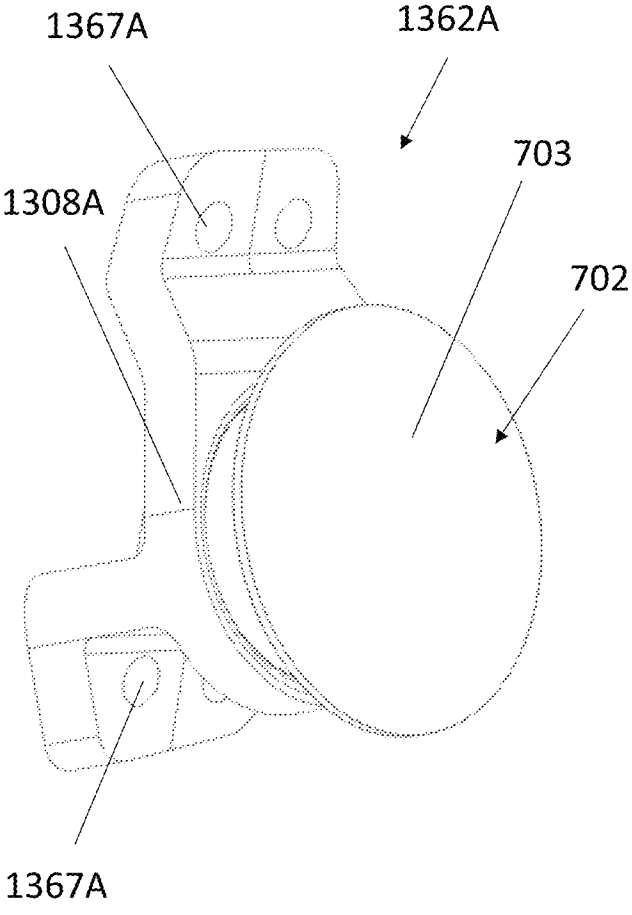
FIG. 77 illustrates an additional perspective view of the support arm and damping element of the golf club head of FIG. 74.

FIG. 74 illustrates a perspective view of an additional embodiment of a golf club head 1300A. FIG. 75 illustrates a perspective view of the golf club head 1300A of FIG. 74 missing the support arm 1366A and damping element 702. FIG. 76 illustrates a perspective view of the support arm 1366A and damping element 702 of the golf club head 1300A of FIG. 74. FIG. 77 illustrates an additional perspective view of the support arm 1366A and damping element 702 of the golf club head 1300A of FIG. 74. FIG. 78 illustrates a perspective view of the support arm 1366A of the golf club head 1300A of FIG. 74.

Golf club head 1300A is substantially similar to the golf club head 1300 illustrated in FIGS. 68-71 including a damping element 702 and a support arm 1362A extending substantially vertically. Unlike the golf club head 1300 of FIGS. 68-71, golf club head 1300A of FIG. 74 includes a support arm 1362A which is manufactured separately from and affixed to the rest of the golf club head 1300A. As in earlier embodiments, the support arm 1362A is configured to support the damping element 702 which is in contact with the rear surface 1319 of the striking face 1318. The support arm 1362A includes a cradle 1308A in contact with the damping element 702. The support arm 1362A also includes a first portion 1365A extending from the cradle 1308A and towards the sole 1305. The first portion 1365A can be affixed to the back portion 1312. The support arm 1362A also includes a second portion 1366A extending from the cradle 1308A towards the topline 1207. The second portion 1365A can be affixed to the topline 1307. Additionally, the support arm 1362A can include a rib 1368A, as illustrated in FIG. 76, extending from the first portion 1365A to the second portion 1366A. The rib 1368A can also contact the cradle 1308A, increasing the stiffness of the support arm 1362A.

As illustrated in FIG. 75, the back portion 1312 can include a first portion mating member 1365B configured to engage the first portion 1365A of the support arm 1362A and the topline 1307 can include a second portion mating member 1366B configured to engage the second portion 1366A of the support arm 1362A. The support arm 1362A can be affixed to the periphery portion 1301 of the golf club head 1300A in a variety of ways which may include, for example, welding, brazing, adhesives, mechanical fasteners, interference fits, clips, deflectable members, etc. The first portion mating member 1365B and the second portion mating member 1366B can include a apertures 1367B configured to receive a fastener. Additionally, the first portion 1366A and second portion 1365A of the support arm 1362A can include apertures 1367A configured to receive a fastener. As illustrated in FIG. 74, the apertures 1367A can be aligned with the apertures 1367B and fasteners (not illustrated) such as a rivet or threaded fastener can be installed into the apertures 1367A, 1367B securing the support arm 1362A to the golf club head 1300A. The support arm 1362A can be affixed to the rear of the back portion 1312 and the topline 1307, as illustrated in FIG. 74, or in an alternative embodiment, the support arm 1362A can be affixed to a front side of the back portion 1312 and the topline 1307. Alternatively, the support arm 1362A could be installed on a front side of the topline 1307 and a rear side of the back portion 1312, or vice-versa. Additionally, the support arm 1362A could be secured to the sole 1305, or the toe 1306, or the heel 1304. In one embodiment, the position which the support arm is affixed to the golf club head may be adjustable such that the location of the damping element may be adjusted relative to the center of the striking face. Additionally, in an additional embodiment a medallion could be incorporated into the support arm and attached via the same affixation method as the support arm.

Figure 79:
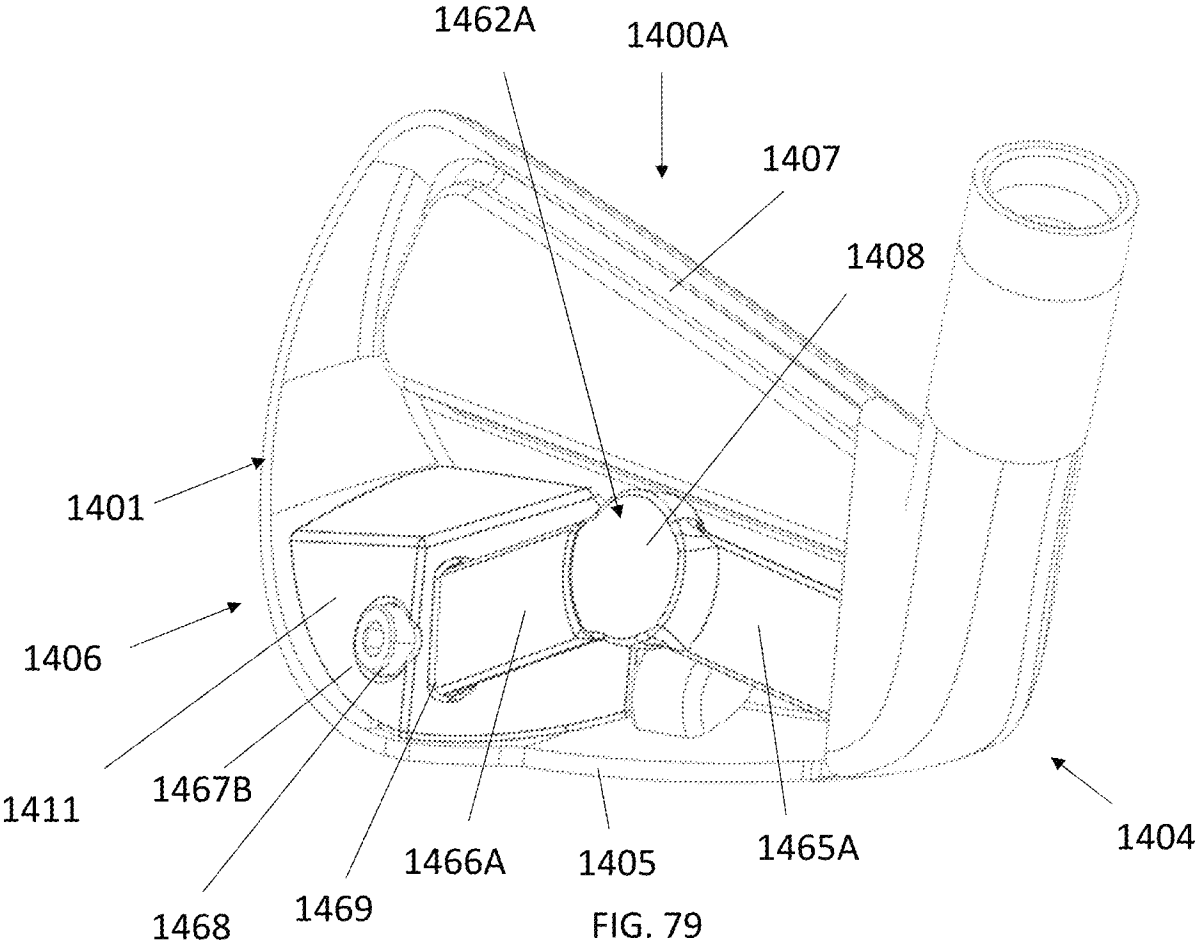
FIG. 79 illustrates a perspective view of an additional embodiment of a golf club head missing the striking face and damping element for illustrative purposes.
Figure 80:
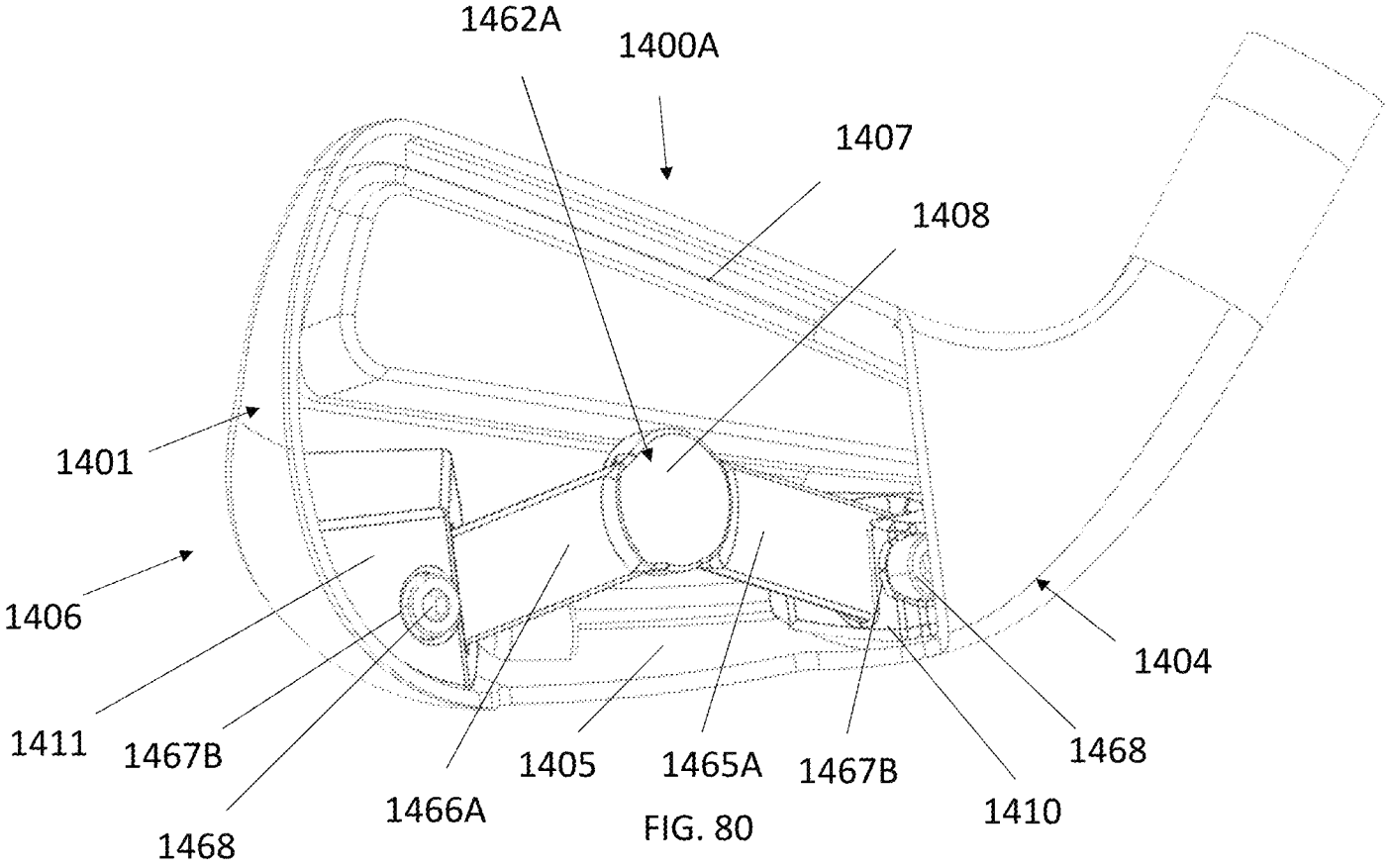
FIG. 80 illustrates an additional perspective view of the golf club head of FIG. 79 missing the striking face and damping element.
Figure 82:
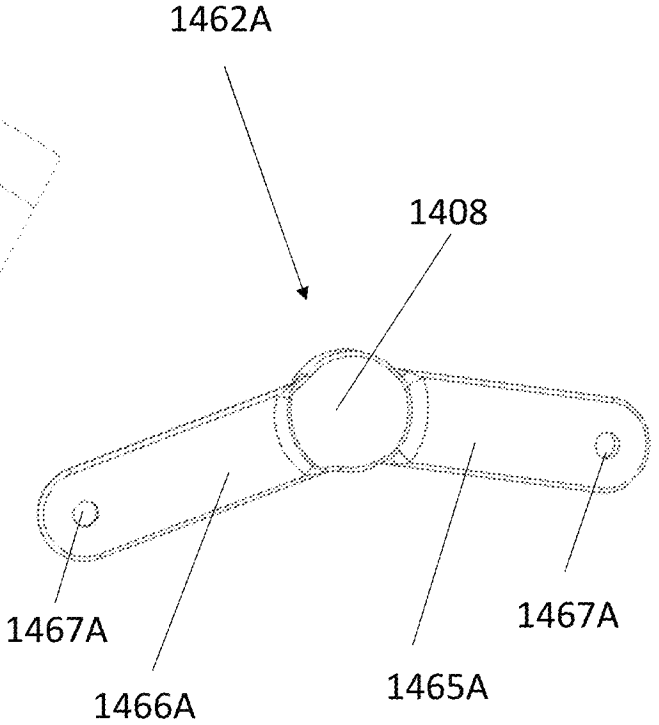
FIG. 82 illustrates a perspective view of the support arm of the golf club head of FIG. 79.
Figure 81:
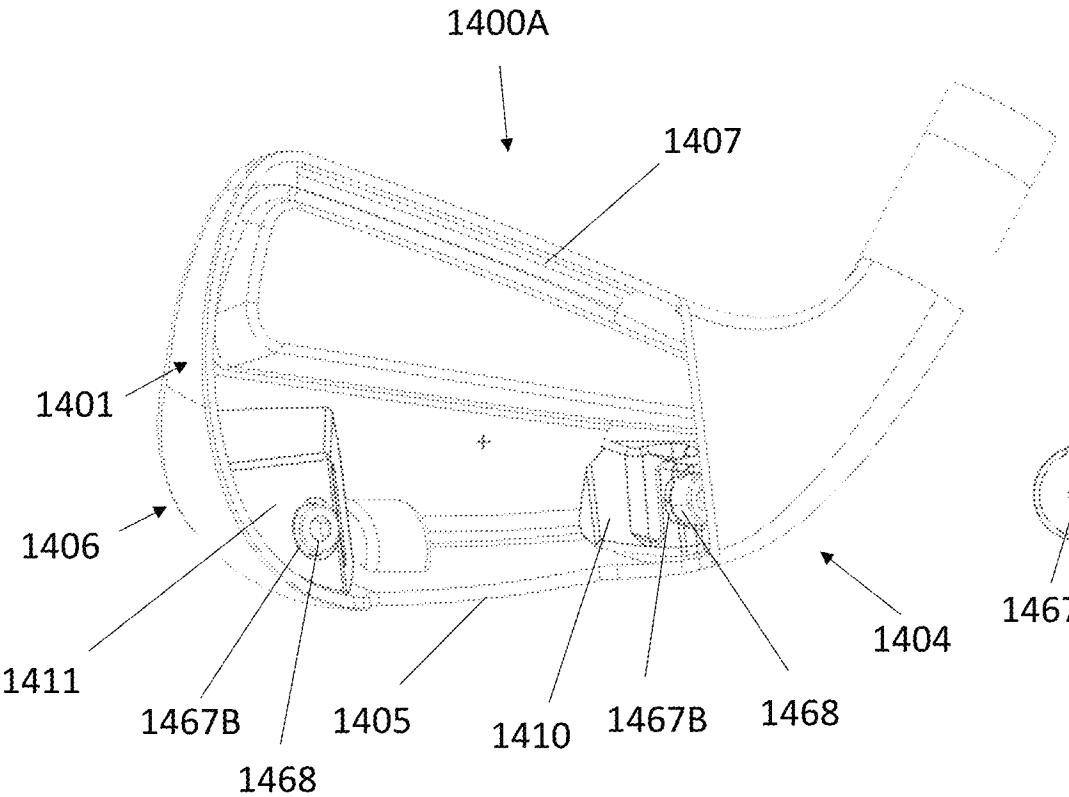
FIG. 81 illustrates a perspective view of the golf club head of FIG. 79 further missing the support arm.
Figure 83:
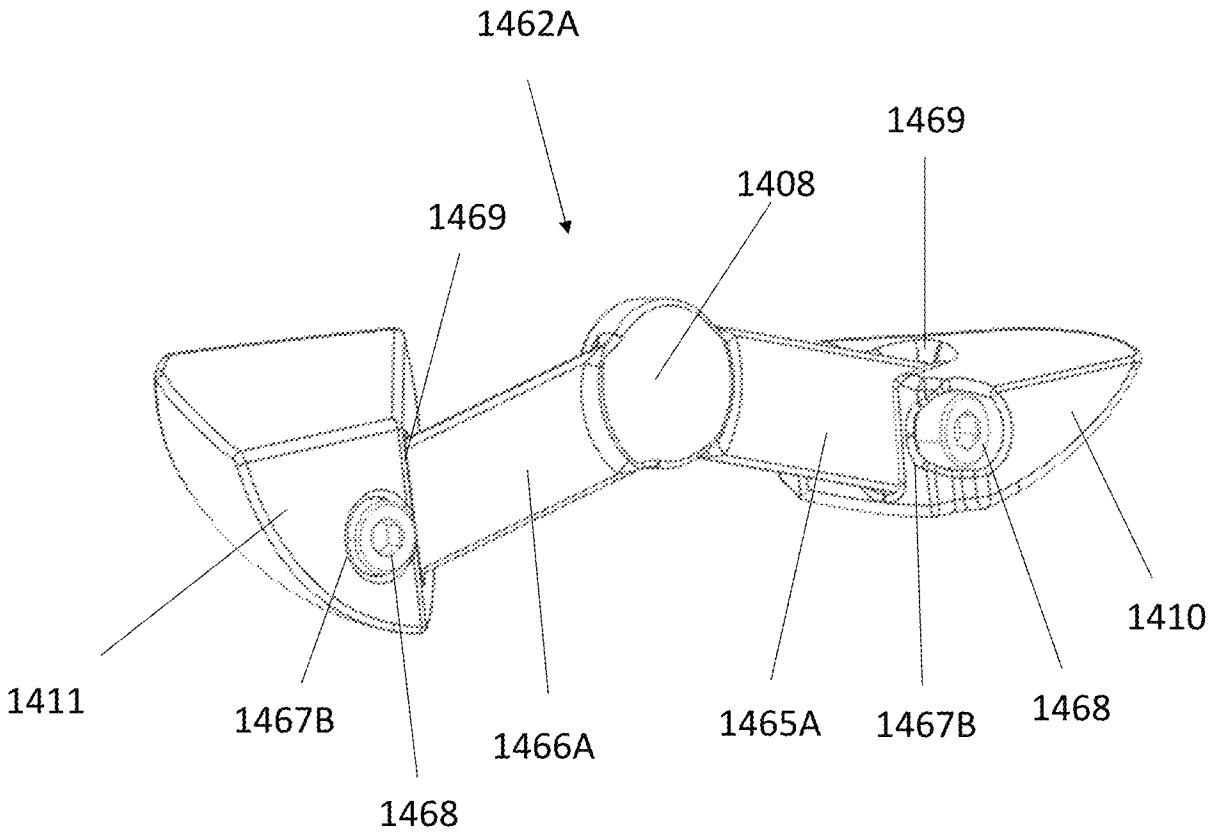

FIG. 79 illustrates a perspective view of an additional embodiment of a golf club head 1400A missing the striking face and damping element for illustrative purposes. FIG. 80 illustrates an additional perspective view of the golf club head 1400A of FIG. 79 missing the striking face and damping element. FIG. 81 illustrates a perspective view of the golf club head 1400A of FIG. 79 further missing the support arm 1462A. FIG. 82 illustrates a perspective view of the support arm 1462A of the golf club head 1400A of FIG. 79. FIG. 83 illustrates a perspective view of the support arm 1462A and weight members 1410, 1411 of the golf club head 1400A of FIG. 79.

Golf club head 1400A is substantially similar to the golf club head 1400 illustrated in FIGS. 72 and 73 including a damping element 702 and a support arm 1462A extending substantially horizontally. Unlike the golf club head 1400 of FIGS. 72 and 73, golf club head 1400A of FIG. 79 includes a support arm 1462A which is manufactured separately from and affixed to the rest of the golf club head 1400A.

As in earlier embodiments, the support arm 1462A is configured to support the damping element which is in contact with the rear surface of the striking face. The support arm 1462A includes a cradle 1408A in contact with the damping element. The support arm 1462A also includes a first portion 1465A extending from the cradle 1408A and towards the heel 1404. The support arm 1462A also includes a second portion 1466A extending from the cradle 1408A towards the toe 1406. The first portion 1465A and second portion 1466A can be affixed to the periphery portion 1401. The periphery portion can include support arm receptacles 1469 configured to engage the support arm 1462A. The periphery portion can include apertures 1467B configured to receive a fastener 1468. The support arm can include apertures 1467A configured to receive a fastener 1468. As illustrated, the first portion 1465A and second portion 1466A can be inserted into the support arm receptacles 1469 aligning the supper arm apertures 1467A with the periphery portion apertures 1467B and fasteners 1468 can be installed to secure the support arm 1462A and damping element (not illustrated) to the golf club head 1400A. In some embodiments, the apertures 1467B and support arm receptacles can be formed in a heel side weight member 1410 and toe side weight member 1411. The fastener can be a threaded fastener and one or more of the apertures 1467A, 1467B can include threads to engage the fastener.

Golf club head 1300A and golf club head 1400A include modular support arms 1362A and 1462A respectively, each of which offer advantages to support arms formed together with a golf club head. By securing the support arm to the golf club head, the support arms can be made from a different material of the golf club head which may include, for example, steel, aluminum, titanium, composites, etc. The support arm can be formed of materials of different density and/or different stiffness from the golf club head. The support arm can be manufactured via a variety of manufacturing techniques which may include, for example, casting, forging, stamping, machining, three dimensional printing, etc.

Additionally, a removeable support arm can allow for various damping elements to be installed in the golf club head, fine tuning the golf club head to maximize coefficient of restitution, or fine tuning the acoustic profile of the golf club head when impacting a golf ball.

Figure 85:
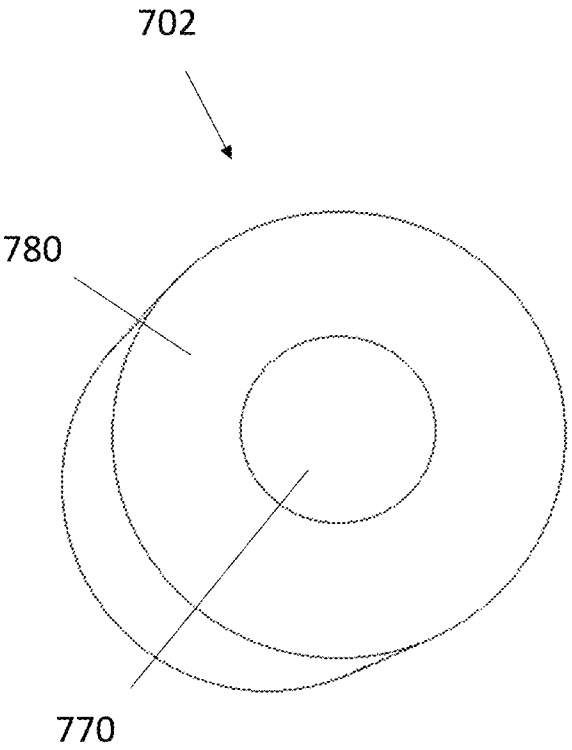
Figure 84:
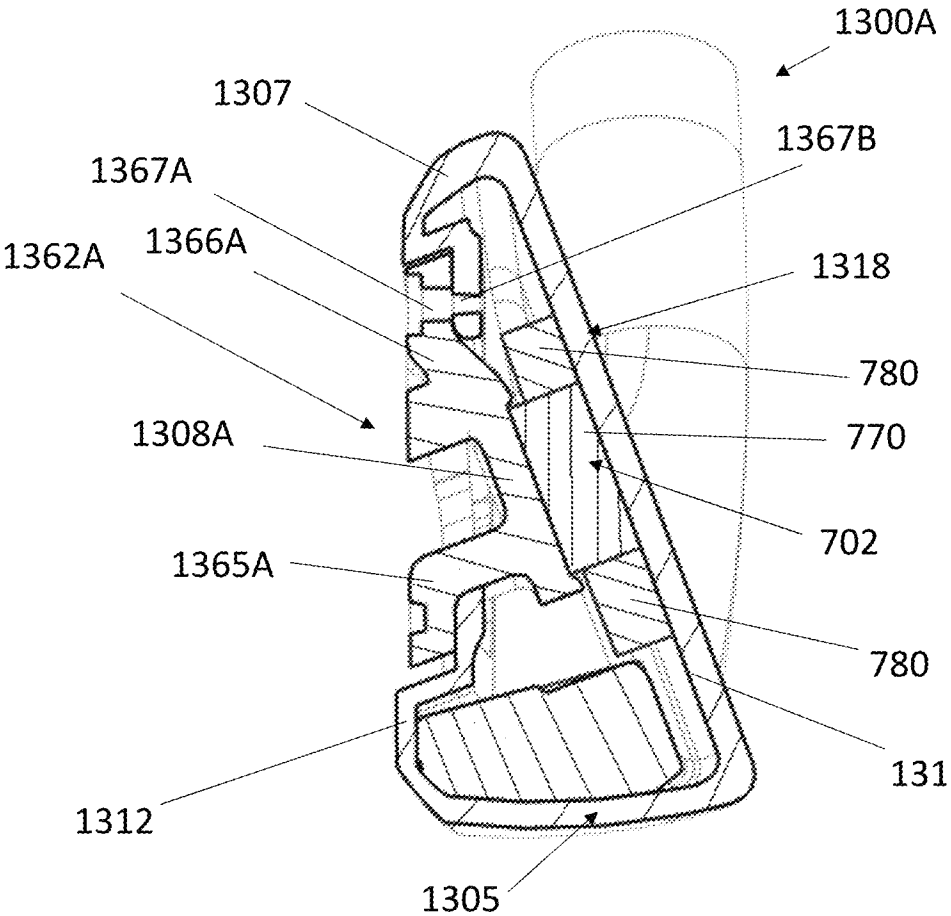

FIG. 84 illustrates a cross sectional view of the golf club head 1300A with an additional embodiment of a damping element 702. FIG. 85 illustrates a perspective view of the damping element 702 of the golf club head 1300A of FIG. 84. The damping element 702 illustrated in FIGS. 84 and 85 includes a first portion 770 and a second portion 780. The first portion 770 is centrally located and the second portion 780 at least partially surrounds the first portion 770. The first portion 770 is made of a first material having a first durometer. The second portion 780 is made of a second material having a second durometer. The first durometer is greater than the second durometer. The first portion 770 helps support the center of the striking face 1318 while the second portion aids in damping the vibrations of the striking face 1318. In the illustrated embodiment, the cradle 1308A supports the first portion 770 of the damping element. In other embodiments, the cradle 1308A could support both the first portion 770 and the second portion 780. The first portion 770 and second portion 780 could be made from one or more materials which may include, for example, elastomer, rubber, silicone, foam, metal, etc.

In one embodiment, the first durometer can be greater than Shore 10A and less than Shore 95A. In an additional embodiment, the first durometer can be greater than Shore 20A and less than Shore 95A. In an additional embodiment, the first durometer can be greater than Shore 30A and less than Shore 95A. In an additional embodiment, the first durometer can be greater than Shore 40A and less than Shore 95A. In an additional embodiment, the first durometer can be greater than Shore 50A and less than Shore 95A. In an additional embodiment, the first durometer can be greater than Shore 60A and less than Shore 95A. In an additional embodiment, the first durometer can be greater than Shore 70A and less than Shore 95A. In an additional embodiment, the first durometer can be greater than Shore 80A and less than Shore 95A. In one embodiment, the first portion 770 is formed from an elastomer.

In one embodiment the second durometer can have a Shore 00 value greater than 10 and less than 100. In an additional embodiment, the second durometer can have a Shore 00 value greater than 20 and less than 100. In an additional embodiment, the second durometer can have a Shore 00 value greater than 30 and less than 100. In an additional embodiment, the second durometer can have a Shore 00 value greater than 40 and less than 100. In an additional embodiment, the second durometer can have a Shore 00 value greater than 50 and less than 100. In an additional embodiment, the second durometer can have a Shore 00 value greater than 60 and less than 100. In an additional embodiment, the second durometer can have a Shore 00 value greater than 70 and less than 100. In an additional embodiment, the second durometer can have a Shore 00 value greater than 80 and less than 100. In an additional embodiment, the second durometer can have an Asker C value greater than 10 and less than 90. In an additional embodiment, the second durometer can have an Asker C value greater than 20 and less than 90. In an additional embodiment, the second durometer can have an Asker C value greater than 30 and less than 90. In an additional embodiment, the second durometer can have an Asker C value greater than 40 and less than 90. In an additional embodiment, the second durometer can have an Asker C value greater than 50 and less than 90. In an additional embodiment, the second durometer can have an Asker C value greater than 60 and less than 90. In one embodiment, the second durometer is less than Shore 20A. In one embodiment, the second portion 780 is formed of a foam.

Figure 87:
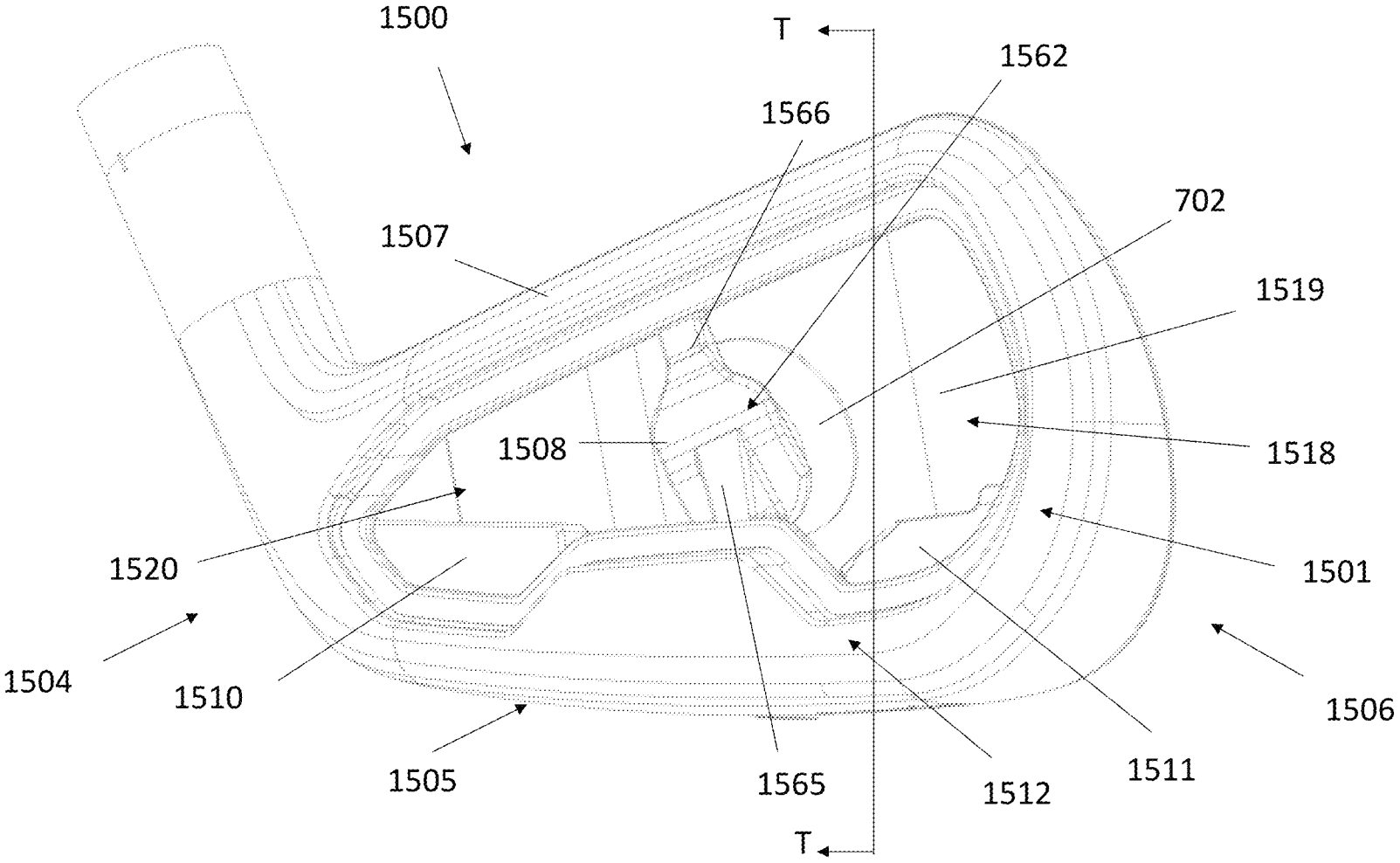
Figure 88:
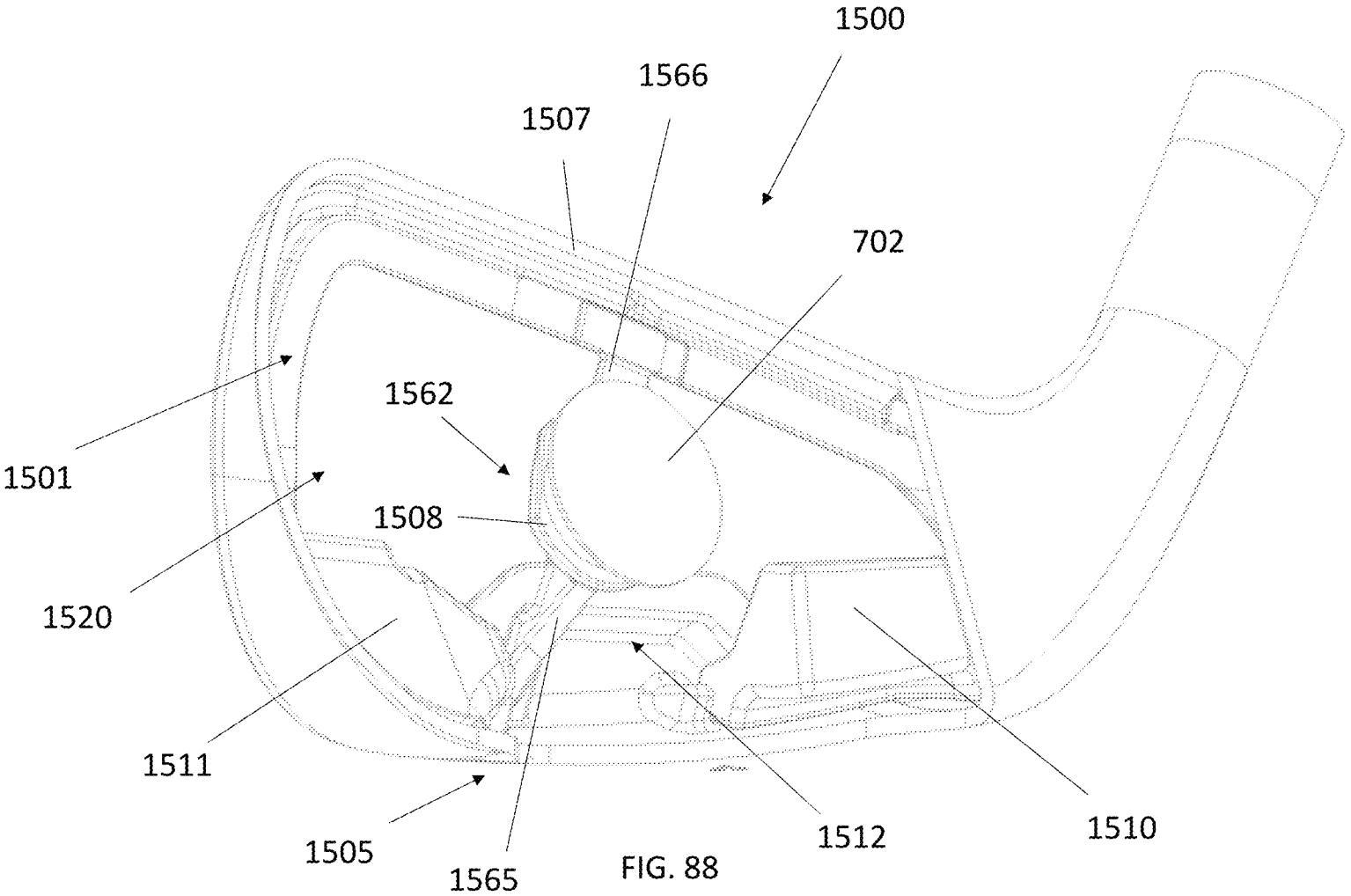
Figure 89:
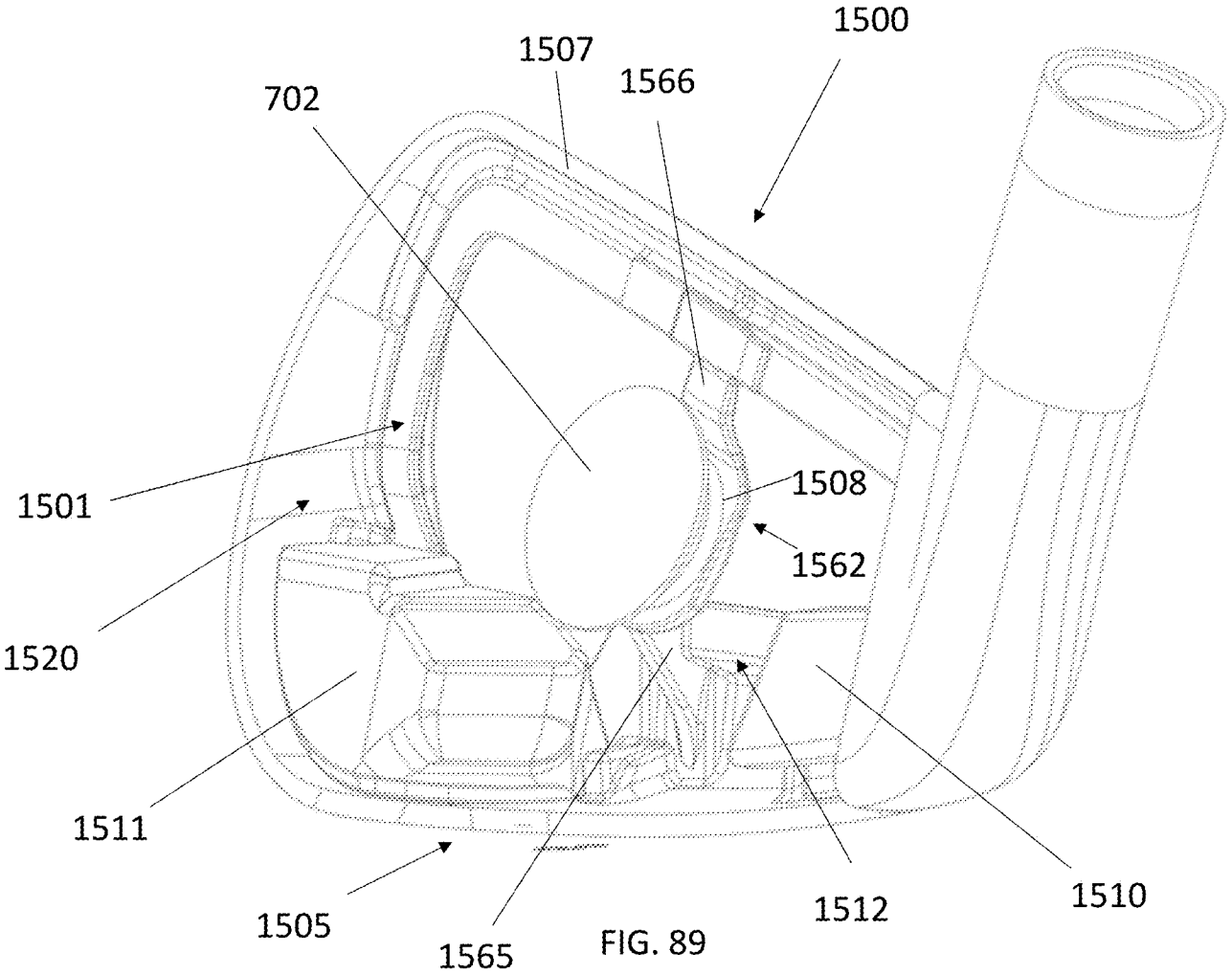
Figure 90:
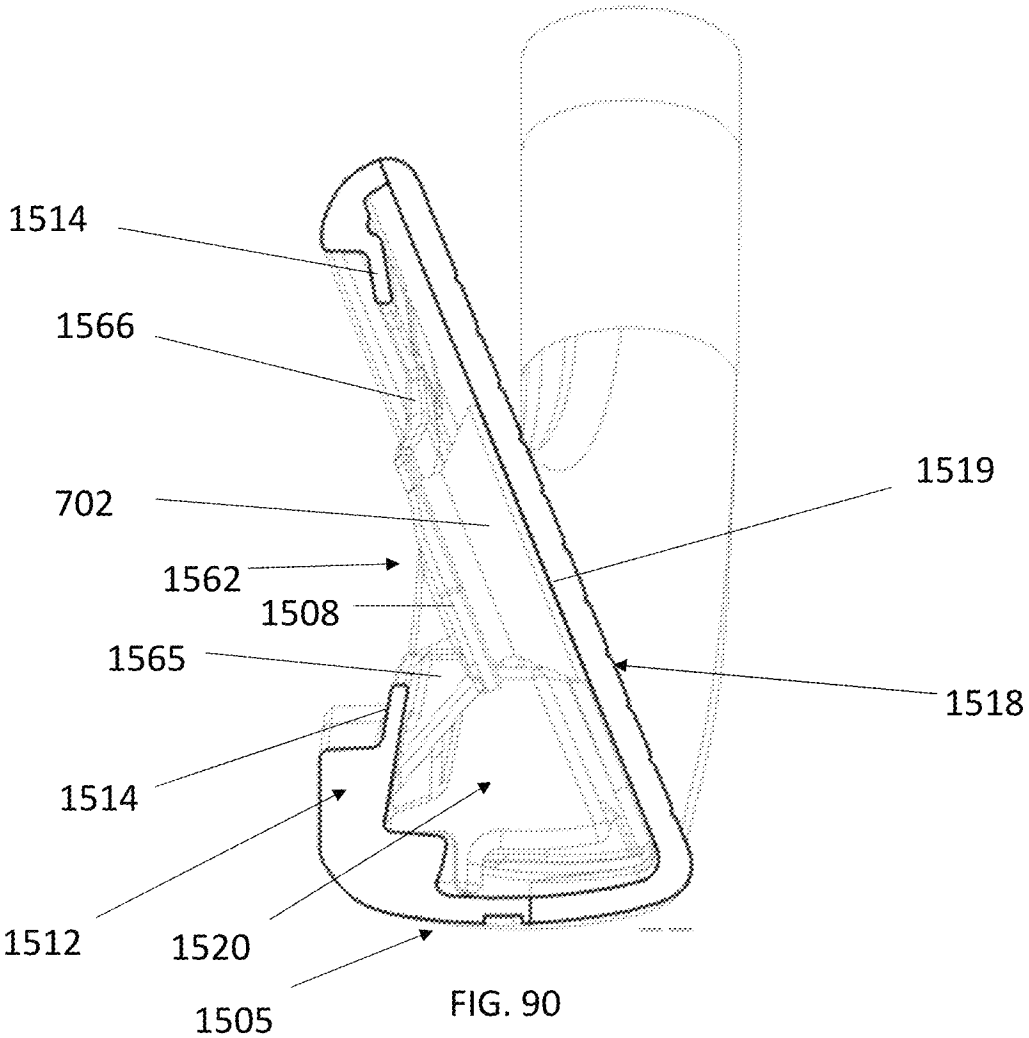

FIGS. 86-94 Depict an additional embodiment of a golf club head 1500 having a damping element 702. FIG. 86 depicts a perspective view of a golf club head 1500. FIG. 87 depicts an additional perspective view of the golf club head 1500 of FIG. 86. FIG. 88 depicts a perspective view of the golf club head 1500 of FIG. 86 missing the striking face. FIG. 89 depicts an additional perspective view of the golf club head 1500 of FIG. 86 missing the striking face. FIG. 90 depicts a cross sectional view T-T of the golf club head 1500 of FIG. 86.

The golf club head 1500 illustrated in FIGS. 86-90 is an iron having a cavity back construction and includes a periphery portion 1501 surrounding and extending rearward from the striking face 1518. The periphery portion 1501 includes the sole 1505, the toe 1506, the heel 1504, and the topline 1507. The periphery portion 1501 can also include a back portion 1512, which may partially enclose the cavity 1520. The periphery portion 1501 of the golf club head 1500 can include a support arm 1562. The support arm 1562 can extend from the sole 1505 to the topline 1507. In another embodiment, the support arm 1562 can extend from the back portion 1512 to the topline 1507. The support arm 1562 can include a first portion 1565, a cradle 1508, and a second portion 1566. The first portion 1565 extends from the sole 1505 or the back portion 1512, or both. The first portion 15165 is connected to the cradle 1508 which is configured to support a damping element 702 disposed between the rear surface 1519 of the striking face 1518 and the cradle 1508 of the support arm 1562. The second portion 1566 extends between the topline 1507 and the cradle 1508. The damping element 702 can support the striking face 1518 and offer damping properties, as discussed above.

As illustrated, the first portion 1565 is substantially thicker in a fore-aft direction than it is in the heel-toe direction and the second portion 1566 is substantially thicker in a heel-toe direction than it is in the fore-aft direction. Additionally, the cradle 1508 is thicker in a heel-toe direction than the second portion 1566. In another embodiment, this could be reversed. In another embodiment, both the first portion 1565 and the second portion 1566 can be substantially thicker in a fore-aft direction than in the heel-toe direction. In another embodiment, both the first portion 1565 and the second portion 1566 can be substantially thicker in a heel-toe direction than it in the fore-aft direction. In another embodiment the second portion 1566 could be thicker in a heel-toe direction than the cradle 1508.

Figure 91:
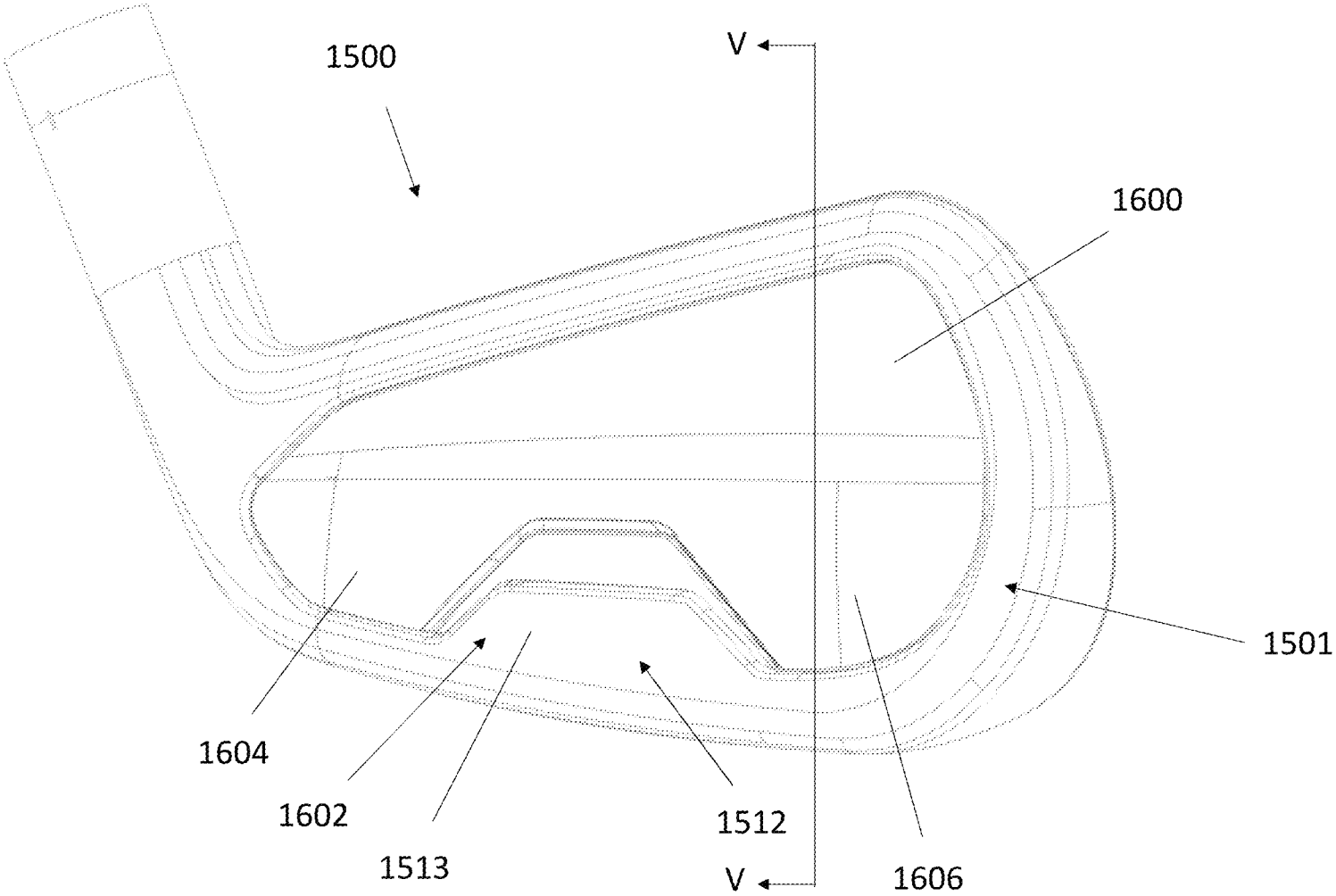
Figure 92:
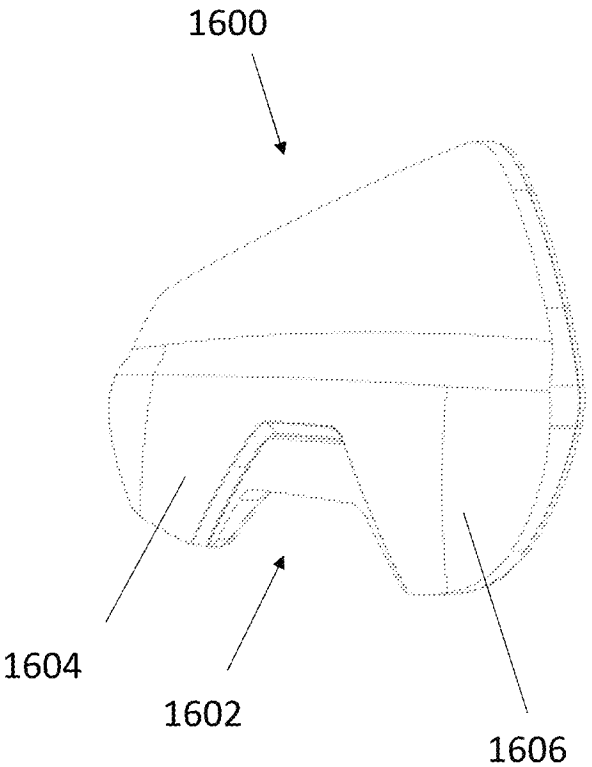

As illustrated in FIGS. 91-94 the golf club head 1500 can include a back cover 1600 affixed to the periphery portion 1501. FIG. 91 depicts a perspective view of the golf club head 1500 of FIG. 86 including a back cover 1600. FIG. 92 depicts a perspective view of the back cover 1600. FIG. 93 depicts an additional perspective view of the back cover 1600. FIG. 94 depicts a cross sectional view V-V of the golf club head 1500 of FIG. 92. As illustrated in FIG. 94 the periphery portion can include a shelf 1514 configured to accept the back cover 1600. The back cover 1600 can be affixed to the periphery portion 1501 in a variety of ways, which may include for example, adhesive, double sided tape, mechanical fasteners, interference fit, an undercut, epoxy, etc. As illustrated in FIGS. 91 to 93 the back cover can include a central recess 1602 with a heel side leg 1604 and a toe side leg 1606 extending downwards. The back portion 1512 of the periphery portion 1501 can include a central protrusion 1513 extending upwards further than the rest of the back portion 1512. As illustrated in FIG. 94, the first portion 1565 of the support arm 1562 can extend from the central protrusion 1513 of the back portion 1512. Additionally, the central protrusion 1513 can extend into the central recess 1602 of the back cover 1600.

Additionally, as illustrated in FIG. 93 the back cover can include a plurality of stiffening members 1610 configured to increase the stiffness of the back cover 1600 while maintaining its light weight. The back cover 1600 can include stiffening members extending vertically and stiffening members extending horizontally. The stiffening members 1610 generally protrude away from the back cover 1600 towards the cavity 1520 of the golf club head 1500.

The golf club head 1500 can include a variable face thickness geometry to further promote more uniform ball speed across the striking face of the golf club head. FIG. 95 depicts the golf club head 1500 of FIGS. 86-94 having a tapered heel portion 1540. FIG. 96 depicts a rear view of the striking face 1518 and damping element 702 of the golf club head 1500 of FIG. 95. FIG. 97 depicts a perspective view of the striking face 1518 and damping element 702 of FIG. 96. FIG. 98 depicts an additional perspective view of the striking face 1518 and damping element 702 of FIG. 96. FIG. 99 depicts a front view of the golf club head 1500 of FIG. 95 including the supported region 742.

As illustrated in FIG. 95 the golf club head 1500 includes a plurality of scorelines on the striking face 1518. A majority of the scorelines 1560 can be considered full length scorelines, each of them having the same length. Some of the scorelines don't extend as far heelward due to the sloped nature of the topline 1507 of iron type golf club heads and can be considered partial length scorelines. The center face plane 1521 extends parallel to the y-axis and the z-axis and is located equidistant between the heel-most extent and the toe-most extent of the full length scorelines 1560. The striking face 1518 can also include a sole return 1517 extending aft from the bottom of the striking face 1518 forming a portion of the sole 1505 of the golf club head.

As illustrated in FIGS. 96-98 the striking face 1518 can include a constant thickness portion 1530 and a tapered heel portion 1540. As illustrated, the constant thickness portion 1530 can have substantially constant thickness. The scorelines are not considered when measuring the thickness of the striking face and considering whether it is substantially constant in thickness. As illustrated above, the rear surface 1519 of the striking face 1518 can be supported by a damping element 702. In a preferred embodiment, the damping element 702 abuts the constant thickness portion 1530 of the striking face 1518. The tapered heel portion 1540 extends from a tapered heel portion thick end 1541 adjacent the constant thickness portion 1530 to a tapered heel portion thin end 1542 heelwards of the thick end 1541. In one embodiment, the thin end can be located heelwards of the heel-most extent of the full length scorelines 1560. In one embodiment, the tapered heel portion 1540 can taper at a substantially constant rate from the thick end 1541 to the thin end 1542. In other embodiments, the taper rate can be variable along the length of the tapered heel portion 1540. The constant thickness portion 1530 can extend above the tapered heel portion 1540. An upper heel chamfer 1544 can be formed between the tapered heel portion 1540 and the constant thickness portion 1530 above the tapered heel portion 1540. The constant thickness portion 1530 can extend below the tapered heel portion 1540. A lower heel chamfer 1543 can be formed between the tapered heel portion 1540 and the constant thickness portion 1530 below the tapered heel portion 1540.

The striking face 1518 can also include a tapered toe portion 1550. The tapered toe portion 1550 extends from a tapered toe portion thick end 1551 adjacent the constant thickness portion 1530 towards a tapered toe portion thin end 1552. In one embodiment the tapered toe portion thin end 1552 is located toeward of the toe-most extent of the full length scorelines 1560. In one embodiment the tapered toe portion thin end 1552 has a boundary which is arcuate in shape, as illustrated in FIGS. 96-98. In one embodiment, the constant thickness portion 1530 extends below the tapered toe portion 1550. In one embodiment, the constant thickness portion 1530 extends above the tapered toe portion 1550. In one embodiment, the constant thickness portion 1530 extends around a toe side of the tapered toe portion 1550. In on embodiment, not illustrated, a chamfer can be formed between the tapered toe portion 1550 and the constant thickness portion 1530.

In one embodiment, the constant thickness portion 1530 of the striking face 1518 has a thickness CT greater than 1.5 mm and less than 2.5 mm. In one embodiment, the constant thickness portion 1530 of the striking face 1518 has a thickness CT greater than 1.7 mm and less than 2.2 mm. In one embodiment the thick end 1541 of the tapered heel portion 1540 has a heel offset HO from the center face plane 1521 that is less than 20 mm and greater than 1 mm. In one embodiment the thick end 1541 of the tapered heel portion 1540 has a heel offset HO from the center face plane 1521 that is less than 15 mm. In one embodiment the thick end 1541 of the tapered heel portion 1540 has a heel offset HO from the center face plane 1521 that is less than 10 mm. In one embodiment the width HW of the tapered heel portion is greater than 5 mm and less than 30 mm. In one embodiment the width HW of the tapered heel portion is greater than 10 mm and less than 25 mm. In one embodiment the width HW of the tapered heel portion is greater than 15 mm and less than 20 mm. In one embodiment the height HH of the thick end 1541 tapered heel portion 1540 is greater than 20 mm and less than 40 mm. In one embodiment the height HH of the thick end 1541 tapered heel portion 1540 is greater than 25 mm and less than 40 mm. In one embodiment the height HH of the thick end 1541 tapered heel portion 1540 is greater than 30 mm and less than 40 mm. In one embodiment the height HH of the tapered heel portion 1540 decreases in a heelward direction. In one embodiment the tapered toe portion 1550 has a toe offset TO from the center face plane 1521 that is less than 40 mm. In one embodiment the tapered toe portion 1550 has a toe offset TO from the center face plane 1521 that is less than 30 mm. In one embodiment the tapered toe portion 1550 has a toe offset TO from the center face plane 1521 that is less than 15 mm. In one embodiment the damping element 702 has a damping offset DO toeward from the center face plane 1521 that is greater than 1 mm and less than 20 mm. In one embodiment the damping element 702 has a damping offset DO toeward from the center face plane 1521 that is greater than 1 mm and less than 15 mm. In one embodiment the damping element 702 has a damping offset DO toeward from the center face plane 1521 that is greater than 1 mm and less than 10 mm. In one embodiment the damping element 702 has a damping offset DO toeward from the center face plane 1521 that is greater than 1 mm and less than 5 mm. In one embodiment the damping element 702 has a damping offset DO toeward from the center face plane 1521 that is 5 mm or less. In another embodiment, the damping element 702 has a damping offset DO toeward from the center face plane 1521 that is greater than 5 mm. In another embodiment, the damping element 702 has a damping offset DO toeward from the center face plane 1521 that is greater than 10 mm. In another embodiment, the damping element 702 has a damping offset DO toeward from the center face plane 1521 that is greater than 15 mm. In one embodiment, as shown in FIG. 100, the damping element 702 has a damping offset DO heelward from the center face plane 1521 that is 5 mm or less. In one embodiment the damping element 702 has a damping offset DO heelward from the center face plane 1521 that is 2 mm or less. In another embodiment, as shown in FIG. 101, the geometric center 743 of the damping element 702 is aligned with the center face plane 1521. In another embodiment, at least a portion of the damping element 702 overlaps the center face plane 1521. In one embodiment the tapered toe portion 1550 can have a decreasing thickness in the toeward direction with similar minimum thicknesses as the tapered heel portion 1540. In one embodiment the toe offset TO is greater than the heel offset HO. In one embodiment the toe offset TO is at least 125% of the heel offset HO. In one embodiment the toe offset TO is at least 150% of the heel offset HO. In one embodiment the toe offset TO is at least 175% of the heel offset HO. In one embodiment the toe offset TO is at least 200% of the heel offset HO.

As illustrated in FIGS. 102-104, the golf club head 1500 can include a back cavity bridge 1571. As illustrated in FIGS. 102 and 103, the back cavity bridge 1571 may be connected to the shelf 1514 and extend across the cavity 1520 from a topline region of the shelf 1514 to a toe region of the shelf 1514. In another embodiment, as shown in FIG. 104, the back cavity bridge 1571 may be connected to the shelf 1514 and extend across the cavity 1520 from a toe region of the shelf 1514 to a sole region of the shelf 1514. The back cavity bridge 1571 is a structural support which changes the acoustic properties of the golf club head 1500 to dampen the sound made when striking a golf ball. Additionally, the back cavity bridge 1571 dampens the sound of the back cover 1600 when the back cover 1600 is impacted and provides uniform sound characteristics when the back cover 1600 is impacted at various locations. The back cavity bridge 1571 may be attached to the shelf 1514 by an adhesive, welding, or other suitable attachment means. As shown in FIGS. 103 and 104, the back cavity bridge 1571 may be integrally formed with the shelf 1514 to span across the cavity 1520. In another embodiment, as shown in FIG. 105, the shelf 1514 has a protruding section 1573 which spans a portion of the cavity 1520 from a topline region of the shelf 1514 to a lower toe region of the shelf 1514. In another embodiment, as shown in FIG. 106, the shelf 1514 has a protruding section 1573 which spans a portion of the cavity 1520 from a toe region of the shelf 1514 to a sole region of the shelf 1514. The protruding section 1573 of the shelf 1514 reduces the area of the opening in the back portion 1512 as well as provides greater rigidity to the shelf 1514 to produce desired acoustic properties of the golf club head 1500 when striking a golf ball. Additionally, the protruding section 1573 of the shelf 1514 dampens the sound of the back cover 1600 when the back cover 1600 is impacted and provides uniform sound characteristics when the back cover 1600 is impacted at various locations.

The golf club head 1500 may include a thermoset material 1575 on the rear surface 1519 of the striking face 1518. The thermoset material 1575 may be a self-leveling material such that the thermoset material 1575 can be placed in the cavity 1520 in an uncured state and permitted to flow onto the rear surface 1519 of the striking face including into areas difficult to access. The thermoset material 1575 then hardens in place to provide sound damping, increased stiffness in the striking face 1518 for adjusting the coefficient of restitution, and increased strength in the striking face 1518. The thermoset material 1575 may be an adhesive material with low viscosity such as DP105 made by 3M. The thermoset material 1575 may be other materials such as DIP SEAL or FLEX SEAL. In one embodiment, the thermoset material 1575 may be applied to the rear surface 1519 of the striking face 1518 near the sole 1505. In another embodiment, the thermoset material 1575 may be applied to the rear surface 1519 of the striking face 1518 near the topline 1507. In another embodiment, the thermoset material 1575 may be applied to the rear surface 1519 of the striking face 1518 near the toe 1506. In another embodiment, the thermoset material 1575 may be applied to the entire rear surface 1519 of the striking face 1518. Upon curing, a thickness of the thermoset material 1575 may be between 0.1 mm and 4.0 mm; more preferably, the thickness of the thermoset material 1575 may be between 0.5 mm and 2.0 mm. In another embodiment, the thermoset material 1575 may be applied to the back cover 1600 to dampen the sound of the back cover 1600 when the back cover 1600 is impacted and provide uniform sound characteristics when the back cover 1600 is impacted at various locations. The thermoset material 1575 may have hardness when cured between approximately 30 Shore D and approximately 50 Shore D; more preferably, the thermoset material 1575 may have hardness when cured of approximately 40 Shore D. The thermoset material 1575 may include a filler material having a different density than the thermoset material 1575 for overall weight adjustment of the golf club head 1500, weight disbursement about different areas within the golf club head 1500, or to provide additional damping of the golf club head 1500 or the back cover 1600.

Although specific embodiments and aspects were described herein and specific examples were provided, the scope of the invention is not limited to those specific embodiments and examples. One skilled in the art will recognize other embodiments or improvements that are within the scope and spirit of the present invention. Therefore, the specific structure, acts, or media are disclosed only as illustrative embodiments. The scope of the invention is defined by the following claims and any equivalents therein.

The invention claimed is:

1. A golf club head comprising:

a striking face;

a back portion behind said striking face extending from a topline to a sole;

a hosel configured to receive a shaft, said hosel located on a heel side of said golf club head, said heel side located opposite a toe side;

a coordinate system centered at a center of gravity of said golf club head, said coordinate system comprising a y-axis extending vertically, perpendicular to a ground plane when said golf club head is in an address position at a prescribed loft and lie, an x-axis perpendicular to said y-axis and parallel to said striking face, extending towards said heel side of said golf club head, and a z-axis, perpendicular to said y-axis and said x-axis and extending through said striking face;

a plurality of scorelines on said striking face;

a damping element comprising a front surface and a rear surface, said rear surface of said damping element opposite said front surface of said damping element;

wherein said striking face comprises a front surface configured to strike a golf ball and a rear surface opposite said front surface;

wherein said front surface of said damping element contacts said rear surface of said striking face;

wherein said striking face comprises a first portion having a constant thickness;

wherein said front surface of said damping element contacts said first portion of said striking face;

wherein said rear surface of said damping element contacts said back portion of said golf club head; and wherein said front surface of said damping element has a hemispherical shape.

2. The golf club head of claim 1, wherein said damping element has an elastic modulus of 40 GPa or greater.

3. The golf club head of claim 2, wherein said damping element has an elastic modulus of 70 GPa or greater.

4. The golf club head of claim 3, wherein said damping element is made from metal.

5. The golf club head of claim 4, wherein said damping element is made from aluminum, steel, or titanium.

6. The golf club head of claim 2, wherein said damping element further comprises an epoxy or a lubricant at said front surface of said damping element.

7. The golf club head of claim 2, wherein said first portion of said striking face has a thickness greater than 1.5 mm and less than 2.5 mm.

8. A golf club head comprising:

a striking face;

a back portion behind said striking face extending from a topline to a sole;

a hosel configured to receive a shaft, said hosel located on a heel side of said golf club head, said heel side located opposite a toe side;

a coordinate system centered at a center of gravity of said golf club head, said coordinate system comprising a y-axis extending vertically, perpendicular to a ground plane when said golf club head is in an address position at a prescribed loft and lie, an x-axis perpendicular to said y-axis and parallel to said striking face, extending towards said heel side of said golf club head, and a z-axis, perpendicular to said y-axis and said x-axis and extending through said striking face;

a plurality of scorelines on said striking face;

a damping element comprising a front surface and a rear surface, said rear surface of said damping element opposite said front surface of said damping element;

wherein said striking face comprises a front surface configured to strike a golf ball and a rear surface opposite said front surface;

wherein said front surface of said damping element contacts said rear surface of said striking face;

wherein said striking face comprises a first portion having a constant thickness;

wherein said front surface of said damping element contacts said first portion of said striking face;

wherein said rear surface of said damping element contacts said back portion of said golf club head;

wherein said front surface of said damping element comprises a geometric center;

wherein said back portion of said golf club head comprises an adjustment mechanism configured to adjust a compression of said damping element against said striking face; and wherein said front surface of said damping element has a hemispherical shape.

9. The golf club head of claim 8, wherein said adjustment mechanism includes an adjustment driver and an adjustment receiver, wherein said adjustment receiver is configured to receive said adjustment driver by threaded engagement.

10. The golf club head of claim 9, wherein said damping element has an elastic modulus of 40 GPa or greater.

11. The golf club head of claim 10, wherein said damping element has an elastic modulus of 70 GPa or greater.

12. The golf club head of claim 11, wherein said damping element is made from steel or titanium.

13. The golf club head of claim 12, wherein said first portion of said striking face has a thickness greater than 1.5 mm and less than 2.5 mm.

14. The golf club head of claim 13, wherein said damping element further comprises an epoxy or a lubricant at said front surface of said damping element.

15. The golf club head of claim 14, wherein said striking face comprises a second portion, said second portion of said striking face having a thickness which tapers from a maximum thickness at a thick end of said second portion to a minimum thickness at a thin end of said second portion, wherein said thick end is located toeward of said thin end.

16. The golf club head of claim 15, wherein said striking face comprises a third portion, said third portion of said striking face having a thickness which tapers from a maximum thickness at a heel end of said third portion to a minimum thickness at a toe end of said third portion.

* * * * *